US006005333A

United States Patent [19]

Kaneko et al.

[11] Patent Number: 6,005,333

[45] Date of Patent: Dec. 21, 1999

[54] ELECTRON BEAM-GENERATING DEVICE, AND IMAGE-FORMING APPARATUS AND RECORDING APPARATUS EMPLOYING THE SAME

[75] Inventors: Tetsuya Kaneko, Yokohama; Ichiro Nomura; Hidetoshi Suzuki, both of Atsugi; Yoshikazu Banno, Ebina; Haruhito Ono, Ashigara; Shinya Mishina, Nagahama, all of Japan

[73] Assignee: Canon Kabushiki Kaisha, Tokyo, Japan

[21] Appl. No.: 08/058,242

[22] Filed: May 5, 1993

[51] Int. Cl.[6] ..... H01J 1/46

[52] U.S. Cl. ..... 313/306; 313/310

[58] Field of Search ..... 313/309, 310, 313/336, 351, 306, 495, 496, 497, 422

[56] References Cited

U.S. PATENT DOCUMENTS

| | | | |
|---|---|---|---|
| 4,904,895 | 2/1990 | Tsukamoto et al. | 313/336 |
| 4,954,744 | 9/1990 | Suzuki et al. | 313/336 |
| 4,956,578 | 9/1990 | Shimizu et al. | 315/3 |
| 5,023,110 | 6/1991 | Nomura et al. | 427/49 |
| 5,155,416 | 10/1992 | Suzuki et al. | 315/366 |
| 5,185,554 | 2/1993 | Nomura et al. | 313/495 |

*Primary Examiner*—Scott Rogers
*Assistant Examiner*—Jerome Grant, II
*Attorney, Agent, or Firm*—Fitzpatrick, Cella, Harper & Scinto

[57] ABSTRACT

An electron beam generating device has at least one electron emitting element and at least one modulation electrode on a substrate. The modulation electrode may be provided on the same or reverse side of the substrate as or to the side bearing the electron emitting element. The electron emitting element is constituted of a lower potential electrode, a higher potential electrode and an electron emitting portion between the electrodes. The lower potential electrode has a different dimension than the higher potential electrode, or the substrate region bearing the electron emitting element has a different thickness than the other region, depending on the type of arrangement of the electron emitting element and the modulation electrode.

14 Claims, 55 Drawing Sheets

ELECTRON BEAM-GENERATING DEVICE, AND IMAGE-FORMING APPARATUS AND RECORDING APPARATUS EMPLOYING THE SAME

BACKGROUND OF THE INVENTION

1. Field of the Invention

The present invention relates to an electron beam-generating device for emitting an electron beam in accordance with an information signal. The present invention also relates to an image-forming apparatus and a recording apparatus employing the electron beam-generating device.

2. Related Background Art

Thin type image displaying apparatuses are known. The known thin displaying apparatus has a plurality of electron-emitting elements and an image-forming member counterposed thereto: the image-forming member being a member which emits light, changes its colors, become electrified, or deteriorates on collision of electrons, and being made of a material such as a fluorescent material and a resist material. FIGS. 92 and 93 illustrate schematically conventional electron beam displaying apparatus respectively as examples of such image-displaying apparatuses.

FIG. 92 illustrates an electron-beam display apparatus having electron-emitting elements and an image-forming member counterposed thereto, and modulation electrode provided therebetween. Specifically, the electron-beam display apparatus has a rear plate 1671, supports 1672, wiring electrodes 1673, electron-emitting portions 1674, electron passage holes 1675, modulation electrodes 1676, a glass plate 1677, a light-transmissive electrode 1678, a fluorescent material (an image-forming member) 1679, and a face plate 1680. The shadowed portions 1682 denote bright spots of the fluorescent material. The electron-emitting portions 1674 of the electron-emitting element (constituted of the parts 1672, 1673, and 1674) is formed by a thin film formation technique to take a hollow structure without contacting with the rear plate 1671. The modulation electrodes 1676 are placed in the space above the electron-emitting portions (in the electron-emitting direction) and have electron beam passage holes 1675.

With this electron beam display apparatus, thermoelectrons are emitted by heating the electron-emitting portion 1674 having a hollow structure by applying voltage to the wiring electrodes 1673; the electrons are taken out through the passage hole 1675 by applying voltage to the modulation electrode 1676 for modulating the electron beam according to an information signal; and the electrons taken out are accelerated and made to collide against the fluorescent material 1679. An image is displayed on the fluorescent material 1679, an image-forming member, by use of an XY matrix formed from the wiring electrodes 1673 and the modulation electrodes 1676.

FIG. 93 illustrates another electron-beam display apparatus which has a base plate 1791, modulation electrodes 1792, a thermoelectron beam sources (electron-emitting elements) 1793, an upward deflection electrode 1794, a downward deflection electrode 1795, a face plate 1796 having a light-transmissive electrode and a fluorescent material (an image-forming member). On the base plate 1791, the modulation electrodes 1792, electron-emitting elements 1793, and the image-forming member are placed in the named order. As shown in the broken-line circle in FIG. 93, the modulation electrodes 1792 and the electron-emitting element 1793 are placed with a spacing therebetween. The thermoelectron source is made of a tungsten wire coated with an electron-emitting substance, having the outside diameter of about 35 $\mu$m, and emitting thermoelectrons at an operation temperature of from 700° C. to 850° C.

Conventional image display apparatuses involve problems below:

(1) In the display apparatus of FIG. 92, the modulation electrodes are placed in the space above the electron-emitting elements (in the direction of electron emission), so that the positional registration of the electron passage holes of the modulation electrodes with the electron-emitting portions is not easy, making insufficient the quantity of the electron emission of the electron beams, (2) The display apparatuses shown in FIGS. 92 and 93 have interspace between the modulation electrode and the opposing electron-emitting element. This interspace causes the following problems: (a) The distance between the modulation electrode and the electron-emitting portion cannot readily be kept constant, and the resulting variation of the distance (variation caused by impact, thermal distortion during driving, and so forth) causes undesired variation of the quantity of the electron emission of the electron beam, and (b) The distances between the modulation electrodes and the electron-emitting elements cannot readily be made uniform, and the non-uniformity of the distances causes the variation of the modulation among the electron beams emitted from electron-emitting portions.

The above problems give the disadvantages of insufficient contrast and variation of luminance of the displayed image and so forth in image display apparatuses.

To solve the above problems, the applicants disclosed, in U.S. Pat. No. 5,185,554, an electron beam-generating device which comprises an electron-emitting element and a modulation electrode for modulating an electron beam emitted from the electron-emitting element, the electron-emitting element and the modulation electrode being arranged on the same plane of a substrate, or the modulation electrode being placed on the reverse side of the substrate of the electron-emitting element, and also disclosed an image-forming apparatus employing the above electron beam-generating device.

SUMMARY OF THE INVENTION

The present invention intends to improve further the electron beam-generating device which comprises an electron-emitting element and a modulation electrode for modulating an electron beam emitted by the electron-emitting element, the electron-emitting element and the modulation electrode being arranged on the same side of a substrate, or the modulation electrode being placed on the reverse side of a substrate to the side bearing the electron-emitting element.

According to an aspect of the present invention, there is provided an electron beam-generating device having an electron-emitting element and a modulation electrode for modulating an electron beam emitted from the electron-emitting element, the electron-emitting element and the modulation electrode being arranged on the same side of a substrate, or the modulation electrode being placed on the reverse side of a substrate to the side bearing the electron-emitting element, in which the electron-emitting element has an electron-emitting portion between a lower potential electrode and a higher potential electrode, and the lower potential electrode is larger in size than the higher potential electrode.

According to another aspect of the present invention, there is provided an electron beam-generating device having an electron-emitting element and a modulation electrode for modulating an electron beam emitted from the electron-emitting element, the modulation electrode being provided on the reverse side of a substrate having the electron-emitting element, wherein the substrate in the region under the electron-emitting element has a thickness different from the thickness in the other region.

According to still another aspect of the present invention, there is provided an electron beam-generating device having an electron-emitting element and a modulation electrode for modulating an electron beam emitted by the electron-emitting element, the electron-emitting element and the modulation electrode being provided on the same side of a substrate, or the modulation electrode being provided on the reverse side of a substrate having an electron-emitting element, wherein the modulation electrode is in a predetermined shape or in a predetermined dimension for improvement of modulation efficiency.

According to a further aspect of the present invention, there is provided an image display apparatus, comprising an electron beam-generating device mentioned above, and an image-forming member for forming an image on irradiation of an electron beam from the electron beam-generating device.

According to a still further aspect of the present invention, there is provided a recording apparatus, comprising an electron beam-generating device mentioned above, a light-emitting member for emitting light on irradiation of an electron beam from the electron beam-generating device, and a recording medium on which an image is recorded by irradiation of light from the light-emitting member, or a supporting member for the recording medium.

BRIEF DESCRIPTION OF THE DRAWINGS

FIGS. 53 to 58A–58B show an electron beam-generating device of Embodiment 3-3 of the present invention.

DESCRIPTION OF THE PREFERRED EMBODIMENTS

Figure 1:
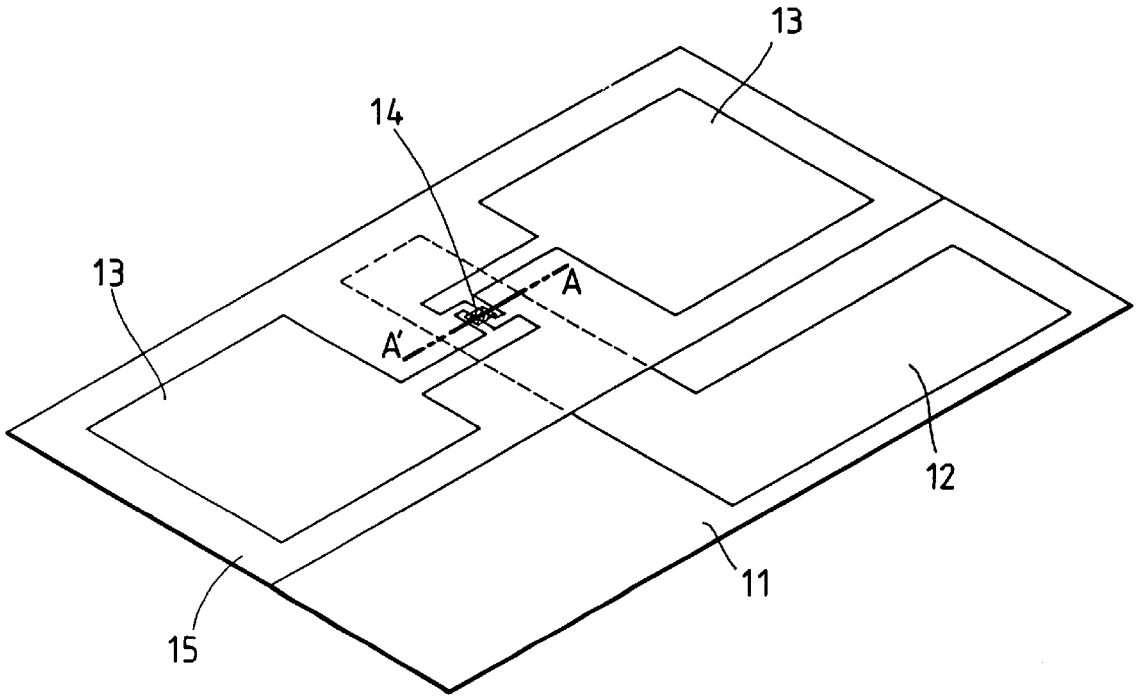
FIGS. 1, 2, and 3 show an electron beam-generating device of Embodiment 1-1 of the present invention.

First to seventh types of embodiments of the present invention improves further the electron beam-generating device and the image-forming apparatus disclosed in U.S.

Pat. No. 5,185,554, and are described below successively. All of these first to seventh types of embodiments relate to an electron beam-generating device having an electron-emitting element and an modulation electrode being arranged on the same plane of a substrate, or the modulation electrode being placed on the reverse side of the substrate of the electron-emitting element, and an image-forming apparatus and a recording apparatus employing it. These embodiments have the advantages in common that (1) the modulation electrode and the electron-emitting element are readily registered in position, and the apparatus is simply constructed; (2) a sufficient quantity of electron emission is obtained, undesired variation of the quantity of electron emisssion and variation of modulation between electrodes are less, and the modulation efficiency is high; and (3) a sharp and clear image is obtained with high contrast and without luminance variation.

The first type of embodiments of the present invention relate to an electron beam-generating device having an electron-emitting element and a modulation electrode for modulating an electron beam emitted from the electron-emitting element, the electron-emitting element and the modulation electrode being arranged on the same face of a substrate, or the modulation electrode being placed on the reverse side of the substrate of the electron-emitting element, in which the electron-emitting element has an electron-emitting portion between a lower potential electrode and a higher potential electrode, and the lower potential electrode is larger in size than the higher potential electrode.

The first type of embodiments also relate to an image-forming apparatus comprising the above electron beam-generating device and an image-forming member to form an image on irradiation of electron beam from the electron beam-generating device.

The first type of embodiments further relate to a recording apparatus comprising the image-forming member having a light-emitting material, and a recording medium for recording an image by irradiation of light from the light-emitting material, or a supporting means for supporting the recording medium.

Some of the first type of embodiments are described below in detail.

Embodiment 1-1 relates to an electron beam-generating device comprising an electron-emitting element having an electron-emitting portion between a lower potential electrode and a higher potential electrode, and a modulation electrode for modulating an electron beam emitted from the electron-emitting element in accordance with an information signal, where the electron-emitting element and the modulation electrode are laminated with interposition, of an insulating substrate; the lower potential electrode has a larger thickness or a larger width than that of the higher potential electrode in the electron-emitting element; and the electron-emitting element is a linear electron-emitting element having a plurality of electron-emitting portions arranged in a line, and the linear electron-emitting elements and the modulation electrodes constitute an XY matrix.

Embodiment 1-1 further relates to an image-displaying apparatus comprising an electron-emitting element having an electron-emitting portion between a lower potential electrode and a higher potential electrode, a modulation electrode for modulating an electron beam emitted from the electron-emitting element in accordance with an information signal, and an image-forming member for forming an image on irradiation of the electron beam, where the modulation electrode, the electron-emitting element; the image-forming member are placed in the named order; the electron-emitting element and the modulation electrode are laminated with interposition of an insulating substrate; the lower potential electrode has a larger thickness or a larger width than that of the higher potential electrode in the electron-emitting element; and the electron-emitting element is a linear electron-emitting element having a plurality of electron-emitting portions arranged in a line, and the linear electron-emitting elements and the modulation electrodes constitute an XY matrix.

Embodiment 1-1 further relates to a recording apparatus comprising an electron-emitting element having an electron-emitting portion between a lower potential electrode and a higher potential electrode, a modulation electrode for modulating an electron beam emitted from the electron-emitting element in accordance with an information signal, a light-emitting material which emits light on irradiation of the electron beam, and a recording medium for recording an image on irradiation of light from the light-emitting material, where the modulation electrode, the electron-emitting element, and the image-forming member are placed in the named order; the electron-emitting element and the modulation electrode are laminated with interposition of an insulating substrate; and the lower potential electrode has a larger thickness or a larger width than that of the higher potential electrode in the electron-emitting element.

Embodiment 1-1 still further relates to a recording apparatus comprising an electron-emitting element having an electron-emitting portion between a lower potential electrode and a higher potential electrode, a modulation electrode for modulating an electron beam emitted from the electron-emitting element in accordance with an information signal, a light-emitting material which emits light on irradiation of the electron beam, and a supporting member for supporting a recording medium for recording an image on irradiation of light from the light-emitting material, where the modulation electrode, the electron-emitting element and the image-forming member are placed in the named order; the electron-emitting element and the modulation electrode are laminated with interposition of an insulating substrate; and the lower potential electrode has a larger thickness or a larger width than that of the higher potential electrode in the electron-emitting element.

Embodiment 1-1 is described more specifically.

The electron beam-generating device of Embodiment 1-1 is characterized by the following two constitutional requirements: (1) the electron-emitting element as the electron beam-generating source and the modulation electrode for modulating the electron beam emitted from the electron-emitting element are laminated with interposition of an insulating substrate; and (2) the lower potential electrode has a larger thickness or a larger width than that of the higher potential electrode in the electron-emitting element.

In the above requirement (1), the insulating substrate is not limited in its shape, material, etc. provided that the substrate is capable of holding the electron-emitting element and the modulation electrode on the face thereof in an electrically insulating state. However, the insulating substrate has preferably a uniform thickness. The uniform thickness realizes a uniform distance between the electron-emitting elements and the modulation electrodes. The uniform thickness herein is in a level which can be attained by the present film formation technique (e.g., the film formation technique mentioned in Examples shown later). The insulating substrate may be in any thickness provided that the insulating state is maintained electrically between the electron-emitting element and the modulation electrode: the thickness being preferably in the range of from 0.03 $\mu$m to 200 $\mu$m, more preferably from 0.1 $\mu$m to 10 $\mu$m.

The modulation electrode is used for ON/OFF control of the electron beam emitted from the electron-emitting element, or for analog control of the electron emission quantity of the electron beam by application of voltage in accordance with an information signal. Therefore, the modulation electrode may be of any material which is electroconductive.

In the above requirement (2), the electron emitting element is not specially limited provided that it has an electron-emitting portion between a lower potential electrode and a higher potential electrode. The thickness of the element electrode of the electron-emitting element in Embodiment 1-1 means the distance in a perpendicular direction from the surface of the insulating substrate to the uppermost end of the element electrode regardless of the shape of the element. The width of the element electrode in Embodiment 1-1 means the smallest distances between the edges of the electrode in lateral direction.

The above two requirements (1) and (2) are essential in Embodiment 1-1. The electronic-generating device of Embodiment 1-1 which satisfies the above requirements gives sufficient quantity of electron emission with less amount of undesired variation in electron emission quantity and less variation in modulation among electron beams, thereby giving image display with high contrast without illuminance variation. In Embodiment 1-1, the arrangement of the electron-emitting element and the modulation electrode as in the requirement (1) has solved simultaneously the problems of the difficulty in positional registration of the electron passage hole of the modulation electrode with the electron-emitting portion, and the variation and non-uniformity of the distances between the modulation electrode and electron emitting element.

Naturally, the modulation electrode is desirably placed in emission path of the electron beam because of modulation efficiency. In Embodiment 1-1, an electron beam-generating device is provided which is improved in electron beam modulation efficiency, especially in low-voltage driving, by the arrangement as shown in the requirement (1) and the use of the electron-emitting element as shown in the requirement (2).

The electron-emitting element of Embodiment 1-1 is described in more detail.

Figure 2:
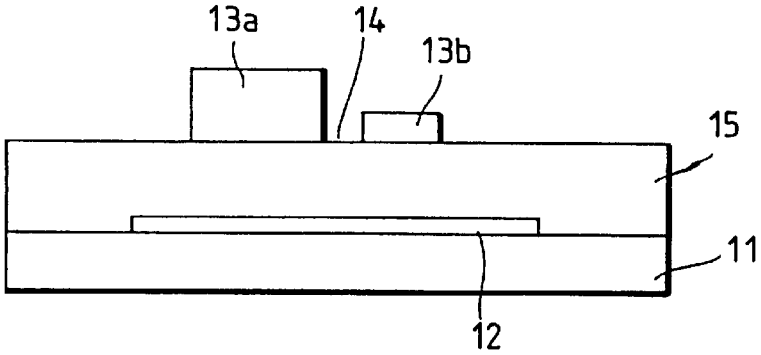

FIG. 1 is a perspective view of an example of the electron-generating device of Embodiment 1-1. The element has a substrate (a rear plate) 11, a grid electrode (a modulation electrode) 12, element electrodes 13, electron-emitting portion 14, and an insulating layer 15. FIG. 2 is a cross-section viewed at the line A–A' in FIG. 1.

The substrate 11 may be made of any material which is heat-resistant and solvent-resistant, including metal, glass, and ceramics.

The insulating layer 15 may be made of a conventional inorganic insulating film, and may also be made of organic insulating film. Specifically, the organic insulating film may formed by vapor deposition, cluster ion beam deposition, or a like method.

The electron-emitting portion 14 in Embodiment 1-1 may be formed by known conventional method. The electrode may be made of any material which has high electroconductivity, the material including metals of Au, Ag, Al, In, Pt, Pd, Sn, and Pb, and alloys thereof.

The electron-emitting element in Embodiment 1-1 may be either a hot cathode or a cold cathode if it satisfies the above requirement (2). The hot cathode is lower in efficiency and response speed than the cold cathode owing to diffusion of heat to the insulating substrate. Therefore, cold cathodes are preferred such as a surface-conduction type emitting element and semiconductor electron-emitting element mentioned later. The surface-conduction type emitting element is particularly preferred, since it has advantages of (1) much higher electron-emitting efficiency, (2) a readily producible simple structure, (3) possibility of arrangement of many elements in high density on one and the same substrate, (4) high response speed, and (5) excellent luminance contrast.

The surface-conduction type emitting element includes a cold cathode element disclosed by M. I. Elinson et al. (Radio Eng. Electron Phys. Vol. 10, pp. 1290–1296 (1965)) which emits electrons by flowing electric current through a thin film of a small area conduction type emitting element includes the one employing Au thin film (G. Dittmer: "Thin Solid Films" Vol. 9, p. 317 (1972)); the one employing an ITO thin film (M. Hartwell and C. G. Fonstad: "IEEE Trans. ED Conf." p. 519 (1975)); the one employing a carbon thin film (Araki et al. "Shinku" Vol. 26, No. 1, p. 22 (1983)), and so forth.

The surface-conduction type emitting element employed in Embodiment 1-1 may be of another type, such as the one having an electron-emitting portion formed from fine metal particle dispersion as described later.

In a preferred embodiment, the surface-conduction type emitting element has a sheet resistance of the thin film of from $10^3$ $\Omega/cm^2$ to $10^9$ $\Omega/cm^2$, and the spacing between the electrodes is from 0.01 $\mu$m to 100 $\mu$m, more preferably 1 $\mu$m to 10 $\mu$m.

The electron-emitting element in Embodiment 1-1 has separate voltage application means for the electron-emitting elements and for the modulation electrodes, and each of the voltage application means have an application voltage adjusting means respectively.

The electron-emitting element in Embodiment 1-1 is preferably a linear electron-emitting element which has a plurality of electron-emitting portions arranged in a line, and a plurality of the linear electron-emitting elements and a plurality of the modulation electrodes respectively.

The electron-emitting element in Embodiment 1-1 is preferably a linear electron-emitting element which has a plurality of electron-emitting portion arranged in a line, and a plurality of the linear electron-emitting elements and a plurality of the modulation electrodes constitute an XY matrix. With such a multiple electron beam-generating device having many electron-emitting portions, the aforementioned requirements (1) and (2) is particularly preferable for low voltage driving.

The description above is given mainly on the electron-generating device of Embodiment 1-1. This electron-generating device is particularly useful as an electron source for an image display apparatus and a recording apparatus.

An example of an image display apparatus employing an electron beam-generating device of Embodiment 1-1 is described below by reference to FIG. 4.

Figure 4:
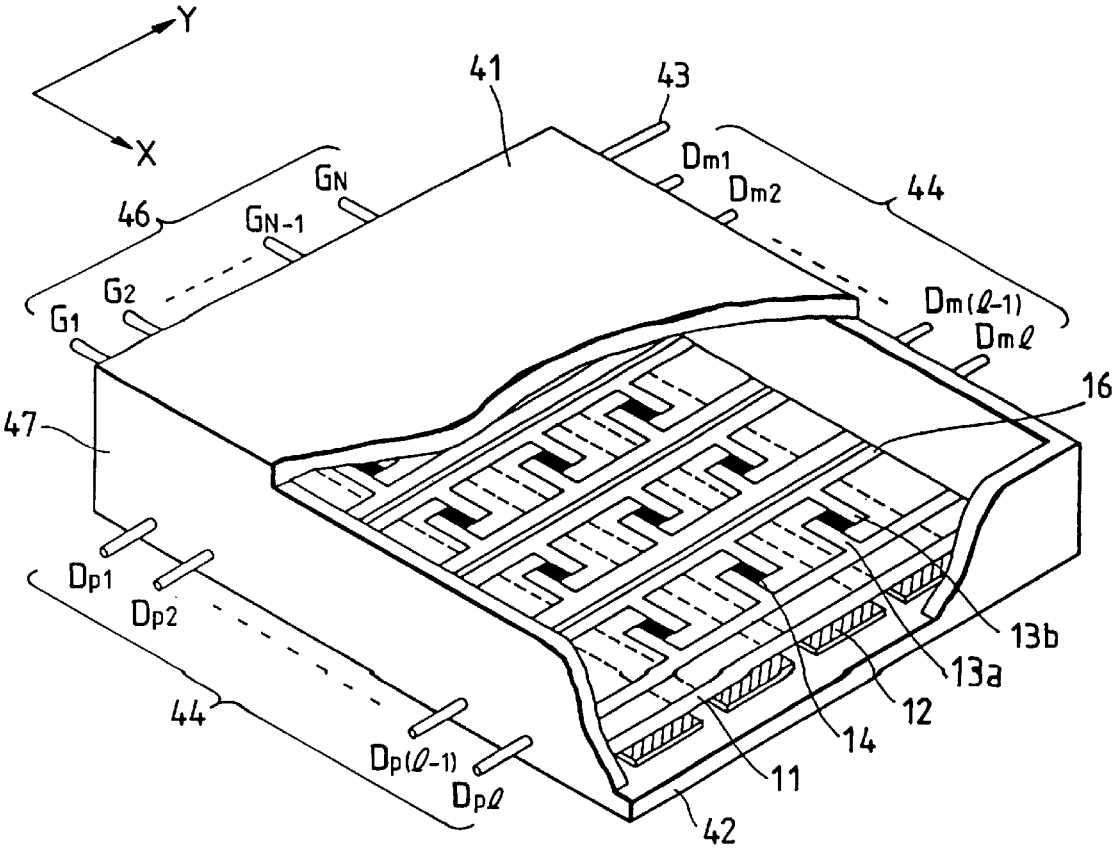
FIG. 4 shows an image-forming apparatus of the present invention.

FIG. 4 illustrates the structure of a display panel. The display panel has a vacuum vessel 47 made of glass as the housing. A face plate 41 constitutes the display face side of the vacuum vessel 47. A light-transmissive electrode made of a material such as ITO is formed on the inside face of the face plate 41, and further thereon fluorescent materials of red, green, and blue are applied separately in a mosaic pattern, the surface of which is treated for metal-backing as known in the technical field of CRT. The light-transmissive electrode is connected electrically through a terminal to a voltage source outside the vacuum vessel.

An electron-generating device of Embodiment 1-1 is fixed on the bottom face of the vacuum vessel 47. The electron-generating device has a glass substrate (an insulating base plate) 11 and electron-emitting elements formed on the face of the substrate in arrangement of N elements×l rows. The electron-emitting elements in each row are connected electrically in parallel, and the anode side wirings 44 (cathode side wirings 45) are electrically connected through terminals $Dp_1$–$Dp_l$ (terminals $Dm_1$–$Dm_l$) to a voltage source outside the vacuum vessel.

On the back side of the substrate 11, grid electrodes (modulation electrodes) 12, N in number, are provided in a direction orthogonal to the above element rows, and respective grid electrodes (modulation electrodes) 12 are electrically connected through terminals 46 ($G_1$–$G_N$) to an outside voltage source.

In this display panel, l electron-emitting element rows (linear electron-emitting elements) and N grid electrodes (modulation electrodes) form an XY matrix. The electron-emitting element rows are driven (or scanned) sequentially, row by row, and simultaneously modulation signals for one line of an image are applied to the grid electrodes (modulation electrodes) synchronously in accordance with information signals to control the projection of respective electron beams onto an fluorescent material, thereby displaying the image by lines.

The image display apparatus gives extremely high resolution with high luminance and high contrast without luminance irregularity owing to the aforementioned advantages of the electron-generating device of Embodiment 1-1.

An example of a recording apparatus employing an electron beam-generating device of Embodiment 1-1 is described by reference to FIG. 5.

Figure 5:
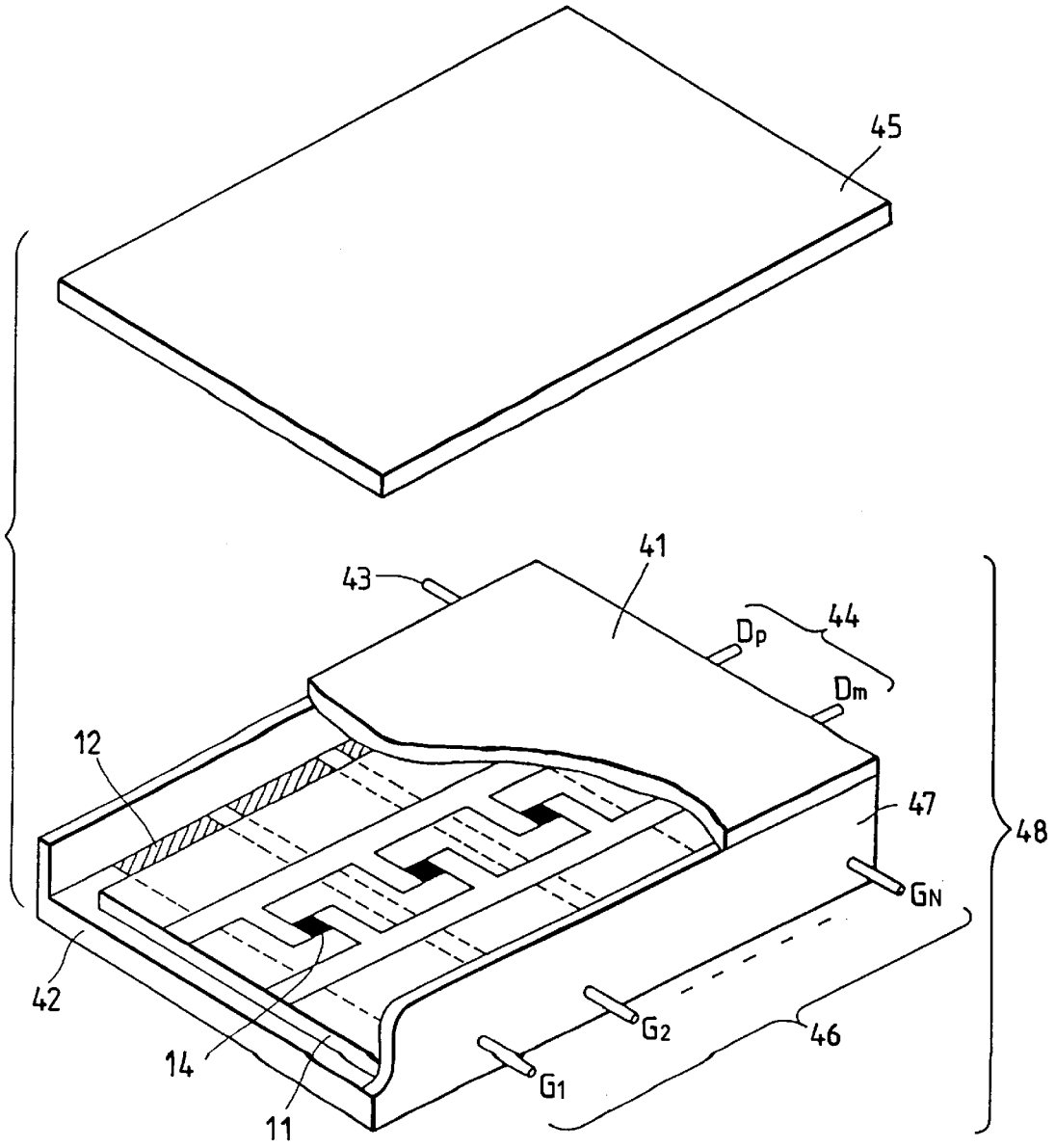
FIGS. 5, 6A–6B, and 7 show a recording apparatus of the present invention.

FIG. 5 illustrates roughly the structure of an optical printer.

The optical printer has a vacuum vessel 47 made of glass as the housing. A face plate 41 constitutes the display face side of the vacuum vessel 47. Through the face plate 41, a light beam is projected to a recording medium 45. A light-transmissive electrode made of a material such as ITO is formed on the inside of the face plate 41, and further thereon fluorescent materials (light-emitting material) are applied, the surface thereof being treated for metal-backing as known in the technical field of CRT. (The light-transmissive electrode, the fluorescent material, and the metal back are not shown in the drawing.) The light-transmissive electrode is connected electrically through a terminal 43 to a voltage source outside the vacuum vessel.

An electron-generating device of Embodiment 1-1 is fixed on the bottom face of the vacuum vessel 47. The electron-generating device has a glass substrate (an insulating base plate) 11, and electron-emitting elements are formed on the face of the substrate in a line. The anode side wirings (the cathode side wirings) 44 of the electron-emitting elements are electrically connected through terminals Dp, Dm to a voltage source outside the vacuum vessel.

On the back side of the substrate 11, grid electrodes (modulation electrodes) 12, N in number, are provided by lamination in a direction orthogonal to the above element row, and respective grid electrodes (modulation electrodes) 12 are electrically connected through terminals 46 ($G_1$–$G_N$) to an outside voltage source.

Figure 6A:
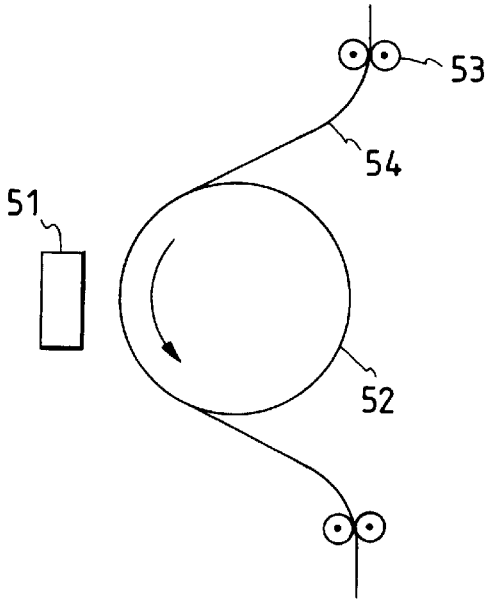
Figure 6B:
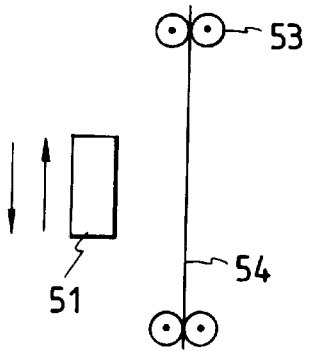

In this optical printer, when the electron-emitting elements in a row are driven, modulation signals for one line of an image are applied simultaneously to the grid electrodes (modulation electrodes) synchronously in accordance with information signals to control the projection of respective electron beams onto the fluorescent material (light-emitting material), thereby forming a light emission pattern for one line of the image. The light emitted from the light-emitting material in accordance with the light emission pattern is projected onto the recording medium, thereby forming a photo-sensitized pattern on a photosensitive recording medium or a heat-sensitized pattern on a heat-sensitive recording medium. The above operation is repeated successively, line by line as shown in FIGS. 6A and 6B, by scanning a recording medium with the light beam, or making the light-emitting source 51 (or 81 in FIG. 8) scan the recording medium over the entire image lines to record an image on the surface of the recording medium. The recording medium may be a photosensitive (or heat-sensitive) sheet 54 as in FIGS. 6A and 6B. In this case, the recording apparatus has a support for supporting the sheet, such as a drum 52, and a delivery roller 53. The recording medium may be a photosensitive drum 64 as shown in FIG. 7.

Figure 7:
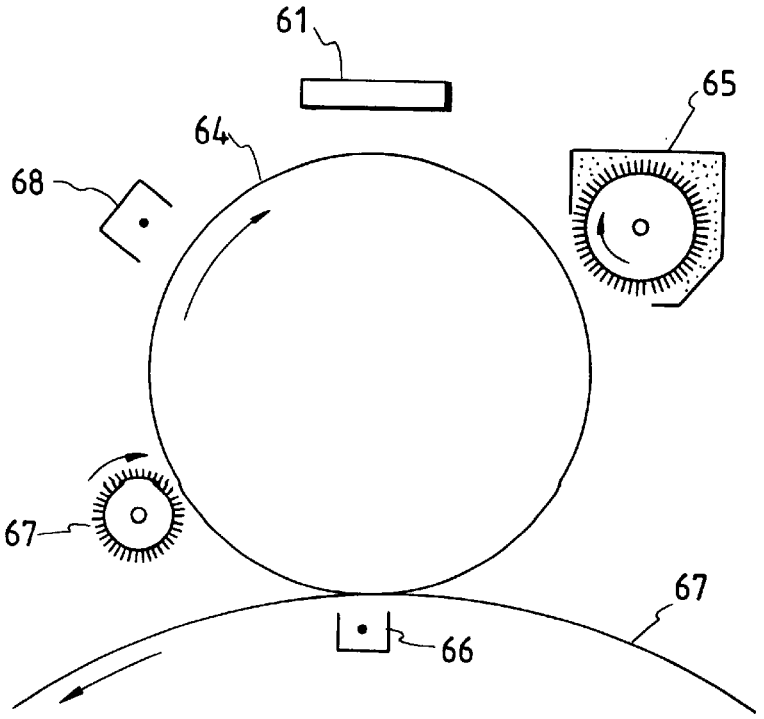

The apparatus of FIG. 7 has, along the periphery of the drum-shaped recording medium 64 in a rotation direction, a developing member 65, a static eliminator 66, a cleaner 67, and an electric charger 68. In recording, firstly, the electric charger 68 electrically charges the recording medium 64. Then the light-emitting source 61 emits light imagewise. The light in an image is projected onto the recording medium 64 to optically sensitize it. The sensitized portion of the recording medium 64 is destaticized, and non-exposed portion which has not been destaticized attracts a toner supplied from the developing member 65 to allow the toner to adhere thereon. The portion having the adhering toner moves with the rotation of the recording medium 64. When the electric charge is eliminated by the static eliminator 66, the adhering toner falls. This toner is received by a paper sheet 69 which is placed between the recording medium 64 and the static eliminator 66. The paper sheet 69 having received the toner moves to a fixing apparatus (not shown in the drawing), and there the toner is fixed on the paper sheet 69, thereby the image formed by the light-emitting source 61 being reproduced and recorded. The drum-shaped recording medium 64 further rotates toward the cleaner 67, where any remaining toner is swept away. Then the portion of the drum is electrically charged by the charger 68 again.

The recording apparatus described above gives extremely high resolution with high speed and high contrast without exposure irregularity owing to the aforementioned advantages of the electron-generating device of Embodiment 1-1.

The dimensions of the aforementioned constitutional elements are as below. The substrate 11 has a thickness preferably of from 0.8 mm to 1 mm in view of mechanical strength although the thickness does not affects the characteristics of the element. The grid electrode 12 has a film thickness of preferably from 0.01 $\mu$m to 1 mm and a breadth of 0.05 $\mu$m or more. The insulating layer 15 has a film thickness of preferably from 0.1 $\mu$m to 200 $\mu$m.

In Embodiment 1-1, the low-potential electrode of the element electrodes 13 is required at least to have a larger thickness or a larger width than that of the high-potential electrode. In FIG. 2, the electrode 13*a* is the low-potential electrode and the electrode 13*b* is a high-potential electrode. Preferably, the low-potential electrode has a width of from 5 to 100 $\mu$m and a thickness of 0.05 $\mu$m to 10 $\mu$m, and the high-potential electrode has a width of from 5 to 20 $\mu$m and a thickness of 0.05 μm to 0.5 μm. However, the dimensions are not limited thereto.

Another example of the first type of embodiments, Embodiment 1-2, is described below. Embodiment 1-2 relates to:

(1) an electron beam-generating device which comprises an electron-emitting element having an electron-emitting portion between a lower potential electrode and a higher potential electrode on an insulating substrate, and a modulation electrode on one of the lower potential electrode and the higher potential electrode, the lower potential electrode having a larger width than that of the higher potential electrode, (2) an electron beam-generating device of the above item (1) in which the modulation electrode is provided only on the side of the higher potential electrode side, (3) an electron beam-generating device of the above items (1) or (2) in which the lower potential electrode has a thickness larger than that of the higher potential electrode, (4) an electron beam-generating device any of the above items (1) to (3) in which the modulation electrode has a thickness larger than that of the higher potential electrode, (5) an electron beam-generating device any of the above items (1) to (4) in which the electron-emitting element is of a surface conduction type electron-emitting element, (6) an electron beam-generating device any of the above items (1) to (5) in which linear electron sources having a plurality of electron-emitting elements are arranged in stripes, and modulation electrodes are placed in a direction orthogonal to the linear electron sources to form a matrix, (7) an electron beam-generating device any of the above items (1) to (6) in which voltage application means for the electron-emitting element and for the modulation electrode are separated to be independent, (8) an image display apparatus which comprises the electron-generating device of any of the above items (1) to (7) and an image-forming member, which forms image on collision of electrons, on the electron emission side of the electron-emitting device, and (9) an optical signal-forming apparatus which comprises the electron-generating device of any of the above items (1) to (7) and a light-emitting member, which emits light on collision of electrons, on the electron emission side of the electron-emitting device, thereby using the emitted light on collision of electrons as a signal.

Embodiment 1-2 is described more specifically.

Figure 10:
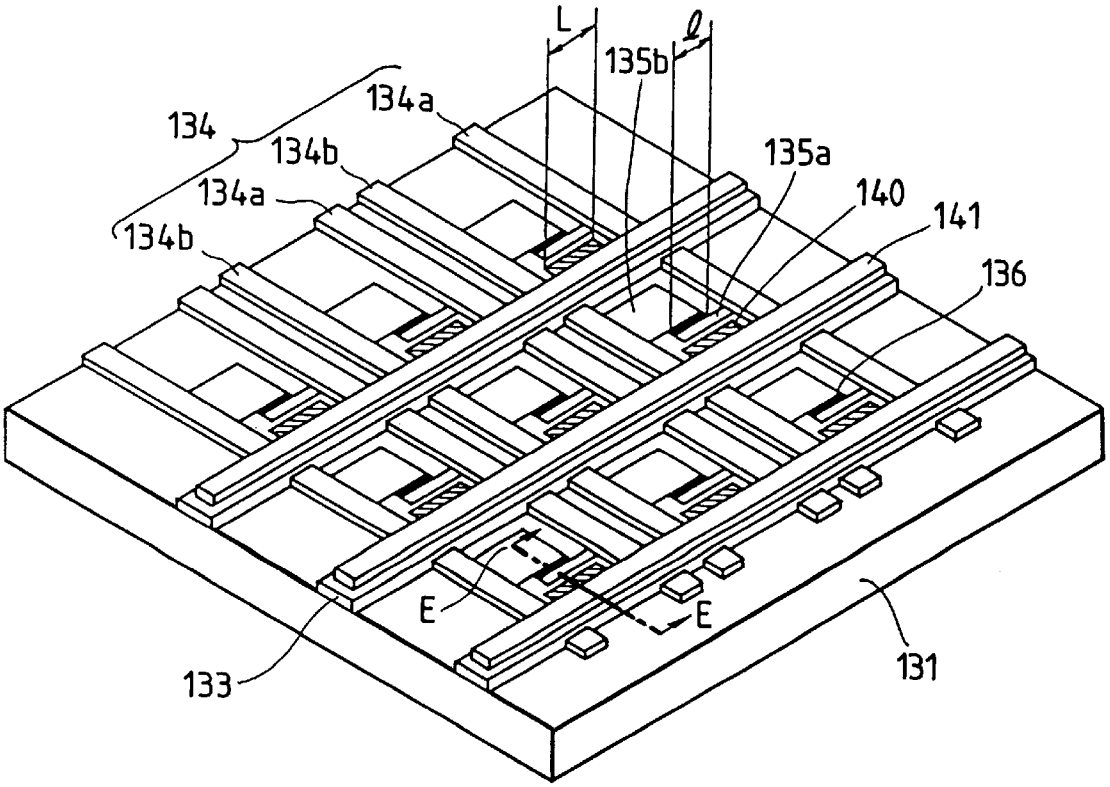
FIGS. 10, 11, 12A–12D, 14, 15, 16, and 17 show an electron beam-generating device of Embodiment 1-2 of the present invention.
Figure 11:
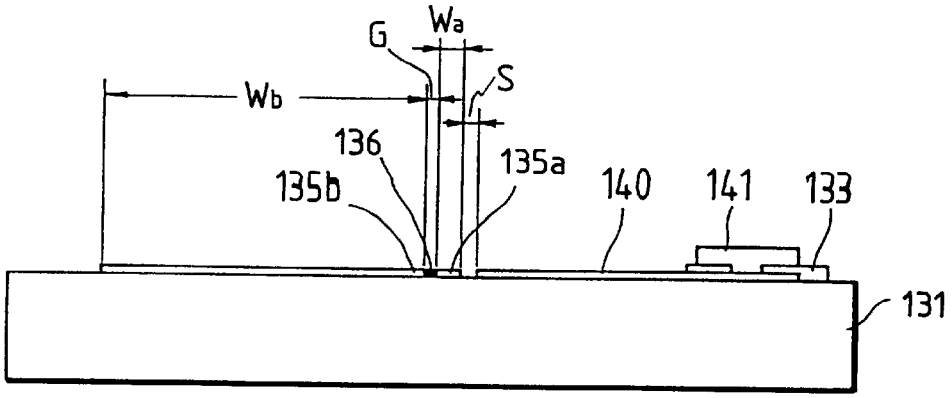
Figure 12A:
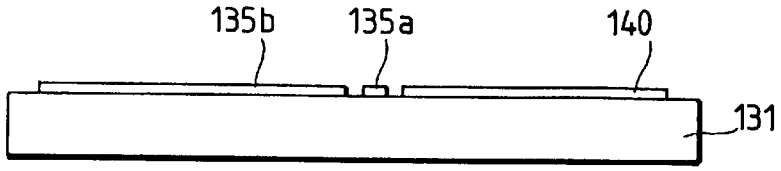
Figure 12B:
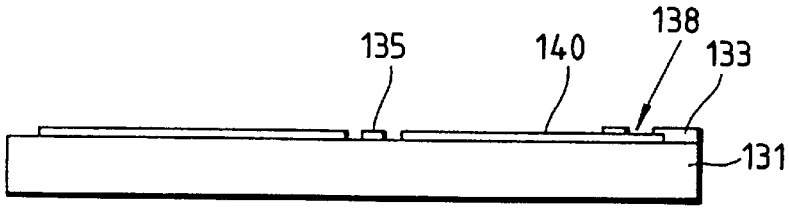
Figure 12C:
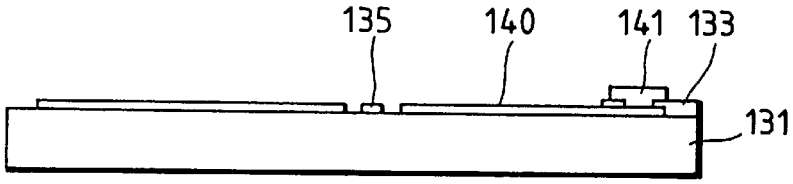
Figure 12D:
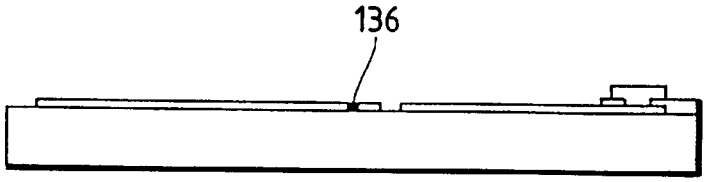

FIG. 10 illustrates an example of the electron-emitting element employed in Embodiment 1-2. In FIG. 10, the device comprises a glass substrate 131, modulation electrodes 140, insulating films 133, element wiring electrodes 134 (134*a* and 134*b*), element electrodes 135, and electron-emitting portion 136. The electron-emitting element shown in FIG. 10 is a surface conduction type electron-emitting element described later, and comprises element electrodes 135 and electron-emitting portion 136. The Embodiment 1-2 is not limited thereto. FIG. 11 is a cross-section of the electron-emitting element viewed at the line E—E in FIG. 10.

The first feature of Embodiment 1-2 is the construction of the modulation electrode and the electron-emitting element held on a substrate 131.

In Embodiment 1-2 also, the same element as in Embodiment 1-1 is employed by the same reason.

The modulation electrode is used for ON/OFF control of the electron beam emitted from the electron-emitting element by application of voltage in accordance with an information signal. The modulation electrode may be of any material which is electroconductive.

The insulating film in Embodiment 1-2 is a substrate for holding both of the electron-emitting element and the modulation electrode, and may be made of any material which is insulating.

Figure 8:
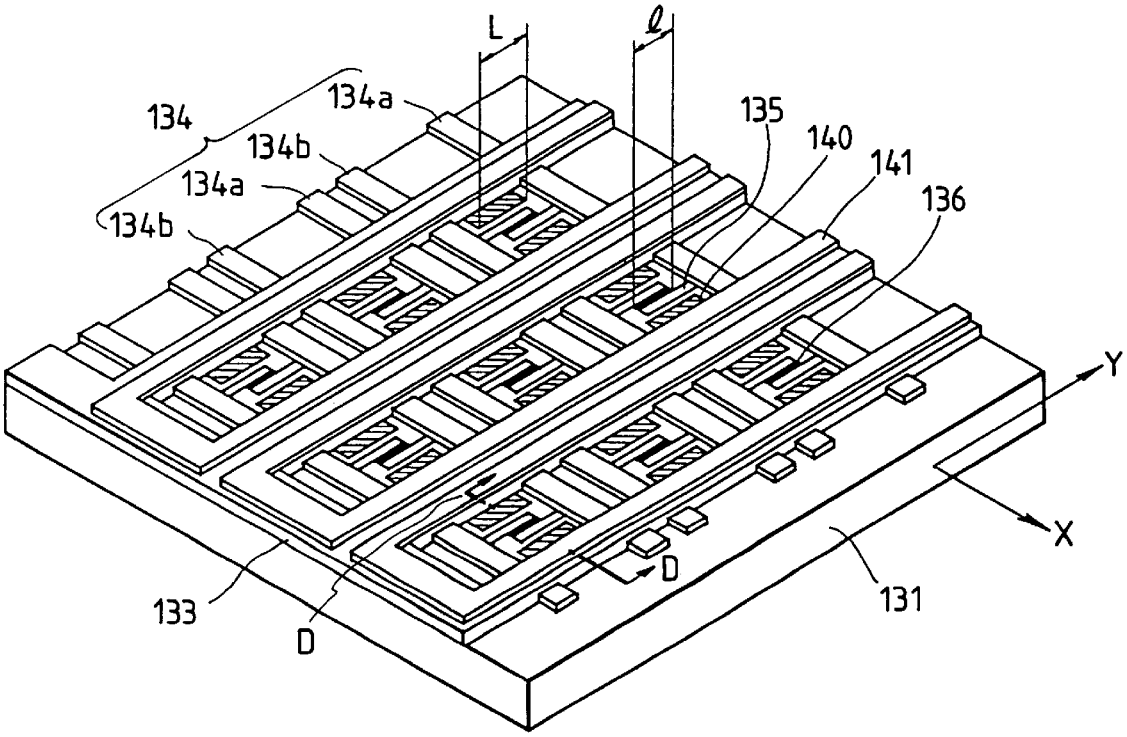
FIGS. 8, 9, and 13 are drawings for explaining the effect of Embodiment 1-2 of the present invention.
Figure 9:
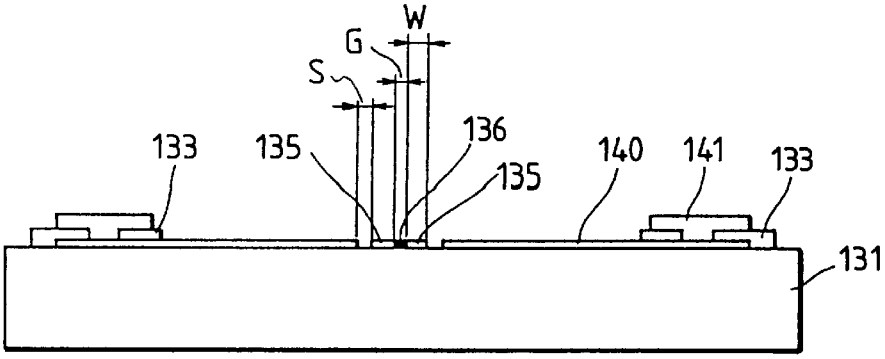

The second feature of Embodiment 1-2 is that the modulation electrode is placed on the side of one of the electrodes contiguous to the electron-emitting portion, and the lower potential electrode has a width smaller than that of the higher potential electrode. In FIG. 8, the modulation electrodes are placed on the both sides of the electron-emitting portion. FIG. 9 is the cross-section viewed at the line D—D in FIG. 8. By providing the modulation electrode not on the both sides but only on one side of the electron-emitting portion, the picture element pitch in the X direction can be made smaller in FIG. 8, which is effective for making the picture element finer. However, when the modulation electrode is provided only on one side of the electron-emitting portion, the absolute value of the voltage is generally larger which is applied to the modulation electrode to cut off the electron beam emitted from the electron-emitting portion. If the modulation electrode is provided on the side of the higher potential electrode and the width of the lower potential electrode is made larger than that of the higher potential electrode as in this Embodiment, the cut-off voltage to be applied to the modulation electrode can be kept unincreased. This is explained below by reference to FIG. 13.

Figure 13:
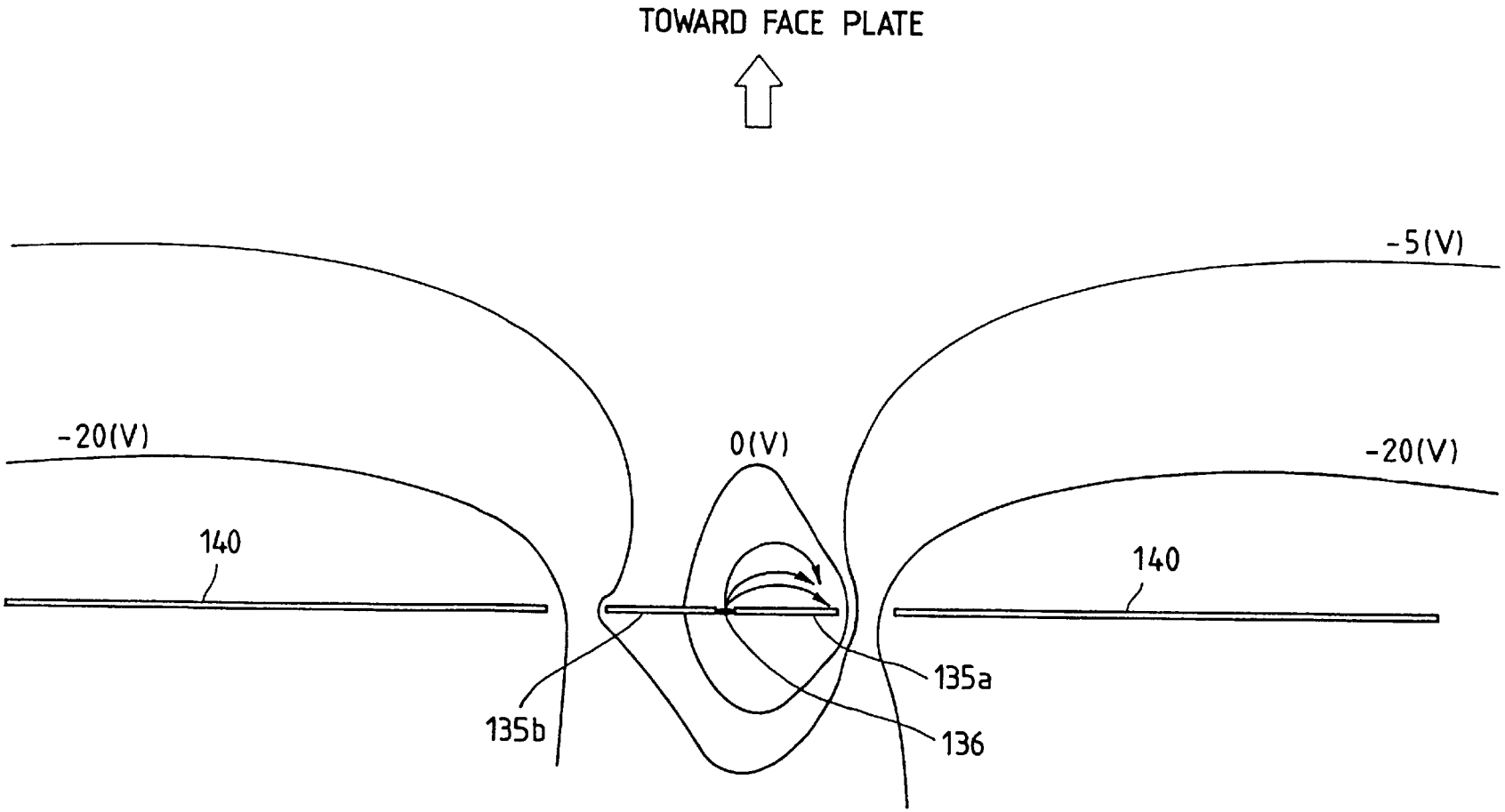

FIG. 13 shows an example of equipotential lines and electron beam paths around the element electrodes in the case of the element of FIG. 9 where the element electrode width W=20 μm, the element electrode distance G=2 μm, the distance between the element electrode and the modulation electrode S=10 μm, the distance between the element and the fluorescent material face=4 mm (not shown in the drawing), the voltage applied to the fluorescent material plane (accelerating voltage)=2 kV (not shown in the drawing), the high potential element electrode voltage=14 V, and the low potential element electrode voltage=0 V.

As shown in FIG. 13, the electron beam is cut off if the electron-emitting portion is surrounded by an equipotential line of 0 [V]. Therefore, the increase of the cut-off voltage (absolute value) is prevented by increasing the width of the low potential element electrode to which the voltage of 0 [V] is applied, even when no modulation electrode is provided on the side of the low potential element electrode.

It is further understood that, when the modulation electrode 140 is provided only on one side of the electron-emitting portion 136, the cut-off voltage (absolute value) is kept low by providing it on the high potential element electrode 135*a*, not on the side of the low potential element electrode side.

As still another example of the first type of embodiments, Embodiment 1-3 is described below.

Embodiment 1-3 relates to:

(1) an electron beam-generating device comprising a plurality of electron-emitting elements having an electron-emitting portion between a lower potential electrode and a higher potential electrode, and modulation electrodes for modulating an electron beam emitted from the electron-emitting element, where the electron-emitting element and the modulation electrode are laminated with interposition of an insulating substrate; and the low potential element wiring electrode has a pair of projections for each of the electron-emitting elements, (2) the electron beam-generating device has the projections which are formed from an electroconductive material, and have a thickness larger than that of the element electrodes, (3) the electron beam-generating device has the projections formed on one and the same substrate with the electron emitting elements, (4) an image display apparatus which comprises the above electron beam-generating device, and at least an image-forming member on the electron emission side of the electron beam-generating device to form an image on collision of electrons thereon, and (5) the image display apparatus has an image forming member above the electron beam-generating device to form an image on collision of electrons thereon.

The "thickness of the element electrode" herein means the thickness of the portion of the element electrodes contiguous to the electron-emitting portion.

Figure 21:
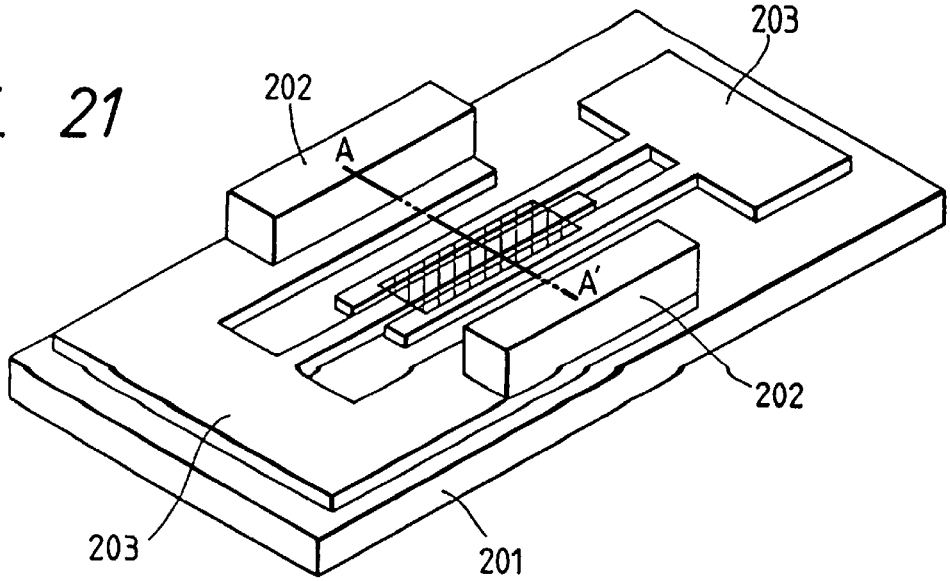
FIGS. 21, 22, 23, 24, and 25 show an electron beam-generating device of Embodiment 1-3 of the present invention.
Figure 22:
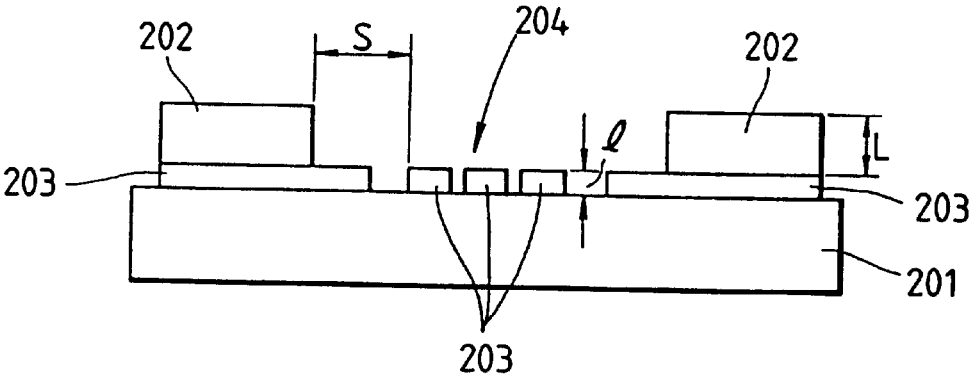

FIG. 21 is a perspective view of an example of the electron-generating device of Embodiment 1-3. The device comprises a substrate (a rear plate) 201, the projections 202 of the wiring electrode of Embodiment 1-3, element wiring electrodes 203, and an electron-emitting portion 204. FIG. 22 is a cross-sectional view of the device at the line A–A' in FIG. 21.

The substrate 201 may be made of any material which is heat-resistant and solvent-resistant, the material including metals, glass, and ceramics.

The electron-emitting element in Embodiment 1-3 may be the same as that in Embodiment 1-1 by the same reasons, and may be made of any material having a high electroconductivity, including metals such as Au, Ag, Al, In, Pt, Pd, Sn, and Pb, alloys thereof, and other materials.

The dimensions of the aforementioned constitutional elements are as below. The substrate 201 has preferably a thickness of from 0.8 mm to 1 mm in view of the mechanical strength although the thickness does not affect the element characteristics. The projections of the wiring electrodes of this Embodiment 1-3 is required to have a thickness larger than that of the element electrodes, and the thickness (L in FIG. 22) of the projection is in the range of from 0.05 to 3000 $\mu$m, and the thickness of the element electrodes (l in FIG. 22) is in the range of from 0.01 to 500 $\mu$m.

Furthermore, formation of the projection of the wiring electrode in a step shape gives the following effects: (1) correction of the shape of the electron beam, (2) improvement of focusing of the electron beam, and (3) decrease of the modulation voltage.

The effect (1) is explained firstly. The step shaped projection enables readily correction of the disturbance of the electric field in the vicinity of the electron-emitting portion, thereby enabling the control of the shape of the electron beam as desired. The disturbance of the electric field herein mentioned is caused by the potential difference between the one pair of the element electrodes to cause electron beam emission. The higher application voltage of the element causes the larger disturbance. Since the shape of the element electrode affects the disturbance, the correction means is required to be adapted to the shape of the element. By changing the shape of the step of the projection in this Embodiment 1-3, the shape of the beam is readily corrected to obtain uniform electron emission.

The effect (2) is explained. The convergence of the electron beam is limited by the influence of the electric field immediately after the electron beam emission. Therefore, the divergence of the electron beam is suppressed by correcting the shape of the beam at the site as close to the element as possible immediately after the emission. Thereby desired beam diameter can be obtained without providing an additional convergence electrode.

The effect (3) is explained. The shape correction and the convergence of the beam immediately after the emission enables the reduction of the size of the modulation electrode to the smallest size, whereby the modulation voltage is concentrated to the vicinity to the emission element, so that the modulation is practicable at a lower voltage.

As described above, the stepped projection gives an electron beam-generating device of higher performance.

Embodiments 1-1 to 1-3 are based on the common idea of making larger the lower potential electrode constituting the electron-emitting element or connected thereto in size than the higher potential electrode.

Next, a second type of embodiments are described which are based on the constitution, common to the first type of embodiments, that a modulation electrode is provided on the base plate on the reverse side of the substrate having an electron-emitting element.

The second type of embodiments of the present invention relate to an electron beam-generating device, which has an electron-emitting element and a modulation electrode for modulating an electron beam emitted from the electron-emitting element, the modulation electrode is provided on the reverse side of a substrate having the electron-emitting element, and the substrate in the region under the electron-emitting element has a thickness different from the thickness in the other region.

The second type of embodiments also relate to an image-forming apparatus comprising the above electron beam-generating device and an image-forming member to form an image on irradiation of electron beam from the electron beam-generating device.

The second type of embodiments further relate to a recording apparatus comprising the image-forming apparatus having a luminescent material as the image-forming member, and a recording medium for recording an image by irradiation of light from the luminescent material, or a supporting means for supporting the recording medium.

Some of the second type of embodiments are described below in detail.

(1) Embodiment 2-1 relates to an electron beam-generating device comprising a modulation electrode for modulating an electron beam in accordance with an information signal and an electron-emitting element above the modulation electrode formed with interposition of an insulating layer in integration, the thickness of the insulating layer being made larger in the region under the electron-emitting portion of the electron-emitting element than that of the other area.

(2) Embodiment 2-1 further relates to an electron beam-generating device comprising a modulation electrode for modulating an electron beam in accordance with an information signal and an electron-emitting element above the modulation electrode formed with interposition of an insulating layer in integration, and the thickness of the insulating layer is made smaller in the region under the electron-emitting portion of the electron-emitting element than that of the other area.

In the above embodiments, the modulation electrode and the electron-emitting element are formed, according to a conventional thin film forming process in integration with interposition of an insulating layer to improve the mutual alignment accuracy, and the thickness of the insulating layer in the region under the electron-emitting element is made different (thicker or thinner) from that in the other region to correct the shape (convergence or divergence) of the emitted electron beam.

(3) Embodiment 2-1 still further relates to an electron beam-generating device which employs the aforementioned surface conduction type electron emitting element (SCE) as the electron-emitting element as the device of the above item (1) or (2).

(4) Embodiment 2-1 still further relates to the electron beam-generating device of the above item (1) to (3), in which the thickness $L_{max}$ of the insulating layer in the region under the electron-emitting portion and the thickness $L_{min}$ of the other region satisfy the relation:

$$L_{max}-L_{min} \geqq 0.3L_{max}$$

(5) Embodiment 2-1 still further relates to the electron beam-generating device of the above item (2) or (3), in which the thickness $L_{min}$ of the insulating layer in the region under the electron-emitting portion and the thickness $L_{max}$ of the other region satisfy the relation:

$$L_{max}-L_{min} \geqq 0.3L_{max}$$

(6) Embodiment 2-1 still further relates to the electron beam-generating device of any of the above items (1) to (5), in which linear electron sources having a plurality of the above electron-emitting elements in line are arranged in stripes and the above modulation electrodes are placed in a direction orthogonal to the modulation electrodes to form a matrix.

With this constitution, the electron beam is made to scan by XY matrix driving of the linear electron sources and the modulation electrodes.

(7) Embodiment 2-1 still further relates to the electron beam-generating device of any of the above items (1) to (6), in which separate voltage application means are provided for the electron-emitting element and the modulation electrode.

In other words, by separating the application of voltage for driving the electron-emitting element and that for driving the modulation electrode, voltage is applied to the modulation electrode in accordance with an information signal to modulate the electron beam independently of the element driving.

(8) Embodiment 2-1 still further relates to an image display apparatus which comprises the electron-generating device of any of the above items (1) to (7) and an image-forming member, which forms image on collision of electrons, on the electron emission side of the electron-emitting device. The image-forming member may be made of any material which emits light, electrically charged, or changes its quality on collision of electron, such as a fluorescent material and a resist material.

(9) Embodiment 2-1 still further relates to an optical signal-forming apparatus which comprises the electron-generating device of any of the above items (1) to (7) and at least a light-emitting member, which emits light on collision of electrons, on the electron emission side of the electron-emitting device, thereby using the emitted light on collision of electrons as a signal.

Embodiment 2-1 is constituted as above and is described more specifically in Examples later.

In the basic constitution of Embodiment 2-1, the electron-emitting element and the modulation electrode under it are formed in integration with interposition of an insulating layer, and the thickness of the insulating layer in the region under the electron-emitting element (at least the electron-emitting portion thereof) is made different (thicker or thinner) from that in the other region. This construction gives the effects below.

Variation of the alignment encountered in conventional devices is eliminated, and consequently electron beam is precisely modulated in accordance with an information signal by the construction of the modulation electrode and the electron-emitting element formed with interposition of the insulating layer in integration by thin film production technique as shown in Examples shown later.

Figure 30:
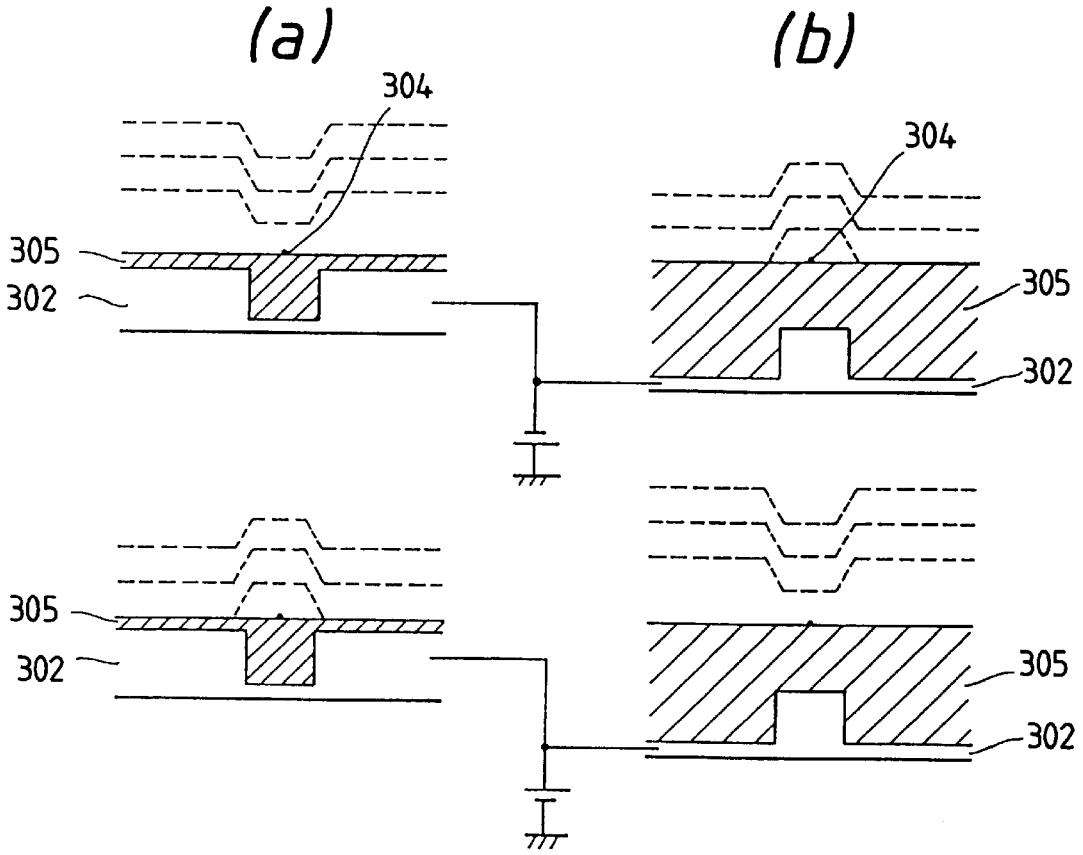
FIGS. 30(*a*), 30(*b*) and 31 are drawings for explaining the effect of an electron beam-generating device of Embodiment 2-1 of the present invention.

In the case where the insulating layer is made thicker under the electron-emitting portion than the other portion, a electric field is hollowed at and around the electron-emitting portion 304 when voltage is applied with the modulation electrode 302 employed as the negative pole as shown in FIG. 30A. In this state, the electron emitted from the electron emitting-portion 304 is accelerated in a direction perpendicular to the electric field, thereby the electron beam converging toward the center of the hollowed electric field distribution. On the contrary, when voltage is applied with the modulation electrode 302 employed as the positive pole, a electric field is protruded at and around the electron-emitting portion 304 as shown in the lower portion of FIG. 30A. In this state, the electron emitted from the electron emitting-portion 304 is accelerated in a direction perpendicular to the electric field, thereby the electron beam diverging from the center of the protruded electric field distribution.

In the case where the insulating layer is made thinner under the electron-emitting portion than the other portion as shown in FIG. 30B, the same convergence or divergence as above is obtained by applying the voltage to the modulation electrode in the reverse direction in comparison with the case above.

As shown in FIGS. 30A and 30B, the convergence and divergence can be controlled whether the insulating layer is made thicker or thinner under the electron- emitting portion. When ON control is made with positive voltage applied to the modulation electrode and OFF control is made negative voltage applied thereto, the former construction is preferred which enables ON control and beam convergence simultaneously.

To obtain the above effects most efficiently, the insulating layer 305 is in the range of from 0.5 to 10 $\mu$m and the difference between the maximum and the minimum of the insulation layer thickness is not less than 30%. The larger the aforementioned difference between the maximum and the minimum, the more remarkable is the effect. However, the difference of 30% is sufficient to obtain practical effects.

The image display apparatus and the optical signal-forming apparatus employing the above electron beam-generating device exhibiting the above effects give image display or optical signal with fineness without irregularity.

In this Embodiment, the electron-emitting element is preferably the same one as employed in Embodiment 1-1.

As another example of the second type of embodiments, Embodiment 2-2 is described below.

(1) Embodiment 2-2 relates to an electron beam-generating device comprising a modulation electrode for modulating an electron beam in accordance with an information signal and an electron-emitting element on the modulation electrode formed in integration with interposition of an insulating layer, the modulation electrode not existing at least immediately under the electron-emitting portion of the electron-emitting element.

In the above embodiment, the modulation electrode and the electron-emitting element are formed in integration with interposition of an insulating layer by thin film forming technique to improve the mutual alignment accuracy, and the damage of the element caused by the presence of the modulation electrode directly under the electron-emitting portion of the electron-emitting element is avoided.

(2) Embodiment 2-1 further relates to an electron beam-generating device which comprises the aforementioned surface conduction type electron emitting element (SCE) as the electron-emitting element as the device of the above item (1).

(3) Embodiment 2-1 still further relates to the electron beam-generating device of the above item (1) or (2), in which linear electron sources having a plurality of the electron-emitting elements in line are arranged in stripes and the above modulation electrodes are placed in a direction orthogonal to the modulation electrodes to form a matrix.

With this constitution, the electron beam is made to scan by XY-matrix driving of the linear electron sources and the modulation electrodes.

(4) Embodiment 2-1 still further relates to the electron beam-generating device of any of the above items (1) to (3), in which separate voltage application means are provided for the electron-emitting element and the modulation electrode.

In other words, by separating the application of voltage for driving the electron-emitting element and that for driving the modulation electrode, voltage is applied to the modulation electrode in accordance with an information signal to modulate the electron beam independently of the element driving.

(5) Embodiment 2-1 still further relates to an image display apparatus which comprises the electron-generating device of any of the above items (1) to (4) and an image-forming member, which forms image on collision of electrons, on the electron emission side of the electron-emitting device. The image-forming member may be made of any material which emits light, electrically charged, or changes its quality on collision of electron, such as a fluorescent material and a resist material.

(6) Embodiment 2-1 still further relates to an optical signal-forming apparatus which comprises the electron-generating device of any of the above items (1) to (4) and a light-emitting member, which emits light on collision of electrons, on the electron emission side of the electron-emitting device, thereby using the emitted light on collision of electrons as a signal.

The constitution of Embodiment 2-2 is as above. It is more specifically described later in Examples.

In the basic constitution of Embodiment 2-2, the electron-emitting element and the modulation electrode under it are formed in integration with interposition of an insulating layer, and the modulation electrode is not provided at least directly under the electron-emitting portion of the electron-emitting element. This construction gives the effects below.

Variation of the alignment encountered in conventional devices is eliminated, and consequently an electron beam is precisely modulated in accordance with an information signal by the construction of the modulation electrode and the electron-emitting element formed with interposition of the insulating layer in integration by thin film production.

Thereby, the insulating layer can be made thinner, and the modulation electrode can be driven with lower voltage. For example, the thickness of the insulating film of from 0.5 to 10 $\mu$m and the voltage application of from −40 to −50 V required in the presence of the modulation electrode can be reduced to the thickness of from 0.1 to 5 $\mu$m and the voltage of from −25 to −40 V in its absence.

The image display apparatus and the optical signal-forming apparatus employing the above electron beam-generating device exhibiting the above effects give image display or optical signal with fineness without irregularity.

In this Embodiment 2-2, the electron-emitting element is preferably the same one as employed in Embodiment 1-1.

As a further example of the second type of embodiments, Embodiment 2-3 is described below. (1) Embodiment 2-3 relates to an electron-generating device in which an electron-emitting element is laminated on a modulation electrode with interposition of an insulating layer, and a part of the insulating layer is eliminated in the region other than the region under the electron-emitting element to expose the modulation electrode.

The electron-emitting element useful in this Embodiment includes an MIM type electron-emitting element and a surface conduction type electron emitting element. The MIM type electron-emitting element has construction of (metal layer)/(insulating layer)/(metal layer), and is capable of emitting, from one of the metal layer to the outside of the element, electrons having penetrated through the insulating layer by tunnel effect on application of voltage between the both metals. The surface conduction type electron-emitting element emits electrons from a thin film of high resistance to the outside of the element on application of voltage to the film in a direction perpendicular to the film surface.

The portion of the insulating layer to be eliminated to expose the underlying modulation electrode is preferably the area positioned at the both sides or one side of the electron-emitting element.

The shape of the area of the elimination of the insulating layer may be rectangular, ellipsoidal, or of a curved crescent moon shape when viewed from the electron emission side, depending on the modulation characteristics required.

(2) Embodiment 2-3 further relates to an electron-emitting device of the above item (1), in which a plurality of linear electron sources having the above electron emitting elements in line is arranged in stripes, and the modulation electrodes are placed in a direction orthogonal to the linear electron sources to form an XY matrix. With this constitution, the electron beam is made to scan by XY-matrix driving of the linear electron sources and the modulation electrodes.

(3) Embodiment 2-3 still further relates to the electron beam-generating device of the above item (1) or (2), in which separate voltage application means are provided for the electron-emitting element and for the modulation electrode.

In other words, by separating the application of voltage for driving the electron-emitting element and that for driving the modulation electrode, voltage is applied to the modulation electrode in accordance with an information signal to modulate the electron beam independently of the element driving.

(4) Embodiment 2-3 still further relates to an image display apparatus which comprises the electron-generating device of any of the above items (1) to (3) and an image-forming member, which forms image on collision of electrons, on the electron emission side of the electron-emitting device. The image-forming member may be made of any material which emits light, electrically charged, or changes its quality on collision of electron, such as a fluorescent material and a resist material.

(5) Embodiment 2-3 still further relates to an optical signal-forming apparatus which comprises the electron-generating device of any of the above items (1) to (3) and a light-emitting member, which emits light on collision of electrons, on the electron emission side of the electron-emitting device, thereby using the emitted light on collision of electrons as a signal.

The constitution and the effects of Embodiment 2-3 is more specifically described below.

Embodiment 2-3 is characterized firstly by the construction in which a modulation electrode, an insulating layer, and an electron-emitting element are held in the named order on a substrate in the same manner as in Embodiment 1-1 described before.

Embodiment 2-3 is characterized secondly by the construction in which the insulating layer for insulating the electron-emitting element from the modulation electrode is partly eliminated in the area other than the portion under the electron-emitting element to expose the modulation electrode. The effects resulting from this construction are explained by reference to FIG. 39.

Figure 39A:
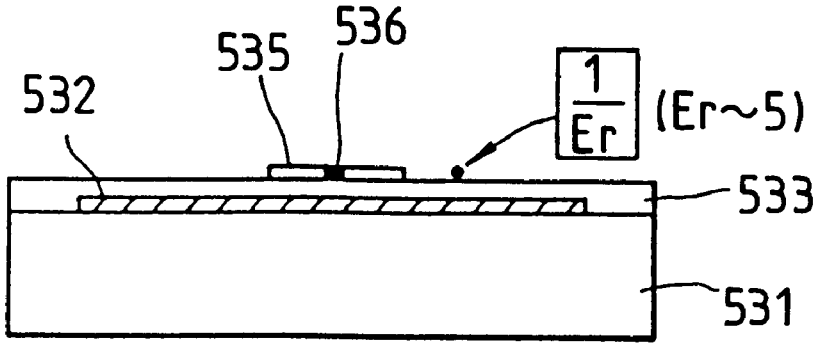
FIGS. 39A–39B are drawings for explaining the effect of an electron beam-generating device of Embodiment 2-3 of the present invention.
Figure 39B:
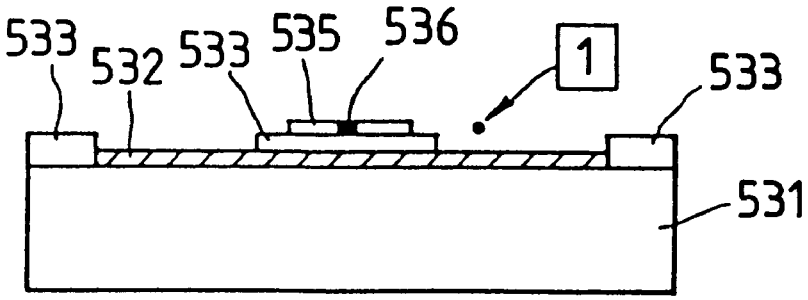
Figure 40A:
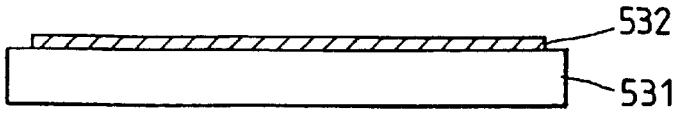
Figure 40B:
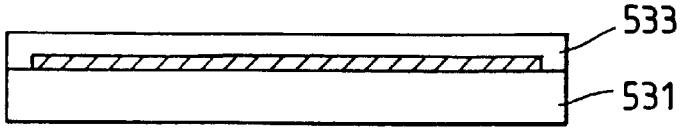
Figure 40C:
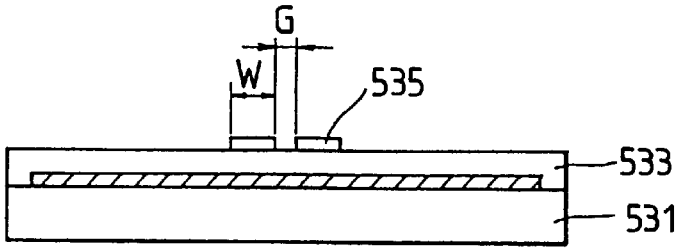
Figure 40D:
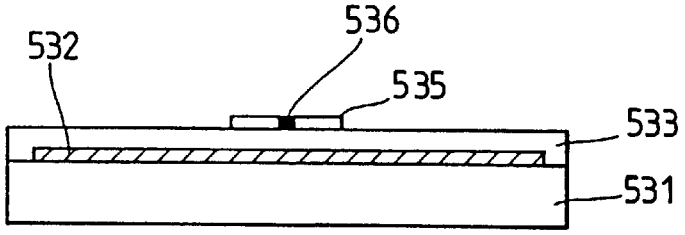
Figure 40E:
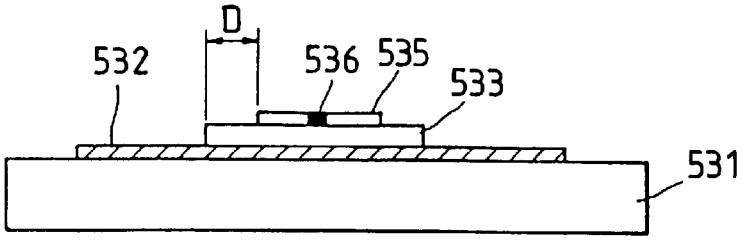

FIG. 39A shows an example of the construction having a complete insulating layer. FIG. 39B shows an example of the construction of this Embodiment in which a part of the insulating layer is removed. In the drawings, the electron-emitting element shown is a surface conduction type electron-emitting element. The device in FIG. 39B is different from the one in FIG. 39A in that a part of the insulating layer 533 is eliminated. The dimensions and the applied voltage are made to be equal for the both devices. In the vicinity of the electron source, assuming the influence of the modulation electrode voltage on the potential to be 1 in the case of FIG. 39B, the influence is reduced to about 1/Er in the case of FIG. 39B (where Er is relative dielectric constant of the insulating layer: e.g., 4.0–6.0).

As described above, the partial absence of the insulating layer which insulates the electron-emitting element from the modulation electrode enhances the effect of the voltage of the modulation electrode in the vicinity of the electron-emitting element. Therefore the absolute value of the modulation electrode voltage can be reduced to control the electron beam emitted from the electron-emitting element.

A further effect of this construction is that the beam shape on the image-forming member can be corrected by changing the shape of the area of elimination of the insulating layer.

It will be understood that, in the partial elimination of the insulating layer, the underlying modulation electrode is not necessarily to be exposed to achieve the effect. However, the exposure of the modulation electrode will additionally prevent charge-up.

Figure 37:
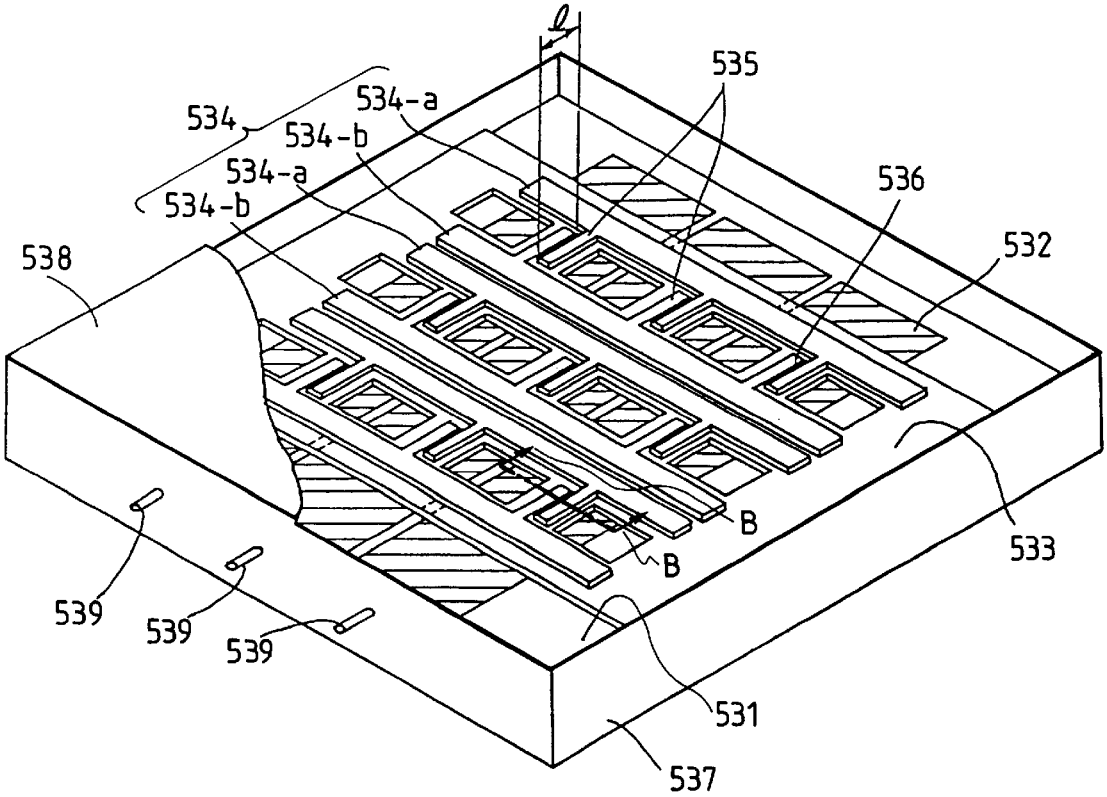
FIG. 37 shows an image-forming apparatus of the present invention.

FIG. 37 shows an example of the image display apparatus employing the electron-generating device of Embodiment 2-3. The apparatus has a vacuum vessel 537 made of glass. A face plate 538 constitutes the display face side of the vacuum vessel 537. A light-transmissive electrode made of a material such as ITO is formed on the inside face of the face plate 538, and further thereon fluorescent materials of red, green, and blue are applied separately in a mosaic pattern, the surface of which is treated for metal-backing as known in the technical field of CRT. (The light-transmissive electrode, the fluorescent material, and the metal-back are not shown in the drawing.) The light-transmissive electrode is connected electrically through a terminal to a voltage source outside the vacuum vessel.

An electron-generating device of Embodiment 2-3 is fixed on the bottom face of the vacuum vessel 537. The electron-generating device has a glass substrate (an insulating base plate) 531, and electron-emitting elements are formed on the face of the substrate in arrangement of N elements×l rows. The electron-emitting elements in one row are connected electrically in parallel, and the anode side wirings 534-*a* (cathode side wirings 534-*b*) are electrically connected through terminals a voltage source outside the vacuum vessel.

On the upper face of the substrate 531, grid electrodes (modulation electrodes) 532, N in number, are provided in a direction orthogonal to the above element rows, and respective grid electrodes (modulation electrodes) 532 are electrically connected through terminals 539 to an outside voltage source.

In this display panel, l electron-emitting element rows (linear electron-emitting elements) and N grid electrode rows (modulation electrodes) form an XY matrix. The electron-emitting element rows are driven (or scanned) sequentially, row by row, and simultaneously modulation signals for one line of image are applied to the grid electrodes (modulation electrodes) synchronously in accordance with information signals to control the projection of respective electron beams onto the fluorescent material, thereby the image being displayed by lines.

The image display apparatus gives extremely high resolution with high luminance and high contrast without luminance irregularity owing to the aforementioned advantages of the electron-generating device of Embodiment 2-3.

Figure 19:
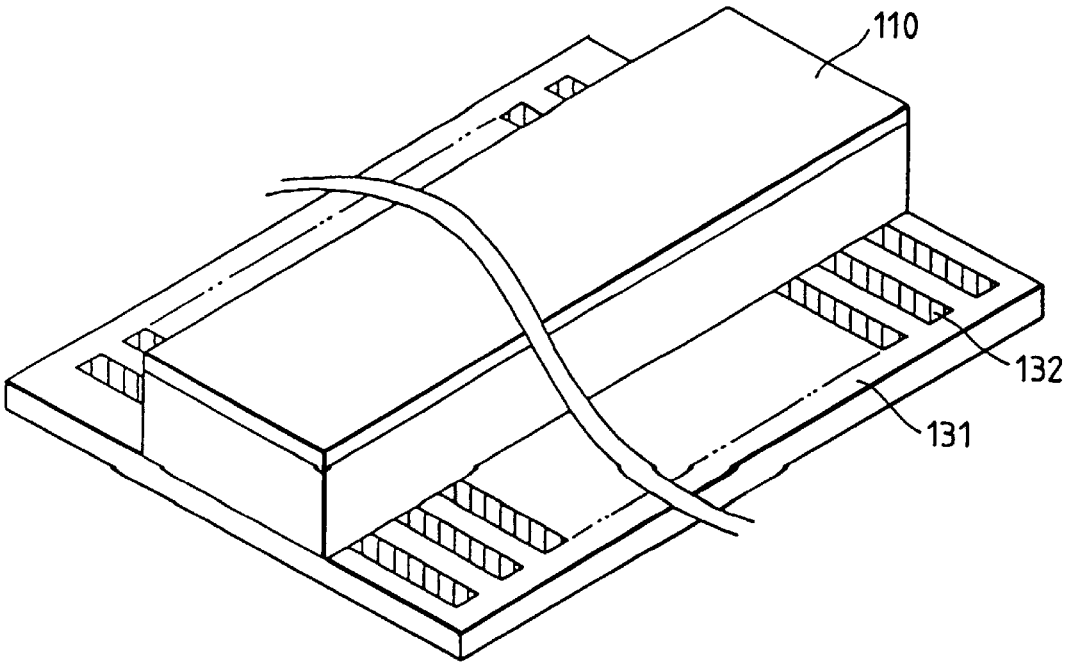

The electron beam-generating device of Embodiment 2-3 is applicable to a recording apparatus similar to that shown in FIG. 19.

Embodiments 2-1, 2-2, and 2-3 are based on the common idea of making different the thickness of the insulating layer at the region under the electron-emitting element from that at the other region.

A third type of embodiments are described which are based on the constitution, common to the first and the second types of embodiments, that the electron-emitting element and the modulation electrode are provided on one and the same face of the substrate, or the modulation electrode is provided on the reverse side of the substrate of an electron-emitting element.

The third type of embodiments relate to an electron beam-generating device which has an electron-emitting element and a modulation electrode for modulating an electron beam emitted by the electron-emitting element, and the electron-emitting element and the modulation electrode are provided on one and the same face of the substrate, or the modulation electrode is provided on the reverse side of the substrate having an electron-emitting element, the modulation electrode being in a defined shape or in a defined dimension for improvement of modulation efficiency. The third type of embodiments also relate to an image-forming apparatus comprising the above electron beam-generating device and an image-forming member to form an image on irradiation of electron beam from the electron beam-generating device, and further relate to a recording apparatus comprising the image-forming apparatus having a light-emitting member as the image-forming member, and a recording medium for recording an image by irradiation of light from the light-emitting member, or a supporting means for supporting the recording medium.

Some of the third type of embodiments are described below in detail.

Firstly, Embodiment 3-1 is described.

Embodiment 3-1 relates to an electron beam-generating device which has an electron-emitting element and a modulation electrode for modulating an electron beam emitted by the electron-emitting element in accordance with an information signal, the electron-emitting element and the modulation electrode being provided on one and the same face of the insulating substrate, and the modulation electrode having a larger occupation area than that of the electron-emitting element.

Embodiment 3-1 also relates to an information display apparatus which has an electron-emitting element, a modulation electrode for modulating an electron beam emitted by the electron-emitting element in accordance with an information signal, and an image-forming member to form an image on irradiation of an electron beam from the electron beam-generating device, the electron-emitting element and the modulation electrode being provided on one and the same face of the insulating substrate, and the modulation electrode having a larger occupation area than that of the electron-emitting element.

Embodiment 3-1 further relates to a recording apparatus which has an electron-emitting element, a modulation electrode for modulating an electron beam emitted by the electron-emitting element in accordance with an information signal, an light-emitting member for emitting light on irradiation of the electron beam, and a recording medium on which recording is made on irradiation of light from the light-emitting member; the electron-emitting element and the modulation electrode being provided on one and the same face of the insulating substrate, and the modulation electrode having a larger occupation area than that of the electron-emitting element.

Embodiment 3-1 still further relates to a recording apparatus which has an electron-emitting element, a modulation electrode for modulating an electron beam emitted by the electron-emitting element in accordance with an information signal, an light-emitting member for emitting light on irradiation of the electron beam, and a supporting means for supporting a recording medium on which recording is made on irradiation of light from the light-emitting member; the electron-emitting element and the modulation electrode being provided on one and the same face of the insulating substrate, and the modulation electrode having a larger occupation area than that of the electron-emitting element.

Embodiment 3-1 is described below in detail. Embodiment 3-1 is characterized by the following constitutional requirements: (1) the electron-emitting element which is an electron beam-generating source, and the modulation electrode which modulates the electron beam emitted from the electron-emitting element are provided on one and the same face of the insulating substrate, and (2) the modulation electrode on the insulating substrate has a larger occupation area than that of the electron-emitting element.

The requirement (1) is explained firstly. The insulating substrate is not limited in the shape, the material, etc. provided that the substrate is capable of being held in an electrically insulating state. The spacing between the electron-emitting element and the modulation electrode arranged on the same plane is preferably not more than 30 $\mu$m, more preferably in the range of from 5 $\mu$m to 20 $\mu$m, for achieving higher modulation efficiency of the emitted electron beam, but is not limited thereto provided that the electron-emitting element is electrically insulated from the modulation electrode.

The modulation electrode is used for ON/OFF control of the electron beam emitted from the electron-emitting element, or for analog control of the electron emission quantity of the electron beam by application of voltage in accordance with an information signal. Therefore, the modulation electrode may be of any material which is electroconductive.

The above requirement (2) is explained below.

Figure 43:
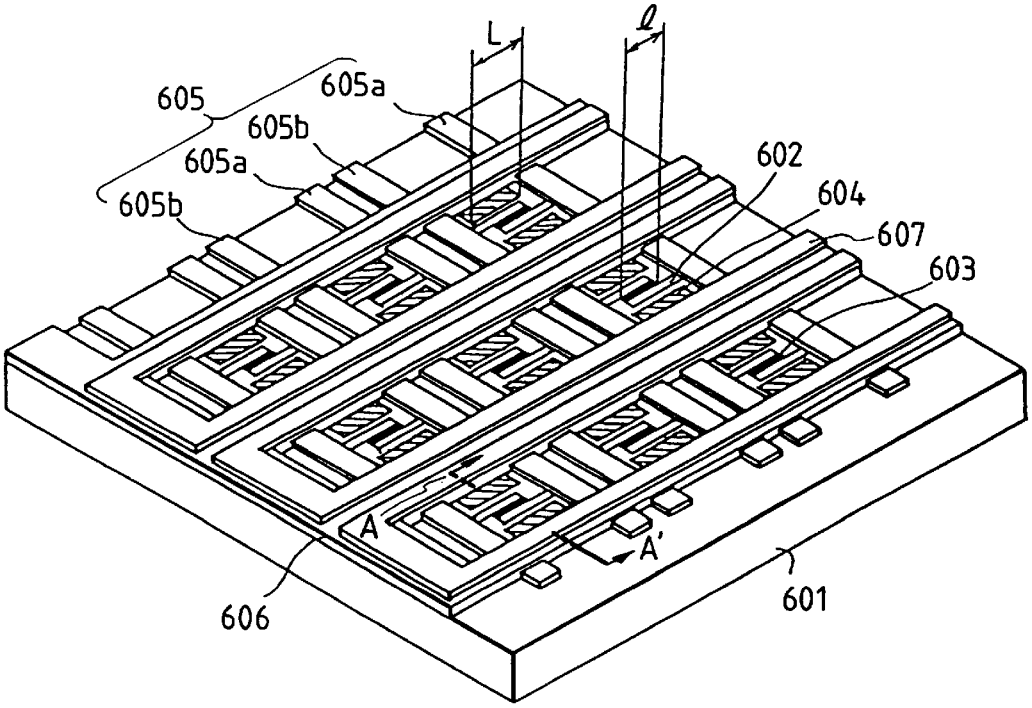
FIGS. 43, 44, 46A–46D, 47, and 48 show an electron beam-generating device of Embodiment 3-1 of the present invention.
Figure 44:
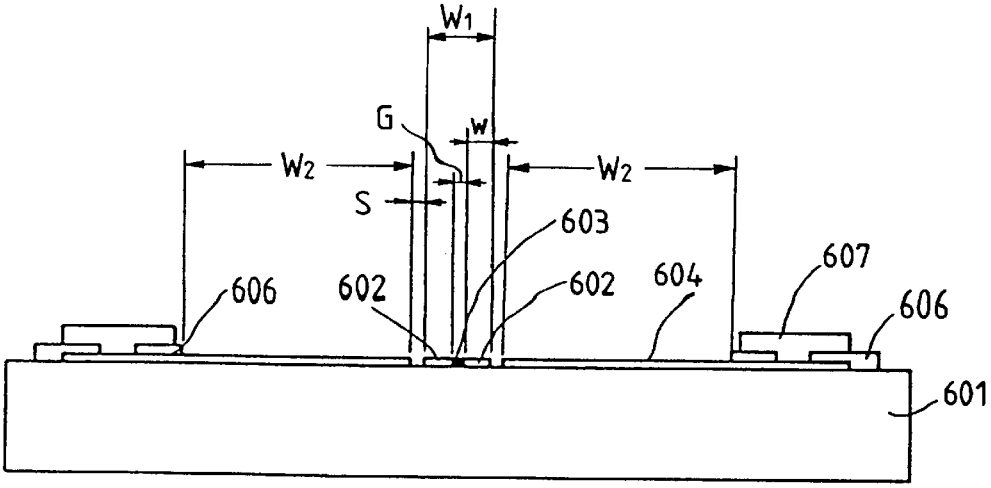

FIG. 43 and FIG. 44 illustrate an example of Embodiment 3-1. FIG. 44 shows the cross-section viewed at the line A–A' in FIG. 43. The device has a glass substrate 601, element electrodes 602, electron-emitting portions 603, modulation electrodes 604, element wiring electrodes 605, insulating films 606, and modulation wiring electrodes. The symbol W denotes the width of the electron-emitting element; G the width of the electron-emitting portion; $W_1$ the width of the electron-emitting element; $W_2$ the width of the modulation electrode; S the spacing between the electron-emitting element and the modulation electrode; l the length of the electron-emitting portion: and L the length of the modulation electrode. In the embodiment of FIG. 43, the modulation electrodes are placed on the both sides of the modulation electrode. The electron beam is controlled by applying voltage to the modulation electrodes to change the potential distribution in the vicinity of the electron-emitting element.

In Embodiment 3-1, preferably the modulation electrodes in the same shape are arranged on the both sides of the electron-emitting element, but the arrangement is not limited thereto. The modulation electrode may be placed on one side of the electron-emitting element, or the modulation electrodes different in shape from each other may be placed on the both sides thereof.

In this Embodiment, the size of the modulation electrodes is defined by the width $W_2$ thereof. If the widths of the modulation electrodes are not equal, the smaller one is taken as the width $W_2$.

In the electron-generating device of FIG. 43, the opposing element electrodes are formed in the same width, and the width of the element electrode is represented by (2W+G).

The spacing (S) between the element electrode 602 and the modulation electrode 604 is preferably made as small as possible so far as the electrical insulation is maintained between the electrodes. Preferably the spacing is not more than 30 $\mu$m, and practically the spacing is desirably in the range of from 5 to 20 $\mu$m. The spacing (S) depends greatly on the voltage applied to the modulation electrode 604. The larger the spacing (S), the higher voltage has to be applied to the modulation electrode 604.

The length (l) of the electron-emitting portion 603 in FIG. 43 is the length of opposition of the electrodes as defined by the width $W_2$ thereof. If the widths of the modulation electrodes are not equal, the smaller one is taken as the width $W_2$.

In the electron-generating device of FIG. 43, the opposing element electrodes are formed in the same width, and the width of the element electrode is represented by (2W+G).

The spacing (S) between the element electrode 602 and the modulation electrode 604 is preferably made as small as possible so far as the electrical insulation is maintained between the electrodes. Preferably the spacing is not more than 30 $\mu$m, and practically the spacing is desirably in the range of from 5 to 20 $\mu$m. The spacing (S) depends greatly on the voltage applied to the modulation electrode 604. The larger the spacing (S), the higher voltage has to be applied to the modulation electrode 604.

The length (l) of the electron-emitting portion 603 in FIG. 43 is the length of opposition of the element electrodes 602. The electrons are emitted uniformly from the portion of the length (l). The width (L) of the modulation electrode 604 is preferably made longer the length (l) of the electron-emitting portion 603. For example, the length (l) of the electron-emitting portion 603 is in the range of from 20 to 500 $\mu$m, the width (L) of the modulation electrode 604 is practically in the range of from 70 to 550 $\mu$m in emission and less modulation irregularity of electron beams, thereby giving excellent image display with high contrast without luminance irregularity. In this Embodiment, the arrangement of the electron-emitting elements and the modulation electrodes as the above requirement (1) solves simultaneously the problems of difficulty in positional registration of the electron passage hole with the electron-emitting portion and of the variation or non-uniformity of the spacing between the modulation electrode and the electron-emitting portion. Naturally, the modulation electrode is desired to be placed within the electron beam-emission path in view of the modulation efficiency. In Embodiment 3-1, an electron beam-generating device is provided which is improved also in the modulation efficiency of the electron beam by satisfying the arrangement of the requirement (1) and the size relation of the requirement (2).

The electron-emitting element of Embodiment 3-1 is described in more detail. The electron-emitting element in Embodiment 3-1 may be of a type of either a hot cathode or a cold cathode. The hot cathode is lower in electron emission efficiency and response speed than a cold cathode because of diffusion of heat to the insulating substrate. Therefore, the cold cathode is preferred such as a surface conduction type emitting element, a semiconductor electron-emitting element, and the like as mentioned later. Of the cold cathodes, the surface conduction type emitting element is preferred as the electron-emitting element, since it has advantages of (1) much higher electron-emitting efficiency, (2) readily producible simple structure, (3) possibility of arrangement of many elements in high density on one and the same rear plate, (4) high response speed, and (5) excellent luminance contrast.

The electron-emitting element in Embodiment 3-1 has separate voltage application means for the electron-emitting element and for the modulation electrode, and the voltage application means have an application voltage adjusting means respectively.

The electron-emitting element in Embodiment 3-1 is preferably a linear electron-emitting element which has a plurality of electron-emitting portion arranged in a line, and a plurality of the linear electron-emitting elements and a plurality of the modulation electrodes constitute an XY matrix. With such a multiple electron beam-generating device having many electron-emitting portions, the aforementioned requirements (1) and (2) are particularly desired to be satisfied for prevention of irregularity in electron emission quantity and of irregularity in modulation.

The description above is given mainly on the electron-generating device of Embodiment 3-1. This electron-generating device is particularly useful as an electron source for an image display apparatus and a recording apparatus.

An example of an image display apparatus employing an electron beam-generating device of Embodiment 3-1 is described below by reference to FIG. 45.

Figure 45:
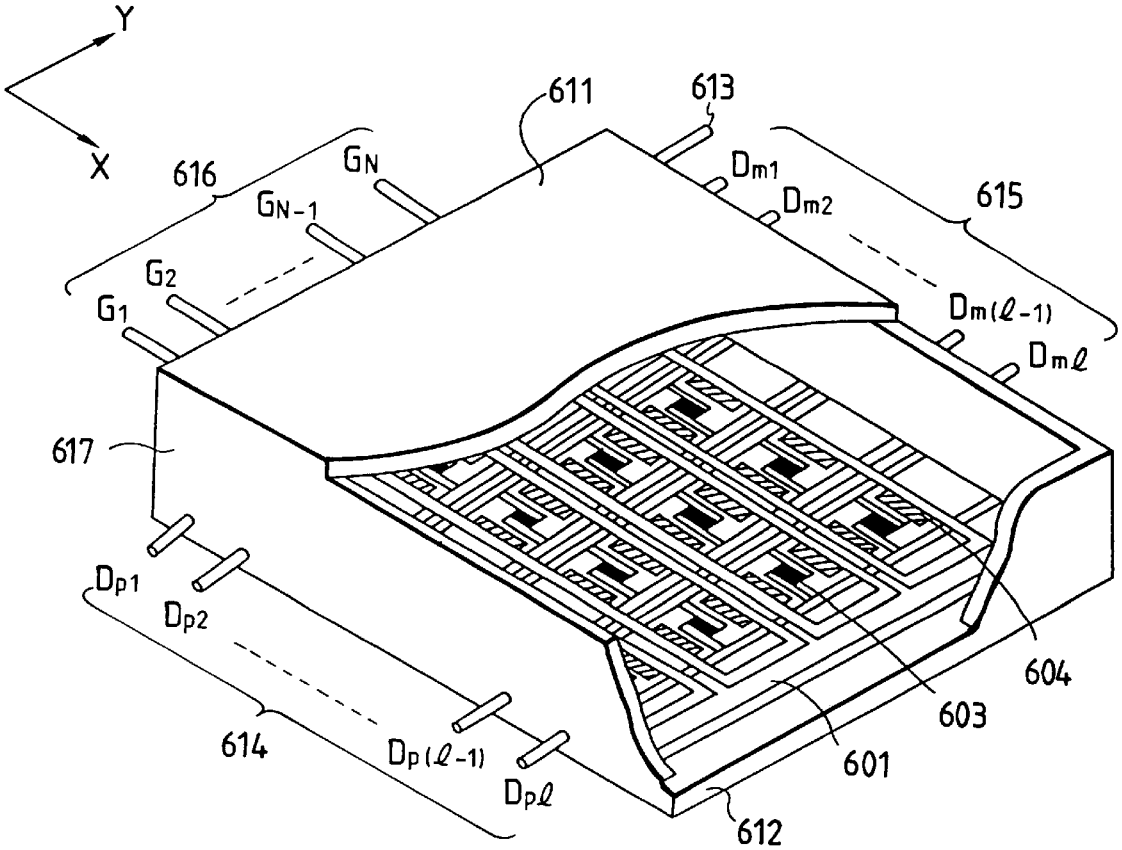
FIG. 45 shows an image-forming apparatus of the present invention.

FIG. 45 illustrates structure of a display panel. The display panel has a vacuum vessel 617 made of glass. A face plate 611 constitutes the display face side of the vacuum vessel 617. A light-transmissive electrode made of a material such as ITO is formed on the inside face of the face plate 611, and further thereon fluorescent materials of red, green, and blue are applied separately in a mosaic pattern (as the image-forming member), the surface of which is treated for metal-backing as known in the technical field of CRT. (The light-transmissive electrode, the fluorescent material, and the metal back are not shown in the drawing.) The light-transmissive electrode is connected electrically through a terminal 613 to a voltage source outside the vacuum vessel.

An electron-generating device of Embodiment 3-1 is fixed on the bottom face of the vacuum vessel 617. The electron-generating device has a glass substrate (an insulating base plate) 601, and electron-emitting elements are formed on the face of the substrate in arrangement of N elements×l rows. The electron-emitting elements in one row are connected electrically in parallel, and the anode side wirings 614 (cathode side wirings 615) are electrically connected through terminals $Dp_1$–$Dp_l$ (terminals $Dm_1$–$Dm_l$) to a voltage source outside the vacuum vessel.

On the back side of the substrate 601, grid electrodes (modulation electrodes), N in number, are provided in a direction orthogonal to the above element rows, and respective grid electrodes (modulation electrodes) 604 are electrically connected through terminals 616 ($G_1$–$G_N$) to an outside voltage source.

In this display panel, l electron-emitting element rows (linear electron-emitting elements) and N grid electrodes (modulation electrodes) form an XY matrix. The electron-emitting element rows are driven (or scanned) sequentially, row by row, and simultaneously modulation signals for one line of image are applied to the grid electrodes (modulation electrodes) synchronously in accordance with information signals to control the projection of respective electron beams, thereby displaying the image by lines.

The image display apparatus gives an image with extremely high resolution, high luminance and high contrast without luminance irregularity owing to the aforementioned advantages of the electron-generating device of Embodiment 3-1.

An example of a recording apparatus employing an electron beam-generating device of Embodiment 3-1 is described by reference to FIG. 49.

Figure 49:
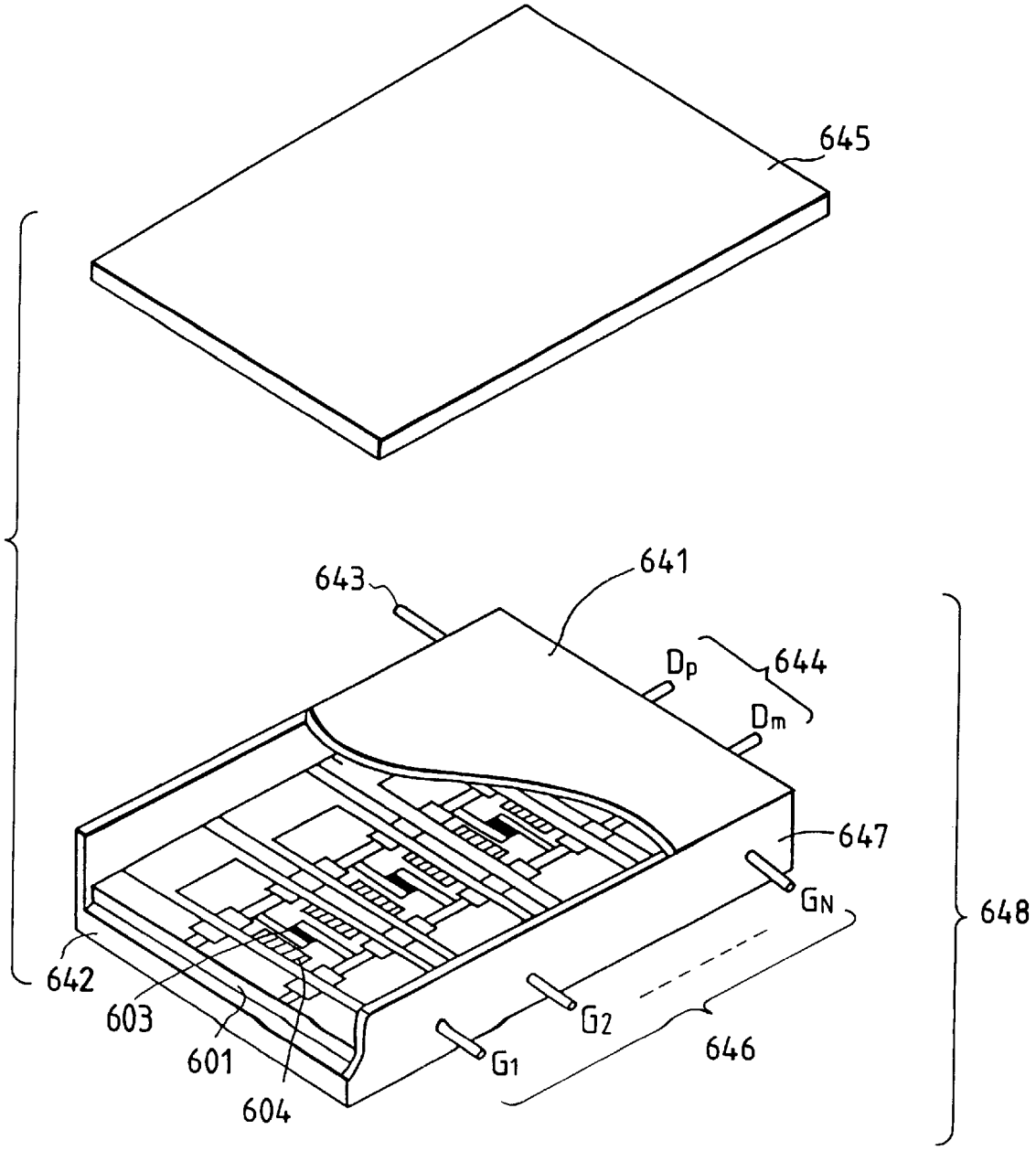
FIG. 49 shows a recording apparatus of the present invention.

FIG. 49 illustrates roughly the structure of an optical printer. The optical printer has a vacuum vessel 647 made of glass as the housing. A face plate 641 constitutes the display face side of the vacuum vessel 647. Through the face plate 641, a light beam is projected to a recording medium 645. A light-transmissive electrode made of a material such as ITO is formed on the inside face of the face plate 641, and further thereon fluorescent materials (light-emitting material) are applied, the surface thereof being treated for metal-backing as known in the technical field of CRT. (The light-transmissive electrode, the fluorescent material, and the metal back are not shown in the drawing.) The light-transmissive electrode is connected electrically through a terminal 643 to a voltage source outside the vacuum vessel.

An electron-generating device of Embodiment 3-1 is fixed on the bottom face of the vacuum vessel 647. The electron-generating device has a glass substrate (an insulating base plate) 601, and electron-emitting elements are formed on the face of the substrate in a line. The anode side wirings (cathode side wirings) 44 of the electron-emitting elements are electrically connected through terminals Dp, Dm to a voltage source outside the vacuum vessel.

On the upper face of the substrate 601, grid electrodes (modulation electrodes), N in number, are provided in a direction orthogonal to the above element row, and respective grid electrodes (modulation electrodes) 604 are electrically connected through terminals 646 ($G_1$–$G_N$) to an outside voltage source.

In this optical printer, the electron-emitting elements in a row are driven, and modulation signals for one line of image are applied simultaneously to the grid electrodes (modulation electrodes) synchronously in accordance with information signals to control the projection of respective electron beams onto the fluorescent member (light-emitting member), thereby forming a light emission pattern for one line of the image. The light emitted from the light-emitting member in accordance with the light emission pattern is projected onto the recording medium, thereby forming a photo-sensitized pattern on a photosensitive recording medium or a heat-sensitized pattern on a heat-sensitive recording medium. The above operation is repeated successively, line by line, as shown in FIGS. 6A and 6B before, by scanning a recording medium with the light beam, or making the light-emitting source 51 (or 648 in FIG. 49) scan a recording medium over the entire image lines to record an image on the surface of the recording medium. The recording medium may be a photosensitive (or heat-sensitive) sheet 54 as in FIGS. 6A and 6B. In this case, the recording apparatus has a support for supporting the sheet, such as a drum 52, and a delivery roller 53. The recording medium may be a photosensitive drum 64 as shown in FIG. 7.

The recording apparatus gives a recorded image with extremely high resolution and high contrast at a high speed without exposure irregularity owing to the aforementioned advantages of the electron-generating device of Embodiment 3-1.

As another example of the third type of embodiments, Embodiment 3-2 is described below.

(1) Embodiment 3-2 relates to an electron beam-generating device which has a modulation electrode formed on a substrate, electron-emitting element laminated on the modulation electrode with interposition of an insulating layer, the modulation electrode occupying a larger area than the electron-emitting element on the surface of the substrate.

(2) Embodiment 3-2 further relates to an electron-emitting device of the above item (1), in which the occupation area of the modulation electrode is five times that of the electron-emitting element or more.

(3) Embodiment 3-2 still further relates to an electron-emitting device of the above item (1) or (2), in which the electron-emitting element is a surface conduction type electron-emitting element.

(4) Embodiment 3-2 still further relates to the electron beam-generating device of any of the above items (1) to (3), in which linear electron sources having a plurality of the electron-emitting elements in line are arranged in stripes and the modulation electrodes are placed in a direction orthogonal to the modulation electrodes to form an XY matrix.

With this constitution, the electron beam is made to scan by XY-matrix driving of the linear electron sources and the modulation electrodes.

(5) Embodiment 3-2 still further relates to the electron beam-generating device of any of the above items (1) to (3), in which separate voltage application means are provided for the electron-emitting element and for the modulation electrode.

(6) Embodiment 3-2 still further relates to an image display apparatus which comprises the electron-generating device of any of the above items (1) to (5) and an image-forming member, which forms image on collision of electrons, on the electron emission side of the electron-emitting device.

(7) Embodiment 3-2 still relates to a recording apparatus which has an electron-emitting element, a modulation electrode for modulating an electron beam emitted by the electron-emitting element, an light-emitting member for emitting light on irradiation of the electron beam, and a recording medium on which recording is made on irradiation of light from the light-emitting member; the apparatus having a modulation electrode formed on a substrate, electron-emitting element laminated on the modulation electrode with interposition of an insulating layer, and the modulation electrode occupying a larger area than the electron-emitting element on the surface of the substrate.

(8) Embodiment 3-2 still relates to a recording apparatus which has an electron-emitting element, a modulation electrode for modulating an electron beam emitted by the electron-emitting element, an light-emitting member for emitting light on irradiation of the electron beam, and a support for a recording medium on which recording is made on irradiation of light from the light-emitting member; the apparatus having a modulation electrode formed on a substrate, electron-emitting element laminated on the modulation electrode with interposition of an insulating layer, and the modulation electrode occupying a larger area than the electron-emitting element on the surface of the substrate.

The constitution and the effects of Embodiment 3-2 are described below specifically.

Figure 50:
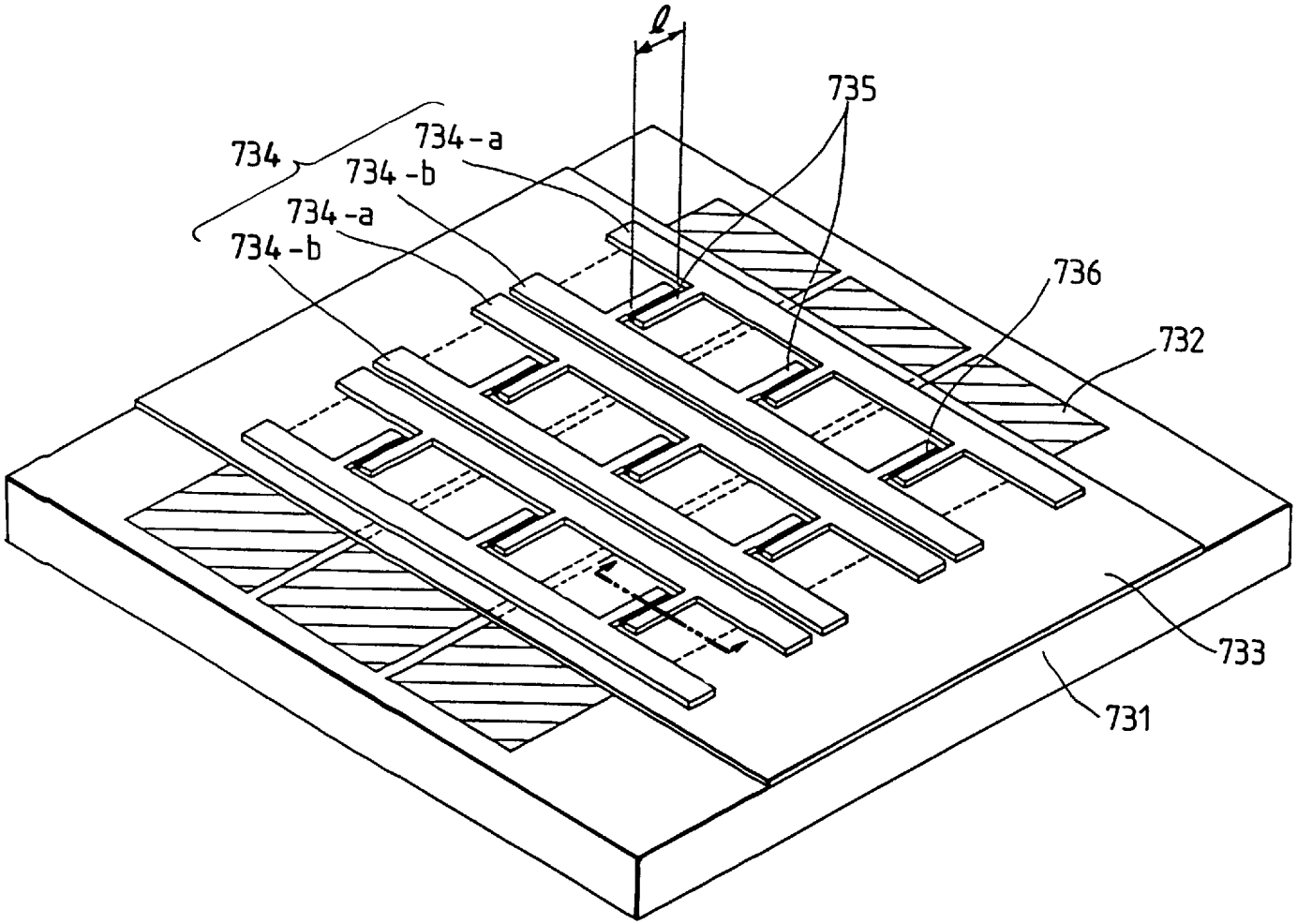
FIGS. 50, 51A–51D, and 52 show an electron beam-generating device of Embodiment 3-2 of the present invention.
Figure 51A:
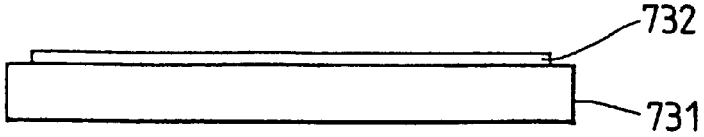
Figure 51B:
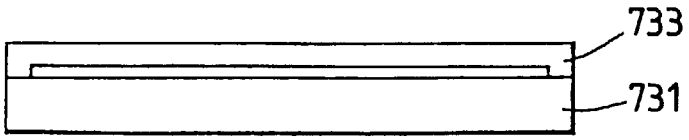
Figure 51C:
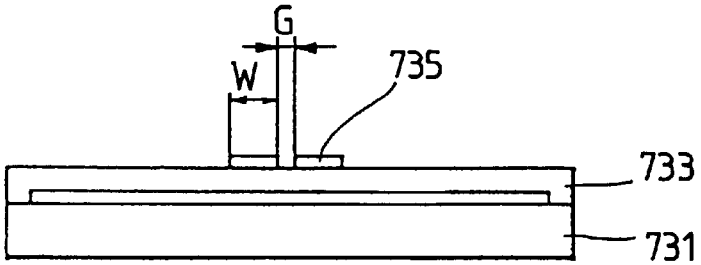
Figure 51D:
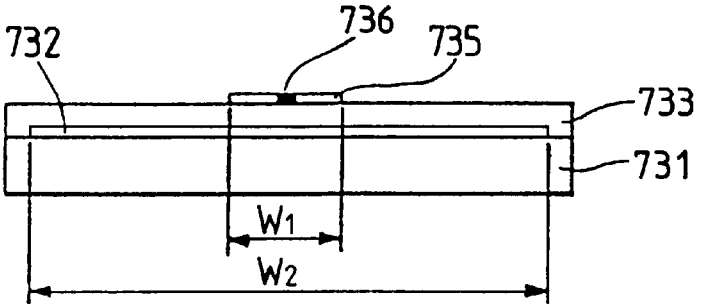

FIG. 50 shows an example of Embodiment 3-2. The device has a glass substrate 731, modulation electrodes 732, an insulating layer 733, element wiring electrodes 734, element electrodes 735, and electron-emitting portions 736. The electron-emitting element in FIG. 50 is a surface conduction type electron-emitting element described later which is formed from element electrodes 735 and an electron-emitting portion. The electron-emitting element in this Embodiment, however, is not limited thereto. FIG. 51 shows cross-section viewed at the line A–A' in FIG. 50. The symbol w denotes the width of the element electrode; G the width of the electron-emitting portion; $W_1$ the width of the element; and $W_2$ the width of the modulation electrode.

A first main feature of Embodiment 3-2 is the construction of the device in which a modulation electrode, an insulating layer, and an electron-emitting element are held on a substrate 731 in the named order.

The electron-emitting element in Embodiment 3-2 may be of a type of hot cathode or cold cathode which is conventionally used. The hot cathode is lower in electron emission efficiency than the cold cathode because of diffusion of heat to the insulating layer. Therefore, cold cathodes are preferred. Of the cold cathodes, the surface conduction type emitting element is preferred as the electron-emitting element in the electron-emitting device, the image display apparatus, and the optical signal-forming apparatus, since the cold cathode has advantages of (1) much higher electron-emitting efficiency, (2) readily producible simple structure, (3) possibility of arrangement of many elements in high density on one and the same substrate, (4) high response speed, and (5) excellent luminance contrast. In particular, the above advantage (5) results mainly from the thin film construction of the surface conduction type emitting element. In Embodiment 3-2, the modulation electrode is placed on the reverse side of the plane of the electron emission of the electron-emitting element. Therefore, if the thickness of the electron-emitting element is extremely large, the distance between the modulation electrode and the electron-emitting face of the electron-emitting element becomes excessively large, and further problems arise that the emitted electron beam is not satisfactorily modulated and the luminance contrast is low. Accordingly the thickness of the electron-emitting element in Embodiment 3-2 is preferably in the range of from 0.1 $\mu$m to 200 $\mu$m to attain satisfactory luminance contrast.

The modulation electrode in Embodiment 3-2 is used for ON/OFF control of the electron beam emitted from the electron-emitting element by application of voltage in accordance with an information signal. The modulation electrode may be of any material which is electroconductive.

The insulating film is a supporting material for holding both of the electron-emitting element and the modulation electrode, and may be made of any material which is insulating in Embodiment 3-2.

The insulating layer in Embodiment 3-2 has desirably a uniform thickness so that the distance between the modulation electrode and the electron emission face of the electron-emitting element may be kept uniform for all of the electron-emitting elements.

A second main feature of Embodiment 3-2 is the construction that the occupation area of the modulation electrode on the substrate face is larger than that of the electron-emitting element.

In the embodiment shown in FIGS. 50 and 51, the quantity of the electron beam emitted from the electron-emitting element is controlled by changing the potential distribution in the vicinity of the electron-emitting element by adjusting the voltage applied to the modulation electrode. Therefore, the electron-emitting element is desirably placed at or near the center of the modulation electrode. The size $W_2$ of the modulation electrode is desired to be larger than the size $W_1$ of the element. The size of the modulation electrode is preferably five or times, more preferably ten or more times that of the element. In this embodiment, the element is rectangular and the element width $W_1$ is constant. The modulation electrode is desired to be larger than the element than the element correspondingly regardless of the shape of the element.

In the electron-generating device of FIG. 50, the opposing element electrodes are formed in the same width, and the width of the element electrode is represented by (2w+G). Embodiment 3-2 includes electron-generating device in which the widths of the element electrodes are different from each other. In such a case, the smaller width is taken as the width w of the element electrodes, and the element width $W_1$ is defined as (2w+G).

The above matter is explained further regarding the image display apparatus for several cases.

(1) Modulation electrode being larger than electron emitting element ($W_1 \geqq W_2$):

The apparatus has no satisfactory modulation function.

(2) Modulation electrode having size of 1 to 5 times that of electron-emitting element ($W_1 < W_2 < 5W_1$):

The apparatus perform the modulation function, but high luminance of the image cannot readily be obtained because the voltage applies to the luminescent material has to be low. To obtain high luminance of the image, the distance between the substrate and the fluorescent material need to be made large, which makes it difficult to achieve fineness and thinness.

(3) Modulation electrode having size of 5 to 10 times that of electron-emitting element ($5W_1 \geqq W_2 10W_1$):

The modulation of the electron beam is readily achievable, and luminance and contrast of the image can be improved desirably. However, if the spacing between the elements is small, the influence of the adjacent element (namely crosstalk) is liable to be produced.

(4) Modulation electrode having size of 10 times that of electron-emitting element or larger ($W_2 \geqq 10W_1$):

The performance modulation of the electron beam is further improved, and is most desirable in luminance, contrast, and fineness of the image.

The constitution of the recording apparatus employing the electron beam-generating device is similar to the one shown before in FIGS. 5 to 7. The recording apparatus is capable of giving sharp image record with high resolution and high contrast at high speed without irregularity of exposure owing to the aforementioned advantages of the electron-generating device of Embodiment 3-2.

As still another example of the third type of embodiments, Embodiment 3-3 is described below.

Embodiment 3-3 relates to an electron beam-generating device comprising an electron-emitting portion held between element electrodes and a modulation electrode for modulating an electron beam emitted from the electron-emitting element, where the modulation electrode and the element electrodes are placed on one and the same substrate, and the modulation electrode has a larger thickness than the element electrodes. The "thickness of the element electrodes" herein means thickness of the portion of the element electrodes adjacent to the electron-emitting portion.

Figure 53:
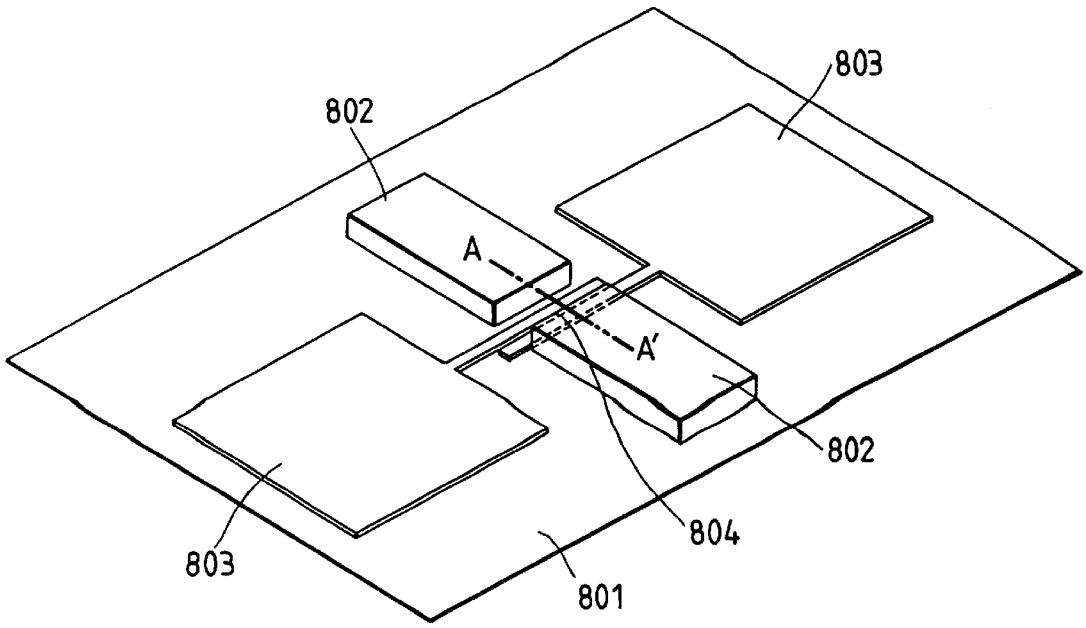
Figure 54:
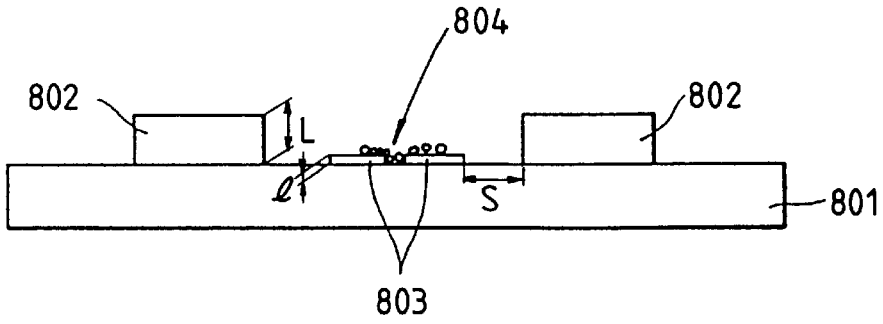

FIG. 53 is a perspective view of an example of the electron-generating device of Embodiment 3-3. The device comprises a substrate (rear plate) 801, modulation electrodes (grid electrodes) 802, element electrodes 803, and an electron-emitting portion 804. FIG. 54 is a cross-sectional view of the device at the line A–A' in FIG. 53.

The substrate 801 may be made of any material which is heat-resistant and solvent-resistant, the material including metals, glass, and ceramics.

The electron-emitting portion 804 in Embodiment 3-3 may be made by a known conventional method, and may be made of any material having a high electroconductivity, including metals such as Au, Ag, Al, In, Pt, Pd, Sn, and Pb, alloys thereof, and other materials.

The dimensions of the aforementioned constitutional elements are as below. The substrate 801 has preferably a thickness of from 0.8 mm to 1 mm in view of the mechanical strength although the thickness does not affect the element characteristics.

The modulation electrodes of this Embodiment 3-3 is required to have a thickness larger than that of the element electrodes; the thickness (L in FIG. 54) of the modulation electrodes is usually in the range of from 0.05 to 3000 $\mu$m; the thickness of the element electrodes (l in FIG. 54) is in the range of from 0.01 to 500 $\mu$m; and the spacing between the modulation electrode and the element electrode (S in FIG. 54) is preferably in the range of rom 5 to 500 $\mu$m.

Furthermore, formation of the modulation electrode in a step shape as shown later in Example in FIGS. 55 to 57 facilitate formation, convergence, and modulation of the electron beam.

In this Embodiment, the above-mentioned arrangement of the electron-emitting elements and the modulation electrodes solves simultaneously the problems of difficulty in positional registration of the electron passage hole with the electron-emitting portion and of the variation or non-uniformity of the spacing between the modulation electrode and the electron-emitting portion. Naturally, the modulation electrode is desired to be placed within the electron beam-emission path in view of the modulation efficiency. In Embodiment 3-3, an electron beam-generating device is further improved also in the modulation efficiency of the electron beam by employing the above-mentioned arrangement.

The electron-emitting element of Embodiment 3-3 is described in more detail.

The electron-emitting element in Embodiment 3-3 may be either of a hot cathode type or of a cold cathode type provided that the element satisfies the above requirements. A hot cathode is lower in electron emission efficiency and response speed than a cold cathode because of diffusion of heat to the insulating substrate. Therefore, cold cathodes are preferred such as a surface conduction type emitting element, a semiconductor electron-emitting element, and the like. Of the cold cathodes, the surface conduction type emitting element is preferred as the electron-emitting element because of the reasons mentioned before.

In Embodiment 3-3, separate voltage application means are provided for the electron-emitting elements and for the modulation electrodes, and the voltage application means have an application voltage adjusting means respectively.

The electron-emitting element in Embodiment 3-3 generally is preferably a linear electron-emitting element which has a plurality of electron-emitting portion arranged in a line, and a plurality of the linear electron-emitting elements and a plurality of the modulation electrodes constitute an XY matrix. With such a multiple electron beam-generating device having many electron-emitting portions, the aforementioned requirements are particularly desired to be satisfied for prevention of irregularity in electron emission quantity and of irregularity in modulation.

The description above is given mainly on the electron-generating device of Embodiment 3-3. This electron-generating device is particularly useful as an electron source for an image display apparatus and a recording apparatus.

An image display apparatus of Embodiment 3-3 has the same constitution as the one described before by reference to FIG. 45 except for the electron beam-generating device portion.

The above image display apparatus gives extremely high resolution with high luminance and high contrast without luminance irregularity owing to the aforementioned advantages of the electron-generating device of Embodiment 3-3.

An image display apparatus of Embodiment 3-3 has the same constitution as the one described before by reference to FIGS. 5 to 7 except for the light source portion.

As still another example of the third type of embodiments, Embodiment 3-4 is described below.

The electron beam-generating device of Embodiment 3-4 is characterized in that an electron-emitting element and a modulation electrode are formed in lamination with interposition of an insulating layer, and the modulation electrode is in an asymmetric shape.

Embodiment 3-4 is explained by reference to FIGS. 59 and 60. A surface conduction type electron-emitting element, for example, can be prepared by laminating an electron-emitting element on a modulation electrode 903 with interposition of an insulating layer 907. If the modulation electrode 903 is made symmetric in shape with the symmetric center at the electron-emitting portion 904, the electric field is uniform above and around the electron-emitting portion 904. If a hole is formed as a control portion 905 in a crescent moon shape, for example, in the modulation electrode 904 as shown in FIG. 60, the above electric field is modified.

Figure 62:
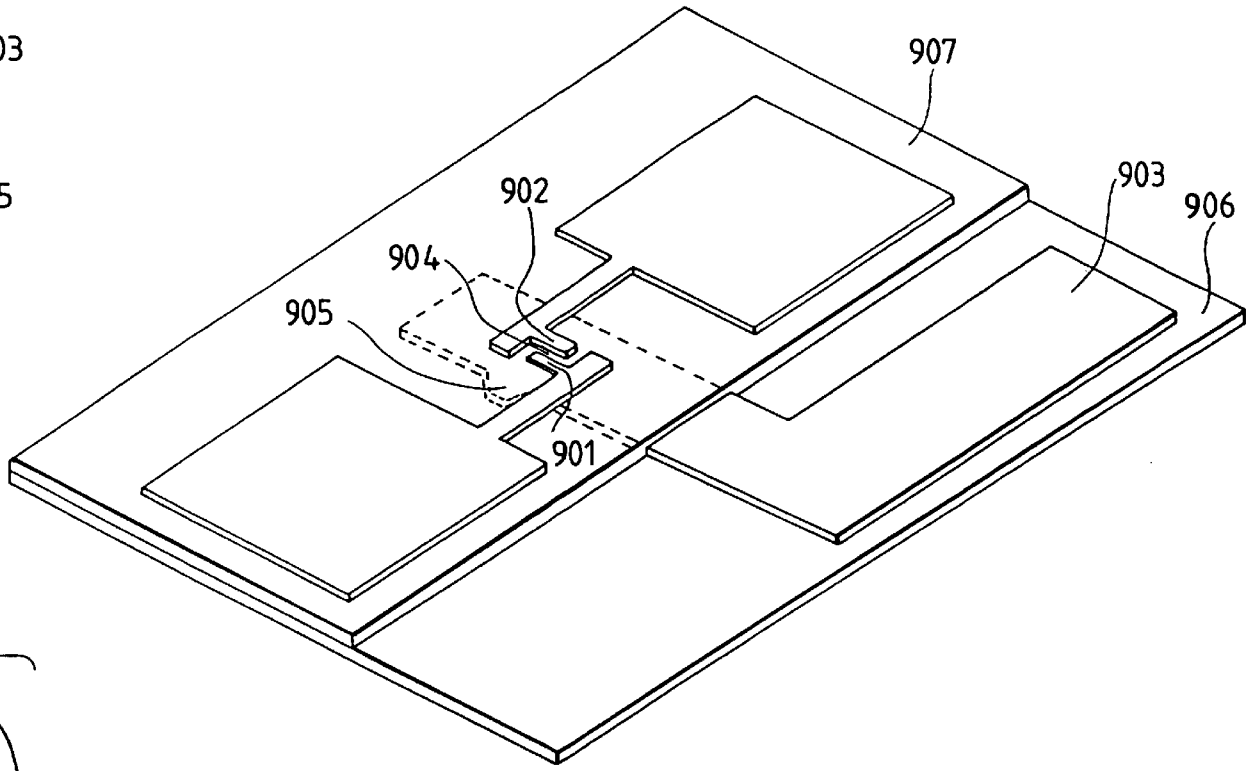
Figure 63:
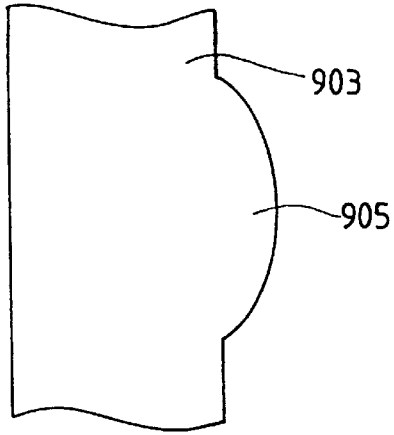

The path of the emitted electron beam, which depends on the electric field, is not necessarily perpendicular to the electron-emitting portion 904. Therefore, the electron beam is advantageously controlled by making the modulation electrode 903 asymmetric with the control portion 905 and thereby modifying the electric field above and around the electron-emitting portion 904. The control portion 905 may be formed in a shape of a notch, other than a hole in FIGS. 59 and 60, or a protrusion as shown in FIGS. 62 and 63. The control portion 905 is provided so as not to overlap vertically with the electron-emitting portion 904 and the element electrodes 902, 906 in order to modify the electric field above and around the electron-emitting portion 904.

In Embodiment 3-4, the modulation electrode 904 is effectively made asymmetric by changing one or more of the shape, the area, and the position of the modulation electrode 903 so as to be different between the left side and the right side relative to the electron-emitting portion 904 within the region not overlapping vertically with the electron-emitting portion 904 and the element electrode 901, 902. Accordingly, instead of formation of the aforementioned control portion 905, the modulation electrode 903 may be prepared so as to be originally asymmetric in the entire shape and size, or may be placed in an asymmetric position to achieve the above effect. For example, the modulation electrode 903 may be placed at an asymmetric position, or may be provided at a part of the periphery of the element electrode 901, 902.

Any electron-emitting element may be used in Embodiment 3-4 provided that it can be laminated on the modulation electrode 903 with interposition of the insulating layer 907, including known semiconductor elements and MIN type elements in addition to the above surface conduction type electron-emitting element. However, the aforementioned surface conduction type electron-emitting element is particularly preferred because of the advantages of (1) much higher electron-emitting efficiency, (2) readily producible simple structure, (3) possibility of arrangement of many elements in high density on one and the same rear plate, (4) high response speed, and (5) excellent luminance contrast when employed to a display apparatus. The surface conduction type electron-emitting element may be the one which has an electron-emitting portion formed by application of dispersed metal fine particles.

The modulation electrode 903 may be made asymmetric either by preparing an electrode originally in an asymmetric shape or by working a once-formed symmetric electrode to make it asymmetric, e.g., by formation of a hole.

The material and the method for production of the electron-emitting element of Embodiment 3-4 is not limited at all.

The modulation electrode 903 in Embodiment 3-4 is used for ON/OFF control of the electron beam emitted from the electron-emitting element by application of voltage in accordance with an information signal. The modulation electrode may be of any material which is electroconductive. The method of production thereof is not limited at all, it may be prepared not only by conventional photolithography but also by screen printing, metal plating, and so forth.

Embodiment 3-5 is explained by reference to FIGS. 65. In the case of a surface conduction type electron-emitting element, for example, if the modulation electrodes 1003, 1003' are made symmetric in shape with the symmetric center at the electron-emitting portion 1004, the electric field is uniform at and around the electron-emitting portion 1004. If a hole as shown in FIG. 66 is formed as a control portion 1005, for example, in the modulation electrode 1003 or 1003' to make asymmetric the modulation electrodes 1003, 1003', the above electric field is modified.

The path of the emitted electron beam, which depends on the electric field, is not necessarily perpendicular to the electron-emitting portion 904. Therefore, the electron beam is advantageously controlled by making the modulation electrodes 1003, 1003' asymmetric and thereby modifying the electric field above and around the electron-emitting portion 1004. The control portion 1005 may be formed in a shape of a notch, other than a hole in FIGS. 66, or a protrusion as shown in FIG. 65.

In Embodiment 3-5, the modulation electrodes 1003, 1003' are effectively made asymmetric by changing one or more of the shape, the area, and the position of the modulation electrode so as to be different between the left side and the right side relative to the electron-emitting portion 1004. Accordingly, instead of formation of the aforementioned control portion 1005, the modulation electrodes 1003, 1003' may be prepared so as to be originally asymmetric in the entire shape and size, or may be placed in an asymmetric position to achieve the above effect. For example, the modulation electrodes may be placed at an asymmetric position, or may be provided at a part of the periphery of the element electrodes 1001, 1002.

The modulation electrode may be made asymmetric either by preparing an electrode originally in an asymmetric shape or by working a once-formed symmetric electrode to make it asymmetric, e.g., by formation of a hole.

Any electron-emitting element may be used in Embodiment 3-5 provided that it can be formed on the same face of the same substrate a the modulation electrode, including known semiconductor element and MIN type element in addition to the above surface conduction type electron-emitting element.

The material and the method for production of the electron-emitting element of Embodiment 3-5 is not limited at all. It is sufficient that modulation electrodes 1003, 1003' are provided on a conventional element and the shape of the modulation electrodes is changed, for example, by forming a control portion 1005, for example, as shown in the drawing.

The modulation electrodes in Embodiment 3-5 are used for ON/OFF control of the electron beam emitted from the electron-emitting element by application of voltage in accordance with an information signal. The modulation electrodes may be made of any material which is electroconductive. The method of production thereof is not limited at all.

As a still further example of the third type embodiments, Embodiment 3-6 is described below.

(1) Embodiment 3-6 relates to an electron beam-emitting device in which an electron-emitting element is laminated on an electroconductive substrate with interposition of an insulating material, and the electron-emitting element and the electroconductive substrate have respectively an independent voltage application means.

(2) The electron-emitting device of the above item (1) employs a surface conduction type of electron emitting element.

(3) Embodiment 3-6 further relates to an electron beam-emitting device in which a surface conduction type electron-emitting element is laminated on an electroconductive substrate with interposition of an insulating material, and the surface conduction type electron-emitting element and a modulation electrode connected to the electroconductive substrate are placed on the same insulating material.

(4) Embodiment 3-6 further relates to an electron beam-emitting device in which a surface conduction type electron-emitting element is laminated on an electroconductive substrate with interposition of an insulating material, and the same electron-emitting film as the one placed between the gap of the electrodes of the surface conduction type electron-emitting element is connected to the electroconductive substrate and is placed on one and the same insulating material with the surface conduction type electron-emitting element.

(5) Embodiment 3-6 further relates to an electron beam-generating device of the above items (1) to (4), in which the electroconductive substrate is made of copper, aluminum, or iron, or an alloy thereof.

Basically, in Embodiment 3-6, an electron-emitting element is placed on an electroconductive substrate with interposition of an insulating film to enable application of modulated voltage signal of the electron-emitting element to the electroconductive substrate. Thereby the structure is simplified, the precise positional registration is made unnecessary, and the modulation efficiency is raised. Further, since the constitutional members are provided on one and the same substrate and the substrate exhibits high heat radiation efficiency, positional deviation of the electron-emitting portion is not caused by heat and uniform line-shaped electron beam is produced even at large-current electron emission.

Figure 67:
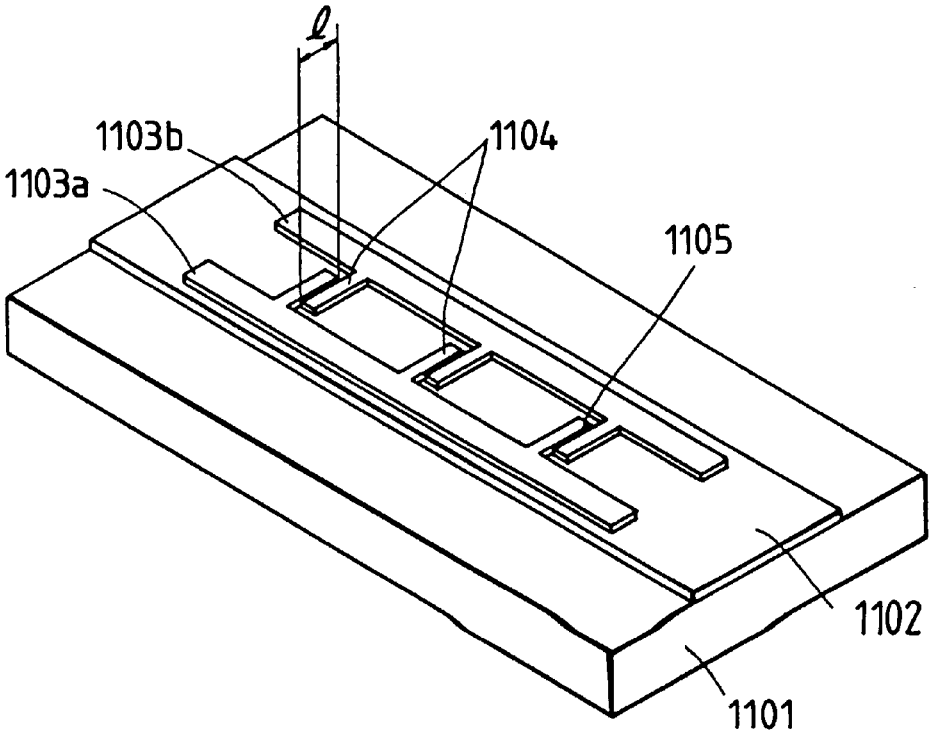
FIGS. 67, 68A–68C, 69, 70, 71, 72A–72D, and 73 show an electron beam-generating device of Embodiment 3-6 of the present invention.

The constitution and the effects of Embodiment 3-6 are described in detail by reference to an example. In FIG. 67, the device comprises an electroconductive substrate 1101, an insulating thin film 1102, formed on the electroconductive substrate 1101, wiring electrodes 1103*a*, 1103*b* made of an electroconductive thin film formed on the insulating film 1102, element electrodes 1104 connected to the wiring electrodes 1103*a*, 1103*b* and having a narrow gap at the portion 1 in, the drawing, and electron-emitting portions 1105 placed at the above narrow electrode gap.

The electron-emitting portion 1105 emits electrons, when this element is kept in vacuum and ten and several volts of element voltage is applied to the element wiring electrodes 1103*a*, 1103*b* and several KV of draw-out voltage is applied to the upper anode electrode plate (not shown in the drawing). In FIG. 67, only three electron-emitting portions are shown for simplicity of the drawing. A line-shaped electron-emitting source can be formed by arranging a plurality of electron-emitting portions in line.

The electron beam emitted from the electron-emitting portion 1105 can be turned on and off by applying minus several tens of volts or plus several tens of volts of modulation voltage to the electroconductive substrate 1101. Further, the quantity of the electron beam can be continuously controlled by changing the modulation voltage continuously.

In another driving method, the electron emission from the electron-emitting portion 1105 is turned on and off by application of zero volt or ten and several volts of element voltage to element wiring electrodes 1103*b*, 1103*b*, and the quantity of the electron beam is continuously controlled by continuously changing the modulation voltage applied to the electroconductive substrate 1101. In such a manner, ON/OFF control of electron emission and quantity control of electron beam can be independently practiced by changing the voltage applied to the element wiring electrodes 1103*a*, 1103*b* and by changing the voltage applied to the electroconductive substrate 1101. The control of the electron beam by voltage applied to the electroconductive substrate 1101 is based on the fact that the potential near the electron-emitting portion 1105 changes between a positive range to a negative range depending on the modulation electrode voltage, and thereby the electron beam is accelerated or decelerated. Embodiment 3-6 employs a surface conduction type electron-emitting element in which electrons are accelerated by several volts to be emitted into vacuum. Embodiment 3-6 is highly effective for modulation of such a type of element.

The constituting elemental members in Embodiment 3-6 are described below. In FIG. 67, the electroconductive substrate 1101 is made of a metal having a finely polished face. As the metal material, copper, aluminum, iron, etc. are suitable because of availability and cost. Such metals are generally used for the metal base plate for high-power hybrid IC. Such materials have a thermal conductivity of about 100 Kcal/m·hr·° C. and exhibit high heat radiation effect in comparison with glass and silica having thermal conductivity of about 1 Kcal/m·hr·° C. The insulating film 1102 is suitably made of a coating glass material, a thin film of oxide such as vacuum-deposited $SiO_2$, or another ceramic material. The thickness thereof is desirably thinner to lower the voltage applied to a modulation electrode, namely an electroconductive substrate 1101, practically the thickness being in the range of from 1 μm to 200 μm, more preferably from 1 μm to 10 μm. The wiring electrodes 1103*a*, 1103*b* may be made of any material provided that the electric resistance thereof is made sufficiently low. The element electrodes 1104 is a metal thin film formed by vacuum deposition and photolithography, and has a gap at the electron-emitting portion 1105, the gap preferably being in the range of from 0.1 μm to 10 μm. The width of the element electrodes (W in FIG. 68) at the electron-emitting portion 1105 is desirably smaller, practically the width being preferably in the range of from 1 μm to 100 μm, more preferably from 1 μm to 10 μm. At the electrode gap at the electron-emitting portion 1105, ultra-fine particle film is provided as the electron-emitting material. The ultra-fine particles is formed suitably from a material including metals such as Pd, Ag, and Au, and oxides such as $SnO_2$, and $In_2O_3$, but is not limited thereto. To obtain the desired properties, the ultra-thin film may be formed at the electrode gap by gas deposition, or otherwise may be formed, for example, by dispersing and applying an organometal and subsequently heat-treating it.

In the above Embodiment, the electron emission is modulated simultaneously in the same manner for one line of elements. On the contrary, in FIG. 73, the element wiring electrodes 1110*a*, 1110*b* are provided respectively and independently for each of electron-emitting portions, and the respective electron-emitting elements are modulated independently. The constitutional members in this Embodiment are the same as in the preceding Embodiment. In driving, however, electron-emitting voltages are applied to respective element wring electrodes in pulse successively, and electrons are emitted dot by dot. By applying modulation voltage to the electroconductive substrate 1101 simultaneously and synchronously with the electron emission voltage pulse, the linear electron source emits electron beams modulated and controlled dot by dot.

The surface conduction type electron-emitting element employed in this Embodiment is capable of being driven in response to voltage pulses of 100 picoseconds or less, thereby a linear electron source in high density being modulated dot by dot successively.

In the constitution described above, the electroconductive substrate 1101 having modulation function and the electron-emitting portion 1105 are formed in one body, therefore no mutual positional deviation between the two members being caused by thermal expansion by heat generation in electron emission at the electron-emitting portion 1105. Further, the electroconductive substrate 1101 as a whole serves as a modulation electrode, which results in a simple structure, making basically unnecessary the registration of the electron-emitting portion and the electroconductive substrate 1101, and raising modulation efficiency. Furthermore, the high thermal conductivity of the electroconductive substrate 1101 eliminates local heat accumulation in the electron-emitting portion 1105. This is greatly useful for large current electron emission.

Embodiments 3-1 to 3-6 are common in that the modulation electrode has a defined shape of a defined size for the purpose of raising the modulation efficiency of the electron beam.

A fourth type of embodiments are described which are based on the constitution, common to the first to the third types of embodiments, that an electron emitting element and a modulation electrode are placed on the same face of a substrate, or the modulation electrode is placed on the other face of the substrate than the face on which electron-emitting element is placed.

The fourth type of embodiments relate firstly to an electron beam-generating device, which comprises linear electron sources having plurality of electron-emitting elements having respectively an electron-emitting portion between a higher potential electrode and a lower potential electrode arranged in line, the higher potential electrodes mutually and the lower potential electrodes mutually being connected respectively by a wiring electrode; modulation electrodes for modulating electron beam emitted from the electron-emitting portion of the linear electron source; and a voltage application means for applying voltage to the electron-emitting elements, wherein the modulation electrode is provided under the electron-emitting portion of the linear electron source with interposition of an insulating layer, and the electron-emitting portion is placed nearer to the low potential wiring electrode than to the high potential wiring electrode, or wherein the electron-emitting portion and the modulation electrode is placed on the one and the same face, and the electron-emitting portion is placed nearer to the low potential wiring electrode than to the high potential wiring electrode.

The effects of the fourth type of embodiments are more remarkable when the center of each of the electron-emitting portions of the linear electron sources is located at a position nearer to the lower potential electrode by the distance of 10 to 30% of the wiring electrode gap from the midpoint between the wiring electrode gap.

The electron-emitting element may the one which has an electron-emitting portion between a pair of electrodes. Surface conduction type electron-emitting element mentioned later is suitable therefor.

The electron beam-generating device is further characterized by an XY matrix construction which is formed by placing in stripes the linear electron sources having a plurality of electron-emitting elements and providing modulation electrodes orthgonally to the linear electron sources.

With this constitution, the electron beam is made to scan by XY-matrix driving of the linear electron sources and the modulation electrodes.

The fourth type of embodiments includes an electron beam-generating device in which voltage application means are provided independently for electron-emitting elements and for modulation electrodes. The application of voltage for driving the electron-emitting elements independently of the application of voltage for driving the modulation electrodes enables electron beam modulation independently of the element driving by application of voltage to the modulation electrodes in accordance with information signals.

The fourth type of embodiments also relates to an image display apparatus comprising the above electron beam-generating device and an image-forming member for forming image on collision of electron on the electron emission side of the electron beam-generating device. The image-forming member may be of any material which emits light, become charged, or causing change of quality on collision of electron: for example, fluorescent materials, and resist materials.

The fourth type of embodiments further relates to a recording apparatus comprising the above electron beam-generating device, a light-emitting member for emitting light on collision of electron on the electron emission side of the electron beam-generating device, and a recording member for recording image on irradiation of light from the light-emitting member, or a supporting means for the recording member.

The above is the constitution of the fourth type of the embodiments. The constitution and the effects thereof are specifically described below in detail.

A first feature of the fourth type of embodiments is the constitution that the electron-emitting element and the modulation electrode for modifying an electron beam in accordance with an information signal are placed on one and the same insulating substrate, or the modulation electrode is placed under the electron-emitting portion with interposition of an insulating layer.

This constitution is derived readily by forming the modulation electrode and the electron-emitting element with interposition of an insulating layer in integration according to thin film production technique, and improves the accuracy of mutual alignment of the element and the electrode.

The electron-emitting element in the fourth relation: $J\alpha 1/d^2$ (in case of thermoelectron source), so that slight variation of the modulation electrode distance will cause large change of the electron emission quantity. In a device in which a plurality of electron-emitting elements are arranged, thermal distortion causes variation of the modulation electrode distance, giving rise to remarkable variation of the electron emission quantity. Accordingly, cold cathodes are preferred. Of the cold cathodes, the aforementioned surface conduction type emitting element is preferred as the electron-emitting element for the electron-emitting device, the image display apparatus, and the optical signal-forming apparatus, since the cold cathode has advantages of (1) much higher electron-emitting efficiency, (2) readily producible simple structure, (3) possibility of arrangement of many elements in high density on one and the same substrate, (4) high response speed, and (5) excellent luminance contrast.

The modulation electrode in the fourth type of embodiments is used for ON/OFF control of the electron beam emitted from the electron-emitting element by application of voltage in accordance with an information signal. The modulation electrodes may be made of any material which is electroconductive.

The insulating layer in the fourth type of embodiments is a base material for holding both of the embodiments is used for ON/OFF control of the electron beam emitted from the electron-emitting element by application of voltage in accordance with an information signal. The modulation electrodes may be made of any material which is electroconductive.

The insulating layer in the fourth type of embodiments is a base material for holding both of the electron-emitting element and the modulation electrode, and may be made of any insulating material.

In the insulating layer in the three-layer structure composed of modulation electrodes, an insulating layer, and electron-emitting elements, the insulating layer is formed to have a uniform thickness so as to make uniform the distances between the modulation electrodes and the electron-emitting elements.

A second feature of the fourth type of embodiments is the constitution that the electron-emitting portion of the electron-emitting element is placed closer to the low-potential side of a pair of wiring electrodes for connecting the higher potential electrodes and for connecting the lower potential electrodes.

Figure 74:
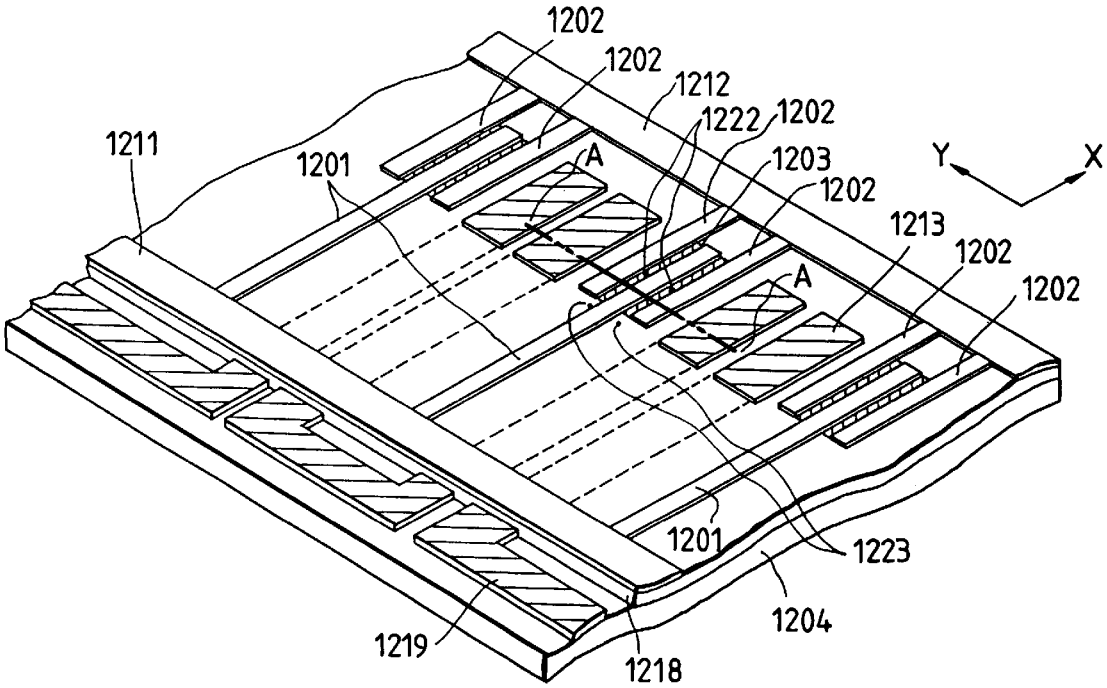
FIGS. 74, 75, 78, 79, and 80 show an electron beam-generating device of the fourth type of embodiments of the present invention.

FIG. 74 illustrates a part of a linear electron source as an example of the fourth type of embodiments. The linear electron source has element electrodes 1201, 1202, electrode gap 1203, an insulating substrate 1204 made of silica, modulation electrodes 1213, an insulating layer 1218, and element wiring electrodes 1211, 1212. In this electron source, high potential is applied to the wiring electrode 1211 and low potential is applied to the wiring electrode 1212, and the electrode gap 1203 is placed closer to the low potential wiring electrodes 1212 than to the high potential wiring electrode 1211.

Figure 75:
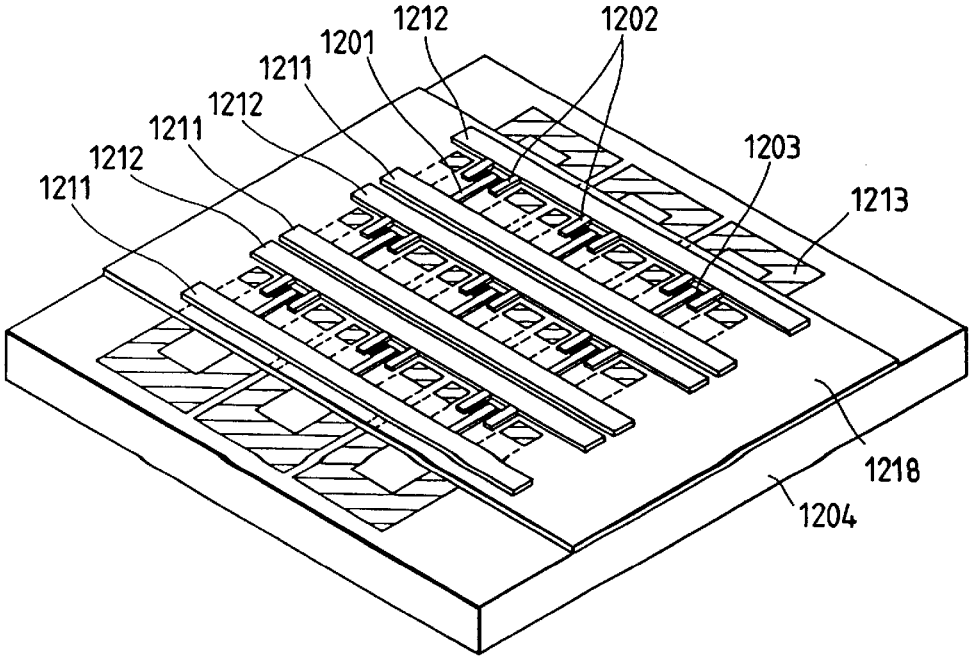

FIG. 75 illustrates an electron beam-generating device as another example of the fourth type of embodiments of the present invention, in which a plurality of the linear electron sources of FIG. 74 are arranged at a pitch of 1 mm, and a plurality of modulation electrodes are placed in a direction orthogonal to the linear electron sources by keeping insulation between the electron sources and the modulation electrodes. An image display apparatus is prepared by providing a face plate above this electron beam-emitting device.

With this apparatus, voltage of 1 kV was applied to the face plate, and pulse voltage of 14 V was applied to the linear electron source with the element wiring electrode 1212 kept at a low potential to emit electrons.

The effects of the position of the electron-emitting portion 1203 are explained below regarding five cases.

Figure 76A:
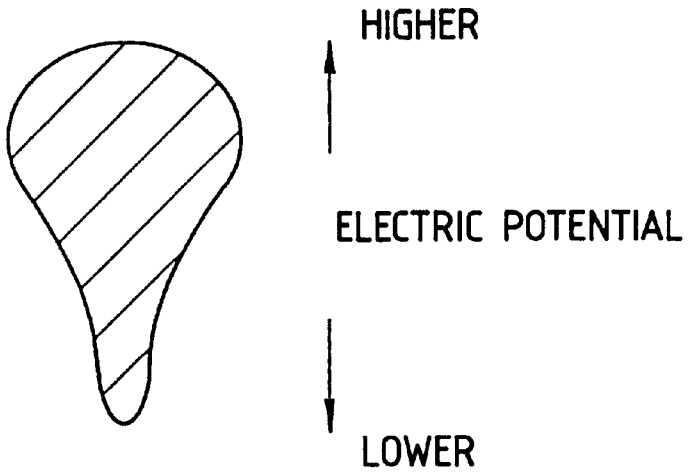
FIGS. 76A–76B, and 77 are drawing for explaining the change of a beam shape in the electron beam-generating device of the present invention.

(1) Electron-emitting portion being closer to high potential side of wiring electrode:

The light spot was deformed to take a form spreading toward the high potential side as shown in FIG. 76A, thereby variation of luminance being caused in line in the image.

Figure 76B:
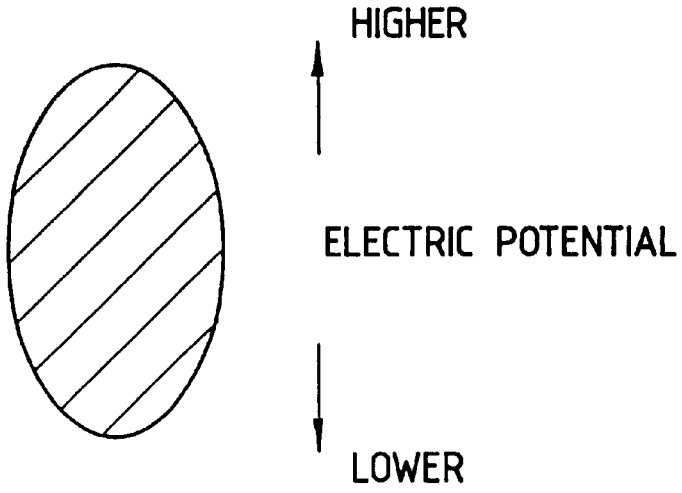
Figure 77:
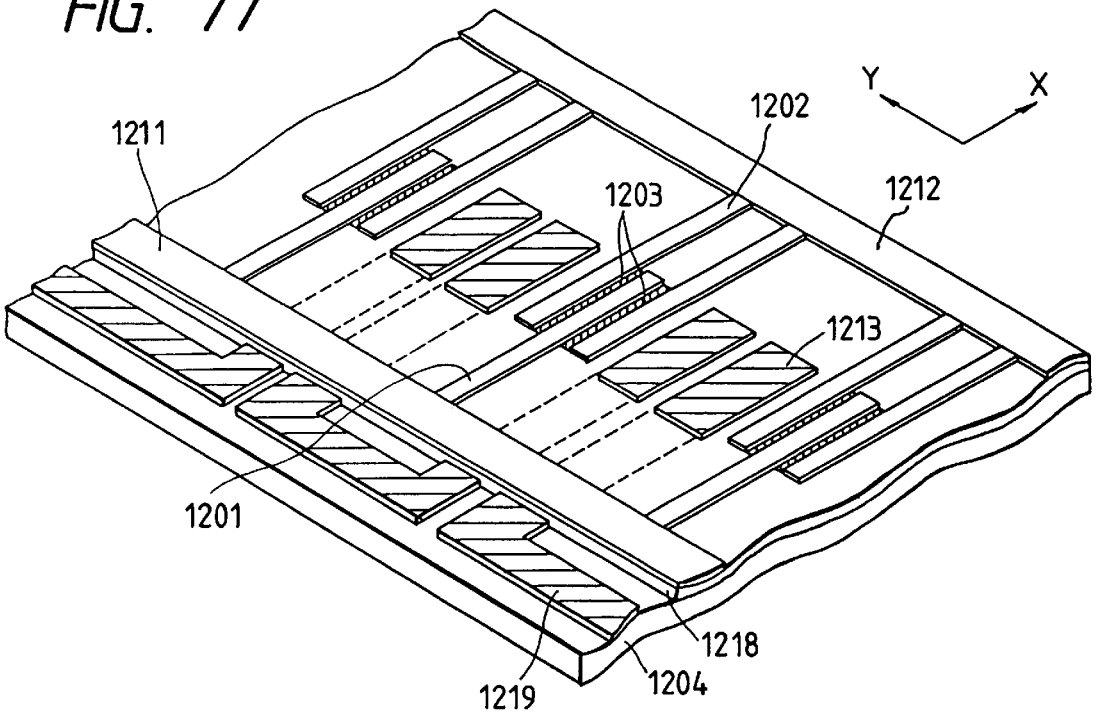

(2) Electron-emitting portion being at middle portion between wiring electrodes as shown in FIG. 77:

The light spot was deformed to take a form spreading toward the high potential side as shown in FIG. 76A, thereby variation of luminance being caused in line in the image. The size of the bean of one element was measured to be 1200 $\mu$m×750 $\mu$m. When the voltage applied to the face plate was raised to 1.5 kV, the light spot was in a desired ellipsoid form as shown in FIG. 76B and the screen exhibited uniform brightness. When the voltage applied to the fluorescent material was raised 2 kV, or 3 kV, the screen exhibited uniform brightness. This phenomena results from the fact that the higher potential voltage applied to the fluorescent material lower the influence of the potential of the element wiring electrode 1211.

(3) Electron-emitting portion being dislocated toward low potential side between wiring electrodes by 0–10% of electrode distance:

The light spot was approximately in a desired ellipsoidal form, and the screen exhibited more uniform brightness than the above case (2).

(4) Electron-emitting portion being dislocated toward low potential side between wiring electrodes by 10–30% of electrode distance:

The light spot was in a desired ellipsoidal form, and the screen exhibited uniform brightness. For example, when the dislocation was 12%, the beam size of the one element was 1100 $\mu$m×700 $\mu$m, which is finer than that of the case when the electron-emitting portion is at the middle of the wiring electrodes, and is suitable for image display apparatuses.

(5) Electron-emitting portion being dislocated toward low potential side between wiring electrodes by 30% or more of electrode distance:

The electron-emitting portion is excessively close to the wiring electrode, whereby leak current flows from the electron-emitting portion to the wiring electrode to result in increase of power consumption. Furthermore, compared at the same wiring electrode distance, the area of the electron-emitting portion is decreased, thereby the emitted electric current being decreased. This is not suitable practically for image display apparatuses From the above reasons, the constitution (4) is suitable for the image display apparatus of the embodiments. In short, placement of the electron-emitting portion closer to one of the pair of the wiring electrodes as shown in the above second feature gives uniform luminance of the image display apparatus and lowers the voltage applied to the fluorescent material.

The description above is made mainly on the electron beam-generating device. The electron beam-generating device is particularly suitable as the electron source for the image display apparatus and the recording apparatus mentioned in connection with the fourth type of embodiments.

The image display apparatus mentioned above gives an image with extremely high resolution, high luminance and high contrast without luminance irregularity owing to the aforementioned advantages of the electron-generating device of the fourth type of embodiments.

The recording apparatus mentioned above gives a sharp recorded image with extremely high resolution, high speed and high contrast without exposure irregularity owing to the aforementioned advantages of the electron-generating device of the fourth type of embodiments.

A fifth type of embodiments are described which are based on the constitution, common to the first to the fourth types of embodiments, that an electron emitting element and a modulation electrode are placed on the same face of a substrate.

The fifth type of embodiments of the present invention relates to an electron beam-emitting device, in which an electron-emitting element and a modulation electrode is provided with interposition of an insulating film on one and the same face of a substrate, and the substrate is electroconductive. Further, the electron beam-emitting device is characterized by use of a surface conduction type electron-emitting element as the aforementioned electron-emitting element. This constitution, which has constituting members formed on the same substrate and substrate exhibits sufficient heat radiation effect, prevents distortion of the substrate by thermal expansion and deterioration of electron-emitting element.

An example of the constitution and the effects of the fourth type of embodiments are described below.

Figure 82:
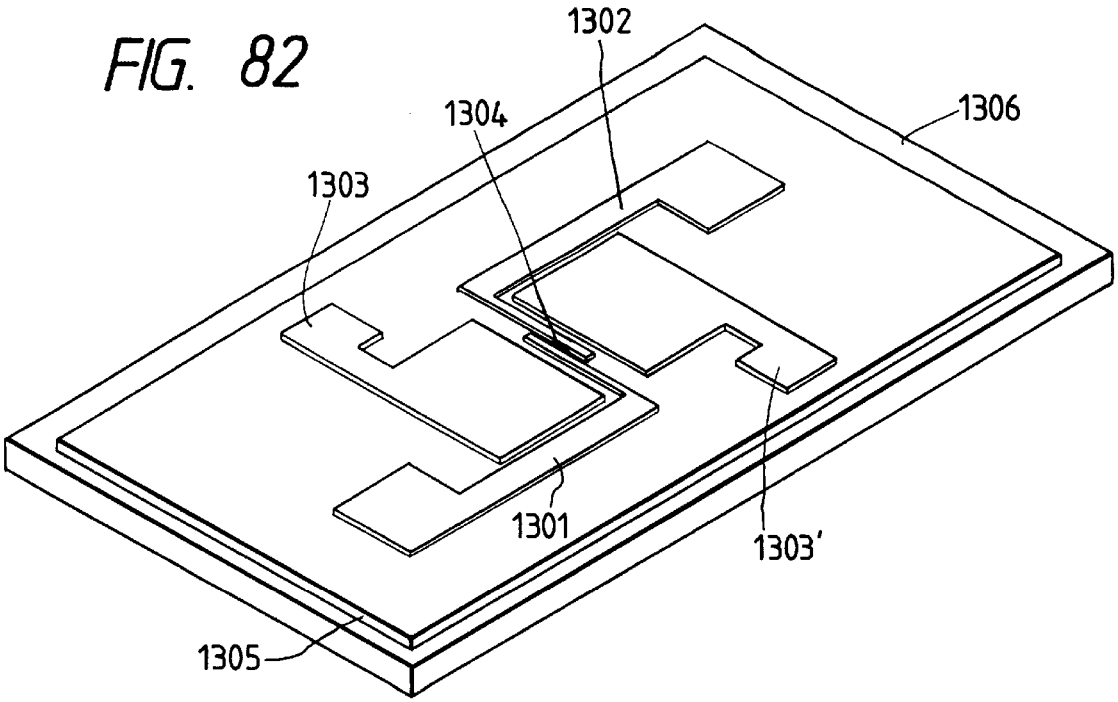
FIG. 82 shows an electron beam-generating device of the fifth type of embodiments of the present invention.

FIG. 82 shows an electron-emitting element which has element electrodes 1301, 1302, modulation electrodes 1303, an electron-emitting portion 1304, an insulating film 1305 and an electroconductive substrate 1306. The electron-emitting portion 1304 emits electrons, when this element is kept in vacuum, and ten and several volts of element voltage is applied between the element wiring electrodes 1301, 1302 and several KV of draw-out voltage is applied to the upper anode electrode plate (not shown in the drawing). The electron beam emitted from the electron-emitting portion 1304 can be turned on and off by applying minus several tens of volts or plus several tens of volts of modulation voltage to the modulation electrodes 1303. Further, the quantity of the electron beam can be continuously controlled by changing the modulation voltage continuously.

In FIG. 82, only one electron-emitting element is shown. A linear or planar electron-emitting source can be formed by arranging a number of electron-emitting portions.

The constituting members of this type of embodiments are explained below.

In FIG. 82, a finely surface-polished metal material is used as the electroconductive substrate 1306. As the metal, copper, aluminum, iron, and the like are suitable in view of availability and cost. Such materials have a thermal conductivity of about 100 Kcal/m·hr·° C. and exhibit high heat radiation effect in comparison with glass and silica having thermal conductivity of about 1 Kcal/m·hr·° C. The insulating film 1305 is suitably made of a coating glass material, a thin film of oxide such as vacuum-deposited $SiO_2$, or another ceramic material. The thickness thereof is desirably thinner to lower the voltage applied to a modulation electrode. In deciding the thickness, however, electric insulation need to be considered.

Other constitution members and the preparation thereof are the same as in the preceding embodiments.

An image-forming apparatus and a recording apparatus is provided by use of the electron beam-generating device of the embodiment in the same manner as in the preceding embodiments.

A sixth type of embodiments are described which are based on the constitution, common to the first to the fifth types of embodiments, that an electron emitting element and a modulation electrode are placed on the same face of a substrate, or the modulation electrode is placed on the other face of the substrate than the face on which electron-emitting element is placed.

(1) The sixth type of embodiments relate to an electron beam-generating device, which has, for each one electron beam-emitting element, a plurality of electrodes having respectively an independent voltage application means for modulating and deflecting an electron beam emitted from the electron-emitting elements on an insulating substrate.

(2) The sixth type of embodiments also relate to an electron beam-generating device of the above item (1), in which at least one of electrodes are provided on one and the same face with the electron-emitting element.

(3) The sixth type of embodiments further relate to an electron beam-generating device of the above item (1) or (2), in which an electron beam emitted from the electron-emitting element is made to address a plurality of picture elements.

(4) The sixth type of embodiments further relate to an electron beam-generating device of any of the above items (1) to (3), in which the electron-emitting element has an electron-emitting portion between electrodes on an insulating substrate, and the electron-emitting portion emits electrons on application of voltage between the electrodes.

(5) The sixth type of embodiments further relate to an electron beam-generating device of any of the above items (1) to (4), in which linear electron sources having a plurality of electron-emitting element is arranged in stripes and a plurality of electrodes is provided orthogonally to the linear electron sources to construct an XY matrix.

(6) The sixth type of embodiments further relate to an electron beam-generating device of any of the above items (1) to (5), in which the voltage application means for applying voltage for the electron-emitting element and the voltage application means for applying voltage to the plurality of the electrodes are separated to be independent.

(7) The sixth type of embodiments still further relate to an image display apparatus which comprises the electron-generating device of any of the above items (1) to (6) and an image-forming member, which forms image on collision of electrons, on the electron emission side of the electron-emitting device.

In the sixth type of embodiments, the electron-emitting element has a plurality of modulation electrodes which modulate the electron beam emitted from the electron-emitting element in accordance with information signals, and deflection function is imparted to the modulation electrodes in addition to the modulation function, thereby solving the aforementioned problems.

The invention on the sixth type embodiments is based on the finding that the high fineness and the high brightness in large-screen image display apparatus depend largely the positional registration of the deflection electrode with other members and the uniformity of the distance therebetween. In this invention, therefore, a plurality of modulation electrodes are provided for one electron-emitting element and deflection function is imparted to the modulation electrodes to serve not only for beam shape correction but also for beam scanning.

The constituting elements and effects of the sixth type of embodiments are described below in detail.

The feature of the sixth type of the embodiments is the constitution that a plurality of modulation electrodes to modulate an electron beam emitted from electron-emitting element as an electron source are provided for one electron-emitting element.

The electron-emitting element in sixth type of embodiments may be either of a hot cathode type or a cold cathode type which is conventionally used. Of the cold cathodes, the surface conduction type emitting element is particularly preferred as the electron-emitting element for the electron beam-generating device and the image display apparatus of the embodiments, since it has advantages of (1) much higher electron-emitting efficiency, (2) readily producible simple structure, (3) possibility of arrangement of many elements in high density on one and the same substrate, (4) high response speed, and (5) excellent luminance contrast. Throughout the entire embodiments, the above advantage (5) results mainly from the thin film construction of the surface conduction type emitting element. In the sixth type of embodiments, the modulation electrode is preferably placed on the reverse side (lower face) of the plane of the electron emission of the electron-emitting element or on the same plane with the electron-emitting element and in close proximity to the electron-emitting portion. Therefore, if the thickness of the electron-emitting element (thickness in electron beam emission direction) is extremely large, the distance between the modulation electrode and the electron-emitting face of the electron-emitting element becomes too large, and further problems arise that the emitted electron beam is not satisfactorily modulated and the luminance contrast is low. Accordingly the thickness of the electron-emitting element in the sixth type of embodiments is preferably in the range of from 100 Å to 200 $\mu$m, especially to attain satisfactory luminance contrast, more preferably from 100 Å to 10 $\mu$m.

The modulation electrode in the sixth type of embodiments is used for control of the electron beam emitted from the electron-emitting element by application of voltage in accordance with an information signal. The modulation electrodes may be made of any material which is electroconductive.

The insulating layer in the sixth type of embodiments is a base material for holding the electron-emitting element and the modulation electrode on the opposite sides thereof, and may be made of any insulating material.

The modulation electrode, which is the main feature of the sixth type of embodiments, is explained below. Originally, one modulation electrode is provided for one electron-emitting element. The modulation electrode serves for ON/OFF control of the beam, correction of the beam shape, and additionally deflection of the beam in only one direction. By the aforementioned multiplication of the modulation electrode, beam deflection, especially beam scanning, is practicable with the same electrode as the one for ON/OFF control. The principle is described by reference to FIG. 83.

Figure 83:
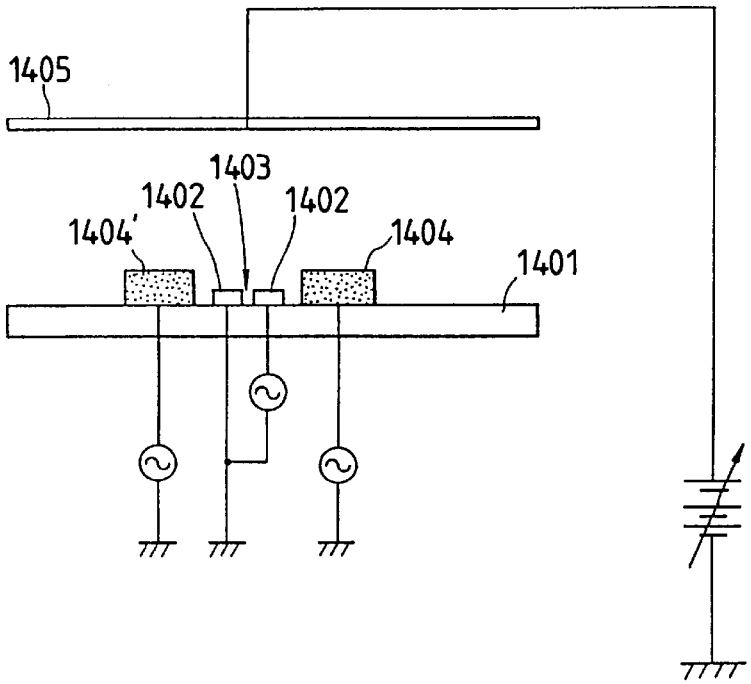
FIGS. 83, 84, 85, and 86 show an electron beam-generating device of the sixth type of embodiments of the present invention.

FIG. 83 shows schematically the principle of the electron-emitting element of the sixth type of embodiments. The element has an insulating substrate 1401, element electrodes 1402, electron-emitting portion 1403, modulation electrodes 1404, 1404', and an anode (an image-forming member) 1405. Under application of voltage to the anode 1405, a voltage for electron emission is applied to the element electrodes 1402. In this state, application of a certain voltage to the modulation electrodes 1404, 1404' conducts OFF control and a light spot on the image-forming member 1405 is made to disappear, and application of another voltage thereto conducts ON control to form a light spot on the image-forming member 1405. Application of zero volt to one modulation electrode 1404 shifts the light spot toward the modulation electrode 1404', while application of zero volt to the other modulation electrode shifts the light spot toward the modulation electrode 1404. This is caused by the change of the electric field in the close vicinity to the electron-emitting portion given by the modulation electrodes 1404, 1404'. By applying pulse voltage of from 1 Hz to 100 Hz successively to the modulation electrodes 1404, 1404', the spotlight is made to conduct scanning in accordance with the frequency. Beam scanning is practicable based on this phenomenon. In other words, the multiplication of the modulation electrode made beam scanning practicable. Further, on the basis of the above principle, one electron source can naturally correspond to a plurality of picture elements, e.g., RGB. It is also clear that one picture element can be irradiated with electron beams simultaneously from a plurality of electron sources by external control (modulation signals).

A seventh type of embodiments are described which are based on the constitution, common to the first to the sixth types of embodiments, that a modulation electrode is placed on the other face of the substrate than the face on which electron-emitting element is placed.

(1) The seventh type of embodiment relates to an electron beam-generating device in which an electron-emitting element having an electron-emitting portion between electrodes, and a modulation electrode for modifying an electron beam emitted from the electron-emitting element are placed with interposition of an insulating layer, and an electroconductive film contacting the electrodes is provided on at least a part of the face of the holding member for holding the electron-emitting element. The material of the electroconductive film is preferably the same as the one forming the electron emitting portion, and more preferably the sheet resistance of the electroconductive film is not higher than $10^9$ $\Omega/cm^2$.

(2) The seventh type embodiments also relates to an image display apparatus which has the aforementioned electron-generating device and an image-forming member, which forms image on collision of electrons, on the electron emission side of the electron-emitting device.

(3) The seventh type of embodiments still further relates to recording apparatus to a recording apparatus which has an electron beam-generating device, an light-emitting member for emitting light on irradiation of the electron beam from the electron beam-generating device, and a recording medium on which recording is made on irradiation of light from the light-emitting member.

(4) The seventh type of embodiments still further relates to recording apparatus to a recording apparatus which has an electron beam-generating device, an light-emitting member for emitting light on irradiation of the electron beam from the electron beam-generating device, and a supporting means for supporting a recording medium on which recording is made on irradiation of light from the light-emitting member.

The constituting elements and the effects of the seventh type of embodiments are described below in detail.

In the embodiments, the electron-emitting element as the electron source and the modulation electrode for modulating the electron beam emitted from the electron-emitting element are held on the same substrate, the modulation electrode being formed on the non-electron-emitting side of the electron-emitting element with interposition of an insulating layer.

The electron-emitting element in the seventh type of embodiments may be of a type of hot cathode or cold cathode which is conventionally used. The hot cathode is lower in electron emission efficiency than the cold cathode because of diffusion of heat to the substrate. Therefore, cold cathodes are preferred. Of the cold cathodes, the surface conduction type emitting element is particularly preferred for the electron beam-generating device, the image display apparatus, and the recording apparatus of the seventh type embodiments as the electron-emitting element, since it has advantages of (1) much higher electron-emitting efficiency, (2) readily producible simple structure, (3) possibility of arrangement of many elements in high density on one and the same substrate, (4) high response speed, and (5) excellent luminance contrast.

The modulation electrode in the sixth type of embodiments is used for ON/OFF control of the electron beam emitted from the electron-emitting element by application of voltage in accordance with an information signal. The modulation electrodes may be made of any material which is electroconductive.

The insulating layer in the seventh type of embodiments is a base material for holding both of the electron-emitting element and the modulation electrode, and may be made of any insulating material.

The insulating layer is formed preferably to have a uniform thickness so as to make uniform the distances between the modulation electrodes and the electron-emitting elements.

The formation of the electron-emitting element and the modulation element in integration with interposition of a substrate improves the alignment accuracy, and solves the problems encountered in prior art.

The insulating film, which is the main feature of the seventh type of embodiments, is described by reference to FIG. 87.

Figure 87:
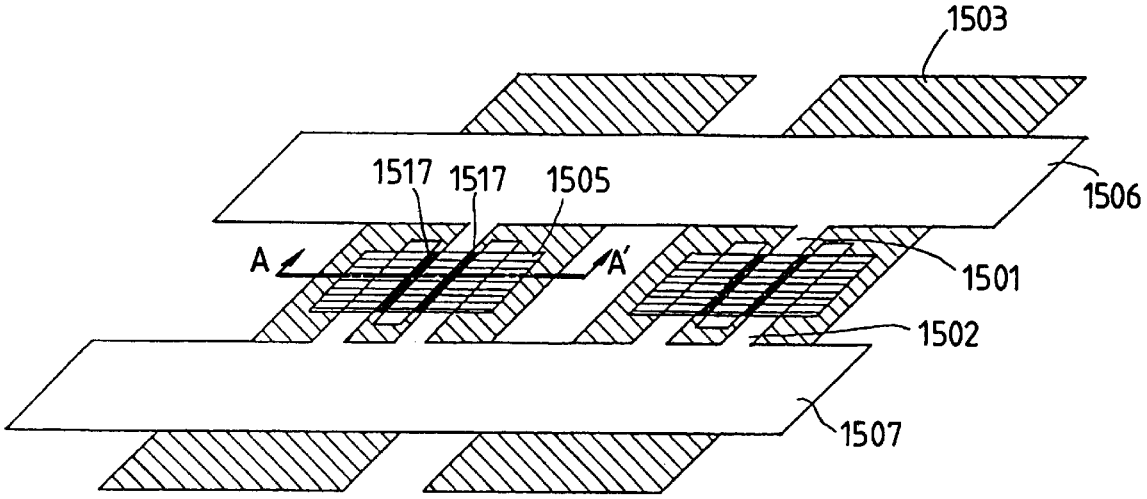
FIGS. 87, 88, and 89 show an electron beam-generating device of the seventh type of embodiments of the present invention.

As shown in FIG. 87, the main feature of the seventh type of embodiment is that an electroconductive film 1505 is provided on the substrate (not shown in the drawing) which holds a pair of a lower potential electrode 1502 and a higher potential electrode 1501 constituting an electron-emitting portion, the electroconductive film being placed at such a position that the electroconductive film is connected electrically to the element electrodes.

If charge-up is caused on the surface of the substrate in the vicinity to the electron-emitting portion of the element, the electric field around the electron-emitting portion is deformed and the orbital of emitted electron is greatly changed. In application of to an image display apparatus or the like in which the element is arranged in high density, an electron beam-generating device is desired which is capable of emitting highly regulated beam. The electroconductive film, the feature of the invention, gives a desirable electron beam-generating device.

The insulating film has preferably the sheet resistance of from about 1 $\Omega/cm^2$ to about $10^9$ $\Omega/cm^2$. A similar effect is obtainable when the insulating film is formed from the same material as the thin film material for the electron-emitting portion.

An electroconductive film having a larger area is more effective generally. However, in the case where modulation is conducted with a modulation electrode of the embodiments of the invention, the area is desirably not larger than that of the modulation electrode.

Figure 88:
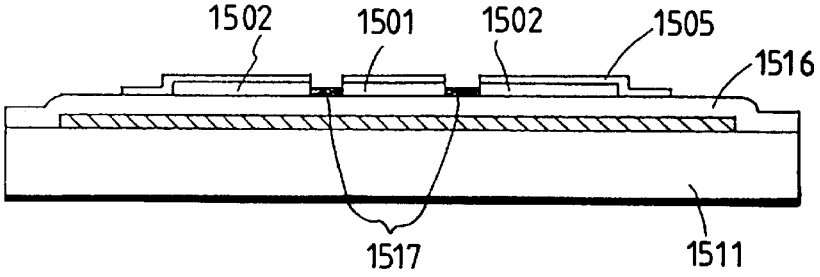

The element in FIG. 87 has element electrodes 1501, 1502, modulation electrodes 1503, electroconductive films 1505, and electron-emitting portions 1517, the electron-emitting portion being formed by denaturing a part of the electroconductive film at the portion between the element electrode 1502 by flowing electric current. FIG. 88 is a cross-sectional view at the line A–A' in FIG. 87. As shown in FIG. 88, the electron-emitting element of this embodiment is constructed by forming on an insulating substrate 1511, a modulation electrode 1503, an insulating film 1516, element electrodes 1501, 1502, and an electroconductive film 1505 in the named order.

In this embodiment, the electroconductive film formed on the insulating film 1516 is required to be brought into contact with the low potential element electrode 1502 in order to introduce the electrons having fallen onto the insulating film 1516 to the low-potential or high-potential electrode 1501, 1502 to prevent charge-up. In a most efficient production method, the electroconductive film is formed as the uppermost layer including the portion on the high potential element electrode 1501 and then electron-emitting portion 1517 is formed by flowing electric current through the required portion.

The method of production of the electron-emitting element of the seventh type of embodiments is not specially limited provided that the electron-emitting element has the above-mentioned constitution, and the element may be produced by conventional vapor deposition or etching. The material therefor is not limited.

First Embodiment

An electron beam generating device as shown in FIGS. 1 and 2 was manufactured.

The manufacturing processes will firstly be described.

(1) A rear plate 11 comprised of quartz glass (by Corning Co., Ltd.) was well scrubbed with neutral detergent and washed by ultrasonic cleaning using organic solvent, and thereafter resist-patterned by photolithography.

(2) Next, an underlying material, Ti, and a modulating electrode material, Ni, were deposited as films on the resist pattern (not shown) to have film thicknesses of 50 Å and 950 Å respectively according to vacuum deposition, and a modulating electrode 12 was formed by lift-off method.

(3) An insulating layer 15 comprised of $SiO_2$ and having a thickness of 1.5 $\mu$m is formed, with a mask deposition at necessary portions, by sputtering.

(4) In totally the same manner as the modulating electrode pattern forming method, an element electrode 13 pattern shown in FIG. 2 was formed. The width and thickness of the element electrode 13*a* were 50 $\mu$m and 1 $\mu$m respectively, while those of the element electrode 13*b* were 15 $\mu$m and 0.1 $\mu$m respectively. The electrode gap between the element electrodes 13*a* and 13*b* was 2 $\mu$m.

(5) A film comprised of Cr for patterning an emitting material was deposited to have a film thickness of 1000 Å by vacuum deposition.

(6) A pattern comprised of photoresist for removing Cr only near the emitting portion (25 $\mu$m×150 $\mu$m) was formed by photolithography.

(7) A desired part of Cr was removed by etching. As etchant, cerium ammonium nitrate or perchloric acid aqueous solution was used.

(8) Organic palladium solution (Catapaste CCP 4230, available from Okuno Pharmaceutical Co., Ltd CCP-4230) was coated and thereafter baked at 300° C. in atmosphere for 12 minutes to form a thin film containing palladium, i.e. emitting material, as the main element over the whole surface.

(9) Cr for patterning the emitting material was etched out using the etchant noted in above (7).

(10) An voltage was then applied between the element electrodes 13*a* and 13*b* to energize the thin film noted in (8) so as to form an electron emitting portion.

An electron beam generating device thus manufactured, together with a fluorescent plane disposed at 5 mm above this device, was located under an environment of $2\times10^6$ Torr. Then, a voltage of 1 KV was applied to the fluorescent plate from outside, and a voltage pulse of 14 V was applied between the element electrodes with the electrode 3*a* as the lower potential side and the electrode 3*b* as the higher potential side.

As a result, a spot light corresponding to the electron beam having been emitted to the fluorescent plate was observed. Further, when voltages of −35 V to +30 V were applied to the modulating electrode, the electron beam amount was continuously changed in accordance with the modulating voltage, and at this time it was possible to perform off-control with the modulating voltage of −35 V or lower and on-control with the modulating voltage of +30 V or higher.

Further, in the above, when the higher potential side electrode (with 15 μm of width and 0.1 μm of thickness) was fixed while the width and thickness of the lower potential side electrode was changed, the resulting cut-off voltages were as follow:

| Lower potential side electrode | | |
|---|---|---|
| Width | Thickness | Cut-off voltage |
| 15 μm | 0.1 μm | −40 V |
| 15 μm | 1 μm | −38 V |
| 15 μm | 5 μm | −31 V |
| 50 μm | 0.1 μm | −38 V |
| 50 μm | 1 μm | −35 V |
| 50 μm | 5 μm | −30 V |

Figure 3:
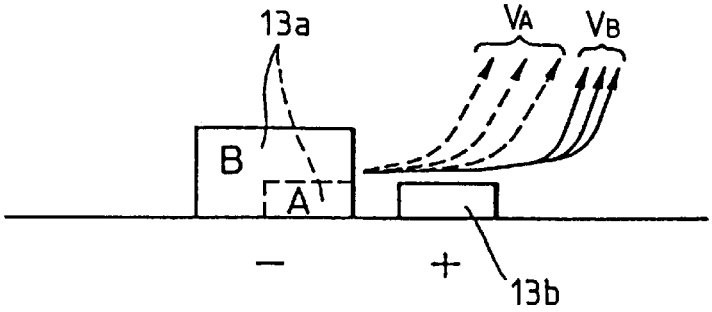

Namely, in the off-controlling, the cut-off voltage can be reduced by increasing the width or the thickness of the lower potential side electrode. In the on-controlling, meanwhile, since the emitted electrons have a larger initial speed, the electrons are directed in the vertical direction at a region not occurring any field distortion caused by the element electrode so as to enhance the convergence, as shown in VA in FIG. 3.

Second Embodiment

FIG. 4 is a perspective view showing an image display apparatus according to another aspect of the present invention. In FIG. 4, the numerals designate respectively: 11, a rear plate; 12, a modulating electrode; 13 (13*a* and 13*b*), an element electrode; 14, an electron emitting portion; 16, a wiring electrode; and 41, a face plate.

A plurality of electron emitting elements were arranged at a pitch of 2 mm in line, and a plurality of modulating electrodes 12 were arranged perpendicularly to the line of the electron emitting elements, and as a wiring electrode 16, Cu was laminated to have a thickness of 2 μm. With the other constitution being totally the same as in the first embodiment, an electron beam generating device 13 was formed on a blue plate (soda lime) glass (manufactured by Ichikawa Special Glass Co., Ltd.) as a rear plate 1.

Subsequently, the face plate 41 having a fluorescent substance (not shown) as an image forming material was disposed with 5 mm (as l) separated from the rear plate 11 to compose an image display apparatus.

A voltage of 1.5 KV was applied to the fluorescent substance surface while voltage pulses of 14 V was applied to a pair of wiring electrodes 16 such that electrons were emitted from the plurality of electron emitting elements arranged in line. At the same time, voltages as information signals were applied to the group of the modulating electrodes to turn the electron beam on and off.

Further, voltage pulses of 14 V were applied to the electrodes 13-*a* and 13-*b* to perform display for the aforementioned one line. By executing sequentially these operations, an image for one screen was formed. Namely, the image was displayed with the group of the element wiring electrodes as the scanning electrodes, and these scanning electrodes and the modulating electrodes constituting a X-Y matrix.

The surface-conduction-type electron emitting elements according to this embodiment can be driven in response to voltage pulses not exceeding 100 ps (picoseconds), so it is possible to form more than 10,000 of scanning lines when one screen is formed in 1/30 second.

The voltage to be applied to the modulating electrodes 12 turned the electron beam off at −40 V or lower and on at 30 V or higher. The amount of the electron beams was continuously changed in the range of −40 V to 30V. Therefore, it was possible to perform display with gradation by adjusting the voltage to be applied to the modulating electrodes.

The reason why the electron beam can be controlled by the voltage applied to the modulating electrodes 12 bases on the fact that the potential near the electron emitting portion 14 changes over ranges of from minus to plus and the electron beam accelerates or decelerates depending on the voltage of the modulating electrodes.

As described above, according to this embodiment, since the electron emitting elements and the modulating electrodes are laminated through the insulating body, the alignment operation becomes easy. Further, due to the use of thin film manufacturing technique, a display with large screen with high resolution can be obtained at low cost. In addition, the precision of the space between the electron emitting portion 14 and the modulating electrode 12 can be significantly enhanced to provide an image display apparatus of high resolution.

The present invention is quite effective for a surface-conduction-type electron emitting element where electrons having an initial speed of several volts are emitted into vacuum environment. Moreover, the whole display image had high lightness and contrast without any lightness non-uniformity.

Third Embodiment

FIG. 5 is a schematic view of an optical printer according to still another aspect of the present invention.

In FIG. 5, the numerals designate respectively: 47, a vacuum container made of glass; 41, a face plate; 43, an electrode for applying voltage to a fluorescent substance; 42, a rear plate; 11, a glass substrate (insulating body); 14, an electron emitting portion; 12, a modulating electrode; 44, electrodes (Dp, Dm) for applying voltage to the electron emitting element; 46, electrodes ($G_1$–$G_N$) for applying voltage to the modulating electrodes 14; 48, an light-emitting source; and 45, a recording medium.

The recording medium 45 was formed by uniformly applying a photosensitive composition having the following contents onto a polyethyleneterephthalate film to a thickness of 2 μm. The photosensitive composition contains a mixture of: a. binder: polyethylenemethacrylate (trade name Dyanal BR, by Mitsubishi Rayon Co., Ltd.), 10 parts by weight, b. monomer: trimethylol propane triacrylate (trade name TMPTA, by New Nakamura Chemical Co., Ltd.), 10 parts by weight, c. polymerization initiator: 2-methyl-2-morpholino (4-thiomethylphenyl) propane-1-one (trade name Irgacure 907, by Ciba-Geigy), 2. 2 parts by weight, and methyl ethyl ketone, 70 parts by weight as solvent.

As the fluorescent substance of the face plate 41, silicate fluorescent substance $(Ba, Mg, Zn)_3Si_{207}$: $Pb^{2+}$ was used.

Further, the light-emitting source 48 was composed in the same manner as in the first embodiment.

A driving method of this embodiment will now be described with reference to FIG. 6A. In FIG. 6A, the numerals 51, 54 and 52 correspond to the light-emitting source 48, the recording medium 45 and a supporting member of the recording medium 45 respectively of the references in FIG. 5, and the numeral 53 designates a transporting roller for the recording medium 45. In this case, the light-emitting source 51 is disposed to oppose to the recording medium 54 with a space not exceeding 1 mm therebetween.

In this embodiment, modulating signals for one line of image in accordance with information signal are applied to the modulating electrodes in synchronicity with driving operation of the row of the electron emitting elements such that the irradiation of the electron beam toward the fluorescent substance is controlled to form a light-emitting pattern for one line of image. The light beam emitted from the luminant in accordance with the light-emitting pattern is irradiated onto the recording medium, and the irradiated recording medium is photochemically polymerized and cured. Subsequently, the transporting roller 53 is driven to perform the similar driving operation. By performing such a driving operation, a photochemically polymerized pattern in accordance with the information signal is formed on the recording medium as the photochemically polymerized pattern. By developing this photochemically polymerized pattern with methyl ethyl ketone, an optical recording pattern is formed on the polyethyleneterephthalate.

The optical printer according to this embodiment can provide clear optical recording pattern having uniform quality and high contrast at high speed.

Fourth Embodiment

FIG. 7 is a schematic view showing an optical printer according to still another aspect of the present invention. In FIG. 7, the numerals designate respectively: 61, a light-emitting source similar to that in FIG. 6A; 64, a photosensitive material for electrophotography as a recording medium; 68, a charger; 65, a developing device; 66, a discharger; 67, a cleaner; and 69, a paper on which image is formed. In this embodiment, a yellow green light-emitting fluorescent substance of $Zn_2SiO_4$: Mn (P1 fluorescent substance) is used as the fluorescent substance, and amorphous silicon photosensitive material is used as the photosensitive body for the electrophotography.

A driving method for the optical printer according to this embodiment will now be described.

The recording medium 64 is firstly charged to a positive voltage by the charger 68. The charging voltage is preferably 100 V–500 V, but not limited thereto. Next, a light-emitting pattern according to information signal is irradiated onto the recording medium 64 by the light-emitting source 61 to discharge the irradiated portion so as to form an electrostatic latent image pattern. The recording medium 64 is then developed by toner particles in the developing device 65.

The toner-absorbed portion moves as the recording medium 64 rotates, and the absorbed toner falls down when the recording medium 64 is discharged by the discharger 66. At this time, a paper 69 is located between the recording medium 64 and the discharger 66, and the toner falls down on this paper 69.

The paper 69 having received the toner then moves to a fixing device (not shown) where the toner is fixed to the paper 69 such that an image given by the light-emitting source 69 is reproduced.

On the other hand, the drum-type recording medium 64 further rotates to move toward the cleaner 67 in which the remained toner is removed, and in the charger 68 the charged state is formed again.

The aforementioned recording apparatus can provide clear image particularly with high resolution and high contrast without any exposure nonuniformity caused by high-speed operation by virtue of the aforementioned advantages of the electron beam generating device of the present invention.

According to the electron beam generating device of the present invention, the modulating electrodes and the electron emitting elements can be readily aligned, which contributes to simplify the manufacturing processes as well as to provide larger electron emitting amount in comparison to the conventional device. Accordingly, such disadvantages as the undesirably fluctuation of the electron emitting amount during the driving operation of the device or the modulation nonuniformity between the electron beams can be significantly reduced. Further, the electron beam generating device according to this invention has an excellent characteristics in emitting the electron beams with lower voltage.

In the image display apparatus incorporating the electron beam generating device of this invention, a desired contrast of the display image with high lightness and less lightness nonuniformity can be obtained.

In the recording apparatus incorporating the electron beam generating device of this invention, a desired contrast of the recorded image with high resolution can be obtained.

Further, in the aforementioned image display apparatus and the recording apparatus, since, as aforementioned, the modulating electrodes and the electron emitting elements can be easily aligned, even if the electron emitting elements are arranged with high density, any problems as having arisen in the conventional art would not take place in the electron emitting operation and the electron beam modulating operation. In consequence, display images, and recorded images with high resolution, high refined degree and high speed can be provided.

Fifth Embodiment

In this embodiment, an example of an electron beam generating device and an image display apparatus incorporating the electron beam generating device will be described with reference to FIGS. 10 and 11. FIG. 10 is a schematic view showing an electron source and a modulating electrode portion of the electron beam generating device of the present invention, and FIG. 11 is a cross-sectional view through E—E line in FIG. 10, wherein the numerals designate respectively: 131, an insulating substrate; 135 (135*a* and 135*b*), element electrodes of surface-conduction-type electron emitting element (135*a* is at higher potential side and 135*b* is at lower potential side; 136, an electron emitting portion; 140, modulating electrodes; 134 (134-*a*, 134-*b*), element wiring electrodes; 133, an insulating film; and 141, modulating wiring electrode.

The linear electron source is composed by arranging a plurality of electron emitting portions 136 between the element wiring electrodes 134-*a* and 134-*b*. The modulating electrodes 140 is located at the higher potential side element electrode 135*a*, and connected to the modulating wiring electrode 141 through a contact hole of the insulating film 133 (hereinafter referred to as linear modulating electrodes). By arranging a plurality of linear electron source and a plurality of linear modulating electrodes 141 in parallel to each other, groups of linear electron sources and linear modulating electrodes are formed.

In this embodiment, an image display apparatus is constructed by mounting a face plate associated with an image forming material as previously mentioned as a conventional embodiment above the substrate incorporating the electron source and the modulating electrodes.

In this embodiment, the surface-conduction-type electron emitting elements and the modulating electrodes 140 were mounted on the same surface of the substrate 131. The width (Wa) of the higher potential side element electrode 135*a* was set to 20 $\mu$m, while the width (Wb) of the lower potential side element electrode 135*b* was set to 50 $\mu$m. The gap (G)

between the element electrodes 135 (135*a* and 135*b*) constituting the electron emitting portion 136 was set to 2 μm.

In forming the electron emitting portion 136, organic palladium solution CCP-4230 manufactured by Okuno Pharmaceutical Co., Ltd. was dispersedly applied, and thereafter baked at 300° C. under atmospheric environment such that a mixed particulate film composed of palladium fine particules and palladium oxide fine particules was formed between the element electrodes, and then this particulate film was energized, i.e. subjected to electrification treatment.

The space (S) between the element electrode 135 and the modulating electrode 140 was set to 10 μm. The length (l) of the electron emitting portion 136 shown in FIG. 10 was set to 150 μm corresponding to the opposed length of the element electrodes 135. The width (L) of the modulating electrodes 140 has set to 200 μm.

Next, the constituting material of the present invention will now be described. As the substrate 131, glass material was used. The element electrodes 135 and the modulating electrodes 140 were formed of nickel having a thickness of 1000 Å. The insulating film 133 was formed of $SiO_2$.

Next, a method for manufacturing the image display apparatus of this embodiment will be mentioned with reference to FIGS. 12A–12D.

(1) The glass substrate 131 was well washed to form the element electrodes 135 and the modulating electrodes 140 thereon by vacuum deposition and photolithography which are often used in the art. All of the electron emitting elements, the linear electron source, and the linear modulating electrodes of this embodiment were formed with a pitch of 1.0 mm.

Subsequently, element wiring electrodes 134 (not shown) for simultaneously driving a plurality of the electron emitting elements were formed. In this embodiment, they were formed to have a thickness of 1.5 μm by a material containing copper as a main element.

(2) The insulating film 133 was formed at an end of the modulating electrodes 140. At this time, it is necessary to mount the insulating film 133 to be perpendicular to the element wiring electrodes 134, and the modulating wiring electrodes 141 and the element wiring electrodes 134 mounted on the insulating film must be mutually electrically insulated. For electrically connecting the modulating electrodes 140 with the modulating wiring electrodes 141, contact holes 138 were formed in the insulating film 133.

(3) The modulating wiring electrodes 141 were formed on the insulating film 133. At this time, the wiring of the modulating electrodes are carried out through the contact holes 138.

(4) A particulate film was formed between the element electrodes and was energized to form an electron emitting portion 136. The particulate film was formed by spinner-coating of organic palladium solution and then baking it at 300° C. over 30 minutes.

(5) The face plate having a fluorescent substance was provided 5 mm apart from the glass substrate 131 incorporating the electron source and the modulating electrodes 140 thus formed in the aforementioned manner, so as to complete an image display apparatus.

Next, a driving method in this embodiment will be set forth.

The fluorescent substance surface is set to have a voltage of 0.8 kV to 2.0 kV. In FIG. 10, voltage pulses (in this embodiment, of 14 V) are applied to a pair of element wiring electrodes 134-*a* and 134-*b* to make the electron emitting elements arranged linearly emit electrons. The emitted electrons turn electron beam on/off by applying voltage to the group of linear modulating electrodes in accordance with the information signals. The electrons emitted from the electron emitting portion 136 are accelerated and collide with the fluorescent substance, which then displays one line in accordance with the information signals. Subsequently, voltage pulses (in this embodiment, of 14 V) are applied to the contiguous wiring electrodes 134-*a* and 134-*b* to make a display of one line as mentioned above. By sequentially executing these operations, an image for one screen is formed. Namely, with the group of the wiring electrodes as scanning electrodes, an X-Y matrix is formed by these scanning electrodes and the modulating electrodes to display the image.

Figure 14:
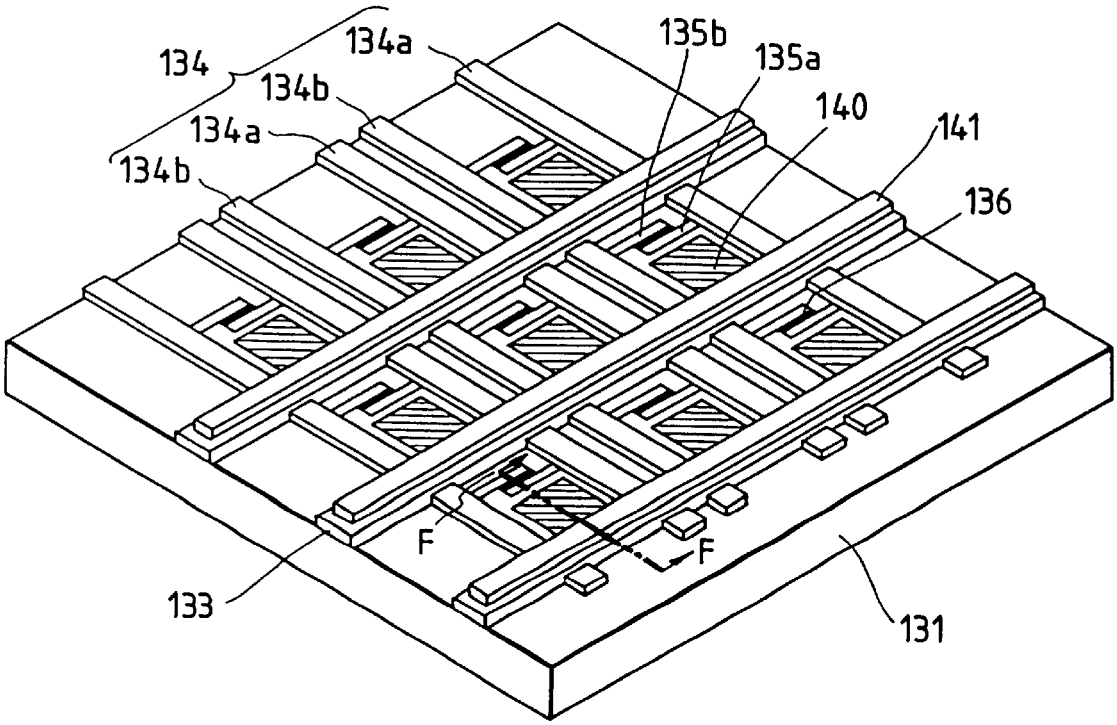
Figure 15:
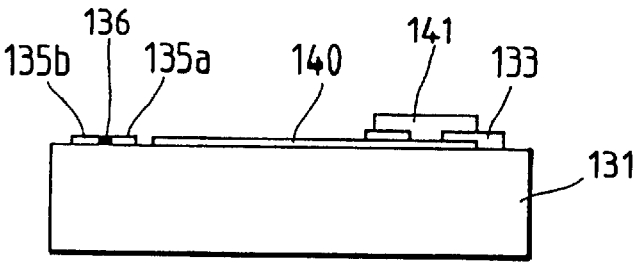

In the embodiment shown in FIG. 14 (FIG. 15 is a cross sectional view through F—F line in FIG. 14) in which the width Wb of the lower potential side element electrode 135*b* is equal to the width Wa of the higher potential side element electrode 135*a*, the cut-off voltage to be applied to the modulating electrodes 40 is approximately −60 V, while the cut-off voltage in this embodiment is approximately −45 V. Thus, an effect of reducing (the absolute value of) the cut-off voltage has been certified.

Sixth Embodiment

Figure 16:
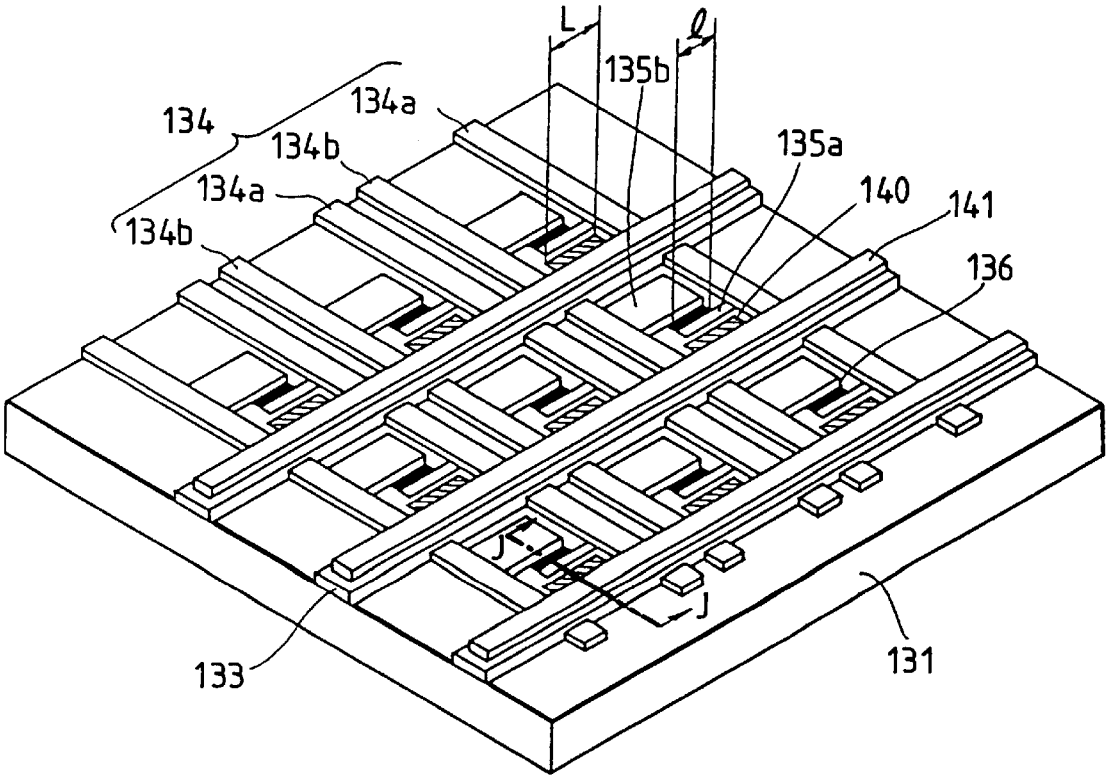
Figure 17:
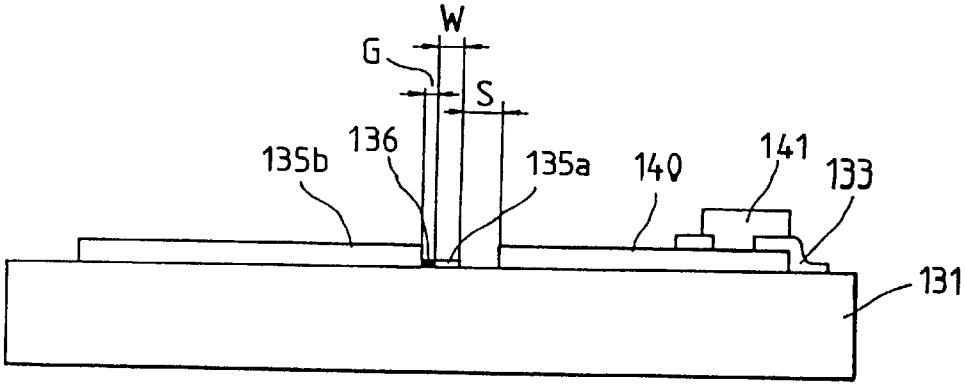

A sixth embodiment of the present invention will now be described with reference to FIGS. 16 and 17. In this embodiment, the thickness of the lower potential side element electrode 135*b* and the modulating electrode 140 is set to 5 μm. As a result, it has been recognized that the cut-off voltage becomes approximately −38 V. Thus, an advantage of further reducing the (absolute value of the) cut-off voltage has been recognized.

Although in this embodiment the thickness of both the lower and higher side element electrodes has been set to the same value, in general it can be set to mutually different value i.e. either one of them can be set to a larger value than another to provide the same effect.

Seventh Embodiment

An optical signal supplying apparatus according to a seventh embodiment of the present invention will now be described. In this case, the term "optical signal supplying apparatus" means a device for converting electrical signals into optical signals, specifically LED (Light Emitting Diode) array or liquid crystal shutter etc.

Figure 18:
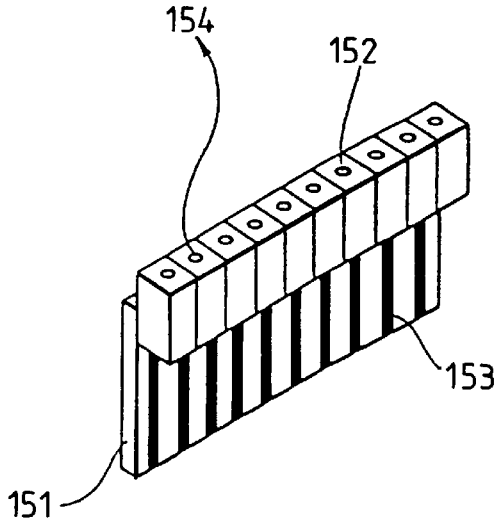
FIGS. 18, 19, and 20 show a recording apparatus of the present invention.

FIG. 18 is a schematic explanatory view of an LED array. In FIG. 18, an LED 152 is one-dimensionally disposed on the substrate 151 and connected to an electrode 153 on the substrate 151. By applying a voltage to the electrode 153, the LED can emit light. Namely, inputting electrical signals to the electrode 153 would make the LED array emit optical signals.

Figure 20:
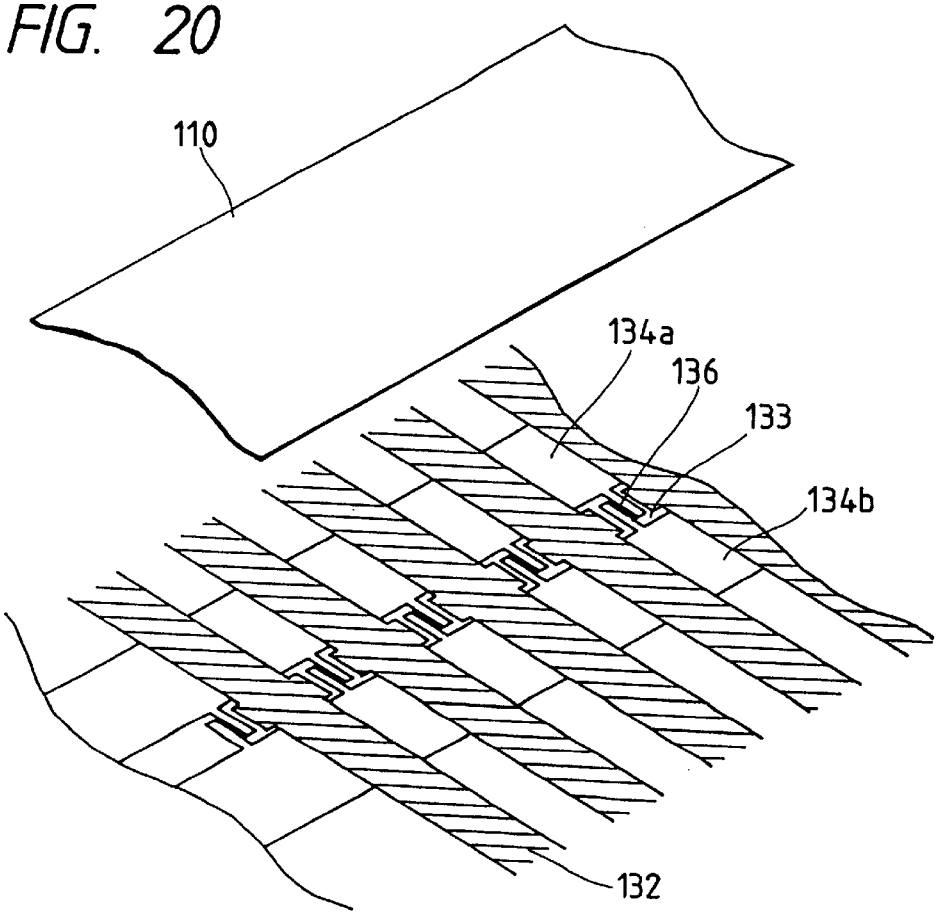

FIG. 19 is a diagram of an aspect in which the electron beam generating apparatus of this invention is composed as an optical signal supplying apparatus. FIG. 20 is a schematic explanatory view of the electron beam generating apparatus. As can be seen from FIG. 20, this embodiment has a similar composition to that of the one-line electron beam generating apparatus of the image display apparatus in the fifth embodiment, and the device structure and the manufacturing method are substantially the same as those in the fifth embodiment so as to be omitted from explanation.

A driving method of the optical signal supplying device according to this embodiment will now be described. A voltage is applied to the element wiring electrode 134 to make the electron emitting section 136 emit electron beam. By applying a predetermined voltage to the fluorescent substance and inputting electrical signals to the modulating electrodes 132 in accordance with the modulating signals, the electron beam is turned on and off. Thus controlled electron beam then collides with the fluorescent substance to be output as optical signals.

By using surface-conducting electron emitting element as the electron emitting element of this embodiment, it is possible to manufacture a remarkably improved optical signal supplying device having not only high lightness and high refined degree characteristics, but also quite high switching speed.

As mentioned above, according to this invention, the electron emitting elements and the modulating electrodes can be readily aligned to provide the following advantages:

(1) Images with high lightness without any display non-uniformity can be provided;

(2) Large-capacity displaying can be carried out;

(3) High refined degree display can be made since thin film technique can be used for the manufacturing technique;

(4) Image display apparatus can be manufactured with low price;

(5) The absolute value of the voltage to be applied to the modulating electrodes can be prevented from increasing; and (6) Further increase of the thickness of the lower potential side element electrodes and/or modulating electrodes would enhance the cut-off voltage reducing effect.

Eighth Embodiment

Figure 23:
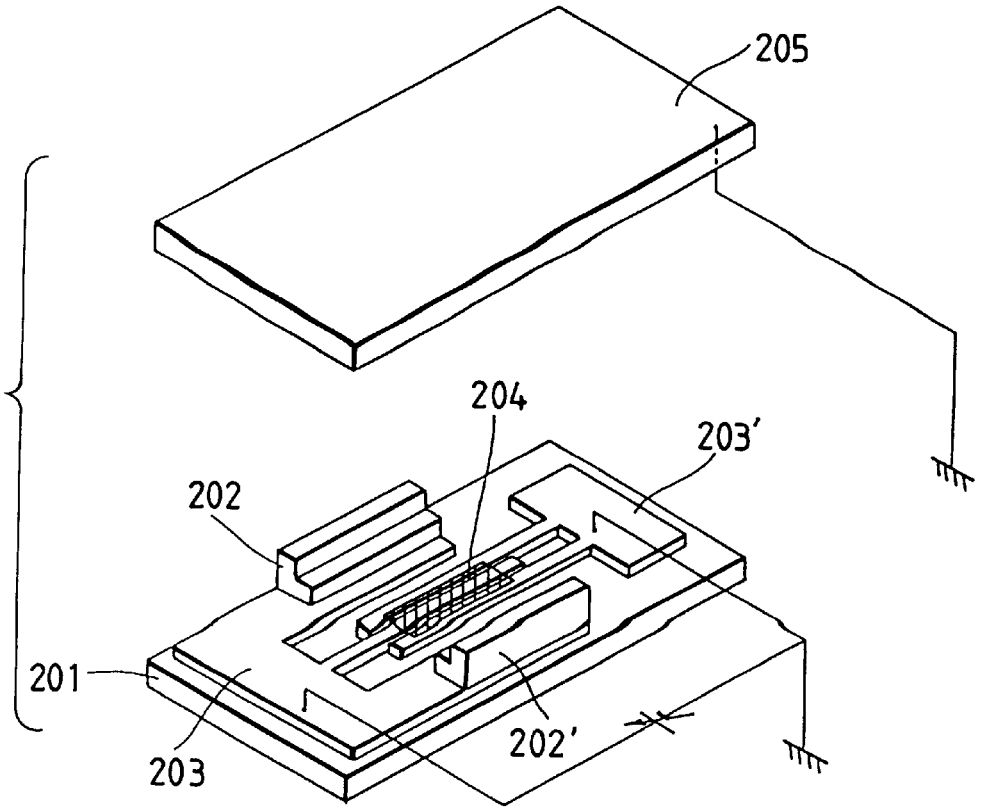

FIG. 23 is a perspective view showing an embodiment of this invention.

The manufacturing processes according to this embodiment shown in FIG. 29 will now be described.

(1) Firstly, quartz glass is used as an insulating substrate 201 and is then scrubbed with neutral detergent. Thereafter, the scrubbed substrate 201 is well cleaned by ultrasonic cleaning using organic solvent such as acetone, IPA or butyl acetate, and then a photoresist pattern of projections 202 and 202' at the first layer and the element electrodes 203 and 203' are formed by photolithography.

(2) Subsequently, a film having a thickness of approximately 50 Å is vacuum formed, totally over the insulating substrate 201 and the photoresist formed in the aforementioned manner, by the resistance heating, using Ti as a material for enhancing the adhesiveness. And then, a film having a thickness of approximately 950 Å is vacuum formed using Ni as element electrode material. Next, the photoresist is removed by lift-off method to form the element electrodes 203, 203', the first step projections 202, 202'. In this embodiment, the element electrode width is set to 15 μm, the electrode gap is set to 2 μm, and the space between the element electrode and the modulating electrode is set to 25 μm.

(3) Subsequently, for forming the electron emitting material only near the electron emitting portion, using Cr as electron emitting material forming material, a film having a thickness of approximately 1000 Å is formed over the whole surface by the resistance heating.

(4) Next, a photoresist is formed by photolithography for removing Cr only near the electron emitting section 25 μm×150 μm.

(5) Then, Cr is removed by a desired dimension by wet etching. The etchant used is cerium ammonium nitrate, perchloric acid solution.

(6) Next, organic palladium (CCP-4230, manufactured by Okuno Pharmaceutical Co.,Ltd.) is coated on the electron emitting material, which is then baked at approximately 300° C. under atmospheric environment for 12 minutes, such that the electron emitting material is formed over the whole surface.

(7) Cr for patterning the electron emitting material is then etched using the etchant mentioned in above (5) to form the electron emitting material only at desired positions.

(8) Projections at the second layer onward are formed. Firstly, the projection of the second layer is formed as shown in FIG. 23 by EB deposition method or lift-off method (in the same manner as in forming the element electrode) with Cr used as a material for enhancing the adhesiveness to have a film thickness of approximately 50 Å, and with Cu as the modulating electrode material to have a film thickness of approximately 1.0 μm to be shorter by 5 μm from the wiring electrode end.

(9) The projection of the third layer is formed to have a length shorter by 5 μm from the electrode end of the second layer by the forming method, material and composition of the projection of the second layer.

(10) Lastly, a voltage is applied between the element electrodes 203 and 203' to form an electron emitting section in the electron emitting material mentioned in above (7).

A voltage of 1 KV is applied, from outside under a vacuum environment of approximately $2\times10^{-6}$ torr, to the fluorescent plate 205, which is composed of transparent electrodes, fluorescent substance and metal back (not shown) and mounted on the glass substrate disposed at a position of 5 mm above from the electron beam generating apparatus, and to the electron beam generating apparatus composed as mentioned above. And, voltage pulses of 14 V are applied between the element electrodes 203 and 203'.

As a result, spot light corresponding to the electron beam emitted onto the fluorescent plate 205 was observed. The aforementioned spot light could be emitted on the fluorescent plate 205 in the form of shaping and converging the electron beam in the direction perpendicular to the electron emitting section i.e. in the longitudinal direction of the projections, due to these projections formed on the wiring electrodes.

Further, since the width of the projections are sufficiently large, it was possible to realize a state where there is no charge up on the insulating substrate.

Ninth Embodiment

Figure 24:
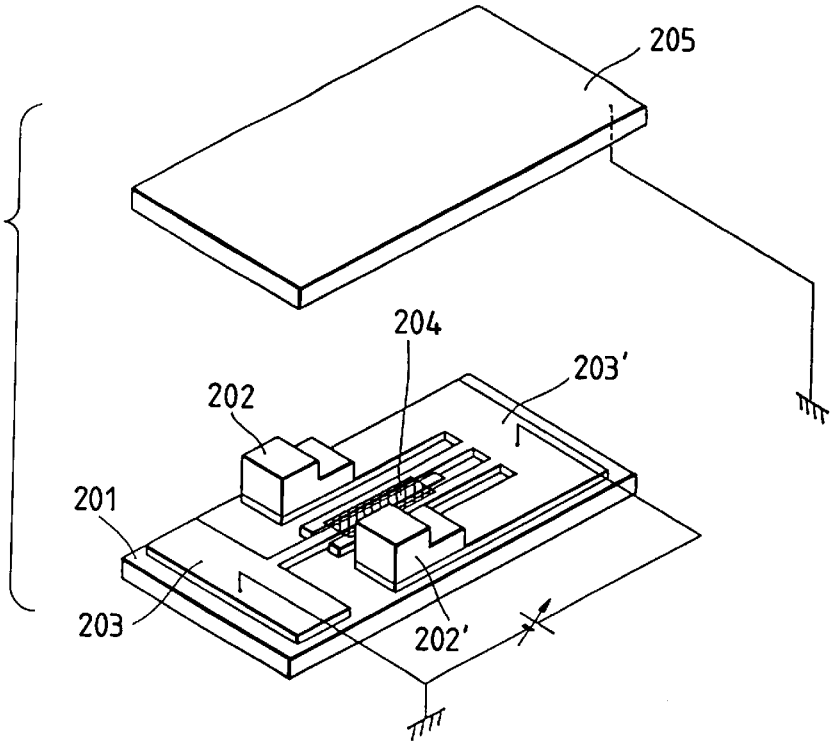

FIG. 24 shows another embodiment of the present invention.

This embodiment is composed substantially in the same manner as in the embodiment shown in FIG. 23. The projecting portion is composed of a first layer formed at a position 25 μm from the element electrode, a second layer formed at a position 50 μm from the wiring electrode end, and further a third layer formed at a position 50 μm from the electrode end of the second layer.

The electron beam generating apparatus composed as mentioned above has been used, in the same composition and manner as in the eighth embodiment, for observing a spot light corresponding to the electron beam emitted by the image display member (face plate) 205. As a result, the electron beam could be irradiated onto the fluorescent substance 205 without deviating toward the positive potential side of the wiring electrodes.

Further, since the width of the projecting portion is sufficiently large, it is possible to totally eliminate any charge-up on the insulating substrate.

Tenth Embodiment

Figure 25:
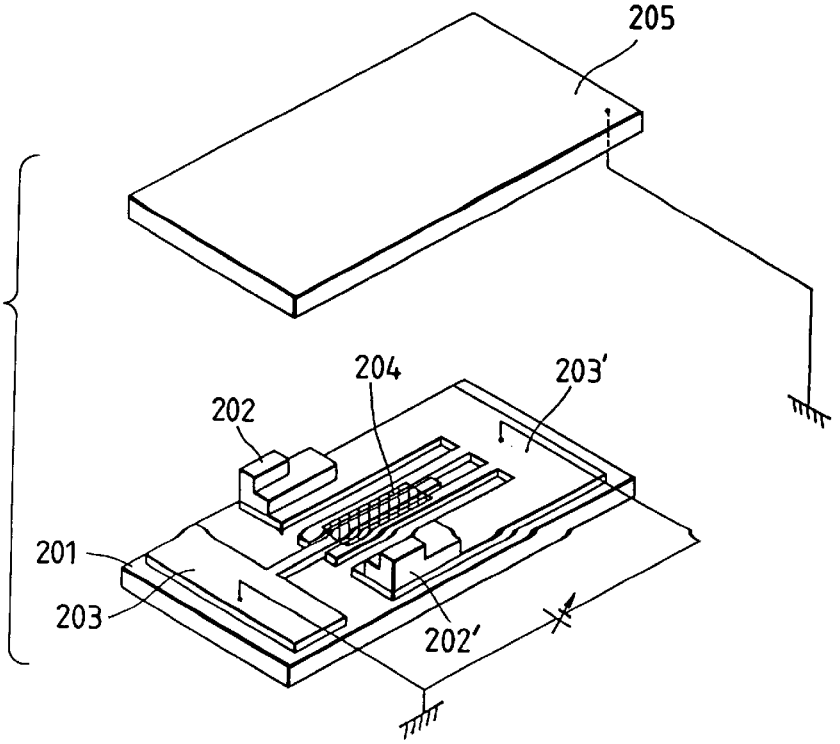

FIG. 25 shows another embodiment of the present invention.

In this embodiment, the apparatus is manufactured by the same processes as in the eighth embodiment. The projecting portion is composed of a first layer formed at a position 25 μm from the element electrode, a second layer formed at a position 5 μm from the electrode end 50 μm from the wiring electrode end, and further a third layer formed in the same manner as the second layer at a position 5 μm and 50 μm from the electrode end, in stage form as shown in FIG. 25.

The electron beam generating apparatus composed as mentioned above is used for observing the spot light corresponding to the emitted electron beam by the image display member (face plate) 205 in the same manner as in the first embodiment. As a result, electron beam directing toward the direction perpendicular to the electron emitting section i.e. in the longitudinal direction of the projecting portion could be shaped, and further the electron beam could be irradiated onto the fluorescent substance 205 without deviating toward the positive potential side of the wiring electrode.

Further, in the same manner as in the eighth and ninth embodiments, since the width of the projecting portion is sufficiently large, it is possible to totally eliminate any charge-up on the insulating substrate.

Eleventh Embodiment

Figure 26:
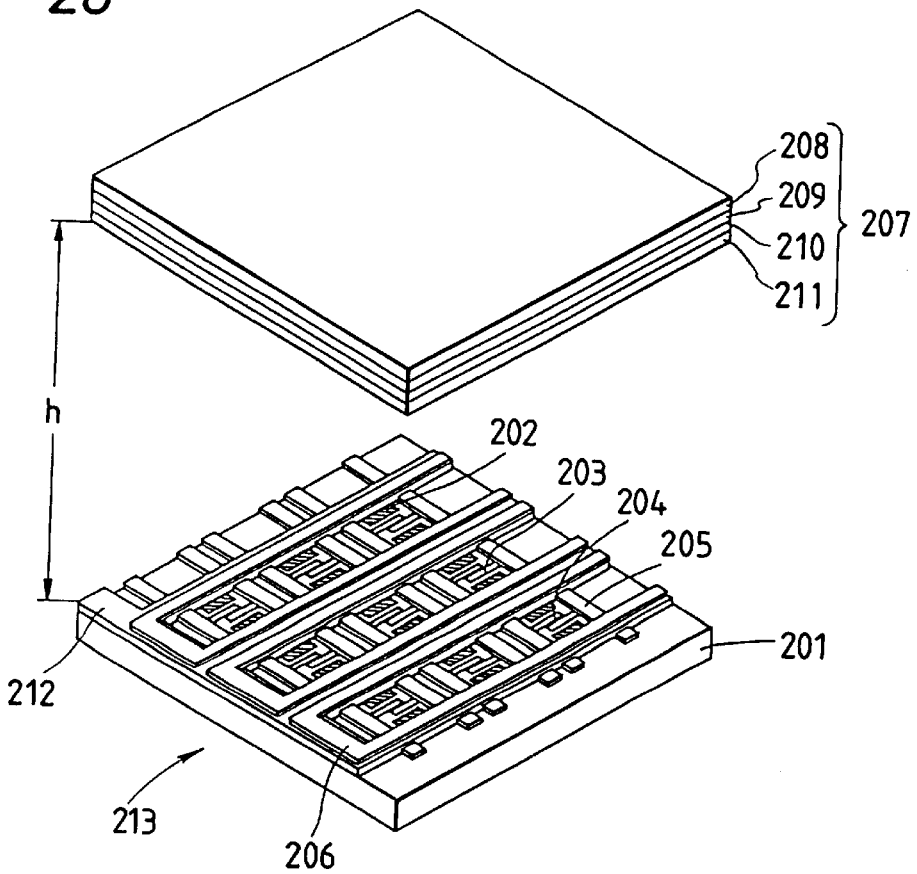
FIG. 26 shows an image-forming apparatus of the present invention.

FIG. 26 is a perspective view showing an image display apparatus according to another embodiment of the present invention. In FIG. 26, the numerals designate respectively: 201, a rear plate; 202, a projecting portion; 203, an element electrode; 204, an electron emitting section; 205, element wiring electrodes; 206, modulating wiring electrodes; 207, a face plate; 208, a glass plate; 209, transparent electrodes; 210, a fluorescent substance; 211, a metal back; 212, an insulating layer for insulating the modulating wiring electrodes and the element wiring electrodes.

A plurality of electron emitting elements are arranged linearly at 2 mm pitch, and a plurality of modulating electrodes (not shown) are perpendicularly intersected with the linear electron emitting elements while insulated from the wiring electrodes. With the other composition being totally the same as that in the eighth embodiment, an electron beam generating apparatus 213 is formed on a blue glass (manufactured by Ichikawa Special Glass Co., Ltd.) as the rear plate 201. The wiring electrodes are formed in the same manner as that used for forming the projecting portion in the eighth embodiment, and only the necessary portion of the insulating layer is mask-deposited by the spattering method.

Next, the face plate 207 having the fluorescent substance 210 as the image forming material is disposed at a position 5 mm (=h ) from the rear plate 201, so as to manufacture an image display apparatus.

A voltage of 1.5 KV is applied to the fluorescent substance surface, and voltage pulses of 14 V is applied to a pair of wiring electrodes 206 to make a plurality of electron emitting elements linearly arranged emit electrons. At the same time, a voltage as information signals is applied to the group of the modulating electrodes to turn the electron beam on and off.

Further, voltage pulses are applied to the contiguous wiring electrode to display one line as aforementioned. These operations are repeated to complete an image for one screen. Namely, the image display is made by forming an X-Y matrix using the wiring electrodes as scanning electrodes and the modulating electrodes.

Twelfth Embodiment

When a similar recording apparatus as in the fourth embodiment shown in FIG. 7 is composed by using the image display apparatus in the eleventh embodiment as a light-emitting source, the same effect could be obtained.

As mentioned above, in the electron beam generating apparatus comprising electron emitting elements having electron emitting sections between the lower potential electrode and the higher potential electrode modulating electrodes for modulating the electron beam emitted from the electron emitting elements, the present invention features to laminate the modulating electrodes on the electron emitting elements through the insulating body and to make each of the lower potential side element wiring electrode have a pair of projections for the respective electron emitting element. As a result, a sufficiently large electron emitting amount can be provided, and the undesirable fluctuation of the electron emitting amount during the operation and the modulating nonuniformity between the electron beams can be remarkably improved.

Further, according to the image display apparatus incorporating the electron beam generating apparatus of this invention, images with high contrast, high lightness and less lightness nonuniformity can be displayed.

Also in the recording apparatus using the electron beam emitting apparatus of the present invention, images with excellent contrast and sharpness can be provided.

Thirteenth Embodiment

In this embodiment, an example of the electron beam generating apparatus will be described with reference FIGS. 27 and 28. FIG. 28 is a cross-sectional view through A—A line in FIG. 27.

Figure 27:
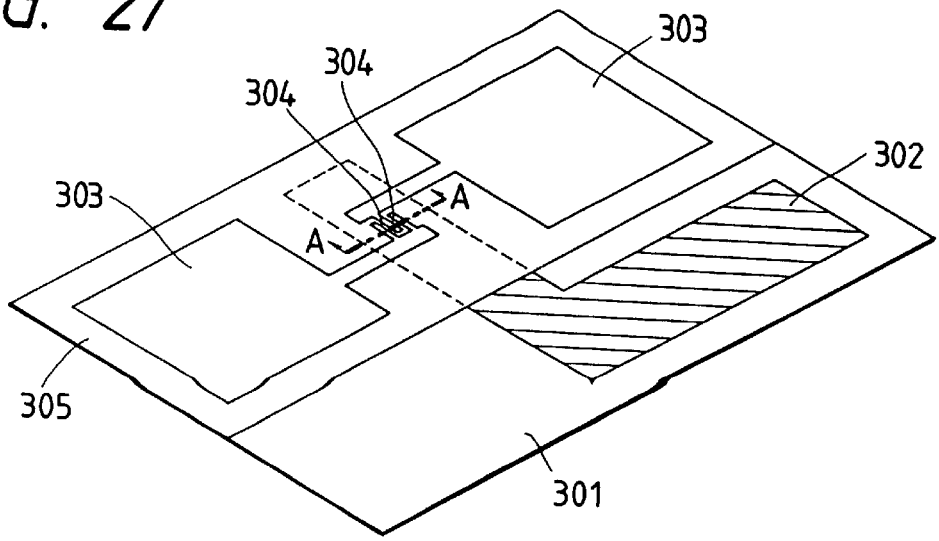
FIGS. 27, 28, and 29 show an electron beam-generating device of Embodiment 2-1 of the present invention.
Figure 28:
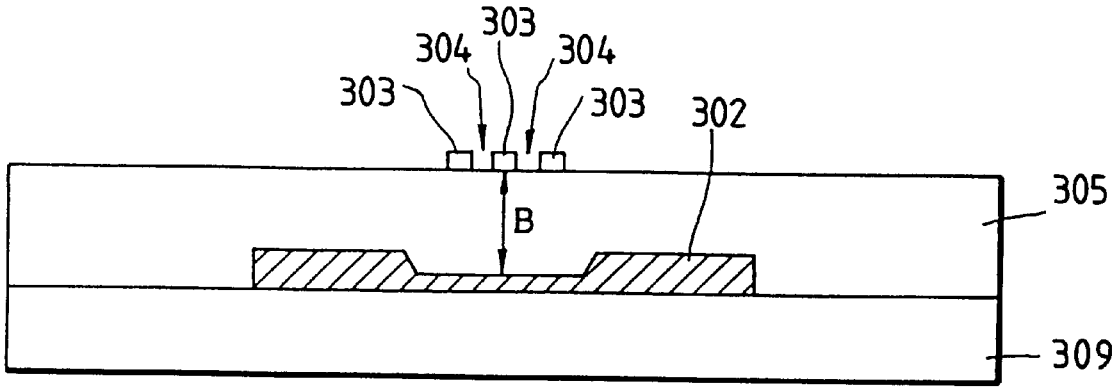

FIG. 27 is a perspective view of the present apparatus, wherein the numerals designate respectively: 301, an insulating substrate; 302, modulating electrodes, characteristic feature of this invention; 303, element electrodes constituting surface-conducting electron emitting element (SCE); 304, electron emitting section thereof; and 305, an insulating layer formed between the electron emitting elements (303 and 304) and the substrate 301, modulating electrodes 302.

In this case, as the substrate any conducting material can be used, but particularly glass, alumina ceramics etc. are preferable. Further, as the modulating electrodes, such conductive materials as gold, nickel, tungsten etc. can be used, but those having a coefficient of thermal expansion as close as possible to that of the substrate material. Further, as the material for the insulating layer, silicon oxide, glass and other ceramics are desirable.

Next, the manufacturing processes for the present apparatus will be described.

(1) Firstly, silicon glass (manufactured by Corning Co., Ltd.) forming the insulating substrate 301 is scrubbed with neutral detergent and well cleaned by ultrasonic cleaning using organic solvent. Thereafter, a resist pattern is formed on the substrate 301 by photolithography.

(2) Next, an underlying material made of Ti (for increasing the adhesiveness) with a thickness of approximately 50 Å and a modulating electrode material made of Ni with a thickness of approximately 5000 Å are deposited totally on the regist pattern, and thereafter a modulating electrode pattern 302 with an width of approximately 2 mm is formed.

(3) Subsequently, using photolithography, a resist pattern for making the modulating electrode laster partly thinner is formed by photolithography.

(4) Ni forming lower portion of the electron emitting elements (303, 304) is etched by approximately 4000 Å (FIG. 28). As the etchant, persulfuric acid ammonium or nitride aqueous solution etc. is used.

(5) Then, the regist is exfoliated to form a desired modulating electrode pattern 302 having an width of 2 mm, a thicknesses of approximately 5000 Å at one side from the center and of approximately 1000 Å at the other side.

(6) SiO2 as the insulating layer 305 is mask-deposited approximately by 3 μm at necessary portions by spattering.

(7) After portions not covered with SiO2 is protected in advance, the surface of SiO2 is flattened by ion-milling. The thickness of B portion in FIG. 28 at this time was approximately 1.5 μm.

(8) In totally the same manner as in the modulating electrode pattern forming method of above (2), an element electrode pattern 303 of SCE with a gap upward from the modulating electrodes 302. The element electrode width at this time was 15 μm, the electrode gap was 2 μm.

(9) Cr for patterning the electron emitting material mentioned later is deposited with a thickness of approximately 1000 Å over the whole surface by resistance heating method.

(10) A resist pattern for removing Cr only near the electron emitting section 304 (10 μm×150 μm) by photolithography.

(11) Desired Cr is removed by etching. As the etchant, nitride cellium ammonium or perichloric acid aqueous solution is used.

(12) Organic palladium as the electron emitting material (manufactured by Okuno Pharmaceutical Co., Ltd. with a trade name of CCP-4230) is dispersed and coated over the substrate, which is then baked at up to 300° C. under atmospheric environment for 12 minutes.

(13) Cr for patterning the electron emitting material is etched out by use of the etchant noted in above (11).

(14) Lastly, a voltage is applied between the element electrodes to form the electron emitting section.

In thus manufactured electron beam generating apparatus, a fluorescent plate is mounted at a position 5 mm upward from the apparatus, the total system is put under an environment of approximately $2\times10^{-6}$ Torr, and a voltage of 1 kV is applied to the fluorescent plate from outside, and voltage pulses of 14 V are applied between the element electrodes 203. Accordingly, spot light corresponding to the electron beam emitted toward the fluorescent plate has been observed.

Figure 31:
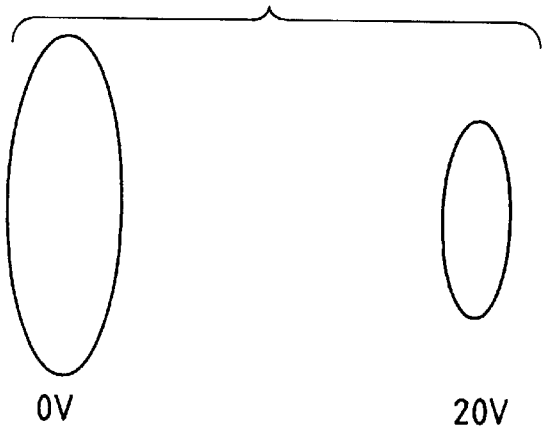

Further, when a voltage ranging −40 V to +30V is applied to the modulating electrodes 302, not only the electron beam amount is continuously changed in response to the modulating voltage, but also the beam shape is changed at a voltage equal to or exceeding 0 V as shown in FIG. 31. In this case, the electron emitting section is formed on a region at the side of the modulating electrode thickness of 5000 Å. Further, it is possible to turn the electron beam off with the modulating voltage not exceeding −40 V while to turn it on with the modulating voltage equal to or more than +30 V.

Fourteenth Embodiment

Figure 29:
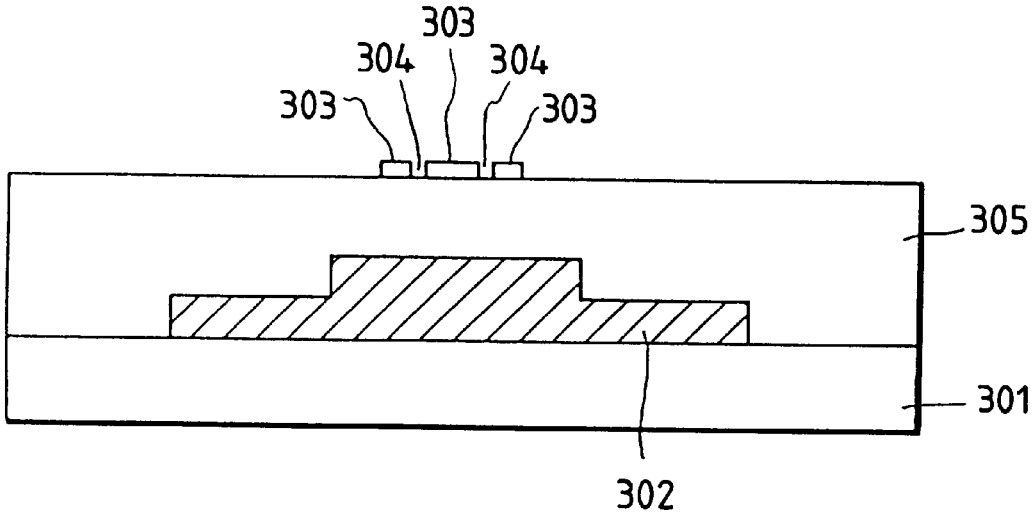

An electron generating apparatus as shown in FIG. 29 is manufactured using similar typical photolithography as used in the thirteenth embodiment. But, the $L_1$ and $L_2$ are set to 2.0 μm and 1.0 μm respectively.

When an estimation similar to that in the thirteenth embodiment is made, the electron beam could be turned off at −30 V and on at +25V. Further, not only the beam amount is continuously changed in response to the modulating voltage, but also a highly converged beam shape could be obtained at a voltage not exceeding 0 V than at a voltage equal to or more than 0 V.

15th Embodiment

In this embodiment, an image display apparatus having a plurality of electron beam generating apparatus as based on the technical concept of the 13th embodiment are arranged, and an image display section diposed above these electron beam generating apparatuses. In this embodiment, the film thicknesses of both the modulating electrodes and the insulating layer are changed, but alternatively it is also possible, not limited thereto, to change only the thickness of the insulating layer while maintaining the thickness of the modulating electrodes constant so as to provide the same advantages.

Figure 32:
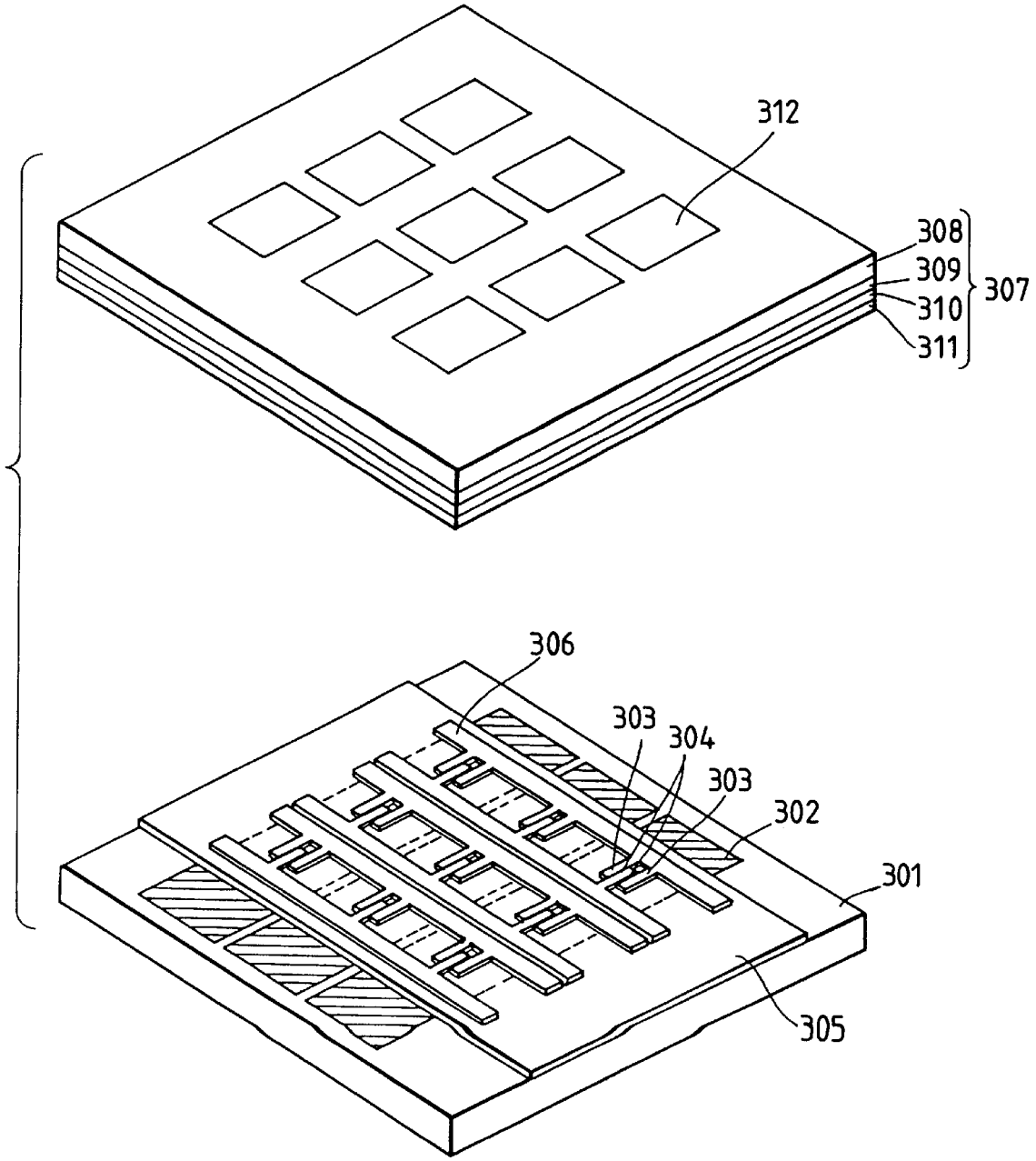
FIG. 32 shows an image-forming apparatus of the present invention.

FIG. 32 shows the present embodiment. In FIG. 32, the numerals designate respectively: 301, an insulating substrate; 302, a modulating electrode; 305, an insulating layer; 306, wiring electrodes; 303, element electrodes of SCE-type electron source; 304, electron emitting section; all of which constitute a single linear electron source. Further, the numerals designate respectively: 307, a face plate composed of a glass plate 308, a transparent electrodes 309, a fluorescent substance 310, and a metal back 311 which are sequentially laminated; and 312, a position of spot light.

In manufacturing such an apparatus, firstly the linear electron sources composed of SCE-type electron emitting elements linearly arranged (2 mm pitch) between the wiring electrodes 306 are arranged further with 2 mm pitch, and each of a plurality of modulating electrodes 302 are arranged to perpendicularly intersect and correspond to the each row of the linear electron emitting elements. Further, Cu as the wiring electrodes 306 is laminated with a thickness of 2 μm. With the other composition is the same as in the 13th embodiment, the electron beam generating apparatus is formed on a blue plate glass (manufactured by Ichikawa Special Glass Co., Ltd.) as the insulating substrate 301.

Next, the face plate 307 having the fluorescent substance 310 as image forming material is diposed at a position 5 mm apart from the substrate 301 (the surrounder is not shown) to compose the image display apparatus in multi-elements structure of 20 column×20 rows.

In the image display apparatus as mentioned above, a bias voltage of 1.5 KV is applied to the fluorescent substance surface and voltage pulses of 14 V are applied to a pair of wiring electrodes 306 to make the electron emitting elements linearly arranged emit electron. Further, at the same time, a voltage as information signals is applied to the group of the modulating electrodes 2 to turn the electron beam on and off.

Further, voltage pulses are applied to the contiguous wiring electrode 306 to make aforementioned display for one line. By sequentially repeating these operations, an image for one screen is displayed. Namely, an image could be displayed by forming an X-Y matrix composed of the wiring electrodes 306 as scanning electrodes and the modulating electrodes 302.

As mentioned above, since the electron emitting elements and the modulating electrodes are integrally formed, the aligning operation can be readily carried out, so as to provide an image display apparatus in thinner form with high lightness. Further, due to the thicker insulating layer 305 of the lower portion of the electron emitting element, the elements can be easily shaped (converged and dispersed). In addition, since the thin film manufacturing technique is used, a large-sized with highly refined display can be inexpensively obtained. Furthermore, since the space between the electron emitting section and the modulating electrodes can be made highly accurate, an image display apparatus having an excellent uniformity without any lightness nonuniformity.

16th Embodiment

In this embodiment, an optical signal supplying apparatus incorporating the electron beam generating apparatus shown in the 15th embodiment will be described.

For manufacturing such an apparatus, in the electron beam generating apparatus obtained by the 15th embodiment, a face plate having a fluorescent substance 310 emitting light upon collision of electrons therewith is disposed at a position 5 mm above the substrate for constituting the optical signal supplying apparatus.

In this apparatus, a bias voltage of 1.5 KV is applied to the fluorescent surface, and voltage pulses of 14 V are applied to a pair of wiring electrodes to make a plurality of linearly arranged electron emitting elements emit electrons. In addition, a voltage ranging +30 V to −40 V as information signals is applied to the modulating electrodes to turn the electron beam on and off.

Figure 33:
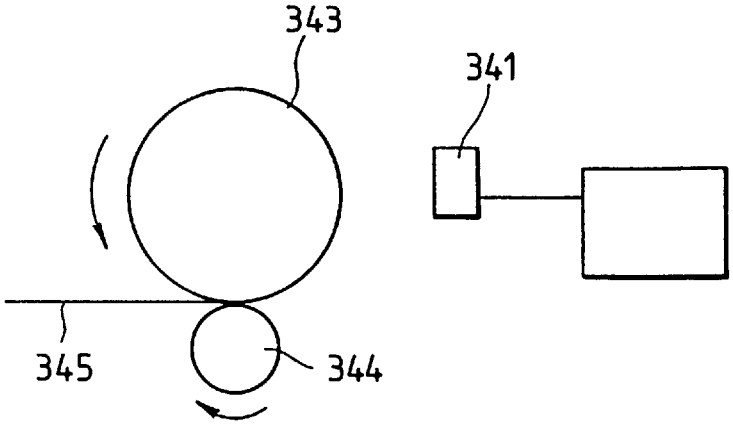
FIG. 33 shows a recording apparatus of the present invention.

With the aforementioned method, for example in the apparatus composed as shown in FIG. 33, when electrical signals are supplied as external information to the optical signal supplying apparatus 341, the electrical signals are converted into optical signals, and as pixel signals reaches the photosensitive paper 345 on the drum 343 as light-receiving element. Furthermore, by moving the paper 345 by the rotation of the drums 343, 344, it is possible to form a desired image on the photosensitive paper.

As explained above, according to this embodiment, since the modulating electrodes and the electron emitting elements are integrally formed on the substrate, and the film thickness of the insulating layer is set to be a value different from that of other regions, the following advantages can be obtained:

(1) The electron source and the modulating electrodes can be easily aligned. Therefore, number of rejects due to e.g. mis-alignment etc. is reduced such that the yield of the fabrication procedure can be improved;

(2) By converting the direction of the voltage to be applied to the modulating electrodes, the electron flow can be converged or dispersed;

(3) In image display apparatus and optical signal supplying apparatus, it is possible to provide highly refined image display and optical signals with less display nonuniformity or light-emitting nonuniformity.

17th Embodiment

Figure 35:
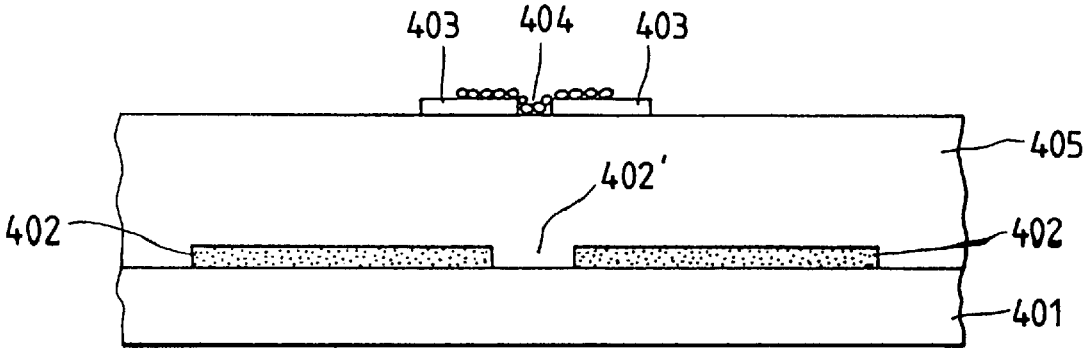
FIGS. 34 and 35 show an electron beam-generating device of Embodiment 2-2 of the present invention.

In this embodiment, an example of the electron beam generating apparatus will be described with reference to FIGS. 34 and 35.; FIG. 35 is a cross-sectional view through a line A—A in FIG. 34.

Figure 34:
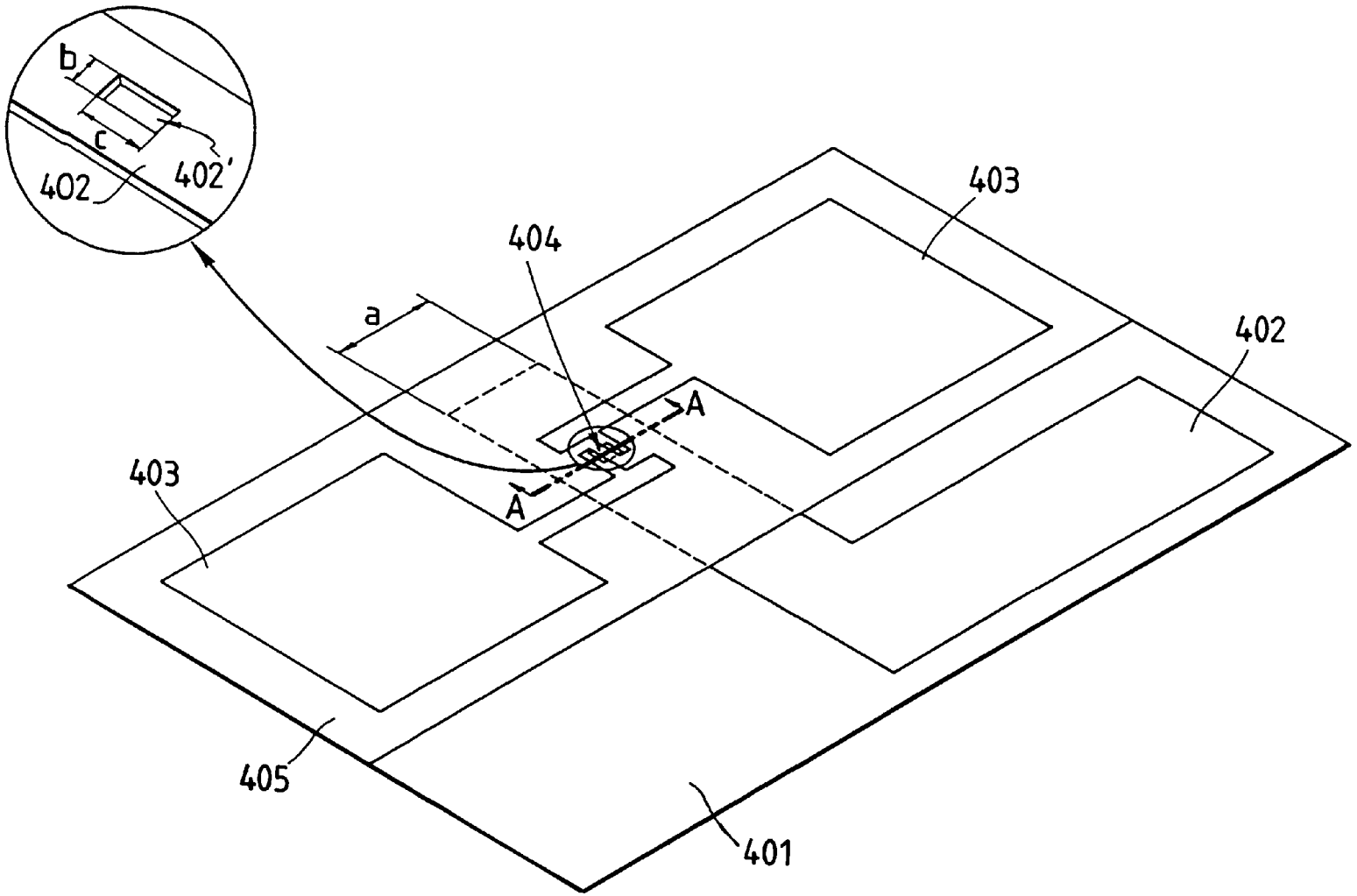

FIG. 34 is a perspective view of the present apparatus, wherein the numerals designate respectively: 401, an insulating substrate; 402, modulating electrodes being characteristic feature of the present invention; 403, element electrodes constituting surface-conducting electron emitting element (SCE); 404, an electron emitting section thereof; 5, an insulating layer formed between the electron emitting elements 403, 404 and the substrate 401, the modulating electrodes 402.

In this case, any material having insulating property can be used as the substrate material, and glass, alumina ceramics etc. are preferable. As the modulating electrode material, any conducting material such as gold, nickel and tungsten can be used, but those having a coefficient of thermal expansion as close as to that of the substrate material are preferable. Further, as material forming the insulating layer, silicon oxide, glass and other ceramics materials are desirable.

Next, the manufacturing processes for the present apparatus will be described.

(1) Firstly, silicon glass (manufactured by Corning Co., Ltd.) as the insulating substrate 401 is scrubbed with neutral detergent and well cleaned by ultrasonic cleaning using organic solvent, and resist pattern is then formed on the substrate 401 by photolithography.

(2) Ti as underlying material (for increasing the adhesiveness) with a thickness of approximately 50 Å and Ni as the modulating electrode material with a thickness of approximately 950 Å are deposited by resistance heating method over the whole resist pattern. Thereafter, a modulating, electrode pattern 402 having an width (a) of approximately 2 mm and a hole of 40 $\mu$m×200 $\mu$m (b×c) is formed.

(3) $SiO_2$ film as the insulating layer 405 is mask-deposited with a thickness of approximately 1.5 $\mu$m on a part of the upper surface of the modulating electrodes 402 and the substrate 401.

(4) In the totally same manner as in the modulating electrode pattern forming method in above (2), an element electrode pattern 403 of SCE with a gap above the hole 402' of the modulating electrodes 402 is formed. The element electrode width is 15 $\mu$m, and the electrode gap is 2 $\mu$m.

(5) Cr for patterning an electron emitting material mentioned later is deposited over the whole surface with a thickness of approximately 1000 Å by resistance heating method.

(6) A resist pattern for removing Cr only near the electron emitting section 404 (25 $\mu$m×150 $\mu$m) is formed by photolithography.

(7) Desired part of Cr is removed by etching, using cerium ammonium nitrate, perchloric acid solution as etchant.

(8) Organic palladium (manufactured by Okuno Pharmaceutical, trade name CCP-4230) is dispersed and coated on the substrate which is then baked under atmospheric environment at a temperature up to 300° C. for 12 minutes to form a thin film over the whole surface thereof.

(9) Cr for patterning the emitting material is etched out by use of the etchant in above (7).

(10) Lastly, a voltage is applied between the electrodes 403, and the thin film mentioned in above (8) is energized to form the electron emitting section.

Thus composed electron beam generating apparatus is used, the fluorescent substance is disposed at a position 5 mm above the apparatus, the whole system is put under an environment of approximately $2\times10^{-6}$ Torr, a voltage of 1 kV is applied to the fluorescent plate from outside, and voltage pulses of 14 V are applied between the element electrodes 403. As a result, spot light corresponding to the electron beam emitted toward the fluorescent plate is observed.

Further, when a voltage ranging −40 V to +30V is applied to the modulating electrodes 402, the electron beam amount has been continuously changed in response to the modulating voltage. Further, for the modulating voltage at this time, it has been possible to turn the electron beam on at not exceeding −40 V and off at equal to or more than +30 V. Further, even if the hole 402' of the modulating electrodes is larger than the electron emitting region, no significant problem arose in the modulating function.

On the other hand, a similar spot light observation was carried out using an electron beam generating apparatus manufactured by totally the same conditions as aforementioned case except that the hole 402' of the modulating electrode 402 is not formed. As a result, at the initial stage the same result was rendered, but as the time passes the lightness became dispersed and the electron emitting section degraded. While there was no change in the apparatus having the hole 402' when driven at approximately 500 Hr, in the apparatus without the hole 402' the spot light significantly changed when the apparatus is driven at approximately 300 Hr.

18th Embodiment

In this embodiment, there is described an image display apparatus in which a plurality of electron beam generating apparatus based on the concept of 17th embodiment are arranged and an image display section is formed thereon.

Figure 36:
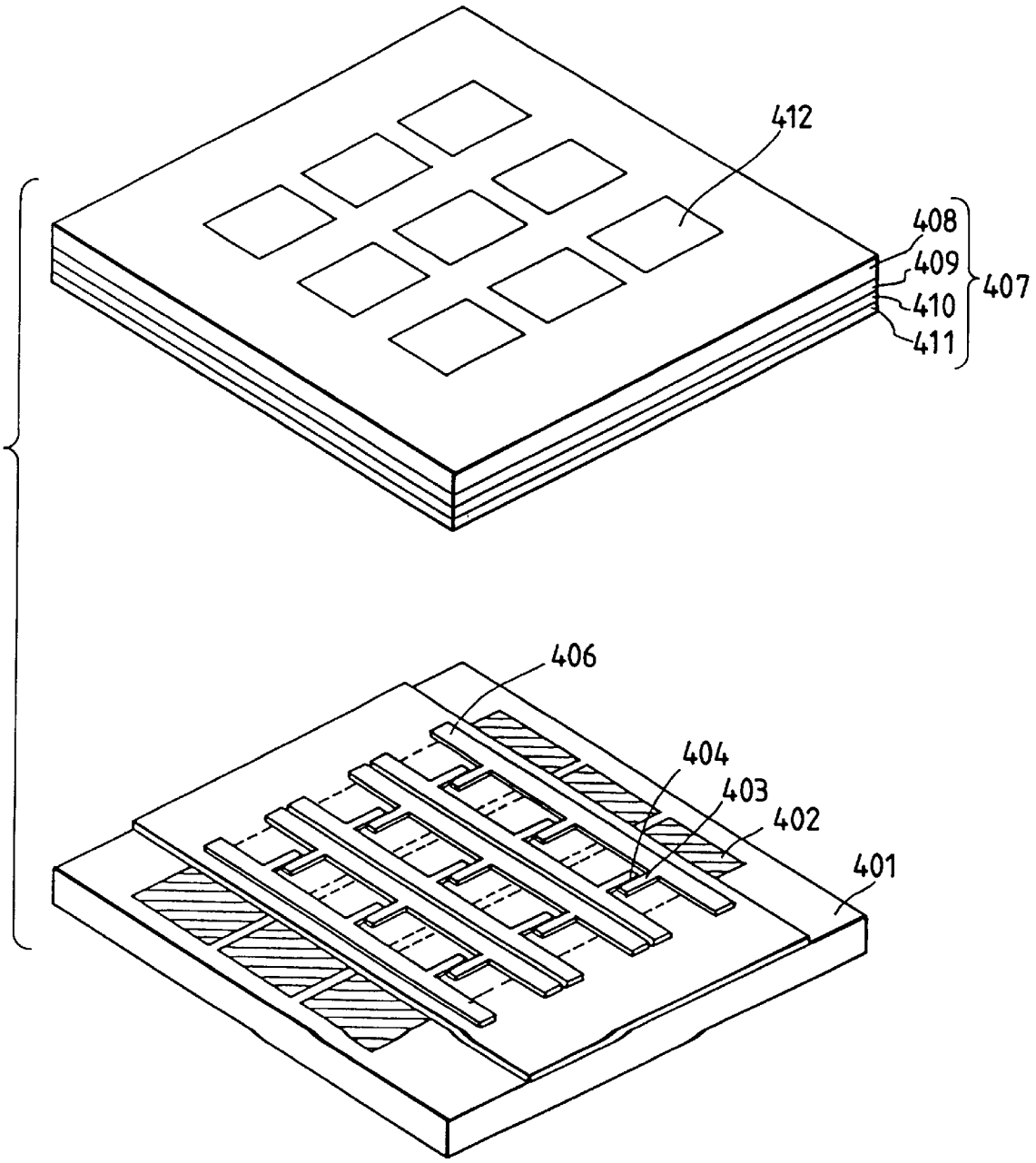
FIG. 36 shows an image-forming apparatus of the present invention.

FIG. 36 is a diagram showing the present embodiment. In FIG. 36, the numerals designate respectively: 401, an insulating substrate; 402, modulating electrodes having holes 402' as shown in the 17th embodiment; 406, wiring electrodes; 403, element electrodes of SCE-type electron source; 404, an electron emitting section. These components constitute a single linear electron source. Further, the numerals designate respectively: 407, a face plate composed by sequentially laminating a glass plate 408, a transparent electrode 409, a fluorescent substance 410, and a metal back 411; and 412, a spot light position.

In manufacturing such an apparatus, firstly a plurality of linear electron sources composed by a plurality of SCE-type electron emitting elements linearly arranged between the wiring electrodes at 2 mm pitch are arranged at 2 mm pitch. A plurality of modulating electrodes 402 are intersected perpendicularly to the corresponding rows of the linear electron emitting elements. Cu as the wiring electrodes 406 is laminated with a thickness of 2 $\mu$m. With the other composition totally the same as in the 17th embodiment, an electron beam emitting apparatus is formed on a blue plate glass (manufactured by Ichikawa Special Glass Co., Ltd.) as the insulating substrate 401.

Next, the face plate having a fluorescent substance 410 as an image forming material is located at a position 5 mm apart from the substrate 401 (surrounder is not shown) to compose the image display apparatus, which has a multi-elements structure of 20 column×20 rows.

In the image display apparatus composed as mentioned above, a bias voltage of 1.5 KV is applied to the fluorescent substance surface and voltage pulses of 14 V are applied to a pair of wiring electrodes 406 to make the linearly arranged electron emitting elements emit electrons. At the same time, a voltage as information signals is applied to the group of the modulating electrodes 402 to turn the electron beam on and off.

Further, voltage pulses are applied to the contiguous wiring electrode 406 to perform the aforementioned one-line display. An image for one screen is displayed by sequentially repeating these operations. Namely, an image can be displayed by forming an X-Y matrix with the wiring electrodes 406 as scanning electrodes and the modulating electrodes 402.

As mentioned above, according to the present embodiment, since the electron emitting elements and the modulating electrodes are integrally formed, the positional alignment can be easily carried out so as to provide thin and high-lightness type image display apparatus. Further, since no modulating electrode is provided immediately below the electron emitting section, the life of the elements can be prolonged. Further, since thin film manufacturing technique is used as the manufacturing art, it is possible to provide a large-screen and highly refined display at low cost. In addition, since the spatial accuracy between the electron emitting section and the modulating electrodes can be quite improved, an image display apparatus without any lightness nonuniformity can be obtained.

19th Embodiment

In this embodiment, an optical signal supplying apparatus incorporating the electron beam generating apparatus as shown in the 18th embodiment will be described.

In manufacturing such an apparatus, the optical signal supplying apparatus is composed by mounting a face plate having a fluorescent substance emitting light in response to the collision of electrons at a position 5 mm above the substrate.

In this apparatus, a bias voltage of 1.5 KV is applied to the fluorescent substance surface voltage pulses of 14V are applied to a pair of wiring electrodes to make linearly arranged electron emitting elements emit electrons. Further, at the same time, a voltage ranging +30 V to −41 V as information signals are applied to the modulating electrodes to turn the electron beam on and off.

In accordance with aforementioned method, when electrical signals as external information are applied to the optical signal supplying apparatus in the apparatus composed as shown in FIG. 33, for example, the electrical signals are converted into optical signals and reach, as pixel signals, a photosensitive paper 345 on a drum 343 being a light receptor. Further, a desirable image can be formed on the photosensitive paper by rotating the drums 343 and 344.

As mentioned above, by integrally forming the modulating electrodes and the electron emitting elements on the substrate and not providing any modulating electrode at least immediately below the electron emitting section, the following advantages can be provided:

(1) The electron source can be easily aligned with the modulating electrodes such that the yield of products is enhanced by reducing the number of rejects due to misalignment etc.;

(2) Undesirable effect of the modulating electrodes on the electron emitting section is reduced to long the life of the elements;

(3) The insulating layer inserted between the electron emitting element and the modulating electrode can be thinner;

(4) Due to above (3), the modulating electrodes can be driven at low voltage; and (5) In image display apparatus and optical signal supplying apparatus, image display and optical signals with highly refined degree without display or light-emitting nonuniformity can be provided.

20th Embodiment

Figure 38:
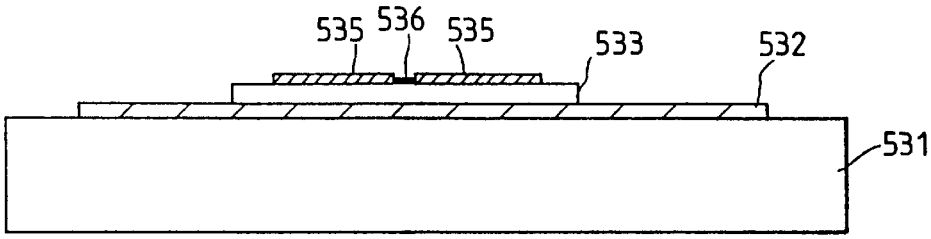
FIGS. 38, 40A–40E, 41A–41B, and 42A–42B show an electron beam-generating device of Embodiment 2-2 of the present invention.

In this embodiment, an example of the electron beam generating apparatus and the image display apparatus will be described with reference FIGS. 37, 38 and 40. FIG. 37 is a perspective view of the composition of the apparatus, FIG. 38 is a partial cross-sectional view thereof, FIG. 40 shows an example of a manufacturing method according to this embodiment. In FIGS. 37, 38 and 40, the numerals designate respectively: 531, a glass substrate; 532, modulating electrodes; 533, insulating layer; 534 (and 534-*a*, 534-*b*), element wiring electrodes.

An example of a manufacturing method of the electron beam generating apparatus according to this embodiment will be described with reference FIG. 40.

(1) Firstly, the glass substrate 531 is well washed, and a group of linear modulating electrodes 532 is formed typically by deposition and photolithography. Instead of glass, other insulating materials such as alumina ceramics etc. can be used as the substrate 531. Further, the modulating electrode 532 can be made of conductive material such as gold, nickel, tungsten etc., but those having a coefficient of thermal expansion as close as possible to that of the substrate.

The modulating electrode in this embodiment is formed of nickel material, and a group of modulating electrodes with 1.6 mm of width and 2 mm pitch.

(2) Next, an insulating layer 533 is made of SiO2 by deposition. As a material of the insulating layer 533, SiO2, glass and other ceramics materials are preferable. In this embodiment, the thickness is set to 10 $\mu$m.

(3) The element electrodes 535 and the element wiring electrodes 534 (not shown in the cross-sectional view) are formed of Ni material by deposition and etching. The element electrodes 535 are connected to the element wiring electrodes 534-*a* and 534-*b* to form opposed electron emitting sections 536. The electrode gap (G) is set to 2 $\mu$m in this embodiment. The length (l in FIG. 3) corresponding to the electron emitting section 536 is set to 300 μm. The width of the element electrodes 535 are set to 20 μm. Further, the electron emitting section 536 is formed near the center of the width of the modulating electrodes 532. The pitch of the group of the element wiring electrodes 534 is set to 2 mm, the pitch of the electron emitting section 536 is set to 2 mm.

(4) Subsequently, an amicron film is formed between the opposed electrodes by gas deposition and is then energized to form the electron emitting section 536. When the material of amicron film is Pd, the diameter of the Pd particle is set to approximately 100 Å.

(5) An insulating layer 533 near the element electrodes 535 is removed in the form of square by photolithography and etching. The distance from the removed square portion to the element electrode 535 is set to 5 μm.

The face plate 510 having the fluorescent substance 509 is mounted at a position 5 mm apart from the glass substrate of the electron beam emitting apparatus composed by the aforementioned processes to complete the image display apparatus.

Next, a method for driving the present apparatus will be described.

The voltage at the fluorescent substance surface is set to 0.8 kV–1.5 kV. In FIG. 37, voltage pulses of 14 V is applied to a pair of element wiring electrodes 534-*a* and 534-*b* to make the linearly arranged electron emitting elements emit electrons. The emitted electrons act to turn the electron beam on and off by applying a voltage to the group of modulating electrodes in response to information signals. The electrons emitted from the electron emitting section 536 are accelerated and collide with the fluorescent substance which performs one-line display in accordance with the information signals. Voltage pulses of 14 V are then applied to the contiguous element wiring electrodes 534-*a* and 534-*b* for performing aforementioned one-line display. By executing sequentially these operations, an image for one screen is displayed. Namely, an image is displayed by forming an X-Y matrix with the element wiring electrodes as scanning electrodes and the modulating electrodes.

The cut-off voltage in this embodiment will now be mentioned. In case of not removing the insulating layer 533 in square form, the voltage applied to the modulating electrodes 532 for turn the electron beam off i.e. the cut-off voltage was −42 [V]. Meanwhile, in this embodiment, the cut-off voltage is −35 [V] and the absolute value of the cut-off voltage was reduced.

In this embodiment, the insulating layers at both sides of the element electrodes (higher potential side and lower potential side), but alternatively it is also possible to remove the insulating film only at one side to render the same advantage.

As described above, according to this embodiment, since the electron emitting elements and the modulating electrodes are laminated through the insulating layer, the alignment can be easily carried out. Further, due to the use of thin film manufacturing art, a display of large size with highly refined degree can be provided at low cost. Moreover, the spatial accuracy between the electron emitting section 536 and the modulating electrodes 532 is significantly enhance, such that highly uniform image display apparatus without any lightness nonuniformity can be obtained. In addition, the lightness contrast of the display image is excellent.

21st Embodiment

Figure 41A:
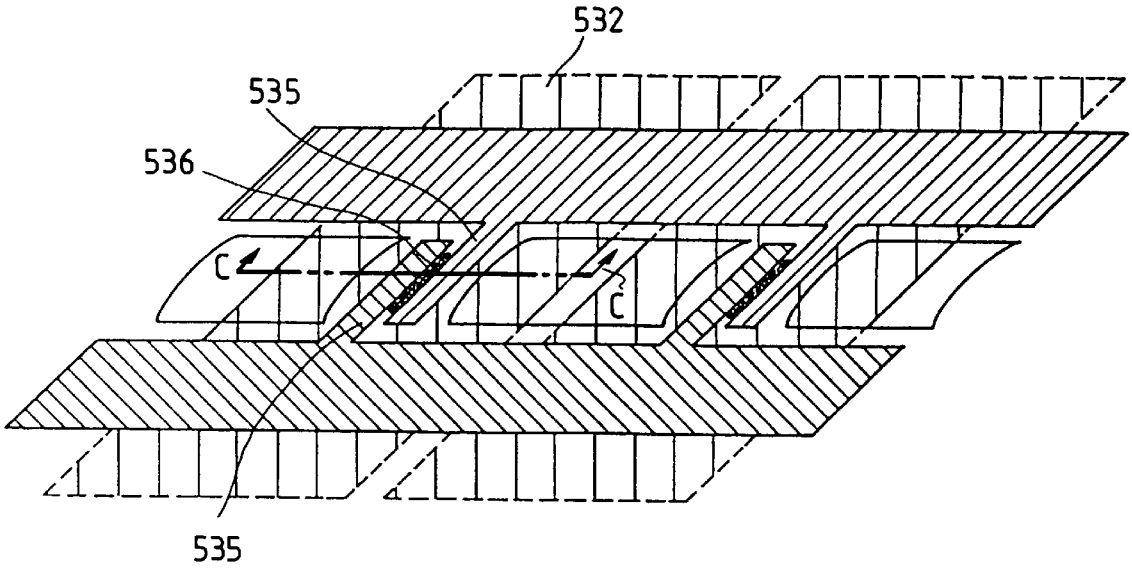
Figure 41B:
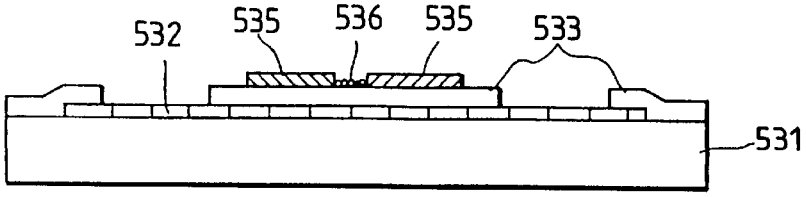

A 21st embodiment of the present invention will be described with reference to FIG. 41. In this embodiment, the insulating layer 533 is removed in convex form along the higher potential side element electrodes. As a result, the beam form on the face plate 510, which was elliptical when the removing shape of the insulating layer 533 is square, changes to square. Namely, it has been confirmed that the beam can be shaped depending on the removed shape of the insulating layer 533.

22nd Embodiment

Figure 42A:
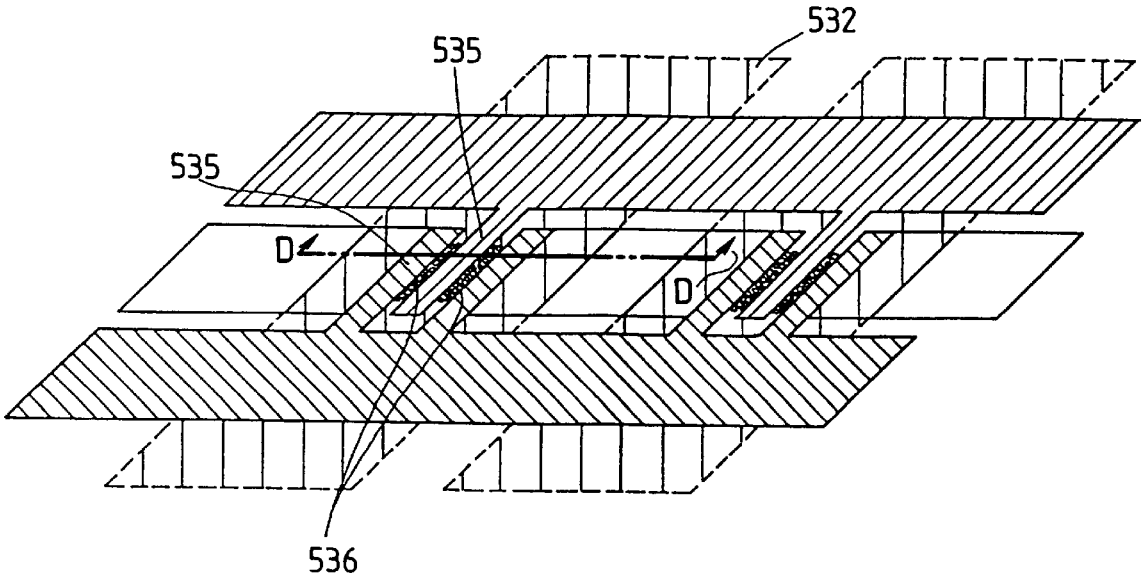
Figure 42B:
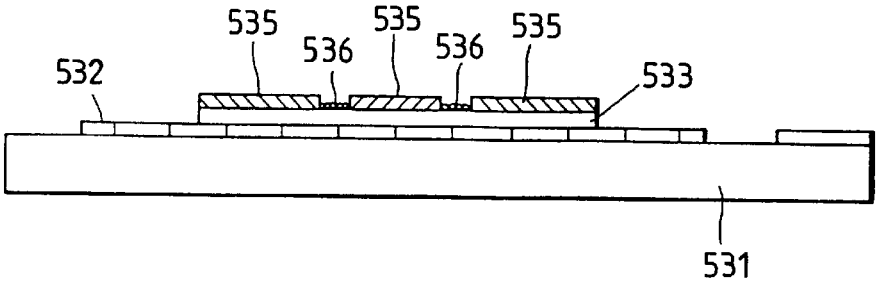

A 22nd embodiment of the present invention will be described with reference to FIG. 42. In this embodiment, the removed portion of the insulating layer 533 is disposed as close as possible to the element electrode portion. As a result, the effect of the voltage of the modulating electrodes could easily act near the electron source.

23rd Embodiment

A 23rd embodiment of the present invention is composed in the same manner as in the 3rd embodiment except in using the display apparatus in 20th embodiment. According to this embodiment, by using surface-conducting electron emitting elements as the electron emitting elements, a remarkably improved optical signal supplying apparatus having not only high-lightness and high refined degree but also very high switching speed could be provided.

24th Embodiment

An optical printer according to this embodiment has been composed in the same manner as in the 4th embodiment except in using the display apparatus of the 20th embodiment as the light-emitting source.

According to this embodiment, the recording apparatus has, in particular, high resolution and high speed operation characteristics and can provide high contrast and clear image without any exposure nonuniformity.

As mentioned above, since the modulating electrodes, insulating layer and the electron emitting elements are sequentially laminated on the insulating substrate, and the modulating electrodes are exposed by removing a part of the insulating layer for insulating the electron emitting elements from the modulating electrodes, the electron emitting elements and the modulating electrodes can be easily aligned, rendering the following advantages:

(1) High-lightness image can be obtained without any display nonuniformity;

(2) Large capacity display can be made;

(3) Since the thin film technique can be used as manufacturing technique, highly refined display can be made;

(4) Image display apparatus can be manufactured at low cost;

(5) The absolute value of the voltage to be applied to the modulating electrodes can be reduced;

(6) The beam form can be shaped depending on the removing shape of the insulating layer; and (7) Exposure of the modulating electrodes by removing the insulating layer serves to prevent the charging up.

25th Embodiment

FIG. 43 is a schematic view showing a composition of a present invention according to 25th embodiment. FIG. 44 is a cross-sectional view through a line A—A in FIG. 43. In the FIGS., the numerals designate respectively: 601, an insulating substrate; 602, element electrodes of surface-conducting electron emitting elements; 603, an electron emitting section; 604, modulating electrodes; 605 (605-*a*, 605-*b*), element wiring electrode; 606, an insulating film; and 607, modulating wiring electrodes;

A linear electron emitting element is formed by arranging a plurality of electron emitting elements (surface-conducting electron emitting elements) having the electron emitting section 603 and the element electrodes 602 between the element wiring electrodes 605-*a* and 605-*b*. The modulating electrodes 604 are disposed with the element electrodes therebetween, and are connected to the modulating wiring electrodes 607 through a contact hole of the insulating film 606 as shown in FIG. 44 (hereinafter referred to as linear modulating electrode). Groups of the linear electron emitting elements and the linear modulating electrodes are formed by arranging a plurality of linear electron emitting elements and the linear modulating electrodes 607 in parallel to each other.

In the present embodiment, there is provided an image display apparatus comprising a face plate 611 having an image forming material as shown in FIG. 45 above the substrate including the electron emitting elements and the modulating electrodes mounted thereon.

The apparatus according to this embodiment features to provide the surface-conducting electron emitting elements and the modulating elements on the same surface of the substrate 601. The width (W) of the element electrodes 602 is preferably set to 1–50 μm, and is in practice desirably set to 3–20 μm, but not limited to such values. Further, if the width (W) of the element electrode is smaller, the voltage to be applied to the modulating electrode 604 can correspondingly be smaller, but when the width (W) becomes less than the aforementioned range, the resistance of the element electrode would undesirably be increased. The gap between the element electrodes 602 as the electron emitting section 603 is practically 0.5–5 μm, but not limited thereto. Subsequently, organic palladium CCP-4230 manufactured by Okuno Pharmaceutical Co., Ltd. is dispersed and coated on the substrate and then baked under atmospheric circumstance at 300° C. such that mixed particle film composed palladium particles and palladium oxide particles is formed and energized, thereby constituting the electron emitting section. But any other methods, alternatively, may be used. The space (S) between the element electrodes 602 and the modulating electrodes 604 is preferably set to be as small as possible so long as the electrical insulating between the electrodes can be made, preferably less than 30 μm, and in practice more preferably 5–20 μm. This space (S) significantly relates to the voltage to be applied to the modulating electrodes 604. Namely, the voltage to be applied to the modulating electrodes 604 increases proportionally to the increase of the space (S). Further, the length (l) of the electron emitting section 603 shown in FIG. 43 is the mutually faced length of the element electrodes 602, and the electrons are emitted uniformly from the whole length (l). The width (L) of the modulating electrode 604 must be longer than the length (l) of the electron emitting section 603. For example, if the length (1) of the electron emitting section 603 is 50–150 μm, the width (L) of the modulating electrode should be practically 100–200 μm, depending on the width (W) of the element electrode and the space (S) between the element electrode and the modulating electrode.

Next, the component materials of the present embodiment will be described. As the insulating substrate 1, glass material is generally used, but alternatively any insulating material such as SiO2 or alumina ceramics can be used. The element electrodes 602 and the modulating electrodes 604 are preferably made of metal materials such as gold and nickel etc., but any other conductive materials can be used. The insulating film 606 is typically formed of insulating film such as SiO2 etc., but any other materials can be used so long as capable of insulating the element wiring electrode 5 from the modulating wiring electrode 607.

A method for manufacturing the electron beam generating apparatus and the image display apparatus according to this embodiment will now be described with reference to FIG. 46.

Figure 46A:
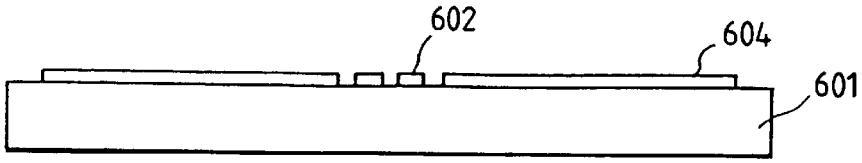

(1) The glass substrate 601 is well washed, and element electrodes 602 and the modulating electrodes 604 are formed by typically deposition and photolithography (FIG. 46A). In this case, nickel is used as the electrode material, but any other conducting materials can be used instead thereof. The gap (G) between the element electrodes is 2 μm, the element electrode width (W) is 10 μm, the magnitude (W1) of the electron emitting element is 22 μm, the distance (S) between the element electrode 602 and the modulating electrode 604 is 5 μm, the length (l) of the electron emitting section is 150 μm, the width (L) of the modulating electrode is 220 μm, and the magnitude (W2) of the modulating electrode is 500 μm. In this embodiment, the element electrodes 602 and the modulating electrodes 604 are formed by the same processes i.e. by the same materials, but it is also possible to use mutually different materials. All the electron emitting elements, the linear electron source, and the linear modulating electrodes are set to 1 mm pitch, respectively.

The element wiring electrodes 605 for simultaneously driving a plurality of electron emitting elements are formed. As a material for these electrodes 605, metals such as gold, copper and aluminum are suitable, and it is desirable for simultaneously driving a plurality of electron emitting elements to use materials having smaller electrical resistance. In this embodiment, it is formed to have a thickness of 1.5 μm using a material containing copper as the main element.

Figure 46B:
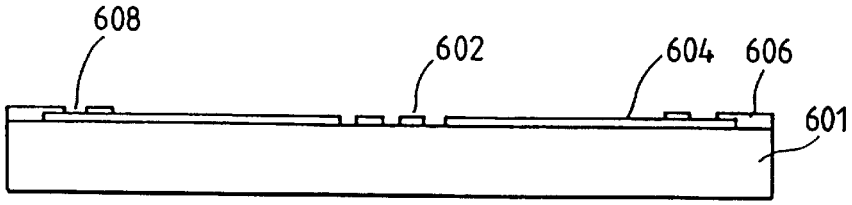

(2) Next, the insulating film 606 is mounted on the end portion of the modulating electrode 604 (FIG. 46B). At this time, the insulating film 606 is directed perpendicularly to the element wiring electrode 605 so as to electrically insulate the modulating wiring electrodes 607 and the element wiring electrodes 605 formed thereon. To this end, the thickness of the insulating film 606 should be thicker than that of the element wiring electrode 605, and is formed of SiO2 with a thickness of 3 μm in this embodiment. Then, contact hole 608 is formed in the insulating film 606 for electrically connecting the modulating electrode 604 and the modulating wiring electrode 607.

Figure 46C:
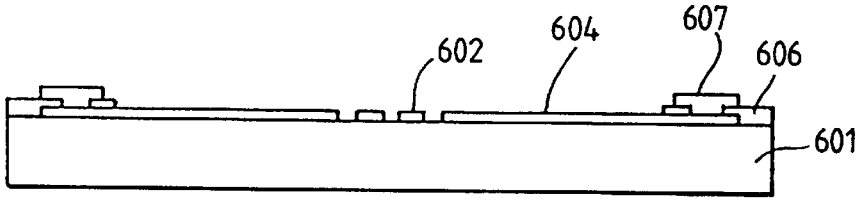

(3) The modulating electrodes 607 are formed on the insulating film 606. At this time, the modulating electrodes are connected through the contact holes 608, such that the same voltage is applied to each of a pair of modulating electrodes with the electron emitting section 603 therebetween (FIG. 46C). In this embodiment, this wiring is made at the end portion of the substrate. The modulating wiring electrode 607 in this embodiment is formed of Ni material with a thickness of 5 μm.

Figure 46D:
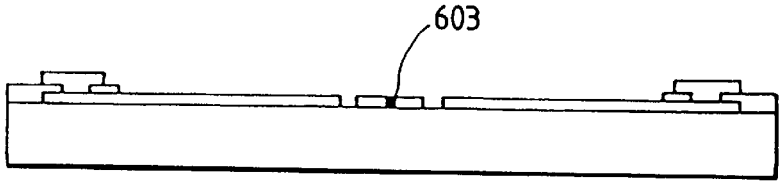

(4) Particle film is then formed between the element electrodes and is then energized to compose the electron emitting section 603 (FIG. 46D). The particle film is formed by spinner-coating organic palladium particles and thereafter baking at a temperature of approximately 300° C. for 30 minutes. The resulting particle film is a mixed particle film composed of palladium and palladium oxide. The patterning is carried out typically by lift-off technique. At this time, the particle film may be disposed not only between the element electrodes but also on the element electrodes 604.

(5) Thus composed electron beam emitting apparatus is mounted on the rear plate 612, a face plate having a fluorescent substance is disposed at a position 5 mm apart from the rear plate 612, so as to constitute the image display apparatus shown in FIG. 45.

Next, a method for driving the apparatus of the present embodiment will be described.

The voltage at the fluorescent substance is set to 0.8 kV–1.5 kV through EV terminal 613. Voltage pulses (in this embodiment, of 14 V) are applied to a pair of element wiring electrodes via wiring 614, 615 to make the linearly arranged electron emitting elements emit electrons. The emitted electrons act to turn the electron beam on and off by applying a voltage to the linear modulating electrodes via the wiring 616 in accordance with the information signals. The electrons emitted by the modulating electrodes 604 are accelerated and then collide with the fluorescent substance. The fluorescent substance performs one-line display in response to the information signals. Then voltage pulses (in this embodiment, of 14 V) are applied to its contiguous wiring electrodes to perform one-line display aforementioned. By sequentially executing these operations, an image for one screen is formed. Namely, the image is formed by an X-Y matrix composed of the wiring electrodes as scanning electrodes and the modulating electrodes. The pulse voltage to be applied to the elements are typically in the range of 8–20 V, depending on the element material and structure.

The surface-conducting electron emitting element according to this embodiment can be driven in response to voltage pulses not exceeding 100 ps. Therefore, when one screen is displayed at 1/30 sec, more than 10,000 scanning lines can be formed.

When the voltage to be applied to the modulating electrodes is not exceeding −36 V, the electron beam is turned off, while when it is equal to or more than 26 V, the beam is turned on. The electron beam continuously varied at the range of −36 V–26 V. Therefore, it is possible to display the grading by adjusting the voltage to be applied to the modulating electrodes 604.

The reason why the electron beam can be controlled by the voltage to be applied to the modulating electrodes 604 is that the potential near the electron emitting section 3 changes from + to − in response to the voltage of the modulating electrode and that the electron beam is accelerated and deccelerated. Further, in this embodiment, the modulating electrodes 604 are provided at a position with the electron emitting section 603 therebetween, but not limited thereto, a single modulating electrode can control the electron beam in the same manner by increasing the modulating voltage.

As explained above, since the electron emitting elements and the modulating electrodes are formed on the same substrate by the same processes, they can be easily aligned with each other. Further, since the thin film manufacturing technique is used, large and highly refined display can be obtained at low cost. In addition, the spatial accuracy between the electron emitting section and the modulating electrodes 604 can be enhanced, so as to provide image display apparatus having high resolution characteristics.

Furthermore, for the surface-conducting, electron emitting elements where electrons with several volts of initial velocity are emitted into vacuum atmosphere, the present invention is quite effective.

The entire display image presents high-lightness and high contrast, without any lightness nonuniformity.

26th Embodiment

The same electron beam generating apparatus and the image display apparatus as in the 25th embodiment, except that the size of the electron emitting element W1 is set to 20 μm and the size of the modulating electrode W2 is set to 60 μm. have been made. These apparatuses could provided images with high-lightness and high-contrast.

27th Embodiment

The same electron beam generating apparatus and the image display apparatus as in the 25th embodiment, except that the size of the electron emitting element W1 is set to 20 μm and the size of the modulating electrode W2 is set to 120 μm. According to the apparatuses of this embodiment, images with higher quality than in the 26th embodiment could be displayed.

28th Embodiment

Figure 47:
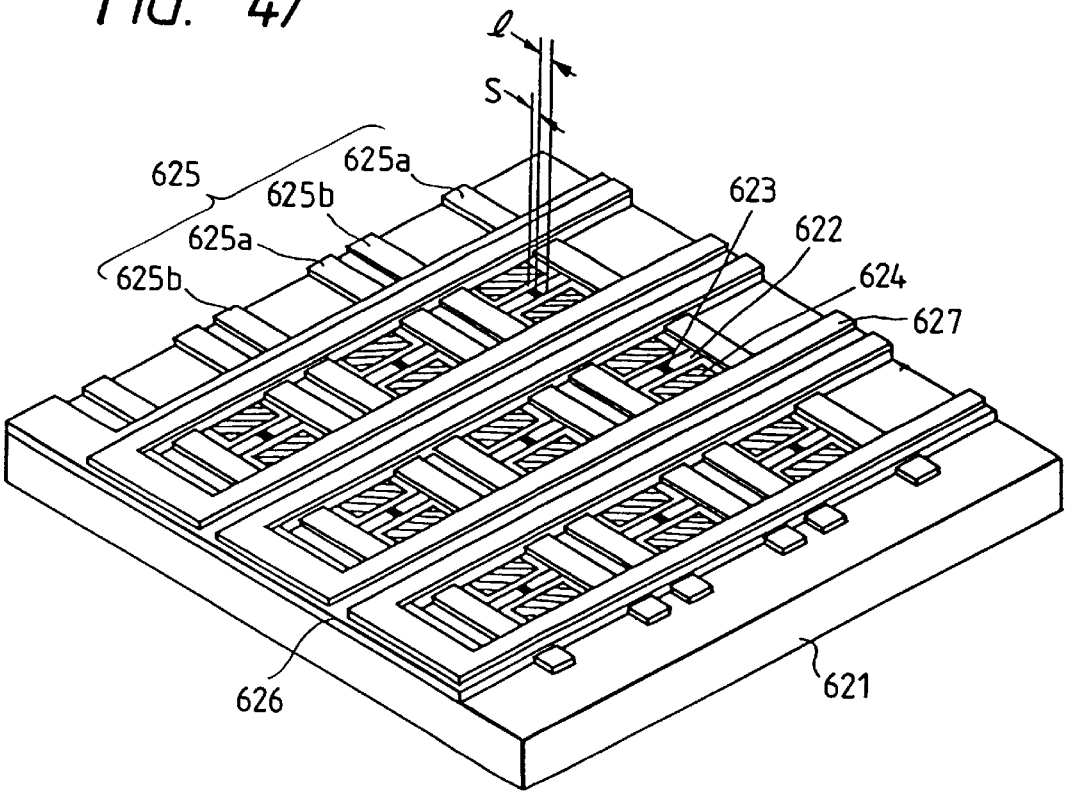

FIG. 47 shows a composition according to another embodiment of the present invention.

This embodiment is composed by changing the shape of the electron emitting element in the 25th embodiment. In the electron emitting element of this embodiment, the width of the element electrode 622 forms the length (l) of the electron emitting section 623.

The method for manufacturing the image display apparatus of this embodiment is the same as in the 25th embodiment so as to be omitted.

In this embodiment, the length (l) (i.e. size of the electron emitting element (W1)) is set to 10 μm, the distance (S) between the modulating electrode 624 and the element electrode 622 is set to 5 μm, and the size (W2) of the modulating electrode is set to 200 μm. The dimensions of other components are substantially the same as in the 25th embodiment.

This embodiment could provide substantially the same effect as in the 25th embodiment, but particularly the convergence and the dispersion of the electron beam can be controlled to provide quite highly refined images. Further, since the distance between the electron emitting section 623 and the modulating electrode 624 can be reduced, the electron beam can be turned on and off at lower voltage.

29th Embodiment

Figure 48:
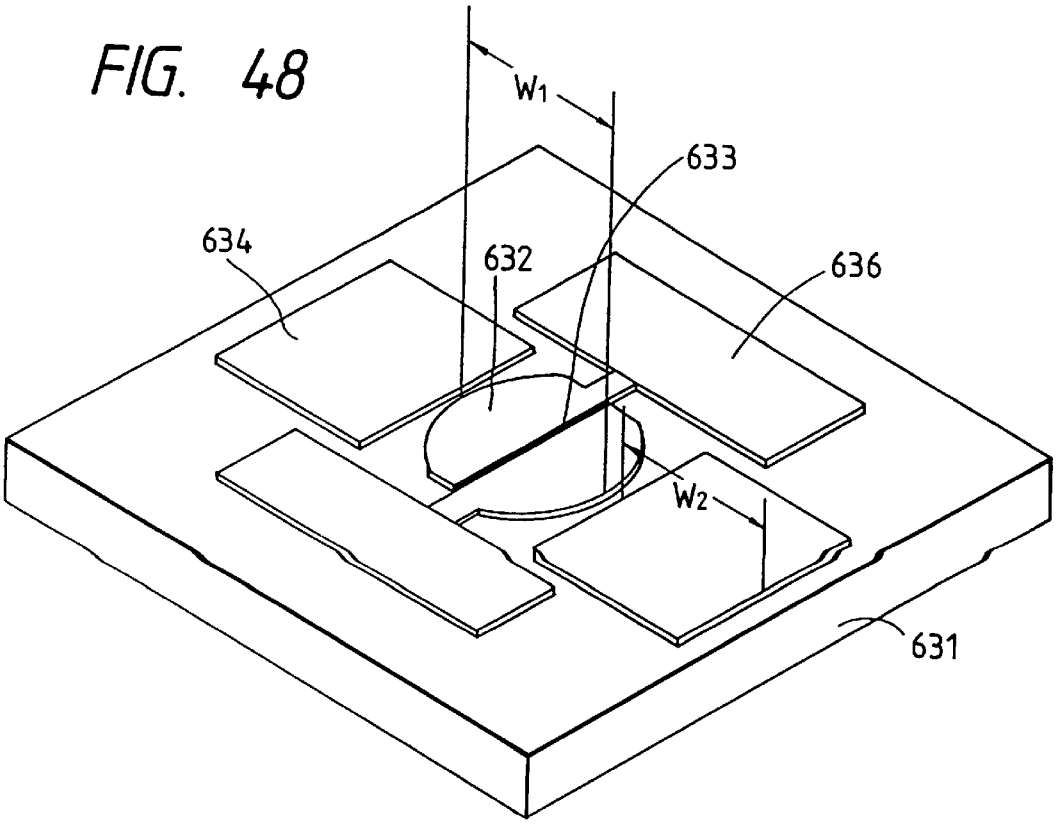

The same image display apparatus as in the 25th embodiment except that the electron generating apparatus is composed as shown in FIG. 48 has been made in the same manner as in the 25th embodiment. In FIG. 48, the numerals designate respectively: 631, an insulating substrate; 632, element electrodes; 633, an electron emitting section; 634, modulating electrodes; and 636, element wiring electrodes. Further, though not shown, in the same manner as in the 25th embodiment, an X-Y matrix is formed by linear electron emitting elements including a plurality of electron emitting sections and the modulating electrodes with element wiring electrodes on the surface of the substrate 631. In this embodiment, based on the aforementioned definitions, the size (W1) of the electron emitting element is set to 22 μm and the size (W2) of the modulating electrode is set to 500 μm.

Also in the image display apparatus of this embodiment, display images with substantially the same quality as in the 25th embodiment could have obtained.

30th Embodiment

FIG. 49 is a schematic composition of an optical printer, as an embodiment of the present invention.

In FIG. 49, the numerals designate respectively: 49, a vacuum container made of glass; 641, a face plate; 643, an electrode for applying voltage to a fluorescent substance; 642, a rear plate; 601, a glass substrate (insulating substrate); 603, an electron emitting section of the surface-conducting electron emitting element; 604, modulating electrodes; 6044, electrodes (Dp, Dm) for applying voltage to the electron emitting elements; 6046, electrodes (G1–GN) for applying voltage to the modulating electrodes 604; 648, light-emitting source; and 645, recording medium.

The recording medium 645 is composed by uniformly coating a photosensitive composition composed by the elements mentioned below on a polyethylene terephthalate film with a thickness of 2 μm. The photosensitive composition is a mixed composition containing: a. binder: polyethylene methacrylate (trade name: Dianarl BR, manufactured by Mitsubishi Rayon) 10 parts by weight, b. monomer: trimethylol-propane-triacrylate (trade name: TMPTA, manufactured by New Nakamura Chemical Co., Ltd.) 10 parts by weight, c. polymerization initiator: 2-methyl-2-morpholino (4-thiomethylphenyl) propane-1-on (trade name: Irgacure 907, Ciba-Geigy Co., Ltd.) 2.2 parts by weight, with methyl ethyl ketone 70 parts by weight as solvent.

As the fluorescent substance of the face plate 641, silicate fluorescent substance (Ba, Mg, Zn)$_3$ $Si_2O_7$: $Pb^{2+}$ is used.

Further, the light-emitting source 648 is formed in the same manner as in the 25th embodiment.

Next, the optical printer in this embodiment is driven in the same manner as in the 3rd embodiment. As a result, uniform optical recording pattern with high contrast could be obtained at high-speed.

31st Embodiment

In this embodiment, the same optical printer as that shown in FIG. 7 is made except that the same light-emitting source as in the 30th embodiment.

According to the recording apparatus of this embodiment, clear recording images with high resolution and high contrast has been obtained at high speed without any exposure nonuniformity, by virtue of the advantages of the aforementioned electron beam generating apparatus of this invention.

In the electron beam generating apparatus of this embodiment, the modulating electrodes and the electron emitting elements can be easily aligned so as to simplify the manufacturing process of the apparatus as well as provide sufficient electron emitting amount compared to conventional apparatus. Further, the undesirable variation of the electron emitting amount during the driving operation and the modulating nonuniformity between electron beams can be significantly improved. Further, the electron beam generating apparatus of this embodiment can provide an excellent modulating efficiency for the emitted electron beam.

Also, in an image display apparatus incorporating the electron beam generating apparatus of this embodiment, an improved contrast of the display image with less lightness nonuniformity can be obtained.

Furthermore, a recording apparatus incorporating the electron beam generating apparatus of this embodiment can provide recording images with an enhanced contrast and clearness.

In addition, for the aforementioned image display apparatus and the recording apparatus, since the modulating electrodes and the electron emitting elements in the electron emitting elements of this invention can be easily aligned, even when the electron emitting elements are arranged at high density, the electron emitting operation and the electron beam modulating operation are not affected thereby as taken place in the conventional case, it is possible to provide images with high resolution and high refined degree at high speed.

32nd Embodiment

In this embodiment, an electron beam generating apparatus and an image display apparatus incorporating the electron beam generating apparatus will be described.

FIG. 50 is a perspective view of the present apparatus wherein the numerals designate respectively: 731, a substrate; 732, modulating electrodes; 733, an insulating layer; 734, element wiring electrodes; 735, element electrodes; and 736, an electron emitting section.

This embodiment is composed by locating the modulating electrodes below the electron emitting section 736 and laminating the electron emitting elements (the element electrodes 735 and the electron emitting section 736) and the modulating electrodes 732 through the insulating layer 733.

FIG. 51 shows manufacturing processes of the electron beam generating apparatus according to this embodiment at the cross-section through line A–A' in FIG. 50. A method for manufacturing the image display apparatus of this embodiment will now be described.

(1) Firstly, the substrate 731 is well washed, and group of linear modulating electrodes 732 is formed by deposition and photolithography. The substrate 731 can be formed of any insulating materials such as glass, alumina ceramics etc. The modulating electrodes 32 can be formed of any conductive materials such as gold, nickel, tungsten etc., but those having a coefficient of thermal expansion as close as to that of the substrate are preferable.

The modulating electrodes in this embodiment are formed of nickel material, with an width (W2) of 1.6 mm and 2 mm of pitch.

(2) The insulating layer 733 is formed of SiO2 by deposition. As the material for the insulating layer 733, SiO2, glass, and other ceramics are preferable. Further, the thickness is set to 10 $\mu$m in this embodiment.

(3) The element electrodes 735 and the element wiring electrodes 734 (not shown in the cross-sectional view) are formed of Ni material by deposition and etching. Any material can be used for the element wiring electrode 734 so long as having sufficiently low electrical resistance. The element electrode 735 is connected to the element wiring electrodes 734-*a* and 734-*b*, and the element electrodes 735 constitutes opposed electron emitting sections 736. The electrode gap (G) is preferably set to 0.1 $\mu$m–10 $\mu$m, and in this embodiment it is set to 2 $\mu$m. The length (l: see FIG. 50) corresponding to the electron emitting section 736 is set to 300 $\mu$m. The width (W1) of the element is preferably small, in practice e.g. 1 $\mu$m –100 $\mu$m, and more preferably 1 $\mu$m–30 $\mu$m. The electron emitting section 736 is formed near the center of the width of the modulating electrodes 732. The pitch of the group of the element wiring electrodes 734 (each "a" and "b" form one pair) is set to 2 mm, the pitch of the electron emitting section 736 is set to 2 mm.

(4) A superfine particle film is formed between the opposed electrodes and then energized by gas deposition to form the electron emitting section. Pd is used as the material for the superfine particle in this embodiment. Also other materials such as metal materials e.g. Ag, Au or oxide materials e.g. SnO2, In 203 are preferable, but not limited thereto. In this embodiment, the diameter of the Pd particle is set to approximately 50 Å, but not limited to that value. Further, instead of the gas deposition, it is alternatively possible to disperse and coat organic metal and thereafter thermally process so as to form superfine particle film between the electrodes and to energize it, thereby providing the desired characteristics.

(5) The face plate 710 having a fluorescent substance (image forming material ) 709 at a position 5 mm apart from the substrate of the electron beam generating apparatus composed by the aforementioned processes to complete an image display apparatus.

Next, a driving method in this embodiment will be described.

The voltage at the fluorescent substance surface is set to 0.8 kV–5.0 kV. In FIG. 50, voltage pulses are applied to a pair of element wiring electrodes 34-*a* and 34-*b* to make linearly arranged electron emitting elements emit electrons. The emitted electrons act to apply voltage to the modulating electrodes in response to information signals to turn the electron beam on and off. The electrons emitted from the electron emitting section 736 is accelerated and then collide with the fluorescent substance disposed to face the electron source as shown in FIG. 36. The fluorescent substance makes one line display in response to the information signals. Subsequently, voltage pulses of 14 V are applied to its contiguous element wiring electrodes 734-*a* and 734-*b* for performing aforementioned one-line display. By sequentially executing these operations, an image for one screen is completed. Namely, the image is displayed by forming an X-Y matrix with the element wiring electrodes as scanning electrodes and the modulating electrodes.

Since the surface-conducting electron emitting element according to this embodiment can operate in response to voltage pulses of less than 100 ps, scanning lines of equal to or more than 10,000 can be formed when one screen of image is displayed in 1/30 second.

Further, the voltage to be applied to the modulating electrodes 732 turns the electron beam off at not exceeding −40 V while turns it off at equal to or more than 30 V. In addition, the electron beam amount was continuously changed in the range of −40 V–−30 V. As a result, it is possible to display gradation by adjusting the voltage to be applied to the modulating electrodes.

The reason why the electron beams can be controlled by the voltage applied by the modulating electrodes 732 is that the potential near the electron emitting section 736 change from + to − by the voltage of the modulating electrodes and the electron beam is accelerated and decelerated. Therefore, as the width of the element electrode 735 increases, the electric field near the electron emitting section 736 could not be controlled unless the voltage to be applied to the modulating electrodes 732 is correspondingly increased.

As mentioned above, in this embodiment, the electron emitting elements and the modulating electrodes are laminated through the insulating layer so as to be easily aligned. Further, since the thin film manufacturing technique is used, large-sized and highly refined display can be obtained at a low cost. In addition, the distance between the electron emitting section 736 and the modulating electrodes 732 can be formed quite accurately, it is possible to provide an image display apparatus capable of displaying images with an improved uniformity without any lightness nonuniformity.

In the surface-conducting electron emitting elements, electrons having an initial speed of several volts are emitted into vacuum atmosphere. The present invention is quite effective for the modulation in such type of element, providing an enhanced lightness contrast.

Next, a component in which an width (W1) of an element is constant while an width (W2) of the modulating electrode is changed as noted below is formed, with which the similar experiment has been performed resulting in as follows:

(1) When the width W1 of the element is 30 μm and the width W2 of the modulating electrode is 120 μm, the modulating operation can be carried out when the voltage to be applied to the fluorescent substance while when the voltage is increased the modulating effect becomes degraded.

(2) When the width (W1) of the element is 30 μm and the width (W2) of the modulating electrode is 150 μm, the electron beam can be modulated even when the voltage to be applied to the fluorescent substance is high, and an image with higher lightness and contrast than in the above (1) can be provided.

(3) When the width (W1) of the element is 30 μm and the width (W2) of the modulating electrode is 330 μm, the modulating function is further enhanced, and an image with higher lightness and contrast could be obtained.l In addition, even if the element distance is reduced, an image with highly refined degree could be obtained without causing any crosstalk.

33rd Embodiment

An optical signal supplying apparatus according to a 33rd embodiment of the present invention will now be described. Here, the term "optical signal supplying apparatus" signifies an apparatus for converting electrical signals into optical signals, specifically including devices such as LED (Light Emitting Diode) array, liquid crystal shutter etc. For example, an LED array as shown in the aforementioned FIG. 18 is used.

The optical signal supplying apparatus according to this embodiment has a composition similar to that of the one-line electron beam generating apparatus of the image display apparatus of 32nd embodiment. Its structure and the manufacturing method are substantially the same as in the 32nd embodiment so as to be omitted.

Next, a method for driving the optical signal supplying apparatus of this embodiment will be described.

A voltage is applied to the element wiring electrodes 734 to make the electron emitting section 736 emit electron beam. A predetermined voltage is previously applied to the fluorescent substance, and electrical signals are input to the modulating electrodes 732 in response to the modulating signals to turn the electron beam on and off. Thus on-off controlled electron beam collide with the fluorescent substance and is output as optical signals.

As the electron emitting element in this embodiment, the surface-conducting electron emitting element is used such that an optical signal supplying apparatus having not only high-lightness and highly refined degree but also quite high switching speed.

Further, in the same manner as in 32nd embodiment, the size of the modulating electrodes is preferably larger than that of the element.

34th Embodiment

Figure 52:
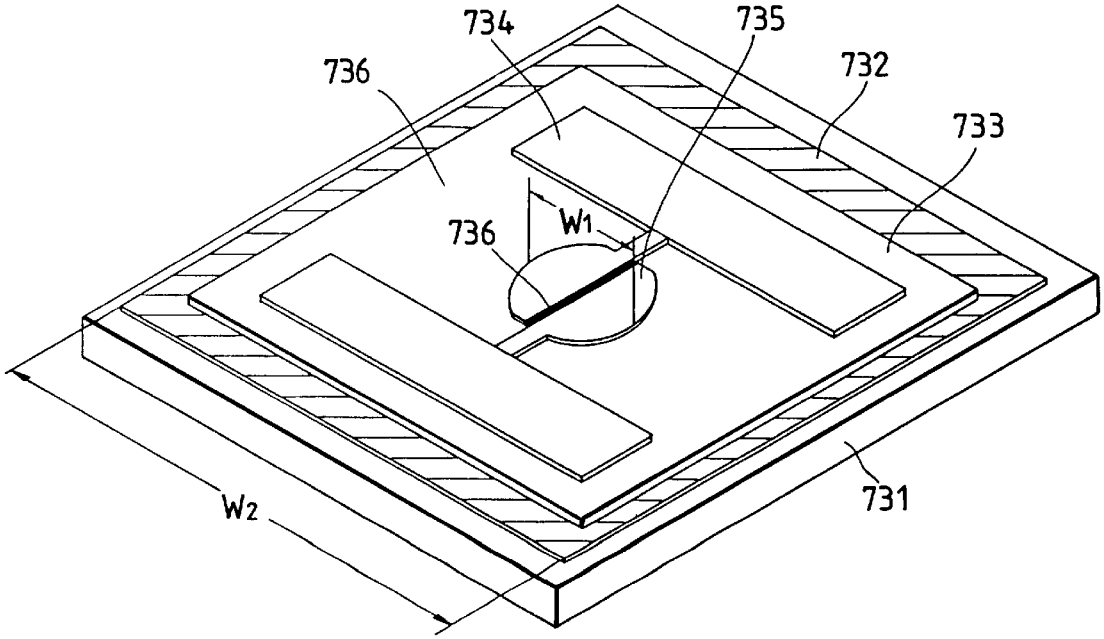

FIG. 52 shows a part of an element of an electron beam generating apparatus according to this embodiment. The composition and the manufacturing method of the electron beam generating apparatus of this embodiment are the same as in the 32nd embodiment so as to be omitted from explanation.

The present embodiment features to the circular form of the element electrode of the electron emitting element. In this time of element, the size of the element is measured at the largest width portion as the element width.

In such a circular electron emitting element, an experiment similar to that in 32nd embodiment has been performed, resulting in substantially the same effect as in 32nd embodiment, but in comparison thereto more uniform lighting points could be obtained on the fluorescent substance.

35th Embodiment

A recording apparatus substantially the same as that shown in FIGS. 5–7 except that the light-emitting source (optical signal supplying apparatus) composed in the 33rd embodiment has been manufactured and driven in the same manner. As a result, clear and uniform optical recording pattern with high contrast could be obtained at high speed.

In this embodiment, the modulating electrodes, insulating layer and the electron emitting element are sequentially laminated, and the modulating electrode is formed to have a larger size than the electron emitting element. Accordingly, the electron emitting elements and the modulating electrodes can be easily aligned, rendering the following practical advantages:

(1) The electron beam generating apparatus according to this embodiment can provide sufficiently large electron emitting amount than in the conventional apparatus, and the fluctuation of the unintentional electron emitting amount and the modulating nonuniformity between the electron beams can be significantly improved. Furthermore, the modulating efficiency of the electron beam to be emitted is also enhanced;

(2) In the image display apparatus incorporating the electron beam generating apparatus of this invention, the display image has an excellent contrast with high-lightness and less lightness nonuniformity;

(3) Also in the recording apparatus incorporating the electron beam generating apparatus of this invention, the recording image has a high contrast and clarity;

(4) In the aforementioned image display apparatus and the recording apparatus, the modulating electrodes and the electron emitting elements can be easily aligned as mentioned above. By virtue of this, even when the electron emitting elements are arranged at high density, the electron emitting action and the electron beam modulation are not undesirably affected thereby. As a result, highly refined display image and recording image with high resolution can be displayed at high speed.

36th Embodiment

An electron beam generating apparatus as shown in FIGS. 53 and 54 has been manufactured.

Firstly, the manufacturing processes will be described in detail.

(1) Quartz glass as a rear plate 801 (manufactured by Corning Co.,Ltd.) is scrubbed with neutral detergent and well cleaned by ultrasonic cleaning using organic solvent. Thereafter, a resist pattern is formed thereon by photolithography.

(2) Ti as an underlying material for enhancing the adhesiveness and Ni as element electrode material are deposited on the whole surface of the resist pattern to have a thickness of 50 Å and 950 Å respectively by resistance heating. Then an element electrode pattern is formed by lift-off method. The width of the element electrode at this time is set to 15 μm, likewise the thickness 0.1 μm and the electrode gap 2 μm.

(3) Cr for patterning the electron emitting material is deposited over the whole surface with a film thickness of 1000 Å by the resistance heating.

(4) A resist pattern is formed for removing Cr only at near the emitting section (25 μm×150 μm) by photolithography.

(5) Desired part of Cr is removed by etching. As an etchant, cellium ammonium nitrate and perchloric acid aqueous solution are used.

(6) Organic palladium (manufactured by Okuno Pharmaceutical Co., Ltd. with a trade name CCP-4230) is dispersed and coated on the substrate which is then baked at 300° C. under atmospheric environment for 12 minutes to form a palladium thin film as the emitting material over the whole surface.

(7) The Cr for patterning the emitting material is etched out by use of the etchant noted in above (5).

(8) By use of EB deposition instead of the resistance heating, Cr with a thickness of 50 Å and Cu with a thickness of 1 μm are formed in the same manner as in the element electrode pattern forming, to constitute a modulating electrode 2. At this time, the distance between the element electrode 803 and the modulating electrode 802 is set to 25 μm.

(9) Lastly, the thin film made in above (5) is energized to form the electron emitting section.

The electron beam generating apparatus made by aforementioned method is put under an environment of $2\times10^{6}$ Torr together with the fluorescent plate disposed at a position 5 mm above the electron beam generating apparatus. Then a voltage of 1 KV is applied to the fluorescent plate from outside and voltage pulses of 14 V are applied between the element electrodes.

As a result, spot light corresponding to the electron beam emitted to the fluorescent plate has been observed. Further, when a voltage of −30 V to +20 V was applied to the modulating electrodes, the electron beam amount continuously changed in response to the modulating voltage. Also, the electron beam could be turned on at a modulating voltage not exceeding −30 V and turned off at equal to or more than +30 V.

Moreover, a cut-off voltage when the element electrode (15 μof width and 0.1 μm of thickness) is fixed while the width and the thickness of the modulating electrode is changed was as follows:

| Modulating electrode | | |
|---|---|---|
| Width | Thickness | Cut-off voltage |
| 200 μm | 1 μm | −30 V |
| 200 μm | 0.5 μm | −41 V |
| 200 μm | 0.3 μm | −47 V |
| 100 μm | 1 μm | −35 V |
| 500 μm | 1 μm | −23 V |
| 1 mm | 1 μm | −20 V |

Namely, by increasing the thickness of the modulating electrode, the cut-off voltage can be reduced in case of turning-off control. Meanwhile, in case of turning-on control, the larger the width, the higher the convergence.

37th Embodiment

An image display apparatus according to 37th embodiment of this invention has been made as shown in FIG. 45.

The electron emitting elements are linearly arranged with a pitch of 2 mm, and a plurality of modulating electrodes 2 are intersected perpendicularly to the linearly arranged electron emitting elements while kept insulated from the wiring electrodes. With the other composition being substantially the same as in 36th embodiment, an electron beam generating apparatus is formed on the rear plate. The wiring electrodes are formed in the same manner as for the modulating electrodes in 36th embodiment, and SiO2 is mask-deposited on only necessary portion of the insulating layer by spattering.

The face plate is disposed at a position apart from the rear plate by 5 mm.

A driving method in this embodiment will now be described.

The voltage on the fluorescent substance surface is set to 0.8 kV–1.5 kV through the EV terminal. Voltage pulses (in this embodiment, of 14 V) are applied to a pair of element wiring electrodes to make the linearly arranged electron emitting elements emit electrons. The emitted electrons turns the electron beam on and off in response to a voltage supplied to the linear modulating electrodes through the wiring 16 in accordance with information signals. The electrons emitted through the modulating electrodes 4 are accelerated and collide with the fluorescent substance. The fluorescent substance performs one-line display in response to the information signals. Then voltage pulses (in this embodiment, of 14 V) are applied to its contiguous wiring electrodes to perform the aforementioned one-line display. By sequentially performing these operations, an image for one screen has been formed. Namely, the image was displayed by forming an X-Y matrix with the wiring electrodes as scanning electrodes and the modulating electrodes. The pulse voltage to be applied to the elements is typically in the range of 8–20 V depending on the element material and structure.

The surface-conducting electron emitting element in this embodiment can be driven in response to voltage pulses not exceeding 100 ps. Therefore, scanning lines of more than 10,000 can be formed when the image is displayed at 1/30 per one screen.

The voltage to be applied to the modulating electrodes act to turn the electron beam off and does not exceed −30 V but is equal to or more than 20 V. Further, the electron beam amount was continuously increased in a range of −30 V–+20 V. Therefore, the gradation can be displayed by adjusting the voltage to be applied to the modulating electrodes 2.

The reason why the electron beam can be controlled by adjusting the voltage to be applied to the modulating electrodes 2 is that the potential near the electron emitting section 4 changes from + to − by the voltage of the modulating electrodes and the electron beam accelerates and decelerates. Further, in this embodiment the modulating electrodes are disposed at a position with the electron emitting section therebetween, but not limited thereto, a single modulating electrode would control the electron beam in the same manner by increasing the modulating voltage.

As mentioned above, since the electron emitting elements and the modulating electrodes are formed on the same substrate by the same processes, they can be easily aligned with each other. In addition, by virtue of the thin film manufacturing method, a large-scale and highly refined display can be obtained at low cost. Moreover, the space between the electron emitting section and the modulating electrodes can be formed at very high accuracy, so as to provide image display apparatus with high resolution.

In the surface-conducting electron emitting element, electrons having an initial speed of several volts are emitted into vacuum atmosphere. The present invention is quite effective for modulation of such an element.

Further, the entire display image had high lightness and contrast without any lightness nonuniformity.

38th Embodiment

Figure 55:
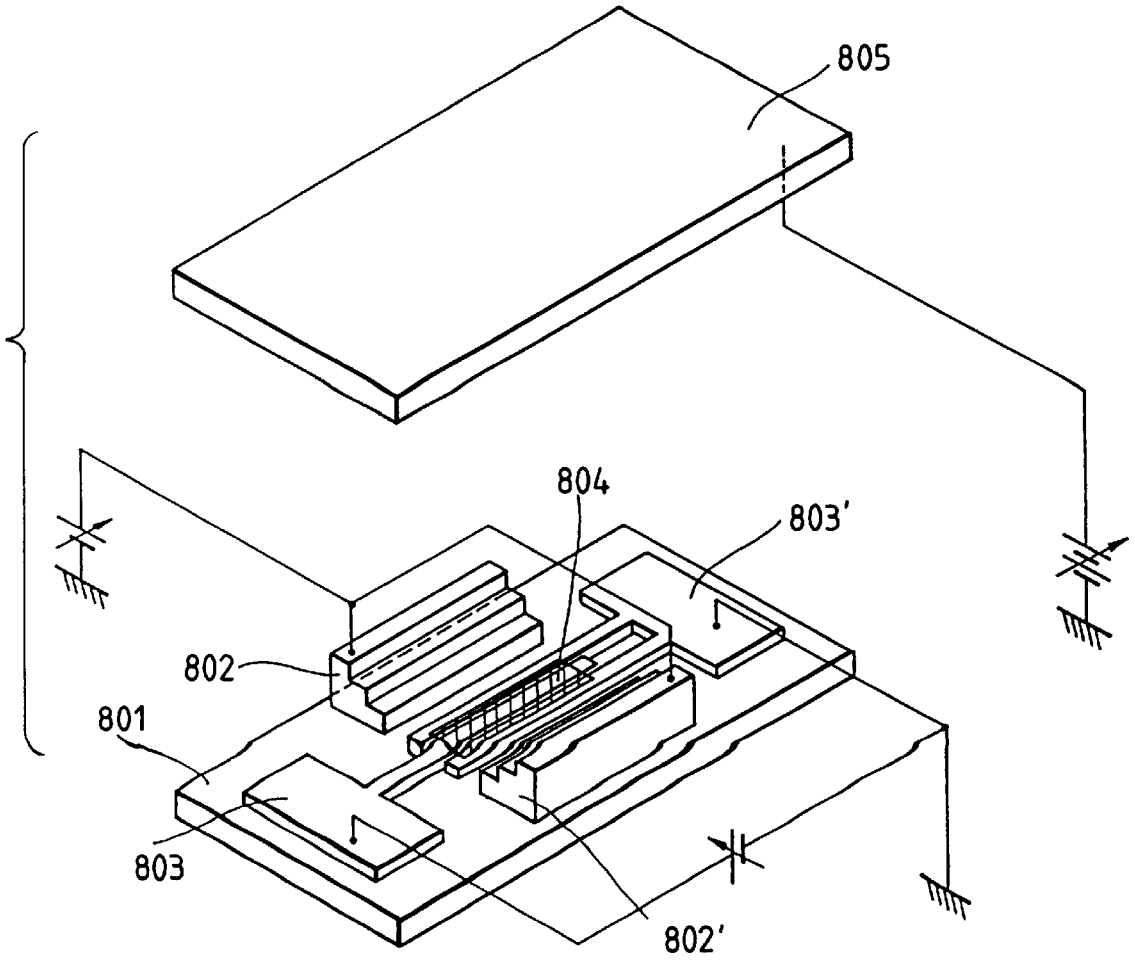

FIG. 55 is a perspective view showing another embodiment of the present invention.

The manufacturing processes of this embodiment shown in FIG. 55 will be described in detail.

(1) Firstly, quartz glass is used as an insulating substrate 801 which is scrubbed with neutral detergent and then well cleaned by ultrasonic cleaning using organic solvent such as acetone, IPA, butyl acetate. Thereafter, a photoresist pattern is formed thereon by photolithography.

(2) Then a film with a thickness of approximately 50 Å is formed of Ti in vacuum for increasing the adhesiveness by resistance heating, and then a film with a thickness of approximately 950 Å is formed of Ni as the element electrode material in vacuum. The photoresist is removed by lift-off method to form element electrodes 803 and 803'. In this embodiment, the element electrode width is set to 15 μm and the electrode space is set to 2 μm.

(3) With Cr used to form the electron emitting material, a film with a thickness of approximately 1000 Å is formed in vacuum over the whole surface in order to form the electron emitting material only near the electron emitting section.

(4) A photoresist is formed only near the electron emitting section 25 μm×150 μm for removing Cr by photolithography.

(5) Cr is then partly removed to become a desired dimension by wet etching. As an etchant, cellium ammonium nitrate and perchloric acid aqueous solution are used.

(6) Organic palladium (manufactured by Okuno Pharmaceutical Co., Ltd. CCP-4230) is dispersed and coated on the electron emitting material which is then baked in the atmosphere at approximately 300° C. for 12 minutes so as to form a thin film of the electron emitting material over the whole surface.

(7) Cr for patterning the electron emitting material is etched by use of the etchant used in above (5), to make the thin film of the electron emitting material remain only at desired portions.

(8) The modulating electrodes are then formed. Firstly, the modulating electrodes of the first layer are formed by EB deposition and lift-off (in the same manner as in forming the element electrodes) with Cr for increasing, the adhesiveness with a film thickness of approximately 50 Å and with Cu as the modulating electrode material with a film thickness of approximately 1.0 82 m. At this time, the space between the element electrodes and the modulating electrodes is set to 25 μm.

(9) Then the modulating electrodes of the second layer are formed to have a length 5 μm less from the electrode end of the first layer as shown in FIG. 55 in the same manner, material and composition as in the case of the first layer.

(10) The modulating electrodes of the third layer are formed to have a length 5 μm less from the electrode end of the second layer by the same manner, material and composition as in the case of the second layer.

(11) Lastly, the thin film formed in above (7) is energized to form the electron emitting section.

A fluorescent plate 5 composed of a transparent electrode, a fluorescent material and a metal back (not shown) is disposed on the glass substrate located at a position 5 mm above the electron beam emitting apparatus. A voltage of 1 KV is applied to the fluorescent substance 5 from outside, and voltage pulses of 14 V are applied between the element electrodes 803 and 803'.

As a result, spot light corresponding to the electron beam emitted toward the fluorescent plate 805 was observed. Further, when a voltage of −30–+20 V is applied to the modulating electrodes 802 and 802', the electron beam amount was continuously changed in response to the modulating voltage.

In addition, the longitudinal electron beam, i.e. that in the direction perpendicularly intersecting the electron emitting section could be easily shaped and converged.

Furthermore, at this time, the electron beam could be turned off when the modulating voltage is not exceeding −30 V while turned on when it is equal to or more than +30 V.

39th Embodiment

Figure 56:
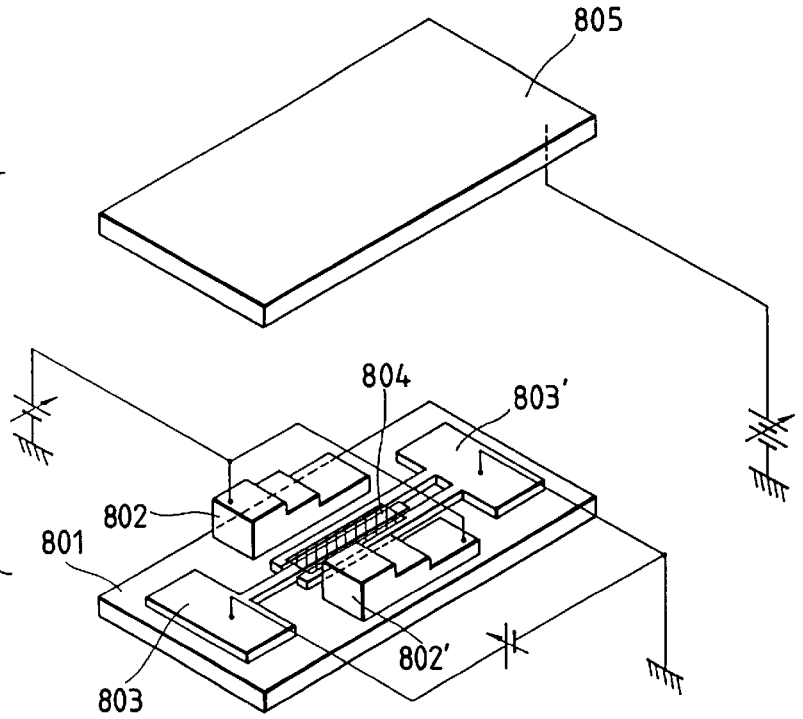

FIG. 56 shows another embodiment of the present invention.

In this embodiment, the same manufacturing processes as in the embodiment shown in FIG. 55 are used. The structure of the modulating electrodes is such that the distance of a first layer from the element electrodes is 25 μm, a second layer is formed at a position 5 μm apart from the electrode end of the first layer, and a third layer is formed at a position 5 μm apart from the electrode end of the second latter, in total three-stage form.

In the same manner and composition as in 38th embodiment, using the electron beam generating apparatus made as aforementioned, spot light corresponding to the electron beam emitted from the image display member (face plate) 805 was observed. As a result, when a voltage ranging −30 V–+20 V is applied to the modulating electrodes 802 and 802', the electron beam amount was continuously changed in response to the modulating voltage.

Further, while the electron beam in the 38th embodiment showed a characteristic of deviating toward the positive potential side with respect to the voltage applied to the element electrode, in this embodiment the electron beam could be deflected by correcting the aforementioned characteristics.

Further, at this time, the electron beam could be turned off when the modulating electrode voltage is not exceeding −30 V and turned on when it is equal to or more than +30 V.

40th Embodiment

Figure 57:
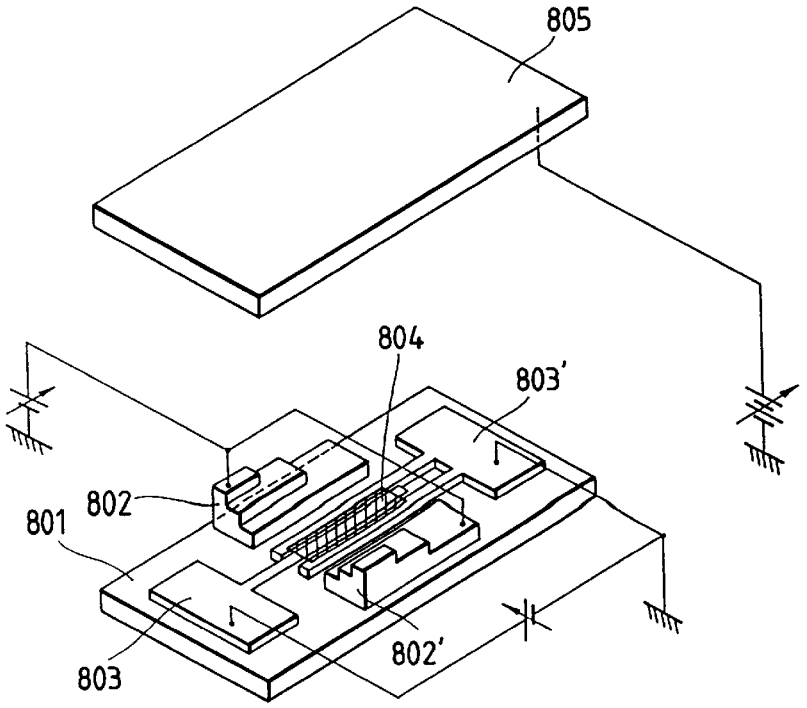

FIG. 57 shows another embodiment of the present invention.

In this embodiment, the same manufacturing processes as in the 38th embodiment were used. The composition of the modulating electrodes is such that a first layer is formed at a position 25 μm apart from the element electrodes, a second layer is formed at a position 5 μm apart from the electrode end of the respective side, and a third layer is formed at a position 5 μm apart from the electrode end in the same manner as in the second layer, as shown in FIG. 57 in the form of stages.

With the same manner and composition in the 38th embodiment, using the electron beam generating apparatus made as aforementioned, spot light corresponding to the electron beam emitted from the image display member (face plate) 805 was observed. As a result, when a voltage of −30 V–+20 V is applied to the modulating electrodes 802 and 802', the electron beam amount was continuously changed in response to the modulating voltage.

Further, it was possible to easily change the shape, convergence and modulation of the electron beam.

Namely, by setting the thickness of the modulating electrode to be larger than that of the element electrode, and intentionally distributing the variation of the thickness of the modulating electrodes as described in the embodiments 38–40, the shaping, converging and modulating of the beam can be carried out more easily.

Specifically, in the 38th embodiment the electrical field distortion at a horizontal distance from the electron emitting section can be corrected, in the 39th embodiment the distortion of the electrical field between the wiring electrodes can be corrected, and in the 40th embodiment both types of the distortions can be corrected.

Figure 58B:
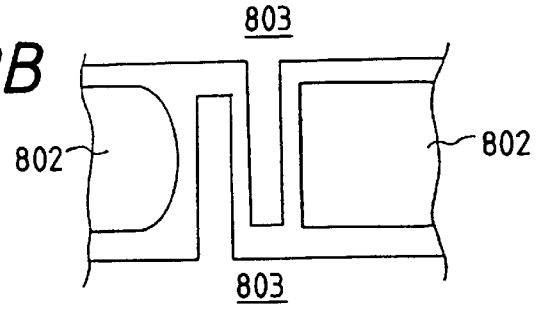
Figure 58A:
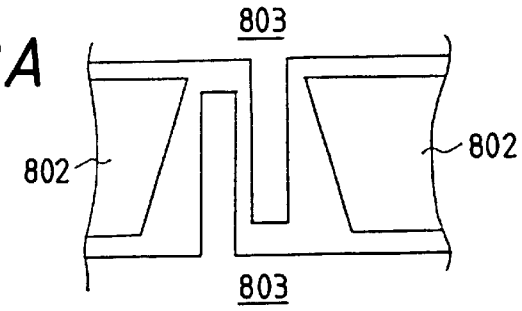

Further, such distortions can be corrected by adjusting the planar configuration of the modulating electrodes as shown in FIG. 58A and 58B.

The electron beam can be turned off when the modulating electrode voltage is not exceeding −30 V and turned on when it is equal to or more than +30 V.

41st Embodiment

In this embodiment, a recording apparatus similar to that shown in FIGS. 5–7 but using the image display apparatus in the 37th embodiment as the light-emitting source was made. Also in this embodiment, by virtue of the advantages of the electron generating apparatus, clear images with particularly high resolution and high contrast without any exposure nonuniformity could be provided at high speed.

As mentioned above, according to the present invention, by setting the thickness of the modulating electrodes to be larger than that of the element electrodes of the element emitting elements in the electron beam generating apparatus including flat grid electrodes on the substrate, it is possible to drive the apparatus with low voltage, to reduce the element damage and to enhance the convergence of the beam, so as to be widely used for domestic and industrial applications.

42nd Embodiment

The electron beam generating apparatus according to one embodiment of this invention shown in FIGS. 59 and 60 was made in the following manner.

In these FIGS. the numerals designate respectively: 901 and 902, element electrodes; 903, modulating electrodes; 904, an electron emitting section; 905, a control section; 906, an insulating substrate; 907, an insulating layer.

Firstly, silicon glass (manufactured by Corning) as the insulating substrate was scrubbed with neutral detergent and well cleaned by ultrasonic cleaning using organic solvent, and thereafter a resist pattern is formed thereon by photolithography.

Ti as an underlying material for enhancing the adhesiveness with a thickness of 50 Å and Ni as a material for the modulating electrodes 903 with a thickness of 950 Å are deposited totally over the resist pattern. Then, a pattern of the modulating electrodes 903 having a control section 905 shown in FIG. 60 is formed by lift-off method.

As the insulating material, SiO2 is mask-deposited at necessary portions with a thickness of 1. 5 μm by sputtering. Thereafter, in the same manner as the pattern forming method for the modulating electrodes 903, the pattern for the element electrodes 901 and 902 are formed.

The width for both element electrodes 901 and 902 is 15 μm respectively, and the electrode gap is 2 μm.

Further, Cr for patterning the electron emitting material is deposited with a thickness of 1000 Å for the whole surface by resistance heating, and a resist pattern for removing Cr only near the electron emitting section 4 (25 μm×150 μm) is formed. Thereafter, Cr at the desired portions are removed by etching. As an etchant, cerium ammonium nitrate and perchloric acid solution are used.

Next, palladium as the electron emitting material is coated with organic palladium solution (manufactured by Okuno Pharmaceutical Co., Ltd., with the trade name CCP-4230) on the substrate which is then baked at a temperature up to 300° C. in atmosphere for 12 minutes for forming a thin film. Cr for patterning the emitting material is etched by the aforementioned etchant. Finally, the thin film is energized and the electron emitting section is formed.

Figure 61:
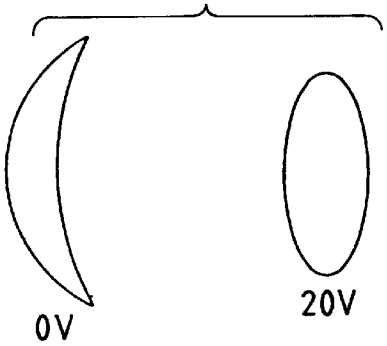
FIGS. 61, and 64 are drawings for explaining the change of the beam shape in the electron beam-generating device of the present invention.

The electron beam generating apparatus thus composed and a fluorescent plate disposed at a position 5 mm above the element are located under an environment of up to $2\times10^{-6}$ Torr. A voltage of 1 KV is applied to the fluorescent plate from outside and voltage pulses of 14 V are applied to the element electrodes 901 and 902. As a result, spot light corresponding to the electron beam emitted toward the fluorescent pate was observed. Further, when a voltage of −40 V–+30 V is applied to the modulating electrode 903, not only the electron beam amount was continuously changed but also the beam shape changed at a voltage equal to or more than 0 V as shown in FIG. 61. The electron beam was turned off when the modulating voltage is not exceeding −40 V and turned on when it is equal to or more than +30 V.

43rd Embodiment

In the same manner as in the 42nd embodiment, an electron beam generating apparatus having a control section 905 shown in FIG. 62 was made as shown in FIG. 63.

Figure 59:
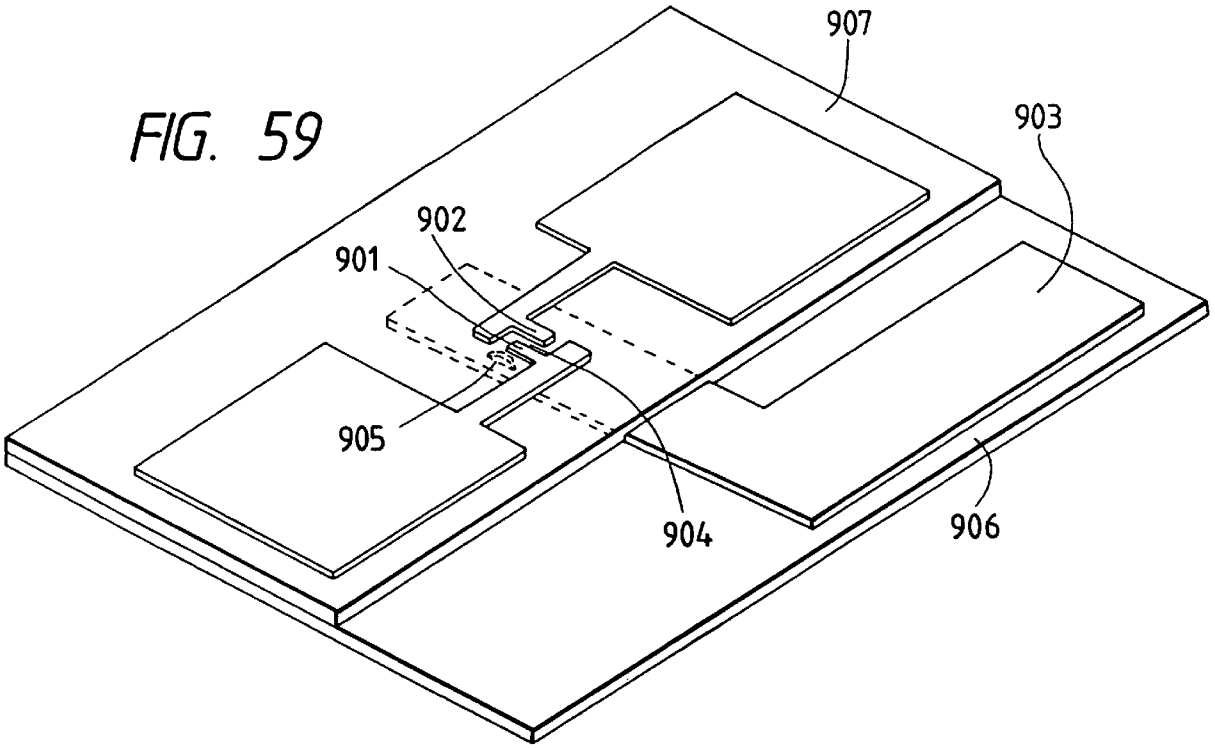
FIGS. 59, 60, 62, and 63 show an electron beam-generating device of Embodiment 3-4 of the present invention.
Figure 60:
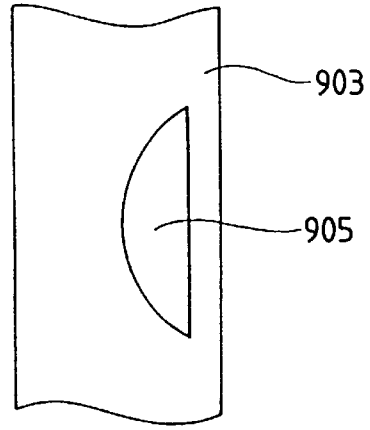

In FIG. 63, the same numerals as in FIGS. 59 and 60 designate the same or corresponding components.

Figure 64:
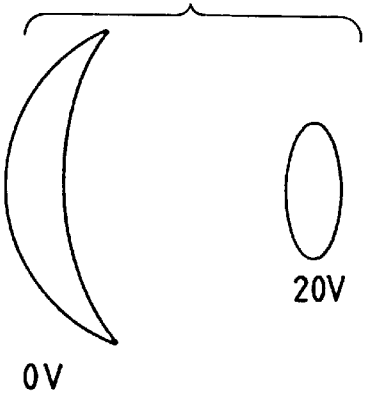

In combination of this electron beam generating apparatus with a fluorescent plate in the same manner as in the 42th embodiment, under an environment of $2\times10^{-6}$ Torr, a voltage of 1 KV is applied to the fluorescent plate from outside and voltage pulses of 14 V are applied between the element electrodes 901 and 902. As a result, spot light corresponding to the electron beam emitted toward the fluorescent plate was observed. Further, when a voltage of −40 V–+40 V is applied to the modulating electrodes 903, not only the electron beam amount was continuously changed, but also the beam shape was changed at a voltage equal to or more than 0 V as shown in FIG. 64. In addition, the electron beam could be turned off when the modulating voltage is not exceeding −40 V and turned on when it is equal to or more than +40 V.

44th Embodiment

An image forming apparatus as shown in FIG. 36 was made with a blue plate glass (manufactured by Ichikawa Special Glass Co., Ltd) as an insulating substrate 401. This apparatus is composed such that a plurality of electron emitting elements are linearly arranged at 2 mm pitch, a plurality of modulating electrodes 402 are arranged to perpendicularly intersect the linearly arranged electron emitting elements, and Cu as the element wiring electrodes 406 is laminated with a thickness of 2 μm. In the same manner as in the 42nd embodiment, control section 905 shown in FIG. 60 is provided for the modulating electrodes 402 near the respective element electrode 404,403.

Next, the face plate 407 shown in FIG. 36 having the fluorescent substance is disposed at a position 5 mm apart from the insulating substrate 401 of the apparatus so as to constitute the image forming apparatus.

Then a voltage of 1.5 KV is applied to the light-emitting element and voltage pulses of 14 V are applied to a pair of element wiring electrodes 406 to make the linearly arranged electron emitting element emit electrons. At the same time, by applying a voltage as information signals to the modulating electrodes 402, the electron beam can be turned on and off.

Further, voltage pulses are applied to its contiguous element wiring electrodes 406 to perform the aforementioned one-line display. By sequentially executing these operations, an image for one screen is formed. Namely, the image could be displayed by forming an X-Y matrix with the element wiring electrodes 406 as scanning electrodes and the modulating electrodes 402.

45th Embodiment

A recording apparatus has been made using the image display apparatus in the 44th embodiment as the light-emitting source has been made. Also in this embodiment, by virtue of the advantages of the electron generating apparatus, clear recording images with high resolution and high contrast without any exposure nonuniformity can be provided.

As mentioned above, according to the electron beam generating apparatus of this invention, the electron beam can be easily controlled by adjusting the shape of the modulating electrode 402, such that a high-quality image forming apparatus can be obtained.

46th Embodiment

Figure 65:
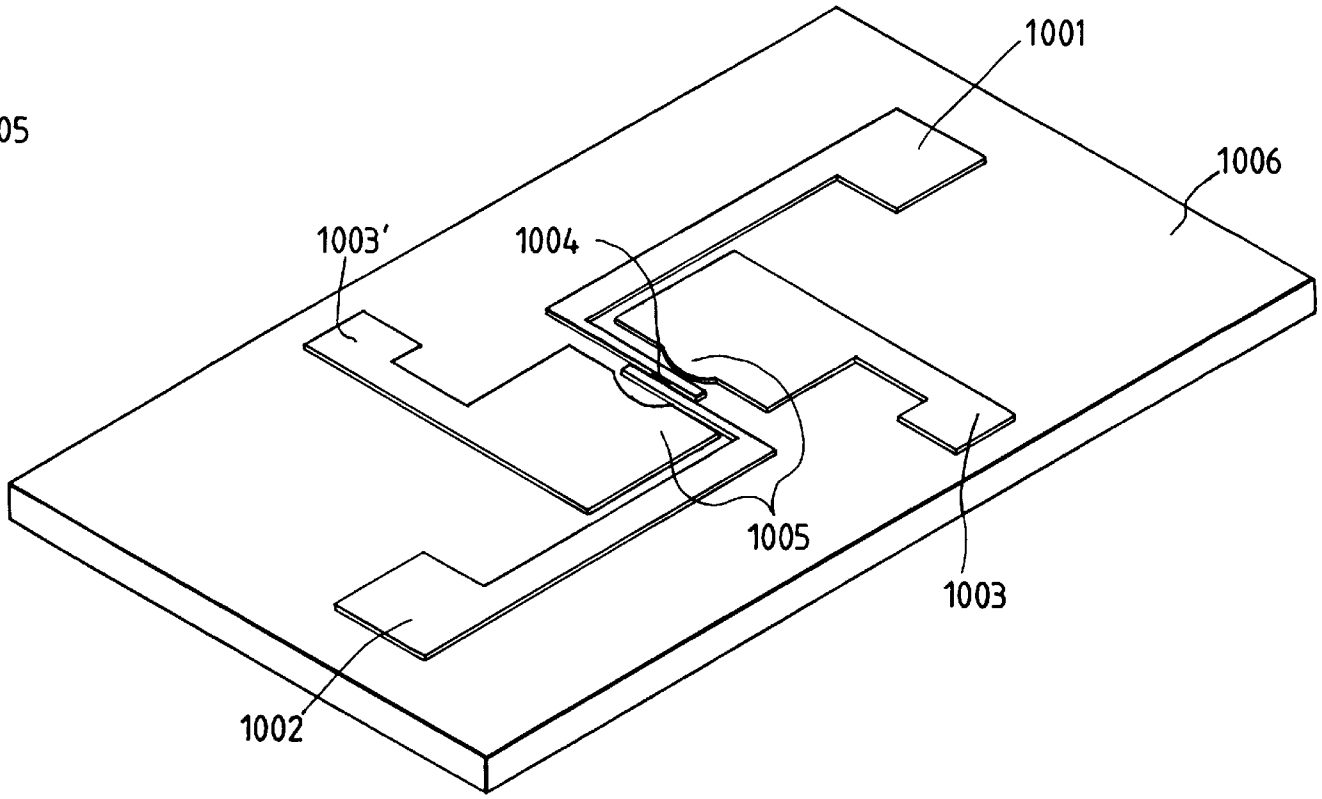
FIG. 65 shows an electron beam-generating device of Embodiment 3-5 of the present invention.
Figure 66:
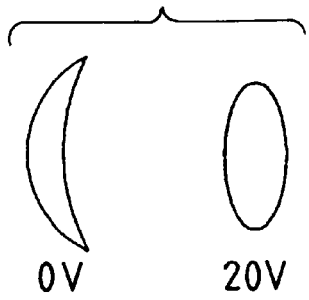
FIG. 66 is a drawing for explaining the change of the beam shape in the electron beam-generating device of the present invention.

FIG. 65 shows an electron beam generating apparatus according to a 46th embodiment of this invention, in which the numerals designate respectively: 1001 and 1002, element electrodes; 1003, 1003', modulating electrodes; 1004, electron emitting section; 1005, control section; 1006, an insulating substrate.

The electron beam generating apparatus together with a fluorescent plate disposed at a position 5 mm above it are put under an environment of up to $2\times10^{-6}$ Torr. A voltage of 1 kV is applied to the fluorescent plate from outside, and voltage pulses of 14 V are applied between the element, electrodes 1001 and 1002, resulting in that spot light corresponding to the electron beam emitted toward the fluorescent plate was observed. Further when a voltage of −40 V–+30 V is applied to the modulating electrodes 1003 and 1003', not only the electron beam amount was continuously changed but also the beam shape changed at a voltage equal to or more than 0 V as shown in FIG. 66. Further, the electron beam was turned off when the modulating voltage was not exceeding −40 V and turned on when it was equal to or more than +30 V.

In FIG. 65, the control section of the modulating electrode 1003 is formed in convex form as shown while that of the modulating electrode 1003' is formed in concave notch-like portion, but even when only one of these is formed, substantially the same effect could be obtained.

As mentioned above, according to the electron generating apparatus of this invention, the electron beam can be easily controlled by adjusting the shape of the modulating electrodes, so as to provide a high-quality image forming apparatus.

47th Embodiment

FIG. 67 shows a composition of an electron beam generating apparatus according to this embodiment. In FIG. 67, the numerals designate respectively: 1101, conductive substrate; 1102, an insulating film; 1103*a* and 1103*b*, wiring electrodes; 1104, element electrode; and 1105, electron emitting section.

In this embodiment, the modulating electrode is disposed below the electron emitting section 1105 as the conductive substrate, and the electron emitting element and the conductive substrate 1101 are integrally formed through the insulating film 1102.

Figure 68A:
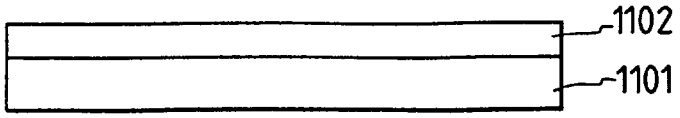
Figure 68B:
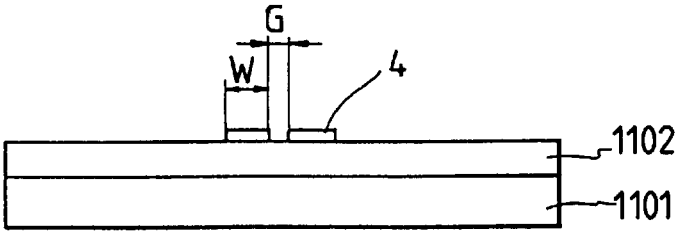
Figure 68C:
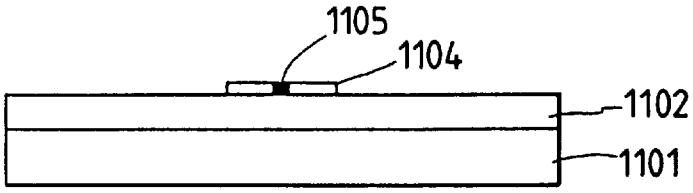

FIGS. 68A to 68C show a method for manufacturing an electron beam generating apparatus according to this embodiment in a cross-sectional view of FIG. 67 in the element row direction.

The manufacturing method will now be described.

(1) A precisely surface-ground aluminum substrate (conductive substrate 1101) is well cleaned, and SiO2 (insulating film 1102) is formed to have a thickness of 10 μm by deposition.

(2) Next, the element electrode 1104 and the wiring electrodes 1103*a* and 1103*b* are made of Ni material. The length (FIG. 67: l) corresponding to the electron emitting section 1105 is set to 300 μm, the width (FIG. 68B: W) of the element electrode is set to 8 μm, the element electrode gap (FIG. 68B: G) is set to 2 μm, and the pitch of the electron emitting section 1105 is set to 2 mm.

(3) Next, by gas deposition, a Pd superfine particle film with a diameter of approximately 100 Å is formed at a portion to be the electron emitting section 1105.

(4) The superfine particle film is energized to form the electron emitting section.

An apparatus thus obtained is disposed in a vacuum environment, and an anode electrode plate not shown is disposed at a position 5 mm apart therefrom, and a drawing voltage of 0.8 KV–1.5 KV is applied. Further, a voltage of 14 V is applied to a pair of wiring electrodes 1103*a* and 1103*b* to make the linearly arranged electron emitting elements emit electrons. At this time, a modulating voltage is applied to the conductive substrate 1101 to turn the electron beam off at a voltage not exceeding −40 V and turn it on at equal to or more than 30 V. The electron beam amount could be continuously changed in a range of −40 V −30 V.

Further, when one hundred of electron emitting elements are linearly arranged, the temperature of the conventional insulating substrate made of glass increased approximately to 120° C., and at this time an electron beam fluctuation partially took place. In this embodiment, however, by appropriately contacting the conductive substrate with a vacuum container, it is possible to restrict the temperature to not exceeding approximately 60° C. as well as to provide a uniform electron beam.

48th Embodiment

Figure 69:
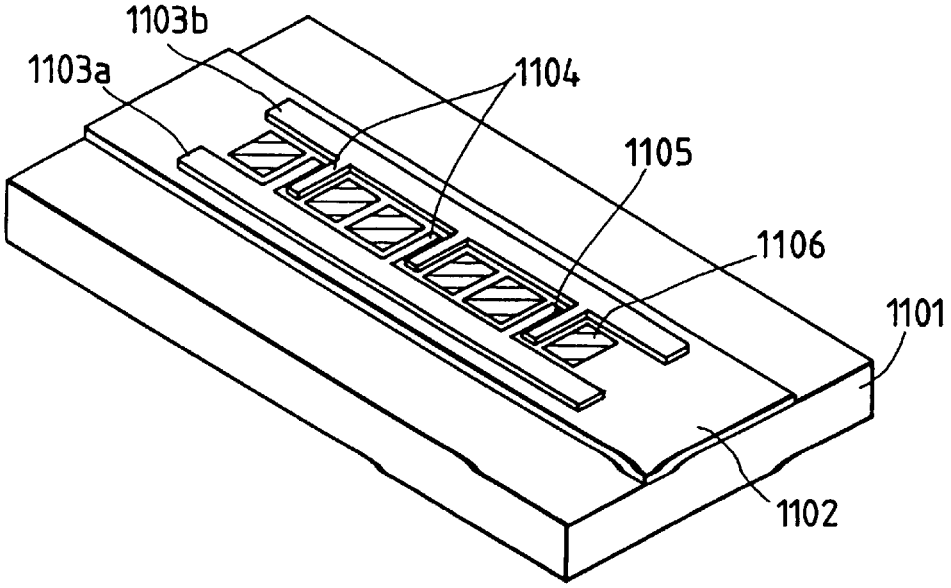

FIG. 69 shows a composition of an electron beam generating apparatus as a 48th embodiment.

Figure 70:
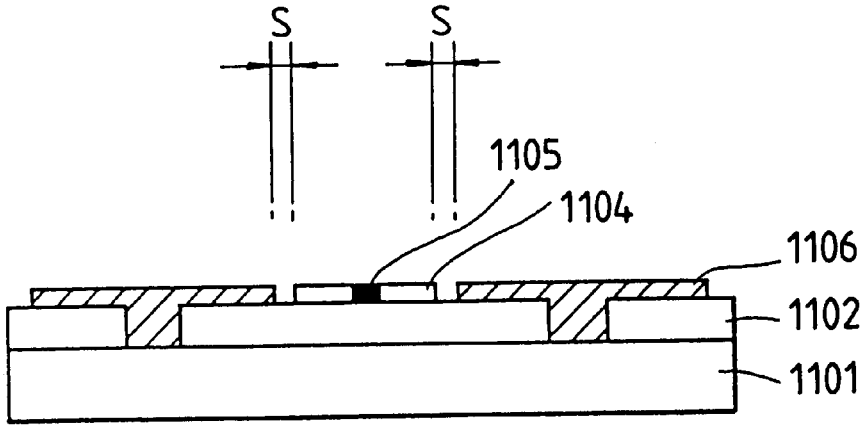

FIG. 70 is a cross-sectional view of FIG. 69 in the element row direction. This embodiment features to dispose the modulating electrodes 1106 coupled to the conductive substrate in the 47th embodiment within the electron emitting surface.

The manufacturing method for this embodiment shown in FIG. 69 can be composed of the similar deposition and etching as in the 47th embodiment so as to be omitted from explanation. Further, the component materials are shaped in the same manner as in the 47th embodiment. In FIG. 70, the space (S) between the element electrode 1104 and the modulating electrode is set to 10 μm.

In this embodiment, the electron beam is turned off when the voltage applied to the conductive substrate 1101 is equal to or less than −25 V while turned on when it is more than 10 V. Further, as in the 47th embodiment, the electron beam amount could be continuously changed at a voltage of −25 V–10 V.

Also in this embodiment, as in the 47th embodiment, the heat accumulation in the electron emitting section can be reduced and an uniform linear electron beam could be provided.

49th Embodiment

Figure 71:
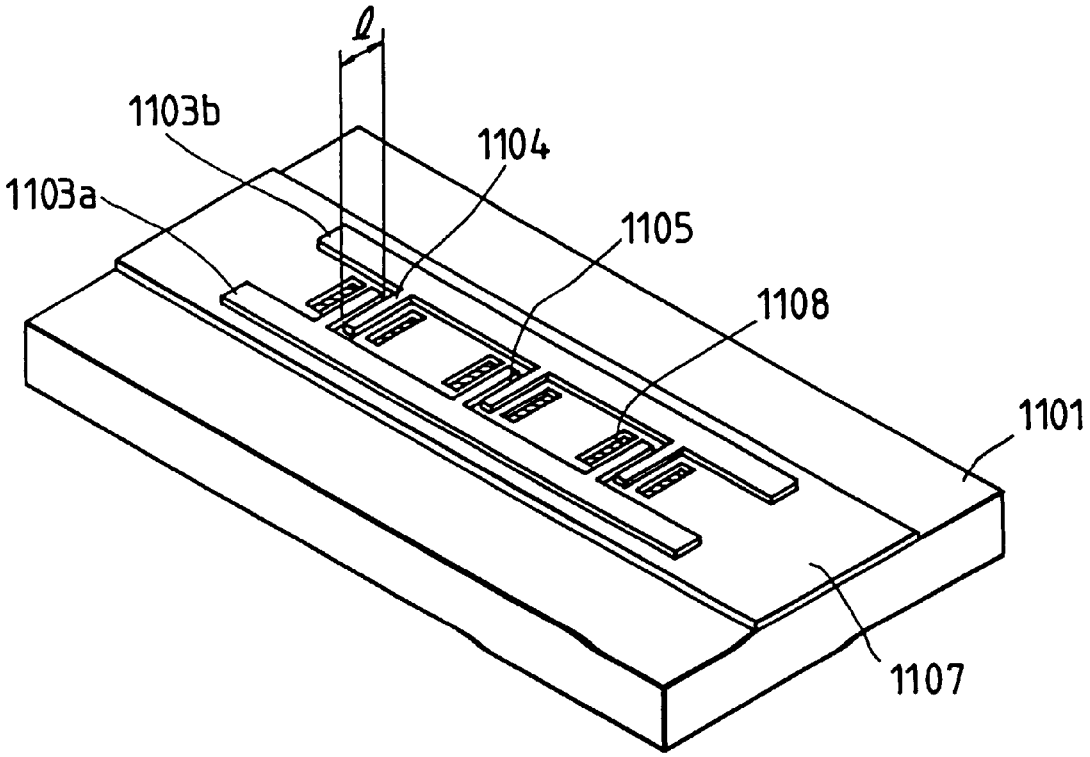
Figure 72A:
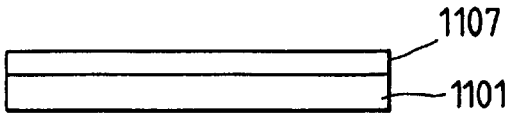
Figure 72B:
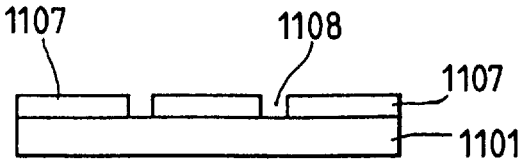
Figure 72C:
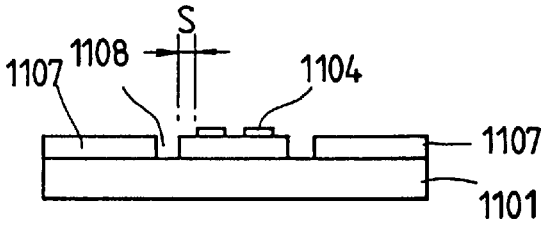
Figure 72D:
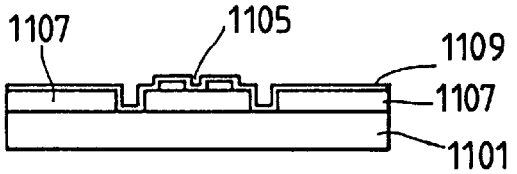

FIG. 71 shows a composition of an electron beam generating apparatus as a 49th embodiment of this invention. FIG. 72 is a cross-sectional view of FIG. 71 in the element row direction for the explanation of the manufacturing method which will now be described. The numeral 1108 designates a contact hole.

(1) Likewise in the manufacturing method in the 47th embodiment, except that the thickness of the insulating film 1107 is set to 3 μm.

(2) A contact hole 1108 is formed, using etching, by partially removing the insulating film 1107 at a position with the element electrode 1104 therebetween. Namely, the conductive substrate 1101 is exposed through the contact hole.

(3) In the same manner as the manufacturing method (2) in the 47th embodiment.

(4) Organic palladium solution is coated over the substrate by dipping, which is then baked at 300° C. over one hour for depositing the palladium particles 1109 over the whole surface of the substrate. As the organic palladium, CCP-4230 manufactured by Okuno Pharmaceutical Co., Ltd. was used. In this process, not only providing the superfine particles containing palladium being the electron emitting material as the main element between the opposed element electrodes 1104, but also conductive particles are deposited over the surface of the insulating film 1107 and the inner wall of the contact hole 8. At this time, the sheet resistance at the surface of the insulating surface is preferably $0.5\times10^5$ Ω/□–$1\times10^9$ Ω/□, and is more preferably $1\times10^5$ Ω/□–$1\times10^7$ Ω/□. Lastly, a voltage is applied between the element electrodes 1104 to form the electron emitting section.

The contact hole 1108 in this embodiment preferably has the same length as that of the electron emitting section 1105 as shown in FIG. 71. Further, the distance between the contact hole and the element electrode is preferably set to 10 μm–500 μm, and more preferably to 25 μm–100 μm.

In this embodiment, when a voltage is applied to the conductive substrate 1101, a current flows through the contact hole 1108 to change the potential of the insulating film surface. Thus, the surface potential of the insulating film near the element electrode 1104 can be controlled.

In this embodiment, the voltage to be applied to the conductive substrate 1101 could turn the electron beam off at not exceeding −25 V while turn it on at equal to or more than 10 V.

Likewise the 47th embodiment, the present embodiment also could provide uniform linear electron beams, reducing the heat accumulation in the electron emitting section.

50th Embodiment

Figure 73:
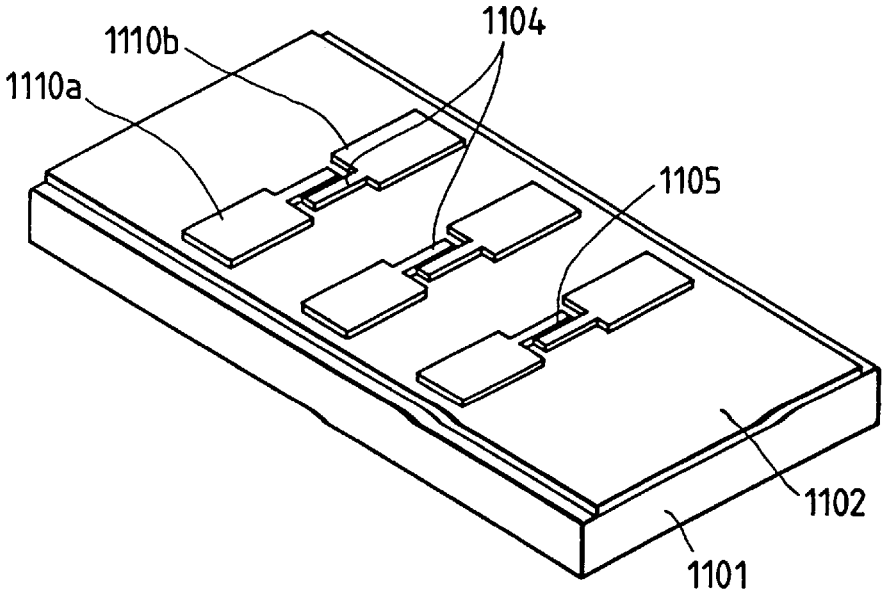

FIG. 73 shows a composition of an electron beam generating apparatus according to a 50th embodiment of the present invention.

This embodiment features to make the respective wiring electrode in the 47th embodiment independent for each electron emitting element. The manufacturing method of this embodiment shown in FIG. 73 is the same as that in 47th embodiment. In this embodiment, voltage pulses of 14 V are sequentially applied to the wiring electrodes 1110*a* and 1110*b* of the electron emitting elements, and in synchronicity therewith a voltage ranging −40 V −30 V as a modulating voltage is applied to the conductive substrate. As a result, it is possible to turn the electron beam on and off and to continuously change the electron beam amount for the respective electron emitting element. Likewise the 47th embodiment, this embodiment could also reduce the heat accumulation in the electron emitting section to provide a uniform linear electron beam. Further, the independent modulation control for each electron emitting element could be realized also in the 48th and the 49th embodiments by changing the wiring electrode shape and the driving application voltage.

As mentioned above, according to this embodiment, the electron source has such a quite simple composition that the electron emitting element is disposed on the insulating film formed over the conductive substrate. As a result, the following advantages can be rendered:

(1) Since the electron emitting element substrate itself acts as the modulating electrode, it is not necessary to accurately align the components. Therefore, the long linear electron source can be made by a simple process and the modulating efficiency can be enhanced.

(2) Even in a case where large amount of current electrons are emitted, the components can be composed on the same substrate, the components would not be deviated due to the heat generated from the electron emitting section due to the large heat radiation effect of the substrate. In consequence, a uniform linear electron beam can also be provided.

51st Embodiment

Figure 78:
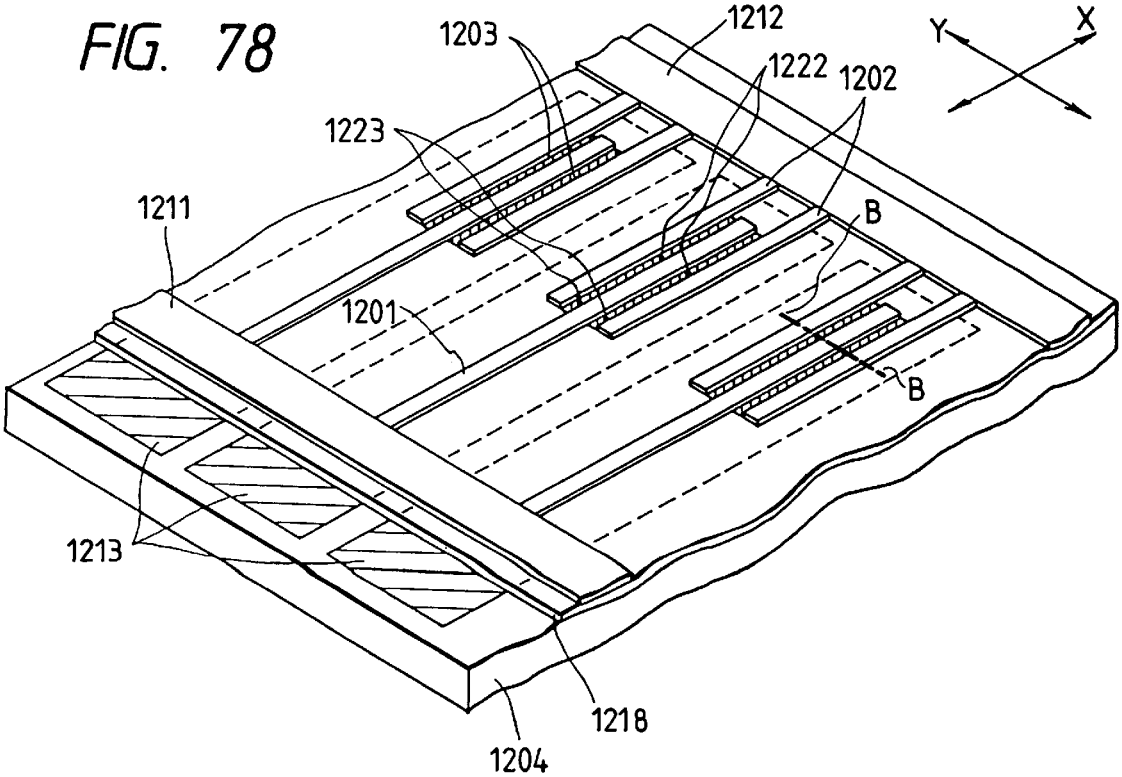
Figure 79:
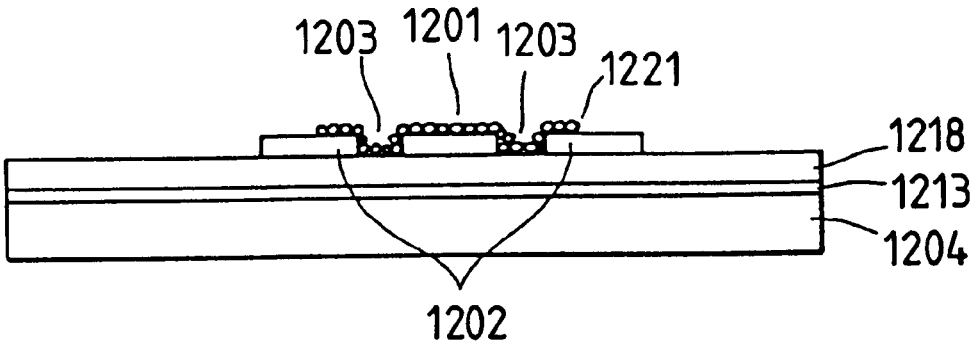

FIG. 78 is a schematic explanatory view of this embodiment. FIG. 79 is a cross-sectional view through B—B line in FIG. 78. In these FIGS., the numerals designate respectively: 1204, a substrate; 1213, modulating electrodes; 1201 and 1202, element electrodes; 1203, an electron emitting section; 1211 and 1212, element wiring electrodes (the latter is lower potential side); 1221, particle film (in FIG. 79); and 1218, an insulating layer.

In FIG. 79, the modulating electrode 1213 is formed on a silicon substrate (manufactured by Corning Co., Ltd) as the insulating substrate well degreased and cleaned by typically photolithography and vacuum deposition. As materials for the electrode, Ti 50 Å as an underlying material and Ni 950 Å are used.

Next, SiO2 as the insulating layer 12113 is filmed with a thickness of 5 μm by sputtering.

Further, by the same technique as in the case of the electrode, a pair of element electrodes 1201 and 1202 are formed. As materials for these electrodes, Ti 50 Å as an underlying material and Ni 950 Å are used. The electrode gap 1203 is set to 2 μm and gap between the electrodes are set to 250 μm. In addition, as shown in FIG. 78, the central portion 1222 of the electrode gap 1203 in the X direction is shifted by 30 μm toward the electrode 1212 side from the central portion 1223 between the element wiring electrodes 1211 and 1212.

Cr 1000 Å is filmed thereon at a region other than the region near the electrode gap 1203 (25 μm×150 μm) by the same manner. Organic Pd compound solution (manufactured by Okuno Pharmaceutical Industry Co., Ltd., with a trade name of Catapaste CCP) is coated by use of spin coater thereon and baked at 300° C. for 12 minutes, and the filmed Cr is etched out to form the particle film 1221 (FIG. 79) is, formed. Lastly, this particle film is energized to form the electron emitting section.

Thus made electron generating apparatus is put in a vacuum container, and a fluorescent substrate to which a voltage of 1 kV is applied is disposed at a position 5 mm vertically above this electron generating apparatus. When voltage pulses of 14 V are applied between the element electrodes 1201 and 1202 with the latter as the lower potential side, spot light is observed indicating an outflowing current on the fluorescent substrate. This spot light has a desirable elliptical form as shown in FIG. 76B.

Namely, in such a linear electron source, even if the electron emitting section has a voltage smaller than that applied by the electron source using the electron emitting element disposed at the center to the fluorescent substrate, it is possible to obtain a desired spot shape so as to decrease the voltage to be applied to the fluorescent substance.

Further, when a voltage of −30 V–+30 V is applied to the modulating electrode, the electron beam amount was continuously changed in response to the modulating voltage. Further, at this time the electron beam could be turned off when the modulating voltage is not exceeding −30 V and turned on when the modulating voltage is equal to or more than +30 V.

52nd Embodiment

Figure 80:
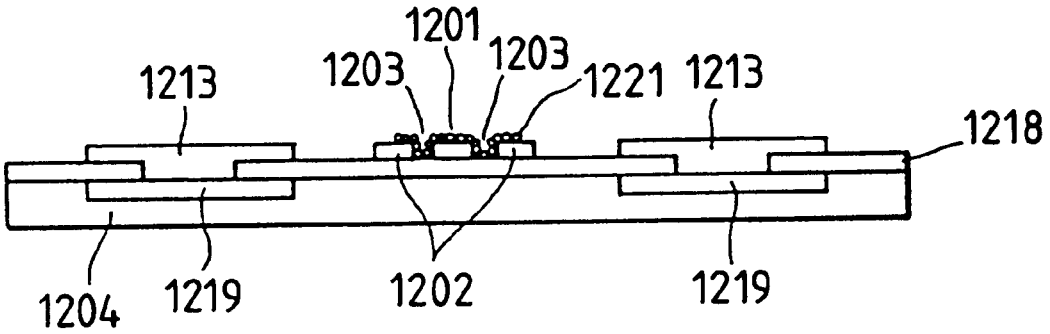

FIG. 74 is a schematic explanatory view for this embodiment. FIG. 80 is a cross-sectional view of FIG. 74 through A—A line. In these FIGS., the numerals designate respectively: 1204, a substrate; 1213, modulating electrodes; 1201 and 1202, element electrodes; 1203, electron emitting section; 1211 and 1212, element wiring electrodes; 1219, modulating wiring electrode; 1221, particle film; and 1218, an insulating layer.

In FIG. 74, the modulating wiring electrode 1219 is formed on a silicon substrate (manufactured by Corning Co., Ltd.) being the insulating substrate having been well degreased and cleaned by typically photolithography and vacuum filming. As materials for the electrode, Ti 50 Å as an underlying material and Ni 950 Å are used.

SiO2 as the insulating layer 1218 is disposed on the necessary portion by sputtering.

As shown in FIG. 80, Ni is deposited at a region near the element electrode where SiO2 was not formed for conduction, and further the modulating electrode 1213, the element electrodes 1201 and 1202, and the element electrodes 1211 and 1212 are formed. As the materials for the electrodes, Ti 50 Å as an underlying material and Ni 1950 Å are used. In FIG. 74, the electrode gap 1203 of the element electrodes is set to 2 μm, the electrode gap between the element wiring electrode is set to 250 μm.

Further, the central portion 1222 of the electrode gap 1203 in the X direction is deflected by 30 μm toward the electrode 1212 side from the central portion 1223 between the element wiring electrodes 1211 and 1212.

Next, with the same photolithography and vacuum filming, Cr 1000 Å is filmed at a region other than the region near the electrode gap 1203 (25 μm×150 μm).

Organic Pd compound solution (manufactured by Okuno Pharmaceutical Industry Co., Ltd. with a trade name Catapaste CCP) is spin-coated by use of spin coater on the substrate which is then baked at 300° C. for 12 minutes. By etching out the Cr previously filmed, the particle film 1221 is formed. Lastly, this particle film is energized to form the electron emitting section.

Thus made electron beam generating apparatus is put in a vacuum container, and a fluorescent substrate to which a voltage of 1 kV is applied is disposed at a position 5 mm vertically above the electron beam generating apparatus. When voltage pulses of 14 V are applied between the element electrodes 1201 and 1202 with the latter being the lower potential side, spot light indicating a outflow current on the fluorescent substrate was observed. This spot light has a desired elliptical form as shown in FIG. 76B.

Namely, in such a linear electron source, even if the voltage applied to the fluorescent substrate by the electron emitting section through the electron emitting element located at its center as the electron source is small, it is possible to obtain a desired spot shape so as to reduce the voltage to be applied to the fluorescent substance.

Further, when a voltage of −25 V–+25 V is applied to the modulating electrodes, the electron beam amount was continuously changed in response to the modulating voltage. The electron beam could be turned off when the modulating voltage is not exceeding −25 V and turned on when it is equal to or more than +25 V.

Thus, more reduction in power consumption could be reduced than the electron source of 51st embodiment.

53rd Embodiment

Figure 81:
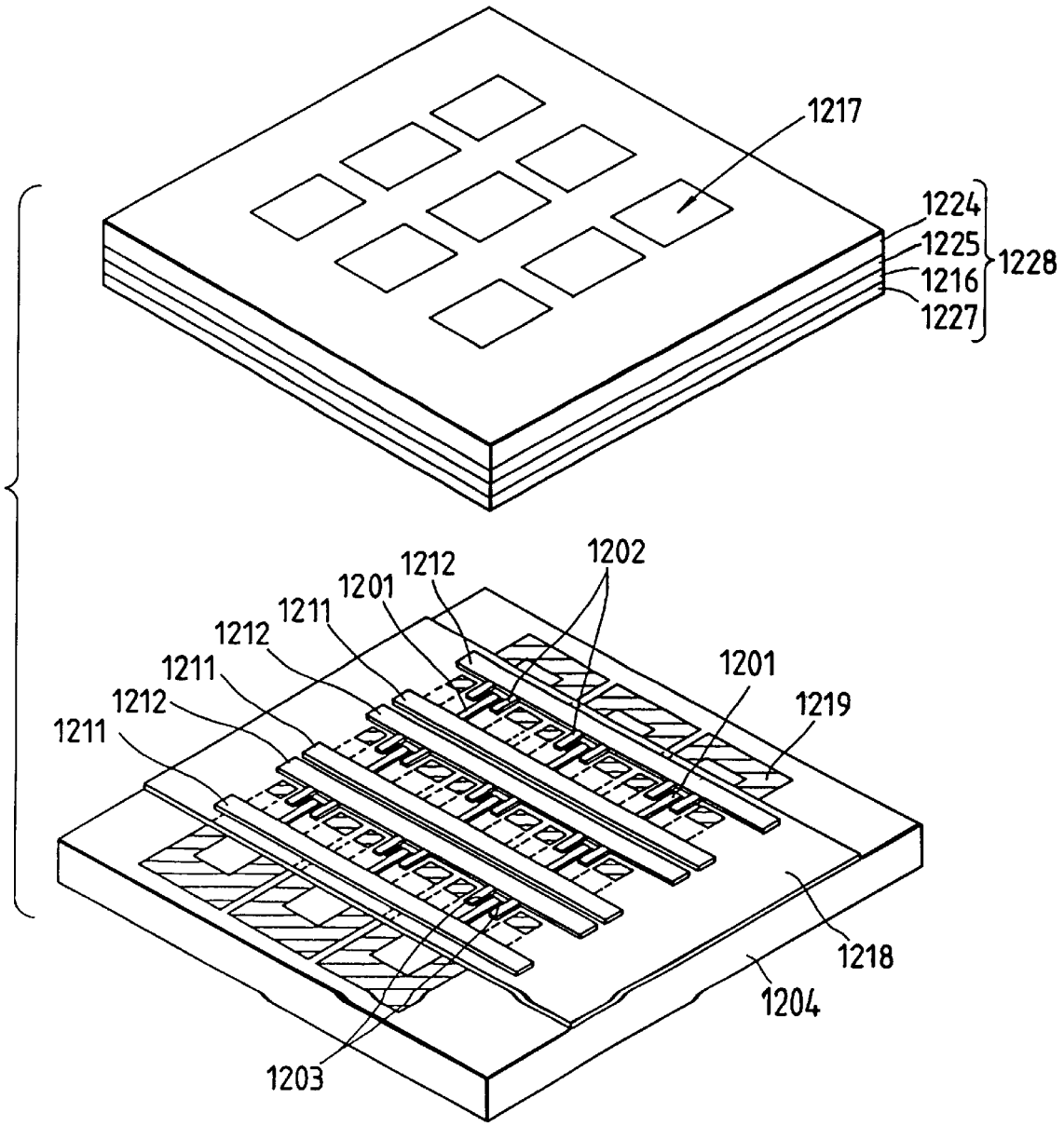
FIG. 81 shows an image-forming apparatus of the present invention.

FIG. 81 is a schematic explanatory view of this embodiment. In FIG. 81, the numerals designate respectively: 1204, a substrate; 1219, modulating wiring electrode; 1201 and 1202, element electrodes; 1203, electron emitting section; 1211 and 1212, element wiring electrodes; 1218, an insulating layer; 1228, a face plate; 1224, a glass plate; 1225, a transparent electrode; 1216, a fluorescent substance; 1227, a metal back; and 1217, a lighting point of the fluorescent substance.

A plurality of linear electron sources in 2nd embodiment, each of which is composed of linearly arranged electron emitting elements, are arranged at 1 mm pitch, and a plurality of modulating electrodes are intersected perpendicularly to the linear electron emitting elements while being insulated from the wiring electrodes. With the other composition totally the same as in 52nd embodiment, an electron beam generating apparatus is formed on a blue plate glass (manufactured by Ichikawa Special Glass Co., Ltd.).

Subsequently, the face plate having the fluorescent substance as an image forming material is disposed at a position 5 mm apart from the rear plate to compose the image display apparatus.

A voltage of 1 kV is applied to the fluorescent substance surface in the vacuum container, and voltage pulses of 14 V are applied between the element electrodes 1201 and 1202 with the latter being the lower potential side so as to make the linearly arranged electron emitting elements emit electrons for performing one-line display.

Furthermore, when a voltage of −25 V–+25 V is applied to the modulating electrodes, the electron beam amount was continuously changed in response to the modulating voltage.

In addition, the electron beam could be turned off when the modulating voltage is not exceeding −25 V while turned on when it is equal to or more than +25 V.

Voltage pulses are applied to its contiguous wiring electrodes to perform aforementioned one-line display. By sequentially performing these operations, an image for one screen is formed. Namely, the image can be formed by forming an X-Y matrix with the wiring electrodes as scanning electrodes and the modulating electrodes.

A driving method in this embodiment will now be described.

The voltage on the fluorescent substance surface is set to 0.8 kV–1.5 kV through an EV terminal. Voltage pulses (in this embodiment, of 14 V) are applied to a pair of element wiring electrodes through lines 1211 and 1212 to make the linearly arranged electron emitting elements emit electrons. Thus emitted electrons act to apply voltage to the linear modulating electrodes in response to the information signals to turn the electron beam on and off. The electrons emitted through the modulating electrodes are accelerated and collide with the fluorescent substance, which performs one-line display in accordance with the information signals. Voltage pulses (in this embodiment, of 14 V) are then applied to its contiguous wiring electrodes to perform aforementioned one-line display. By sequentially performing these operations, an image for one screen is displayed. Namely, the image is displayed by forming an X-Y matrix with the wiring electrodes as scanning electrodes and the modulating electrodes. The pulse voltage to be applied to the elements are typically in the range of 8–20 V depending on the element material and structure.

The surface-conducting electron emitting element of this embodiment can be operated in response to voltage pulses of not exceeding 100 ps, so more than 10,000 of scanning lines can be formed when the image is displayed with 1/30 second for one screen.

The electron beam could be turned off when the modulating voltage is not exceeding −30 V and turned on when it is equal to or more than 20 V. The electron beam amount was continuously changed in a range of −30 V–20 V. Accordingly, the gradation could be displayed by adjusting the voltage to be applied to the modulating electrodes.

The reason why the electron beam can be controlled by the voltage to be applied to the modulating electrodes is that the potential near the electron emitting section changes from + to − in response to the voltage of the modulating electrodes and the electron beam is accelerated and decelerated. In this embodiment, the modulating electrodes are disposed at a position with the electron emitting section therebetween. But, not limited thereto, it is also possible to obtain the same effect with a single modulating electrode by increasing the modulating voltage.

As explained above, since the electron emitting elements and the modulating electrodes are formed on the same substrate by the same processes, they can be easily aligned. Further, since thin film manufacturing technique is used, a display with large scale and high refined degree can be provided at low cost. In addition, it is also possible to set the space between the electron emitting section 1203 and the modulating electrodes with significantly high accuracy so as to provide an image display apparatus with high resolution.

Furthermore, in the surface-conducting electron emitting elements, electrons with a initial speed of several volts are emitted into vacuum. The present invention is quite effective for modulating operation for such type of element. The total display image has high brightness and contrast without any brightness nonuniformity.

At this time, the shape of the spot light on the fluorescent substance may be a desirable elliptical form as shown in FIG. 76B, and the beam size is 1100 μm×700 μm, which is smaller than in the case where the electron emitting section in the center of the wiring electrodes. Namely, the voltage to be applied to the fluorescent substance can be reduced so as to provide highly refined images with low power consumption. Further, unlike in the case where the electron emitting section is at the center between the wiring electrodes, any brightness nonuniformity did not arise such that the whole screen could be displayed at a uniform brightness.

54th Embodiment

In this embodiment, a recording apparatus using the image display apparatus according to 53rd embodiment is used as the light-emitting source. As a result, clear recording images with high resolution and high contrast without any exposure nonuniformity could be provided at high speed.

As mentioned above, according to this embodiment, the electron emitting elements and the modulating electrodes can be easily aligned, providing the following advantages:

(1) Even if the voltage to be applied to the fluorescent plate is small, the beam can be shaped in a desired elliptical form;

(2) The electron emitting elements and the modulating electrodes can be easily aligned to provide highly refined images.

(3) Images without lightness nonuniformity can be provided in image display apparatus;

(4) The composition can be more simplified and the production yield can be enhanced.

55th Embodiment

FIG. 82 shows an electron beam generating apparatus according to a 55th embodiment of this invention, in which the numerals designate respectively: 1301 and 1302, element electrodes; 1303, modulating electrode; 1304, electron emitting section; 1305, an insulating film; 1306, a conductive substrate.

Under an environment of $2\times10^{-6}$ Torr, the electron beam generating apparatus together with a fluorescent plate (not shown ) disposed at a position 5 mm above the apparatus are located. When a voltage of 1 kV is applied to the fluorescent plate from outside and voltage pulses of 14 V are applied between the element electrodes 1301 and 1302, spot light corresponding to the electron beam emitted toward the fluorescent plate is observed. Further, when a voltage of −40 V–+30 V is applied to the modulating electrodes 1303 and 1303', the electron beam amount was continuously changed. The electron beam could be turned off when the modulating voltage is not exceeding −40 V and turned on when it is equal to or more than +30 V.

Further, when one hundred of electron emitting elements are linearly arranged, the apparatus according to this embodiment in which the elements are formed on the conductive substrate of this invention can restrict the temperature to be lower by several tens degrees in comparison in the conventional composition where the they are formed on the insulating substrate, so as to provide a uniform electron beam without fluctuation.

As mentioned above, the electron emitting elements and the modulating electrodes are disposed on the insulating film of the conductive substrate. As a result, even in case of large current electrons flowing, a uniform electron beam can be provided without positional deviation due to the heat generated from the electron emitting section and the fluctuation.

56th Embodiment

Figure 84:
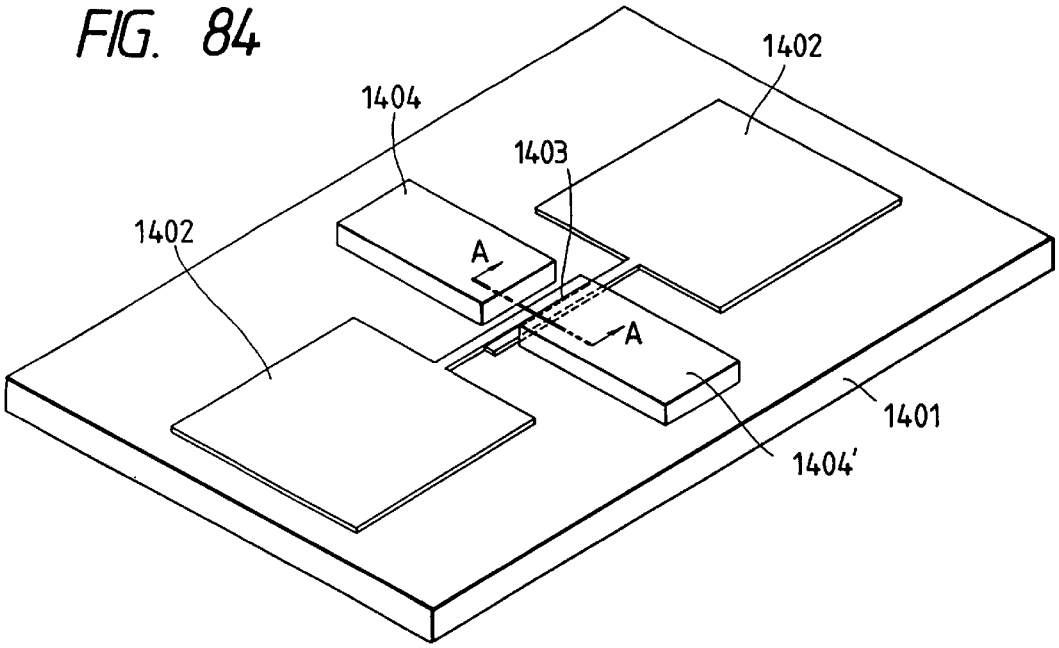

FIG. 84 shows an embodiment of an electron beam generating apparatus according to this invention, in which the numerals designate respectively: 1401, an insulating substrate; 1404 and 1404', modulating electrodes; 1402, element electrode; and 1403, electron emitting section.

Figure 85:
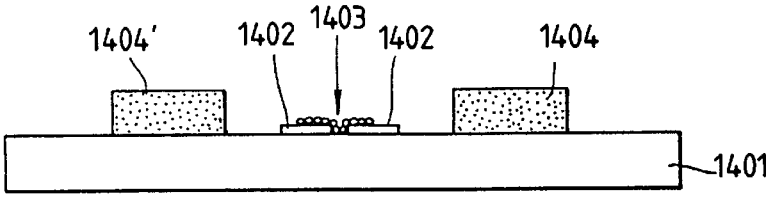

FIG. 85 is a cross-sectional view of the apparatus in FIG. 84 through the line A—A.

The manufacturing processes in this embodiment will be described in detail.

(1) Firstly, silicon glass (manufactured by Corning Co., Ltd.) as the insulating substrate 1401 is scrubbed with neutral detergent and well cleaned by ultrasonic cleaning using organic solvent etc., and thereafter a resist pattern is formed by photolithography.

(2) Next, Ti up to 50 Å as an underlying material for enhancing the adhesiveness and Ni up to 950 Å as the element electrode material are deposited over the whole surface, and thereafter an element electrode pattern 1402 is formed thereon by lift-off method. At this time, the element electrode width is set to 15 $\mu$m and the electrode gap is set to 2 $\mu$m.

(3) Cr for patterning the emitting material is deposited over the whole surface of the substrate by resistance heating.

(4) A resist pattern for removing Cr only near the emitting section (25 $\mu$m×150 $\mu$m) is formed by photolithography.

(5) Cr at desired portions is removed by etching. As an etchant, cerium ammonium nitrate and perchloric acid aqueous solution are used.

(6) Organic palladium (manufactured by Okuno Pharmaceutical Co., Ltd. with a trade name CCP-4230) being a mixture of palladium particles as the emitting material and palladium monoxide is dispersed and coated on the substrate, which is then baked at 300° C. under atmosphere for 12 minutes so as to form the particle film over the whole surface.

(7) With the etchant noted in above (5), Cr for patterning the emitting material is etched out.

(8) Cr 50 Å and Cu 1 $\mu$m are formed by EB deposition instead of resistance heating in the same manner as in forming the element electrode. At this time, the gap between the element electrode and the modulating electrode is set to 25 $\mu$m.

(9) Lastly the particle film formed in above (6) is energized to constitute the electron emitting section.

The electron beam generating apparatus composed as mentioned above together with the fluorescent plate disposed at a position 5 mm above the substrate of the apparatus are put under an environment of approximately $2\times10^{-6}$ Torr. When a voltage of 1 kV is applied to the fluorescent plate from out-side, and voltage pulses of 14 V are applied between the element electrodes. As a result, spot light corresponding to the electron beam emitted toward the fluorescent plate was observed.

Further, when a voltage of −30 V–+20 V is applied to the modulating electrodes 1404 and 1404', the electron beam amount was continuously changed in accordance with the modulating voltage. At this time, for both the modulating voltages 1404 and 1404', the electron beam could be turned off at not exceeding −30 V and turned on at equal to or more than +30 V.

Then, when a voltage of +30 V is applied only to the modulating electrode 1404 (0 V for 1404'), the spot light was shifted by 1 mm toward the modulating electrode 1404' side. On the other hand, when a voltage of +30 V is applied only to the modulating electrode 1404 (0 V for 1404'), the spot light was shifted by 1 mm toward the modulating electrode 1404 side. In view of above, it has been confirmed that the modulating electrode could act to deflect the spot light.

When the similar experiment is carried out by use of a fluorescent substance coated divisionally in RGB, the spot light could be controlled by adjusting the voltage to be applied to the respective modulating electrode corresponding to the respective pixel (R, G, B). Of course, anti proper value may be selected for the element as the modulating voltage. In addition, when a pulse voltage of a certain frequency is applied as the modulating voltage, the spot light corresponding to the frequency was observed.

57th Embodiment

The modulating electrodes 1404 and 1404' are laminated through the insulating layer at the surface opposed to the electron emitting side surface. With the other composition totally the same as that in the 56th embodiment, similar study was executed.

As a result, although the absolute value of the modulating voltage tends to be slightly larger than in the case of 56th embodiment, substantially the same effect could be obtained. This mean that it is possible to make deflection using the modulating electrode by controlling the electrical field near the emitting section.

Thus, three types of multiplication of grid has been described, however not limited thereto, any other combination can provide the same effect by appropriately selecting the modulating voltage for each case. Further, there is no limitation for the form of the electron emitting element.

58th Embodiment

Figure 86:
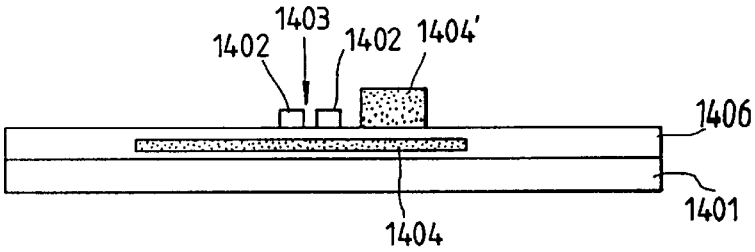

As shown in FIG. 86, in this embodiment, only one of the modulating electrodes 1404 and 1404' in the 56th embodiment is disposed on the same surface as the electron emitting element, while the other is disposed on the surface opposed to the electron emitting side surface through the insulating layer 1406 to perform the same study as in the 56th embodiment.

As a result, it was possible to deflect the beam by applying a voltage of −80 V–+80 V even to only one modulating electrode.

59th Embodiment

By use of the electron beam generating apparatus in 56th embodiment, an image display apparatus shown in FIG. 26 is made. The width of the element electrode is 25 $\mu$m for both the higher and the lower potential sides, and the electrode gap is set to 2 $\mu$m and the emitting section width is set to 300 $\mu$m. A plurality of elements with a pitch of 2 mm are arranged to perpendicularly intersect the linear electron source. Furthermore, the element wiring electrode is formed of Cu with a thickness of 2 $\mu$m.

Next, a face plate composed of an ITO electrode, a fluorescent substance and metal back is provided through a glass spacer of 5 mm thickness, and sealing by use of flit glass is made, so as to complete the image display apparatus.

After vacuuming the image display apparatus as composed above to approximately $2\times10^{-6}$ Torr, a voltage of +1.5 KV is applied to the fluorescent substance surface, and a pulse voltage of 14 V is applied between the element electrodes.

As a result, a sufficiently converged lighting point could be observed by setting the modulating voltage always to −20 V without causing any crosstalk with the contiguous emitting section. Image could be displayed by applying a information signal voltage to the modulating electrode simultaneously with the linear driving. In addition, by multiplying the modulating voltage as mentioned in the previous embodiment, it is possible to irradiate the electron beam onto a plurality of pixels from the same element. Accordingly, the electron beam can be irradiated from a plurality of electron sources onto the same position at a desired position and time by external control, so as to further enhance the screen brightness.

In this embodiment surface-type electron sources are used. However, it is also possible to effectively use the deflecting function of the modulating electrodes for segmenting the screen in order to divide the lines, thereby providing the same advantages.

60th Embodiment

A recording apparatus using the image display apparatus in 59th embodiment as the light-emitting source is made as shown in FIGS. 5–7. Also in this embodiment, clear recording images with high resolution and contrast without any exposure nonuniformity could be obtained at high speed, by virtue of the advantages of the electron beam generating apparatus.

As mentioned above, by multiplying the modulating electrode, it is possible to add a deflecting function to the modulating electrode so as to render the following advantages:

(1) Since the modulating electrode having the deflecting function without occupying space is provided near the electron emitting section, it can be easily aligned with other component, and the gap between both components can be readily assured, contributing to enlarge the scale of the screen.

(2) Since the modulating electrode having a deflecting function is disposed near the electron emitting section, the deflecting efficiency can be enhanced.

(3) By the modulating and deflecting functions of the multiplied modulating electrodes, the electron beam scanning can be carried out by a single element. Therefore, resolution and the brightness of the image could be increased.

(4) The composition can be simplified since there is no need of separately disposing any deflecting electrode.

(5) Since the screen can be segmented, the wiring resistance in the plane direction can be reduced by increasing the space between the linear electron sources.

(6) By virtue of the modulating an deflecting function of the multiplied modulating electrodes, the positional accuracy of the electron beam irradiation can be enhanced to improve the refined degree of the image.

61st Embodiment

The electron emitting elements shown in FIGS. 87 and 88 are made in the following manner.

Firstly, quartz glass as an insulating substrate 1511 is well cleaned, and then a resist pattern for forming modulating electrodes on the quartz glass is formed by conventional lithography.

Ti with a thickness of 50 Å and Ni with 950 Å are formed, over the whole glass surface on which the resist pattern is formed, by vacuum deposition, and thereafter the resist pattern is stripped to form the modulating electrode 1503.

By RF spattering method, a thin SiO2 film is formed with a thickness of 1.5 μm to provide an insulator 1516.

With the same manner as in forming the modulating electrode, element electrodes 1501 and 1502 composed of Ti with 50 Å thickness and Ni with 950 Å thickness as the modulating electrode on the insulator. The electrode width, is all 15 μm, and the gap between the element electrodes 1501 and 1502 are set to 2 μm.

For forming a conductive film including the electron emitting section, Cr thin film with a thickness of 1000 Å is formed over the whole surface of the substrate provided with the aforementioned element electrode by vacuum deposition. Subsequently, the Cr thin film at a desired conductive film forming region is removed by etching using photolithography. The size of the removed Cr thin film is 100 μm×150 μm, and the portions between the element electrodes, on the element electrode or on the insulator near the element electrode, a conductive film mentioned later are etched to form a conductive film mentioned later.

Organic solvent (Catapaste CCP manufactured by Okuno Pharmaceutical Industry Co., Ltd.) containing organic palladium compound is spin-coated on the substrate which is then baked at 300° C. for 12 minutes, to form a conductive film primarily of palladium. Thereafter, the remained Cr thin film is removed, a voltage is applied between the element electrodes, and the conductive film is energized to form the electron emitting section.

Thus obtained electron emitting element and the fluorescent plate disposed at a position 5 mm above the element are put in a vacuum container with up to $2\times16^{-6}$ Torr. And, the element electrode 1501 is set to +14 V, the element electrode 1502 is earthed, the fluorescent plate is set to +1 KV, and the modulating electrode is earthed. As a result, spot light corresponding to the emitted electron beam was observed on the fluorescent plate.

Further, when a voltage of −40 V–+30 V is applied to the modulating electrode 1503 from outside with the same conditioned as above case, the electron beam amount reaching the fluorescent plate was continuously changed in response to the applied voltage, and it was confirmed that the modulating electrode 1503 played that role. In the electron emitting element in this composition, the dispersion of the electron beam in the direction perpendicularly intersecting with the element electrode gap so as to provide a desirable spot shape.

62nd Embodiment

Figure 89:
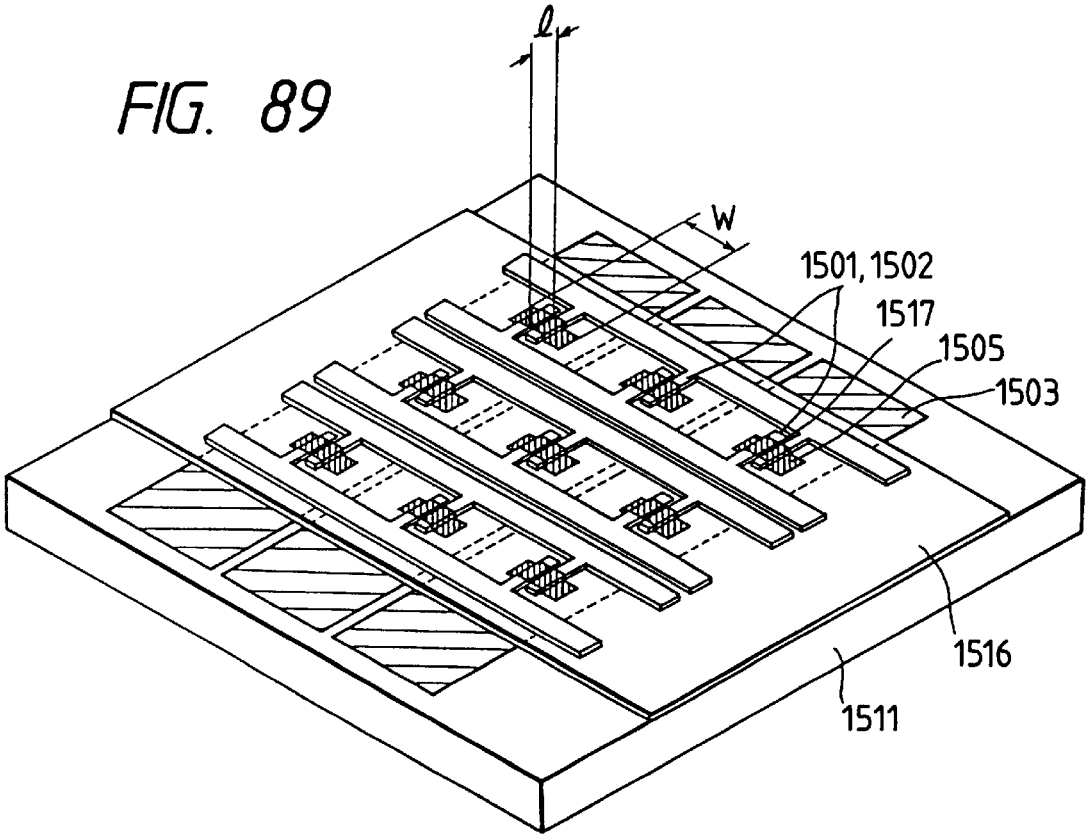

FIG. 36 shows an image forming apparatus according to this embodiment. FIG. 89 is a perspective view of the electron emitting element used in this embodiment. In these FIGS., the numerals designate respectively: 1501 and 1502, element electrodes; 1517, an electron emitting section; 1506 and 1507, element wiring electrodes; 1503, a modulating electrode formed through an insulator 1516; and 1505, a conductive film for constituting the electron emitting section.

A plurality of electron emitting elements are linearly arranged at 2 mm pitch, a plurality of modulating electrodes are arranged to perpendicularly intersect the linearly arranged electron emitting elements, and the element wiring electrode is formed of Cu with a thickness of 2 μm. With the other composition totally the same as in 61st embodiment, the electron emitting element is formed. The size of the conductive thin film is l=300 μm, W=100 μm, and the element electrode width is 25 μm for both the higher and lower potential sides.

Lastly, a vacuum container as an outer surrounding member of the image forming apparatus is vacuumed to a pressure of $2\times10^{-6}$ Torr, and then the outlet is sealed to complete the image forming apparatus.

A voltage of +1.5 KV is applied to the fluorescent surface of thus obtained image forming apparatus and a pulse voltage of 14 V is applied to the element electrode to make the linearly arranged electron emitting section emit electrons. Simultaneously, the electron beam could be turned on and off by applying an information signal voltage to the modulating electrode. An image is displayed by sequentially executing the aforementioned operations for each line.

Comparative Example

Figure 90:
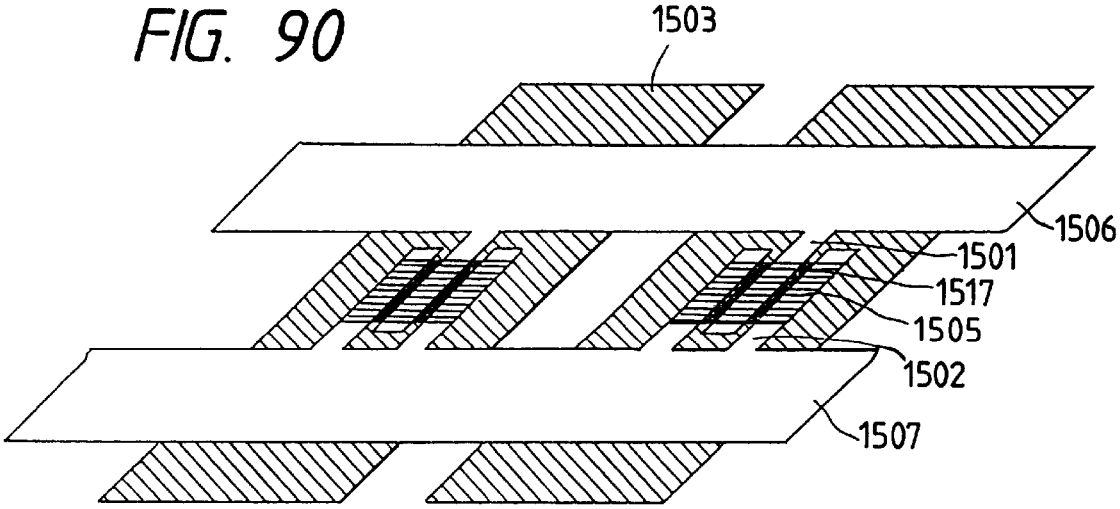
FIG. 90 shows an electron beam-generating device for comparison with the one of the seventh type embodiments of the present invention.

An apparatus for a comparative example made in the similar manner to in 61st embodiment is shown in FIG. 90. In FIG. 90, the numerals designate respectively: 1501 and 1502, element electrodes; 1503, modulating electrodes;

1517, an electron emitting section; and 1505, a conductive thin film. The difference from the 61st embodiment is that in this embodiment the region of the conductive thin film 1505 is only between the element electrodes 1501 and 1502 and on the element electrode. Accordingly, in comparison with the 61st embodiment, the insulator is exposed except the element electrode portion.

When the same experiment is carried out with the present electron emitting element as in 61st embodiment, the electron beam amount could be continuously changed by adjusting the voltage to be applied to the modulating electrode. However, by the continuous driving, the lighting point on the fluorescent plate is gradually expanded so as to cause a crosstalk with the contiguous elements. In addition, under such a circumstance, the voltage applied to the modulating electrode for stopping the electron emission is gradually increased in accordance therewith, such that after several minutes of operation the cut-off was unable with a applying voltage of −40 V.

63rd Embodiment

Figure 91:
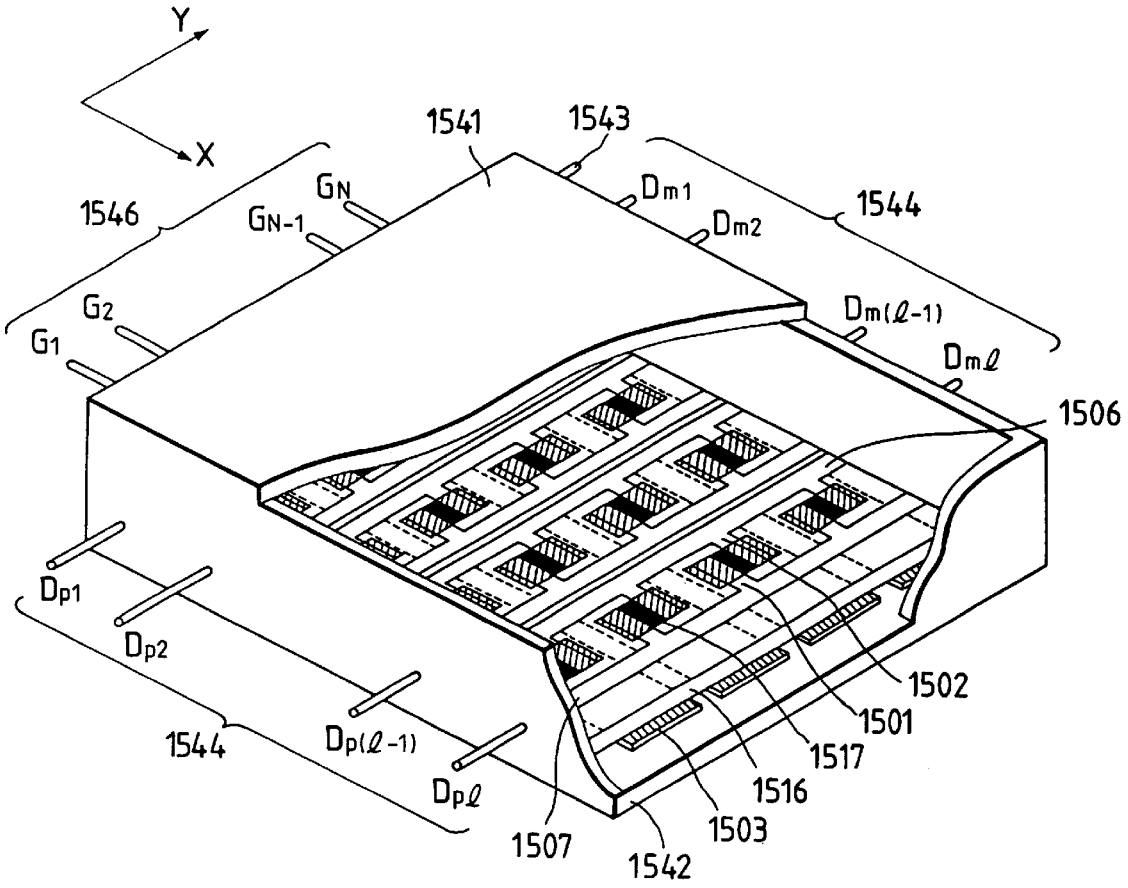
FIG. 91 shows an image-forming apparatus of the present invention.
Figure 92:
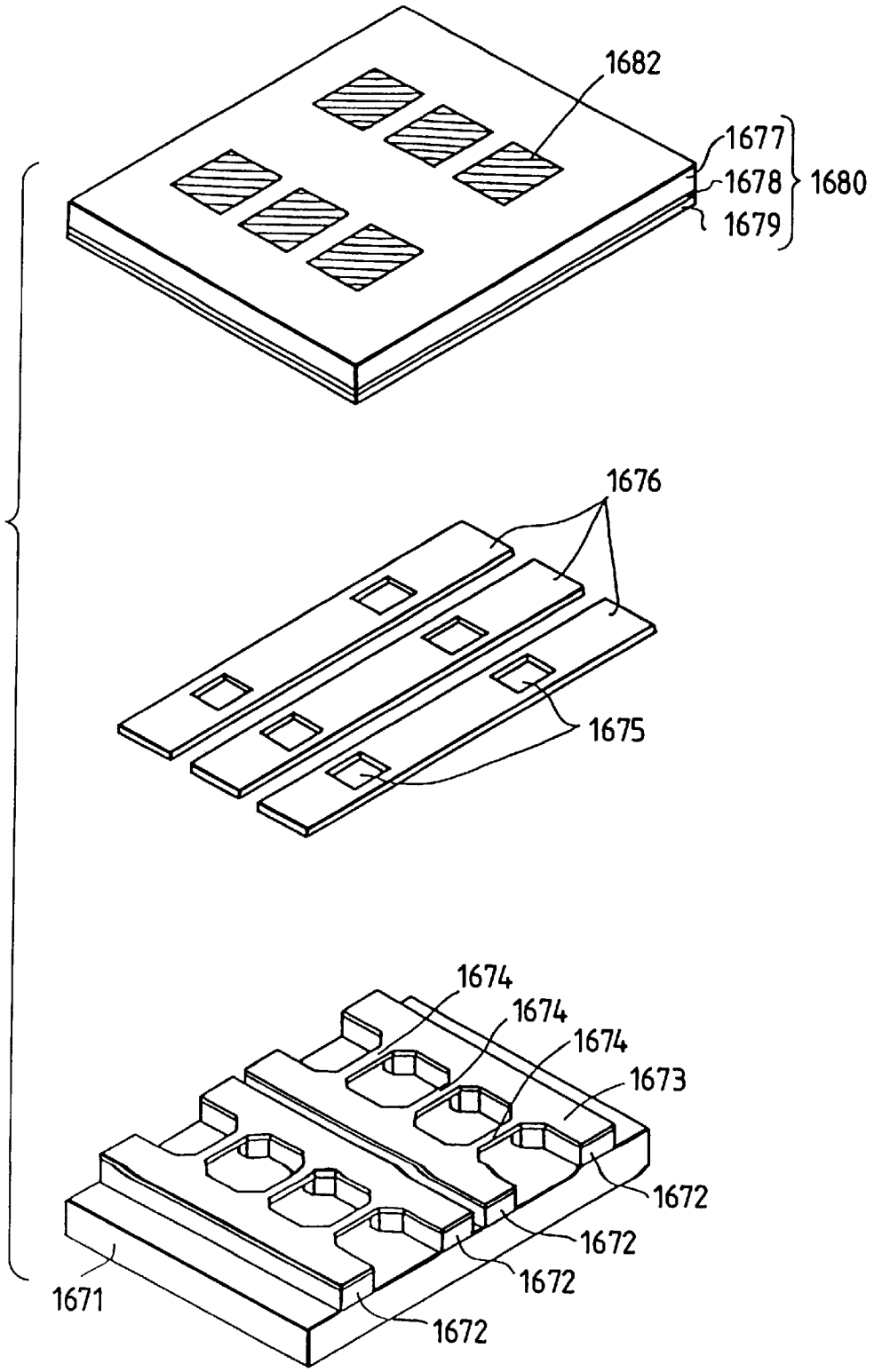
FIGS. 92, and 93 show conventional image-forming apparatuses.
Figure 93:
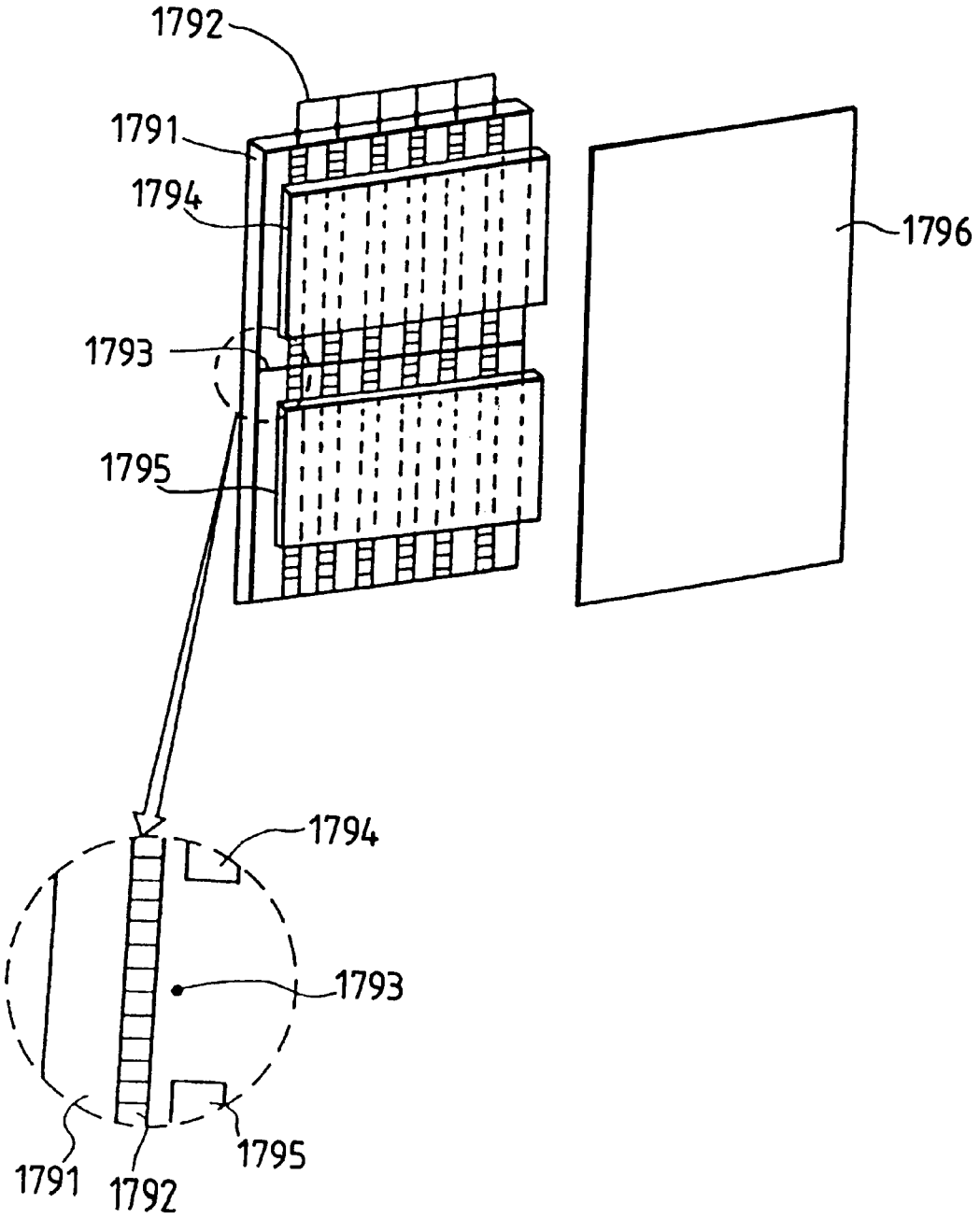

FIG. 91 shows an image display apparatus according to this embodiment.

A plurality of electron emitting elements are linearly arranged at 2 mm pitch, and a plurality of modulating electrodes 1503 are arranged to perpendicularly intersect the linearly arrange electron emitting elements, and Cu as the wiring electrodes 1506 and 1507 is laminated with a thickness of 2 $\mu$m. With the other composition totally the same as in 61st embodiment, an electron beam generating apparatus is formed on a blue plate glass (manufactured by Ichikawa Special Glass) as a rear plate 1542.

A face plate 1541 having a fluorescent material as an image forming material is disposed at a position. 5 mm (=l) apart from the rear plate 1542 to made the image display apparatus.

A voltage of 1.5 KV is applied to the fluorescent substance surface and voltage pulses of 14 V are applied to a pair of wiring electrodes 1506 and 1507 to make the linearly arranged electron emitting elements emit electrons. At the same time, a voltage as information signals is applied to the modulating electrodes to turn the electron beam on and off.

Further, voltage pulses are applied to the contiguous wiring electrodes for performing one-line display. An image for one screen is formed by sequentially performing these operations. Namely, an image can be displayed by forming an X-Y matrix with the wiring electrodes as scanning electrodes with the modulating electrodes.

The surface-conducting electron emitting element used in this embodiment can be driven in response to voltage pulses not exceeding 100 ps, so more than 10,000 of scanning lines can be formed when one screen of image is displayed at 1/30 second.

The electron beam could be turned off when the voltage to be applied to the modulating electrode 1546 is not exceeding −40 V and turned on when it is equal to or more than 30 V. The electron beam amount was continuously changed in a range of −40 V–+30 V. Accordingly, gradation display was possible by adjusting the voltage to be applied to the modulating electrodes.

The reason why the electron beam can be controlled by adjusting the voltage to be applied to the modulating electrodes 1503 is that the potential near the electron emitting section 1517 changes from + to − and the electron beam is accelerated and decelerated.

As mentioned above, according to this embodiment, the electron emitting elements and the modulating electrodes are laminated through the insulating substrate, both components can be easily aligned. Further, due to the use of thin film manufacturing technique, a large-sized and highly refined display can be provided at low cost. Moreover, the space between the electron emitting section 1517 and the modulating electrode 1503 can be set with a significantly high accuracy so as to provide an image display apparatus with high resolution.

In the surface-conducting electron emitting element, electrons with an initial speed of several volts are emitted toward vacuum. The present invention is quite effective for the modulating function in such an element. The entire display image has a high lightness and contrast without any lightness nonuniformity. 64th Embodiment A recording apparatus with the image display apparatus of the 63rd embodiment as the light-emitting source is made as shown in FIGS. 5–7. Also in this embodiment, clear recording images with high resolution and contrast without any exposure nonuniformity could be provided at high speed.

The electron beam generating apparatus as aforementioned can provided a sufficiently larger electron emitting amount in comparison with the conventional art, and the unintentional fluctuation of the electron emitting amount at starting and the modulating nonuniformity between the electron beams are significantly improved. Moreover, the electron beam generating apparatus of this embodiment can prevent the charge up of the substrate surface to provide a highly refined characteristics.

In an image display apparatus incorporating the electron beam generating apparatus of this embodiment, the contrast of the display image is excellent with high lightness and less lightness nonuniformity.

Further in a recording apparatus incorporating the electron beam generating apparatus of this embodiment, the recording image has a desirable contrast with clarity.

Moreover, in the aforementioned image display apparatus and the recording apparatus, the electron beam generating apparatus of this embodiment is not undesirably affected in its electron emitting and electron beam modulating functions as in the conventional art even when the electron emitting elements are arranged with high density. Accordingly, it is possible to provide display images and recording images with high resolution and highly refined degree at high speed.

What is claimed is:

1. An electron beam-generating device having an electron-emitting element and a modulation electrode for modulating an electron beam emitted from the electron-emitting element, the electron-emitting element and the modulation electrode being arranged on a same surface of a substrate, or the modulation electrode being placed on a reverse surface of the substrate to the surface bearing the electron-emitting element, wherein the electron-emitting element comprises an electron-emitting portion between a lower potential electrode and a higher potential electrode, and wherein the lower potential electrode extends outward from the substrate surface bearing the electron-emitting element further than the higher potential electrode.

2. An electron beam-generating device according to claim 1 wherein the lower potential electrode is located such that the lower potential electrode surrounds the electron-emitting portion, and the lower potential electrode extends outward from the surface of the substrate further than the electron emitting portion.

3. An electron beam-generating device comprising a plurality of electron-emitting units, each electron emitting unit including an electron-emitting element and a modulation electrode for modulating an electron beam emitted from the electron-emitting element, the electron-emitting elements and the modulation electrodes of the electron emitting units being arranged on a same surface of a substrate, or the modulation electrodes being placed on a reverse surface of the substrate to the surface bearing the electron-emitting elements, wherein the electron-emitting element of each electron emitting unit comprises an electron emitting portion, a higher potential electrode on one side of the electron emitting portion and a lower potential electrode on a side of the electron emitting portion opposite the one side, wherein the lower potential electrode extends further than the higher potential electrode; and the modulation electrode of each electron emitting unit is placed only on the one side of the higher potential electrode of the electron emitting unit.

4. An electron beam-generating device having an electron-emitting element and a modulation electrode for modulating an electron beam emitted from the electron-emitting element, the modulation electrode being placed on a reverse surface of a substrate to a surface of the substrate bearing the electron-emitting element, wherein the electron-emitting element comprises a lower potential electrode, a higher potential electrode and an electron-emitting portion between the lower potential electrode and the higher potential electrode, and wherein the modulation electrode is disposed on a portion of the reverse surface that excludes a region under the electron-emitting portion.

5. An electron beam-generating device comprising:

an electron-emitting element and a modulation electrode for modulating an electron beam emitted from the electron-emitting element, the modulation electrode being provided on a reverse surface of a substrate to a surface bearing the electron-emitting element and formed integrally with the electron-emitting element, the distance between the surface of the modulation electrode and the surface of the substrate bearing the electron-emitting element being different between a region under the electron-emitting element and another region; and the device further comprising means for applying a voltage for converging or diverging a spot diameter of the electron beam concurrently with applying a voltage for modulating the electron beam to the modulation electrode.

6. An electron beam-generating device according to claim 5, wherein the substrate has a larger thickness in the region under the electron emitting element than the thickness in the other region.

7. An electron beam-generating device according to claim 6, wherein the thickness $L_1$ of the substrate in the region under the electron-emitting element and the thickness $L_2$ of the substrate in the other region satisfy the following relation:

$$|L_1-L_2|\geqq 0.3L_1$$

8. An electron beam-generating device according to claim 5, wherein the substrate has a smaller thickness in the region under the electron-emitting element than the thickness of the other region.

9. An electron beam-generating device according to claim 8, wherein the thickness $L_1$ of the substrate in the region under the electron-emitting element and the thickness $L_2$ of the substrate in the region in the other region satisfy the following relation:

$$|L_1-L_2|\geqq 0.3L_1$$

10. A driving method of an electron beam-generating device having an electron-emitting element and a modulation electrode for modulating an electron beam emitted from the electron-emitting element, the modulation electrode being provided on a reverse surface of a substrate to a surface bearing the electron-emitting element and formed integrally with the electron-emitting element, the distance between the surface of the modulation electrode and the surface of the substrate bearing the electron-emitting element is different between a region under the electron-emitting element and another region, and the method comprising applying a voltage for converging or diverging a spot diameter of the electron beam concurrently with applying a voltage for modulating the electron beam to the modulation electrode.

11. An electron beam-generating device according to any of claims 1, 3, 2, 6 to 4, 8, 9, and 5, wherein the electron-emitting element is a surface conduction type electron-emitting element.

12. An electron beam-generating device according to any of claims 1, 3, 2, 6 to 4, 8, 9, and 5, wherein the electron-emitting element is a linear electron-emitting element having a plurality of electron-emitting portions in a line, and a plurality of the linear electron-emitting elements and a plurality of the modulation electrodes constitute an XY matrix.

13. An image display apparatus, comprising an electron beam-generating device of any of claims 1, 3, 2, 6 to 4, 8, 9, and 5, and an image-forming member for forming an image on irradiation of an electron beam from the electron beam generating device.

14. A recording apparatus, comprising an electron beam-generating device of any of claims 1, 3, 2, 6 to 4, 8, 9, and 5, a light-emitting member emitting light on irradiation of an electron beam from the electron beam-generating device, and a recording medium on which an image is recorded by irradiation of light from the light-emitting member of a supporting member for the recording medium.

* * * * *

UNITED STATES PATENT AND TRADEMARK OFFICE

CERTIFICATE OF CORRECTION

PATENT NO. : 6,005,333
DATED : December 21, 1999
INVENTOR(S) : Tetsuya Kaneko et al.

It is certified that error appears in the above-identified patent and that said Letters Patent is hereby corrected as shown below:

Title page,
Item [57], ABSTRACT,
Line 4, "or to" should be deleted.

Column 4,
Line 40, "drawing" should read -- drawings --;
Line 65, "First" should read -- The first --; and
Line 66, "improves" should read -- improve --.

Column 5,
Line 4, "an" should read -- a --; and
Line 52, "interposition," should read -- interposition --.

Column 8,
Line 19, "includes" should read -- including --; and
Line 52, "is" should read -- are --.

Column 13,
Line 45, "enables readily" should read -- readily enables --.

Column 16,
Line 13, "a" should read -- an --.

Column 27,
Line 27, "perform" should read -- performs --;
Line 29, "applies" should read -- applied --;
Line 35, "$(5W_1 \geq W_2 10W_1)$ :" should read -- $(5W_1 \leq W_2 \leq 10W_1)$ : --; and
Line 42, "$(W_2 \geq 10W_1)$ :" should read -- $(W_2 \leq 10W_1)$ : --.

Column 31,
Line 66, "1 in," should read -- ℓ in --.

Column 36,
Line 48, "apparatuses" should read -- apparatuses. --.

Column 43,
Line 13, "follow:" should read -- follows : --.

UNITED STATES PATENT AND TRADEMARK OFFICE

CERTIFICATE OF CORRECTION

PATENT NO. : 6,005,333
DATED : December 21, 1999
INVENTOR(S) : Tetsuya Kaneko et al.

It is certified that error appears in the above-identified patent and that said Letters Patent is hereby corrected as shown below:

Column 52,
Line 52, "an" should read -- a --;
Line 54, "laster" should read -- layer --;
Line 64, "SiO2" should read -- $SiO_2$ --;
Line 66, "SiO2" should read -- $SiO_2$ --; and
Line 67, "SiO2" should read -- $SiO_2$ --.

Column 57,
Line 11, "at 2 mm pitch" (first occurrence) should be deleted.

Column 58,
Line 21, "long" should read -- prolong --;
Line 58, "SiO2" should read -- $SiO_2$ --; and
Line 59, "SiO2," should read -- $SiO_2$ --.

Column 59,
Line 25, "is" should read -- are --;
Line 44, "turn" should read -- turning --;
Line 48, "layers" should read -- layers are removed --; and
Line 60, "enhance," should read -- enhanced, --.

Column 61,
Line 30, "composed" should read -- composed of --; and
Line 61, "SiO2" should read -- $SiO_2$ --.

Column 62,
Line 3, "by typically" should read -- typically by --; and
Line 36, "SiO2" should read -- $SiO_2$ --.

Column 64,
Line 59, "6044," should read -- 644, --; and
Line 60, "6046," should read -- 646, --.

Column 70,
Line 17, "(15 μof" should read -- (15μm of --;
Line 46, "SiO2" should read -- $SiO_2$ --.

Column 72,
Line 20, "1.0 82 m." should read -- 1.0 μm. --.

UNITED STATES PATENT AND TRADEMARK OFFICE

CERTIFICATE OF CORRECTION

PATENT NO. : 6,005,333
DATED : December 21, 1999
INVENTOR(S) : Tetsuya Kaneko et al.

It is certified that error appears in the above-identified patent and that said Letters Patent is hereby corrected as shown below:

Column 74,
Line 20, "SiO2" should read -- $SiO_2$ --;
Line 49, "pate" should read -- plate --; and
Line 63, "42th" should read -- 42nd --.

Column 76,
Line 61, "-40 V –30V." should read -- - 40 V - 30 V. --.

Column 77,
Line 24, "V-10 V." should read -- V - 10 V. --.

Column 78,
Line 6, "turn" should read -- turning --;
Line 21, "-40 V -- 30 V." should read -- - 40 V - 30 V. --;
Line 60, "by typically" should read -- typically by --; and
Line 64, "SiO2" should read -- $SiO_2$ --; and "layer 12113" should read -- layer 1218 --.

Column 79,
Line 3, "are" should read -- is --.

Column 81,
Line 40, "-30 V-20 V." should read -- - 30 V - 20 V. --.

Column 83,
Line 47, "out-side," should read -- outside, --.

Column 84,
Line 3, "anti" should read -- any --;
Line 20, "has" should read -- have --;
Line 48, "flit" should read -- frit --; and
Line 58, "a" should read -- an --.

Column 85,
Line 37, "an" should read -- and --;
Line 52, "SiO2" should read -- $SiO_2$ --;
Line 55, "composed" should read -- are composed --; and
Line 59, "are" should read -- is --.

UNITED STATES PATENT AND TRADEMARK OFFICE

CERTIFICATE OF CORRECTION

PATENT NO. : 6,005,333
DATED : December 21, 1999
INVENTOR(S) : Tetsuya Kaneko et al.

It is certified that error appears in the above-identified patent and that said Letters Patent is hereby corrected as shown below:

Column 87,
Line 18, "a" should read -- an --.

Column 88,
Line 12, "64th Embodiment" should read (new paragraph)
-- 64th Embodiment --; and
Line 60, "1" should read -- 1, --.

Column 90,
Line 35, "claims 1, 3, 2, 6 to 4, 8, 9, and 5," should read -- claims 1 to 9, --;
Line 39, "claims 1, 3, 2, 6 to 4, 8, 9, and 5," should read -- claims 1 to 9, --;
Line 47, "claims 1, 3, 2, 6 to 4, 8," should read -- claims 1 to 9, --;
Line 48, "9, and 5," should be deleted;
Line 52, "claims 1, 3, 2, 6 to 4, 8, 9, and" should read -- claims 1 to 9, --; and
Line 53, "5," should be deleted.

Signed and Sealed this

Twentieth Day of November, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,005,333
DATED : December 21, 1999
INVENTOR(S) : Tetsuya Kaneko et al.

It is certified that error appears in the above-identified patent and that said Letters Patent is hereby corrected as shown below:

Title page,
Item [75], Inventors: please insert the following: Toshihiko Takeda, Atsugi, Kumi Iwai, Isehara, all of Japan.

This certificate supersedes Certificate of Correction issued November 20, 2001.

Signed and Sealed this

Twenty-seventh Day of August, 2002

*Attest:*

*Attesting Officer*

JAMES E. ROGAN
*Director of the United States Patent and Trademark Office*